United States Patent [19]

Wachi

[11] 4,395,931

[45] Aug. 2, 1983

[54] METHOD AND APPARATUS FOR GENERATING MUSICAL TONE SIGNALS

[75] Inventor: Masatada Wachi, Hamamatsu, Japan

[73] Assignee: Nippon Gakki Seizo Kabushiki Kaisha, Hamamatsu, Japan

[21] Appl. No.: 245,126

[22] Filed: Mar. 18, 1981

[30] Foreign Application Priority Data

Mar. 31, 1980 [JP] Japan ..... 55-41484

[51] Int. Cl.[3] ..... G10H 1/08; G10H 7/00

[52] U.S. Cl. ..... 84/1.21; 84/1.22; 84/1.23

[58] Field of Search ..... 84/1.19–1.23

[56] References Cited

U.S. PATENT DOCUMENTS

| | | | |
|---|---|---|---|
| 4,077,294 | 3/1978 | Hiyoshi et al. | 84/1.23 |
| 4,205,577 | 6/1980 | Deutsch | 84/1.21 |
| 4,231,278 | 11/1980 | Deutsch | 84/1.19 |
| 4,257,303 | 3/1981 | Nagai et al. | 84/1.22 |
| 4,282,790 | 8/1981 | Wachi | 84/1.21 |

*Primary Examiner*—Stanley J. Witkowski

*Attorney, Agent, or Firm*—Spensley, Horn, Jubas & Lubitz

[57] ABSTRACT

A method and an apparatus for producing a musical tone of the so-called partial tone synthesizing type are disclosed, in which the sampling frequencies are established with respect to the respective partial tone components to satisfy the sampling theorem, and the highest frequency among the sampling frequencies is used as a reference frequency. Ratios of sampling frequencies of respective partial tone components to the reference frequency are determined. A partial tone component having a ratio of one is calculated with one channel at a period corresponding to the reference frequency whereas a plurality of partial tone components each having a ratio of less than one are combined into a set wherein the sum of the ratios of the combined partial tone components does not exceed one and the plurality of partial tone components are calculated on the time division basis with one channel at periods corresponding to the respective sampling frequencies.

17 Claims, 47 Drawing Figures

METHOD AND APPARATUS FOR GENERATING MUSICAL TONE SIGNALS

BACKGROUND OF THE INVENTION

This invention relates to a method and an apparatus for generating a musical tone signal in which a plurality of partial tone components are formed according to the tone pitch of a musical tone to be produced and these components are synthesized at suitable levels to produce a desired musical tone signal and more particularly a method and an apparatus for generating a musical tone signal capable of producing a musical tone signal containing a plurality of partial tone components with a simple construction.

A method of generating a musical tone signal by utilizing digital technique is disclosed in Japanese preliminary Publication of Patent No. 12172/1978 (corresponding to U.S. Pat. No. 4,282,790 assigned to the same assignee as the present application) which reaches a partial tone synthesizing system.

In such a musical tone generating system of the partial tone synthesizing type there are provided the number of calculating channels equal to the number of the partial tone components to be synthesized, and the calculating channels are used to calculate the partial tone components of preassigned orders and these calculated partial tone components are synthesized at suitable levels to generate a desired musical tone.

The term "calculating channel" used herein means a time slot for calculating each partial tone component on the time division basis where a single arithmetical operation circuit is used for calculation, or respective arithmetical operation circuits which are of the same number as the number of partial tone components where the arithmetical operation circuit are used in parallel for calculating the partial tone components.

According to the prior art musical tone signal generating system described above, since each calculating channel calculates only one predetermined partial tone component it is necessary to prepare the same number of calculating channels as that of the partial tone components to be synthesized, so that where a musical tone signal including many partial tone components is to be produced, the number of calculating channels increases greatly thus making the musical tone signal generating apparatus bulky.

SUMMARY OF THE INVENTION

Accordingly, it is an object of this invention to provide a novel method and a novel apparatus for generating a musical tone signal which can generate a musical tone signal containing a plurality of partial tone components by efficiently utilizing smaller number of calculating channels and has a simple construction.

Another object of this invention is to provide a novel method and a novel apparatus for generating a musical tone signal in which a sine function modified by a window function is used to produce a large number of partial tone components with relatively small number of calculating channels thus being produced a musical tone rich in tone colors.

Briefly stated to acomplish these objects according to this invention, sampling frequencies that satisfy the sampling theorem are determined for a plurality of partial tone components to be calculated, the highest sampling frequency among the determined sampling frequencies is selected as a calculation reference frequency and the ratios of the sampling frequencies regarding respective partial tone components to the selected calculating reference frequency are determined. A partial tone component having a ratio of one is calculated at a period corresponding to the calculation reference frequency with one calculating channel, whereas partial tone components whose ratio are less than one are calculated with a single calculating channel on the time division basis by combining into one set a plurality of partial tone components, the sum of ratios thereof does not exceed one, and at a period corresponding to respective sampling frequency ratios of the plurality of partial tone components.

According to one aspect of this invention, there is provided a method for generating a musical tone signal of the type wherein a plurality of partial tone components having different frequencies corresponding to a musical tone signal to be produced are calculated with a plurality of calculating channels and the musical tone signal is generated by sequentially synthesizing the partial tone components, which comprises the steps of determining sampling frequencies that satisfy the sampling theorem with respect to the plurality of partial components setting the sampling frequency having the highest frequency among the determined sampling frequencies as a calculation reference frequency determining ratios of the calculation reference frequency to sampling frequencies of respective partial tone components calculating a partial tone component whose ratio is 1 with one channel at a period corresponding to the calculation reference frequency combining a plurality of tone components, the ratio of each being less than 1, into one set wherein the sum of the ratios of the plurality of partial tone components does not exceed 1 and calculating the set of partial tone components on the time division basis, in one channel at a period corresponding to respective sampling frequency ratios.

According to another aspect of this invention there is provided apparatus for generating a musical tone signal of the type comprising a plurality of calculating channel means for obtaining a plurality of partial tone components corresponding to a musical tone to be produced and having different frequencies, and means for sequentially synthesizing the partial tone components to produce the musical tone, wherein there are provided means for determining respective sampling frequencies that satisfy the sampling theorem regarding respective partial tone components calculation reference signal generating means for producing a calculation reference signal having a frequency corresponding to the highest sampling frequency among the sampling frequencies and means for determining ratios of the sampling frequencies of the partial tone components to the frequency of the partial tone components to the frequency of the calculation reference signal, at least one of the calculating channels calculating a partial tone component having the ratio of one at a period of the calculation reference signal, while the remaining calculating channels combining a plurality of the partial tone components each having the ratio of less than one into one set wherein sum of the ratios does not exceed one, and calculating, on the time division basis, the one set of the partial tone components at a period corresponding to the ratio.

DESCRIPTION OF THE PREFERRED EMBODIMENTS

Figure 1:
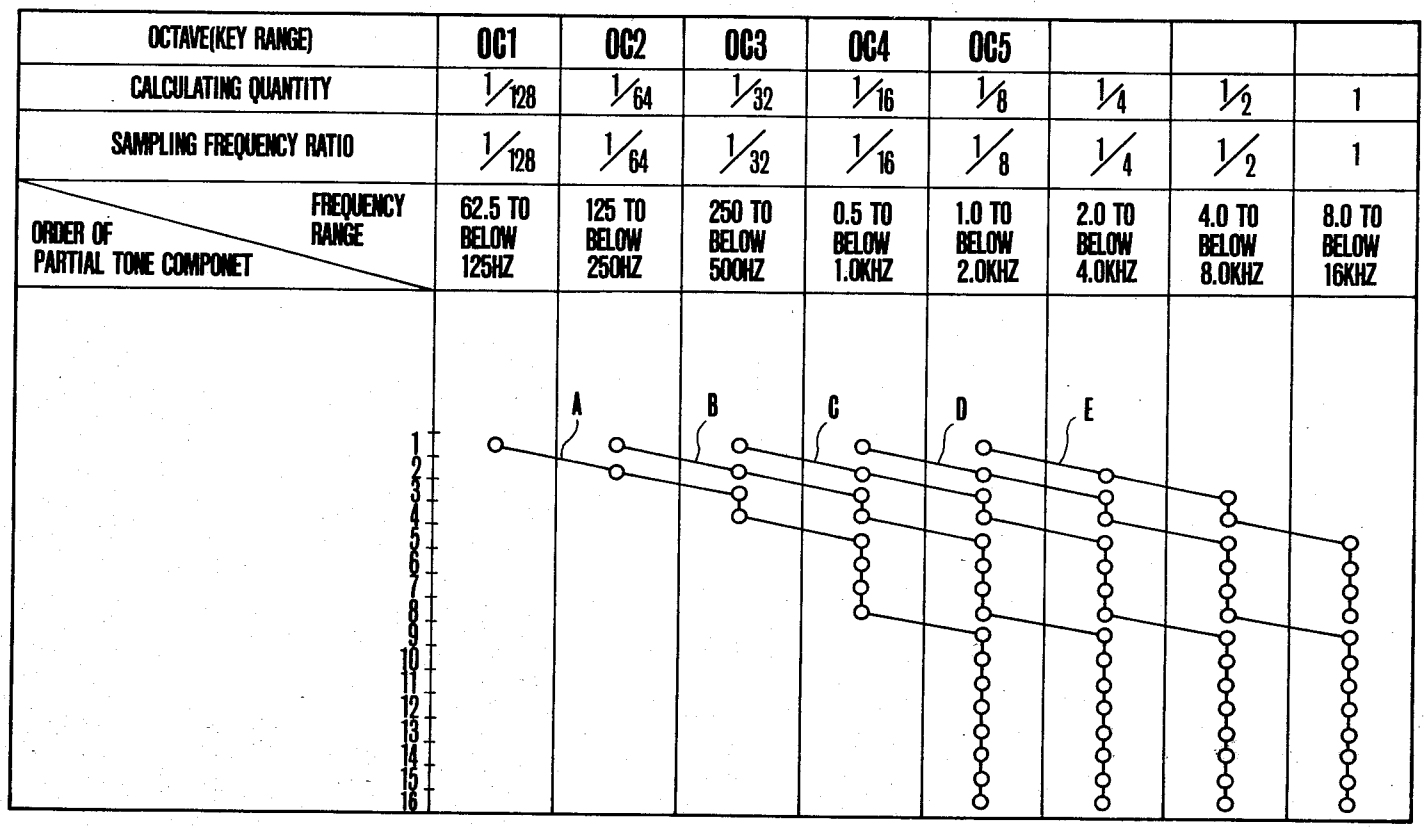
FIG. 1 is a distributional map showing the frequency distribution of partial tone components to be calculated in the first embodiment of this invention.

Principle of the method of generating the musical tone signal

As is well known in the art, in the calculation of a nth-order partial tone component of a frequency n times the fundamental frequency f, since the frequency of the nth-order partial tone component is expressed by n f, its calculating rate, that is the sampling frequency fs must be equal to at least twice the highest frequency 2.n.f to satisfy the sampling theorem. Accordingly the sampling frequency fs must be determined to satisfy a following expression (1).

$$n \cdot f = (fs/2) \qquad (1)$$

where n represents order of a partial tone component. However, in this specification, for the sake of description, it is assumed that n is an integer (1, 2, 3 . . . ).

A musical tone signal is produced by synthesizing k partial tone components H1 to Hk after calculating k partial tone components H1 (having a frequency of 1·f) through Hk (having a frequency of k·f) corresponding to the fundamental frequency f (tone pitch) of a musical tone signal to be produced, where n = 1 to k. In this case respective partial tone components H1 to Hk must be calculated at respective sampling frequencies fs1, fs2 . . . fsk satisfying $$1 \cdot f \leqq \frac{fs1}{2},\ 2 \cdot f \leqq \frac{fs2}{2},\ 3 \cdot f \leqq \frac{fs3}{2},\ \ldots\ w \cdot f \leqq \frac{fsk}{2}$$

derived by applying equation (1).

However, according to the prior art method of generating a musical tone signal described above, the following steps are executed.

(a) providing one calculating channel for each of partial tone components to be produced, and (b) calculating all partial tone components H1 to Hk in respective calculating channels at a frequency that is equal to at least twice the highest frequency, or satisfies the sampling theorem concerning a partial tone component Hk of the highest frequency among those of partial tone components H1 to Hk to be calculated regardless of the frequencies of partial tone components H1 to Hk.

For this reason, an actually unnecessary calculation is made with regard to a partial tone component Hn having a low frequency. Because, the sampling frequency of a low-frequency partial tone component Hn may be low as it is not necessary to calculate such a low-frequency partial tone component Hn at a high speed. This means a low utilization efficiency of the calculating channel that calculates the low-frequency partial tone component Hn as well as a bulky device.

The method of this invention comprises the steps of (a) determining respective sampling frequencies fs1, fs2 . . . fsk that satisfy the sampling theorem for respective ones of k partial tone components H1 to Hk to be calculated, (b) setting, as the calculation reference frequency fCA, the sampling frequency of a partial tone component of the highest frequency among the sampling frequencies fs1, fs2 . . . fsk described above, that is the sampling frequency concerning the highest frequency, (c) determining the ratios of the respective sampling frequencies fs1, fs2 . . . fsk to the calculation reference frequency FCA, that is $fs1/fCA=\beta 1$, $fs2/fCA=\beta 2$, $fs3/fCA=\beta 3$ . . . $fsk/fCA=\beta k$ (d) calculating each of the partial tone components whose ratios are respectively equal to [1] in calculating channel corresponding to the partial tone component at a period (1/fCA) corresponding to the calculation reference frequency fCA and (e) combining into one set a plurality of partial tone components whose ratios are less than [1], the sum $\Sigma\beta$ of the ratios thereof does not exceed [1] and calculating, on the time division basis in another calculating channel, the partial tone components belonging to the set respectively at periods corresponding to frequencies obtained by multiplying ratios of the respective plurality of partial tone components with the calculation reference frequency fCA, that is at periods corresponding to respective sampling frequencies.

More particularly, according to the prior art method of producing a musical tone signal, all of the k partial tone components, H1 to Hk are calculated at a period that satisfies the sampling frquency regarding the partial tone component Hk of the highest frequency. On the other hand, according to the present invention, each partial tone component Hn is calculated at a period corresponding to its own sampling frequency fsn, and a plurality of partial tone components of low frequencies are respectively calculated by using, on the time division basis, one calculating channel according to the values of the sampling frequency ratios. Accordingly, the utilization efficiency of the calculating channels can be improved. In other words, it is possible to have a smaller number of the calculating channels than the number of the partial tone components to be calculated.

Among the expression "a plurality of partial tone components to be calculated" are included a case wherein all partial tone components constituting a musical tone signal are meant and a case wherein a specific portion is meant. In other words, where the number of the partial tone components that constitute a musical tone signal is (A+B), all of these (A+B) partial tone components may be calculated according to the method of this invention, or A partial tone components among (A+B) components may be calculated according to the prior art method, while the remaining B partial tone components may be calculated according to the method of this invention.

As above described, the present invention is characterized in that a plurality of partial tone components of low frequencies are respectively calculated by using one calculating channel, on the time division basis, and at periods corresponding to the ratios of the sampling frequency to the calculation reference frequency FCA of the respective partial tone components. The details of the method of setting the calculation reference frequency fCA, the method of setting the sampling frequency fsm, and the method of determining the number of the calculating channels necessary to calculate respective partial tone components H1 to Hk will now be described.

Method of setting the calculation reference frequency fCA and the sampling frequency ratio $\beta$ n As above described, the calculation reference frequency fCA is set so as to be equal to the sampling frequency regarding the partial tone component Hk of the highest frequency among all partial tone components H1 to Hk to be calculated. For example, where the highest frequency among those of the partial tone components H1 to Hk to be calculated is equal to 16 KHz, the calculation reference frequency fCA is set to a value, for example 40 KHz, that satisfies a following relation $$fCA(=fsk) \geqq 2.16 \text{ KHz}$$

Generally stated, there are two methods of setting the sampling frequency ratio $\beta$n, that is, (1) a method of setting the sampling frequency ratio for each one of the partial tone components, and (2) a method of setting the sampling frequency ratio for each of predetermined partial tone frequency bands belonging to the partial tone components. The method (1) is used where the number of the partial tone components to be calculated is relatively small, whereas the method (2) is used where the number of the partial tone components to be calculated is relatively large and set for each partial tone component frequency band of one octave unit, for example. The use of the method (2) makes easy the time division control for using on the time division basis a calculating channel according to the sampling frequency ratio $\beta$n.

Method of calculating the number of the calculating channels

In a usual numerical calculation, where the calculating ability representing the quantity of data which the computing apparatus (calculating channel) can calculate in a unit time, and the data quantity DQ to be calculated per unit time are given, the number of computing apparatus necessary to calculate the data quantity DQ in a unit time can be readily expressed by a ratio of DQ/CA.

However, as a partial tone component Hn to be calculated according to the method of this invention, where the data quantity to be calculated is known and where the periods of calculating respective data are different, it is advantageous to calculate a plurality of data having long calculating periods by using, on the time division basis, a single computing device from the standpoint on the construction of the apparatus. Accordingly, it is not necessarily easy to determine the number of the computing apparatus.

In such a case the method of calculating the number of the calculating apparatus may be relied upon in which evaluations regarding the calculating periods of respective data (partial tone components) to be calculated are made and then the number of the computing apparatus is determined according to an index based on the evaluations.

Let us assume a computing apparatus having a calculating ability of [1] and can calculate and output a single data at a period of 1/XHz (i.e., at each 1/XHz). Furthermore, let us assume that there are data A to be calculated at a period of 1/X and two data B and C to be calculated at a period of 2/X.

To calculate these data A, B and C with the computing apparatus described above, as it is necessary to calculate the data A at the period of 1/X, the computing apparatus must be exclusively used each 1/X. Accordingly, regarding data A it is necessary to normally prepare a computing apparatus having a calculating ability of [1].

However, the data B and C may be calculated respectively at a period of 2/X (or each 2/X), it is only necessary to use the computing apparatus on alternate intervals of 1/X. Consequently, with regard to the data B and C, these data are paired as a set and it is necessary to prepare a single computing apparatus having a calculating capability of [1].

As above described, the number of the computing apparatus for calculating a plurality of data having different calculating periods, that is the overall calculating ability CA necessary to calculate all the data can be determined by evaluating the amount of time occupying the computing apparatus of a calculating ability of [1] during the calculating periods of respective data.

According to this invention, where there is a calculating channel having a calculating ability of [1] capable of calculating and outputting one partial tone component at a period of 1/X, each partial tone component Hn calculated by using the calculating channel is evaluated in terms of an interval that occupies the calculating channel during the period of calculating each partial tone component Hn.

A partial tone component that occupies the calculating channel at the period of N/X is herein defined as a "partial tone component Hn having a calculating quantity of 1/N". Then the total sum of the calculating quantities of respective partial tone components H1 to Hk represents the overall calculating ability CA necessary to calculate all partial tone components H1 to Hk.

In this regard, when the calculating frequency xHz of the calculating channel is made to coincide with the above mentioned calculation reference frequency fCA, the calculating quantity regarding respective partial tone components H1 to Hk would coincide with the aforementioned sampling frequency ratios $\beta 1$ to $\beta k$. Accordingly, the overall calculating ability CA necessary to calculate partial tone components H1 to Hk respectively having sampling frequencies fs1 to fsk would have a value $$\sum_{n=1}^{k} \beta n.$$

For example, where the sampling frequency ratios $\beta 1$ to $\beta k$ have values shown in the following Table I, the overall calculating capability CA can be expressed by the following equation (2), provided that k=8.

TABLE I

| Sampling frequency ratio | | | | | | | |
|---|---|---|---|---|---|---|---|
| $\beta 1$ | $\beta 2$ | $\beta 3$ | $\beta 4$ | $\beta 5$ | $\beta 6$ | $\beta 7$ | $\beta 8$ |
| $\frac{1}{128}$ | $\frac{1}{64}$ | $\frac{1}{32}$ | $\frac{1}{16}$ | $\frac{1}{8}$ | $\frac{1}{4}$ | $\frac{1}{2}$ | 1 |

$$CA = \beta 1 + \beta 2 + \beta 3 + \beta 4 + \beta 5 + \beta 6 + \beta 7 + \beta 8 \quad (2)$$

$$= \frac{1}{128} + \frac{1}{64} + \frac{1}{32} + \frac{1}{16} + \frac{1}{8} + \frac{1}{4} + \frac{1}{2} + 1$$

$$= \frac{255}{128} \simeq 2$$

Accordingly, in the case of the example shown in Table I, it is necessary to prepare two calculating channels, each having a calculating ability of [1], and to calculate and output a partial tone component Hn at a period of 1/fCA corresponding to the calculation reference frequency fCA.

In this case, the first calculating channel calculates a partial tone component H8 having a sampling frequency ratio $\beta 8$=[1] at each period of 1/fCA corresponding to the calculation reference frequency fCA, whereas the second calculating channel calculates partial tone components H1 to H7 corresponding to the sampling frequency ratios $\beta 1$ to $\beta 7$ respectively at periods as shown in the following Table II. More particularly, a partial tone component Hn whose sampling frequency ratio $\beta n$ is less than [1] is calculated, on the time division basis, in the second calculating channel at a period of ($1/\beta n$ fCA) corresponding to a frequency equal to the product $\beta n$.fCA of the ratio $\beta n$ and the calculation reference frequency FCA wherein the plurality of partial tone components are combined into a set such that the sum $\Sigma \beta n$ of the ratios sampling frequency does not exceed [1].

TABLE II

| partial tone component | H1 | H2 | H3 | H4 | H5 | H6 | H7 |
|---|---|---|---|---|---|---|---|
| sampling frequency ratio $\beta n$ | $\frac{1}{128}$ | $\frac{1}{64}$ | $\frac{1}{32}$ | $\frac{1}{16}$ | $\frac{1}{8}$ | $\frac{1}{4}$ | $\frac{1}{2}$ |
| calculated period ($1/\beta n \cdot$ fCA) | $\frac{128}{fCA}$ | $\frac{64}{fCA}$ | $\frac{32}{fCA}$ | $\frac{16}{fCA}$ | $\frac{8}{fCA}$ | $\frac{4}{fCA}$ | $\frac{2}{fCA}$ |

In this case, the control for calculating, on the time division basis, respective partial tone components H1 to H7 is controlled such that one calculating cycle time for calculating all partial tone components H1 to H7 would be equal to one calculating period of a partial tone component having the longest calculating period, and that a plurality of time slots obtained by dividing the one calculating cycle time with one period interval of the calculation reference frequency fCA are assigned in accordance with the sampling frequency ratios $\beta 1$ to $\beta 7$ of respective partial tone components H1 to H7.

In the case of the example shown in Table II, one calculation frame time is set to be (128)/(fCA), the one calculation frame time is divided at intervals of (1)/(fCA) to obtain 128 time slots which are assigned for calculating respective partial tone components H1 to H7 according to the values of the sampling frequency ratios B1 to B7 of respective partial tone components H1 to H7. More particularly, with regard to the partial tone component H1, one time slot in one calculation cycle time is assigned and with regard to the partial tone component H2 two time slots are assigned. In the same manner, remaining partial tone components H3 to H7 are assigned with 128.$\beta$n time slots. Then, it becomes possible to calculate respective partial tone components H1 to H7 according to respective sampling frequencies fs1 to fs7.

Now a typical example of the method of producing a musical tone signal according to this invention will be described and follows:

An Example of an Application of This Invention to the Method of Producing a Musical Tone Signal Where the method of producing a musical tone signal according to this invention is applied to an electronic musical instrument satisfying the conditions shown in the following Table III, the calculation reference frequency fCA and the number of the calculating channels are determined in the following manner.

TABLE III

| | condition |
|---|---|
| number of simultaneously produced tones | one |
| key range | 5 octaves ranging from tone pitch C2 to B6 |
| partial tones constituting a musical tone | total 16 kinds, i.e., primary partial tone (fundamental tone) through 16th partial tone (16th harmonic) |
| max. frequency of a partial tone component that can be produced | 16 KHz |

At first, the distribution of frequencies of partial tone components to be produced is analyzed. In the case of the example shown in Table III, the fundamental frequency of tone pitch C2 is equal to 65.4 Hz, whereas that of the tone pitch B6 is equal to 1975.5 Hz. Moreover, since the musical tone is constituted by 16 partial tone components up to the 16th partial tone component H16, the partial tone components contributing to the tone pitches C2 to B6 are distributed in a frequency range of from 65.4 Hz (corresponding to the frequency of the first partial tone component of the tone pitch C2) to 31608 Hz (corresponding to the frequency of the 16th partial tone component of the tone pitch B6).

However, the maximum frequency that can be produced is limited by the upper limit (i.e. 16 Khz) of the audible frequency band in view of the conditions shown in Table III so that the frequencies of the partial tone components to be produced distribute in a range of from 65.4 Hz to 16 KHz. The following Table IV shows the frequency bands of the partial tone components of from the first octave OC1 to the fifth octave OC5.

TABLE IV

| octave | tone pitch | first partial tone frequency | 16th partial tone frequency | frequency band |
|---|---|---|---|---|
| OC1 | C2 | 65.4 Hz | 1046.4 Hz | 65.4–1976 Hz |
| | . | . | . | |
| | . | . | . | |
| | B2 | 123.5 | 1976 | |
| OC2 | C3 | 130.8 | 2092.8 | 130.8–3950.4 |
| | . | . | . | |
| | . | . | . | |
| | . | . | . | |
| | B3 | 246.9 | 3950.4 | |
| OC3 | C4 | 261.6 | 4185.6 | 261.6–7902.4 |
| | . | . | . | |
| | . | . | . | |
| | . | . | . | |
| | B4 | 493.9 | 7902.4 | |
| OC4 | C5 | 523.3 | 8372.8 | 523.3–15804.8 |
| | . | . | . | |
| | . | . | . | |
| | B5 | 978.8 | 15804.8 | |
| OC5 | C6 | 1046.5 | 16744 | 1046.5–16000 |
| | . | . | . | |
| | . | . | . | |
| | . | . | . | |
| | B6 | 1975.5 | 31608 | |

Then, the sampling frequency ratio $\beta$n of each partial tone component Hn is determined by taking the partial tone component of the maximum frequency 16 KHz as a reference. In this case, since the frequency band of the partial tone components H1 to H16 to be calculated for each tone pitch is wide, the sampling frequency ratios is determined to be $\beta n=1$ to $\beta n=1/128$ at respective frequencies band for respective octaves as shown in the following Table V.

TABLE V

| frequency band of partial tone components | 62.5 to 125 Hz | 125 to 250 Hz | 250 to 500 Hz | | |
|---|---|---|---|---|---|
| sampling frequency ratio n | 1/128 | 1/64 | 1/32 | | |
| | 0.5–1.0 KHz | 1.0–2.0 KHz | 2.0–4.0 KHz | 4.0–8.0 KHz | 8.0–16 KHz |
| | 1/16 | 1/8 | 1/4 | 1/2 | 1 |

Let us investigate the fact that respective partial tone components H1 to H16 regarding respective musical tones belonging to first to fifth octaves OC1 to OC5 belong to which group of the sampling frequency ratios with respect to each octave.

Then it can be clarified that respective partial tone components less than 16 KHz regarding respective musical tones of the first to fifth octaves OC1 to OC5 belong to groups of the sampling frequency ratios depicted by small circles in a frequency ratios depicted by small circles in a distributional map in FIG. 1. As shown by a line A interconnecting the small circles, the partial tone components H1 to H16 regarding the musical tone belonging to the first octave OC1 are distributed such that the first partial tone component H1 belongs to a group of the sampling frequency ratio $\beta n=1/128$, the second partial tone component H2 belongs to a group of $\beta n=1/64$, the third and fourth partial tone components H3 and H4 belong to a group of $\beta n=1/32$, the fifth to eigth partial tone components H5 to H8 belong to a group of $\beta n=1/16$ and the 9th to 16th partial tone components H9 to H16 belong to a group of $\beta n=1/8$.

Similarly, the partial tone components H1 to H16 regarding musical tones respectively belonging to the second to the fourth octave OC2 to OC5 and the partial tone components H1 to H8 regarding a musical tone belonging to the fifth octave OC5 belong to the groups of the sampling frequency ratios shown by lines B to D and line E in FIG. 1 respectively.

Then, the overall calculating ability CA for calculating partial tone components belonging to first to fifth octaves OC1 to OC5 is calculated for respective octaves. As above described, since the overall calculating ability CA coincides with the sum of the sampling frequency ratios, the overall calculating abilities CA1 to CA5 of first to fifth octaves OC1 to OC5 are given by the following equations (3) through (7).

$$CA1=1/128+1/64+(1/32)\times 2+(1/16)\times 4+(\tfrac{1}{8})\times 8=2 \quad (3)$$

$$CA2=1/64+1/32+(1/16)\times 2+(\tfrac{1}{8})\times 4+(\tfrac{1}{4})\times 8=3 \quad (4)$$

$$CA3=1/32+1/16+(\tfrac{1}{8})\times 2+(\tfrac{1}{4})\times 4+(\tfrac{1}{2})\times 8=6 \quad (5)$$

$$CA4=1/16+\tfrac{1}{8}+(\tfrac{1}{4})\times 2+(\tfrac{1}{2})\times 4+1\times 8=11 \quad (6)$$

$$CA5=\tfrac{1}{8}+\tfrac{1}{4}+(\tfrac{1}{2})\times 2+1\times 4=6 \quad (7)$$

As a consequence, in order to calculate all partial tone components regarding musical tones respectively belonging to first to fifth octaves OC1 to OC5, it is necessary only to prepare a overall calculating ability of [11] corresponding to the overall calculating ability CA4 manifecting the maximum valve among the overall calculating abilities CA1 to CA5 expressed by equations (3) to (7). Thus, it is sufficient to prepare [11] calculating channels, each having a calculating ability of [1], that is each being capable of calculating the highest-pitch partial tone component at a period of the calculation reference frequency fCA.

As above described, the number of the calculating channels necessary to calculate 16 partial tone components H1 to H16 regarding musical tones in a key range of first to fourth octaves OC1 to OC4 and 8 partial tone components H1 to H8 regarding a musical tone in a key range of fifth octave OC5 is determined. Then, the modes of utilization of the 11 calculating channels are determined for respective frequency bands of respective partial tone components. In other words, it is determined that a partial tone component Hn of a given frequency should be calculated in a predetermined one of the 11 calculating channels and at a predetermined calculating period.

Figure 2:
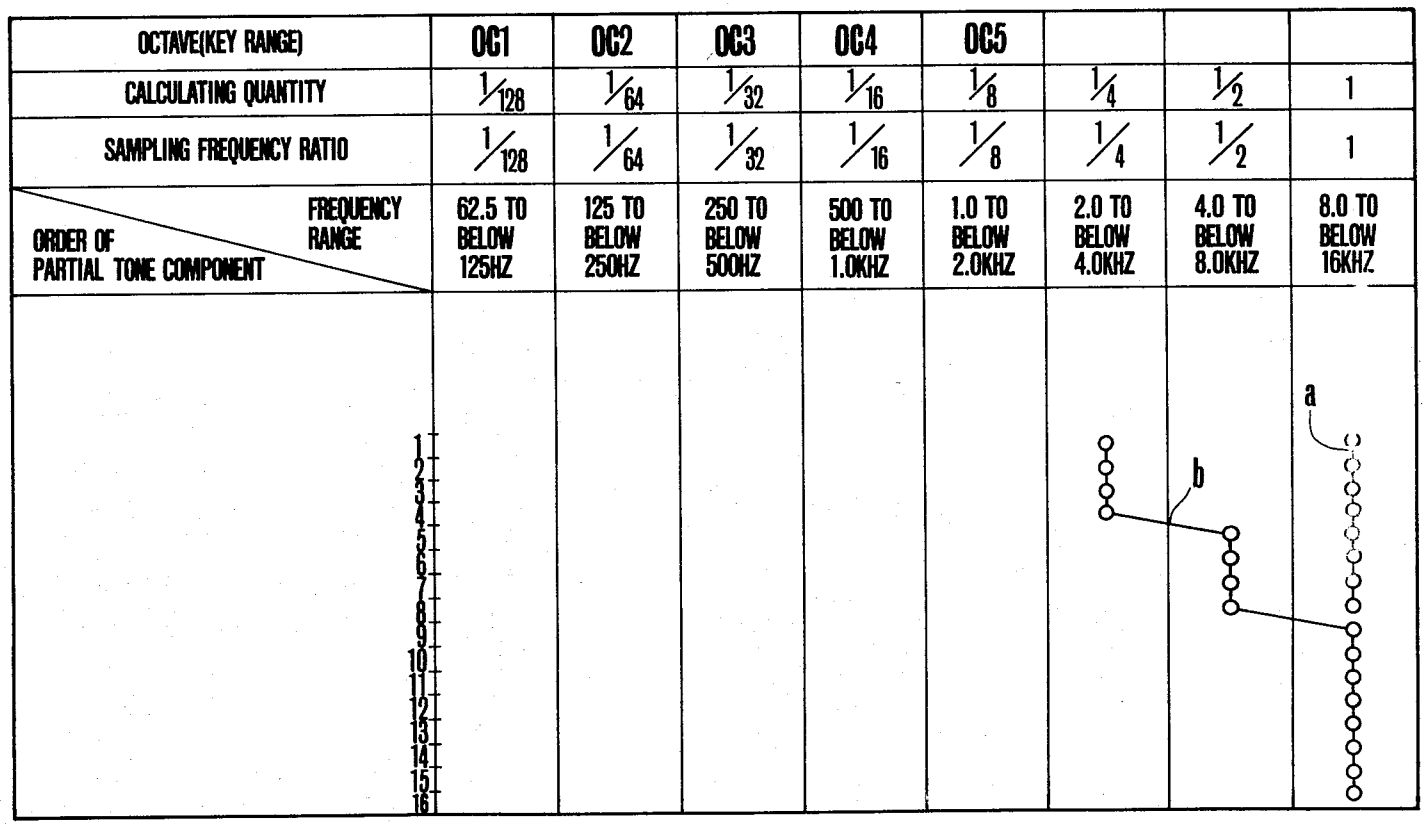
FIG. 2 is a map showing the manner of calculating the partial tone components having a distribution as shown in FIG. 1 in respective calculating channels at different periods.

FIG. 2 is obtained by rewriting FIG. 1 such that all of the overall calculating abilities CA1 to CA5 for respective octaves OC1 to OC5 would become [11]. More particularly, as shown by a line a interconnecting small circles shown in FIG. 2, respective partial tone components H1 to H8 regarding a musical tone belonging to the fifth octave OC5 are calculated at a period corresponding to a sampling frequency ratio $\beta n=[1]$. On the other hand, as shown by a line b interconnecting small circles shown in FIG. 2, the partial tone components H1 to H16 regarding musical tones belonging to first to fourth octaves OC1 to OC4 are calculated, the first to fourth musical tone components H1 to H4 being calculated at a period corresponding to $\beta n=\frac{1}{4}$, the fifth to 8th partial tone components H5 to H8 being calculated at a period corresponding to $\beta n=\frac{1}{2}$ and the 9th to 16th partial tone components H9 to H16 being calculated at a period corresponding to $\beta n=1$.

Next, the calculation reference frequency fCA is determined. Since the frequencies of the partial tone components to be calculated range from 65.4 Hz to 16 KHz, the reference frequency fCA is set to be "fCA=40 KHz", for example, that satisfies a relation $fCA \geqq 2.16$ KHz.

Consequently, the partial tone components H1 to H8 regarding a musical tone belonging to the fifth octave OC5, that is the partial tone components H1 to H8 in a case wherein the fundamental frequency of the musical tone signal to be generated is higher than 1.0 KHz, can be calculated in any 8 channels among the 11 calculating channels CH0 to CH10 at a sampling frequency of 1/40 KHz as shown in the following Table VIa. Since the maximum frequency of the partial tone component to be calculated is prelimited up to 16 KHz, the partial tone component of the maximum order among the partial tone components to be calculated in this case would be the 8th order partial component H8. However, in the following description, for convenience of description the 9th order partial component to the 11th partial tone components corresponding to the frequencies higher than 16 KHz are not omitted. Naturally, those partial tone components are not essential to form a tone. On the other hand, the partial tone components Hn regarding musical tones belonging to first to fourth octaves OC1 to OC4, that is the partial tone components in a case wherein the fundamental frequency of the musical tone signal to be generated are less than 1 KHz are calculated as shown in the following Table VIb in the 11 calculating channels CH0 to CH10 such that the first to the fourth partial tone components H1 to H4 are calculated at a period of 1/10 KHz, that the fifth to eighth partial tone components H5 to H8 at a period of 1/20 KHz and that 9th to 16th partial tone components H9 to H16 at a period of 1/40 KHz.

TABLE VIa

| | | ← T1 → | | | | | | $T1=\frac{1}{40\ KHz}$ |
|---|---|---|---|---|---|---|---|---|
| calculating channel | CH0 | H1 | H1 | H1 | H1 | H1 | ... | H1 |
| | CH1 | H2 | H2 | H2 | H2 | H2 | ... | H2 |
| | CH2 | H3 | H3 | H3 | H3 | H3 | ... | H3 |
| | CH3 | H4 | H4 | H4 | H4 | H4 | ... | H4 |
| | CH4 | H5 | H5 | H5 | H5 | H5 | ... | H5 |
| | CH5 | H6 | H6 | H6 | H6 | H6 | ... | H6 |
| | CH6 | H7 | H7 | H7 | H7 | H7 | ... | H7 |
| | CH7 | H8 | H8 | H8 | H8 | H8 | ... | H8 |
| | CH8 | H9 | H9 | H9 | H9 | H9 | ... | H9 |
| | CH9 | H10 | H10 | H10 | H10 | H10 | ... | H10 |
| | CH10 | H11 | H11 | H11 | H11 | H11 | ... | H11 |

TABLE VIb

| | | | | | | | | | | |
|---|---|---|---|---|---|---|---|---|---|---|
| | | ← T3 → | | | | | | | | $T1=\frac{1}{40\ KHz}$ |
| | | ← T2 → | | | | | | | | $T2=\frac{1}{20\ KHz}$ |
| | | ← T1 → | | | | | | | | $T3=\frac{1}{10\ KHz}$ |
| calculating channels | CH0 | H1 | H2 | H3 | H4 | H1 | H2 | H3 | H4 | |
| | CH1 | H5 | H7 | H5 | H7 | H5 | H7 | H5 | H7 | |

TABLE VIb-continued

| | | | | | | | | |
|---|---|---|---|---|---|---|---|---|
| | ←T3→ | | | | | | | $T1 = \frac{1}{40\ KHz}$ |
| | ←T2→ | | | | | | | $T2 = \frac{1}{20\ KHz}$ |
| | ←T1→ | | | | | | | $T3 = \frac{1}{10\ KHz}$ |
| CH2 | H6 | H8 | H6 | H8 | H6 | H8 | H6 | H8 |
| CH3 | H9 | H9 | H9 | H9 | H9 | H9 | H9 | H9 |
| CH4 | H10 | H10 | H10 | H10 | H10 | H10 | H10 | H10 |
| CH5 | H11 | H11 | H11 | H11 | H11 | H11 | H11 | H11 |
| CH6 | H12 | H12 | H12 | H12 | H12 | H12 | H12 | H12 |
| CH7 | H13 | H13 | H13 | H13 | H13 | H13 | H13 | H13 |
| CH8 | H14 | H14 | H14 | H14 | H14 | H14 | H14 | H14 |
| CH9 | H15 | H15 | H15 | H15 | H15 | H15 | H15 | H15 |
| CH10 | H16 | H16 | H16 | H16 | H16 | H16 | H16 | H16 |

Method of Eliminating Images Produced by Sampling

Figure 3:
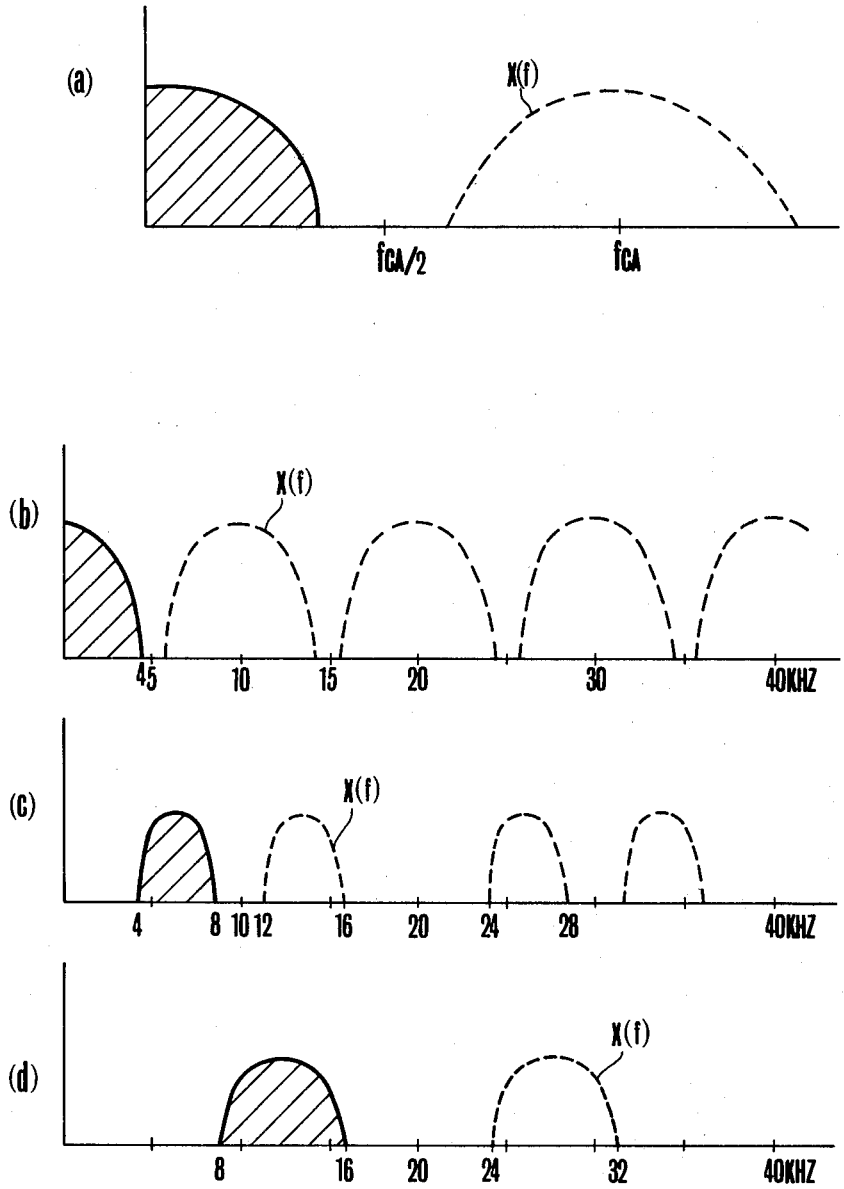
FIGS. 3*a* through 3*d* are graphs showing images of an original signal produced by sampling.

In the case of calculating a plurality of partial tone components according to the method of producing a musical tone signal embodying the invention, an infinite number of images x(f) of the original signal x(f) appears by sampling, each centered at integer multiples of the sampling frequency as shown by dotted lines in FIG. 3*a*, so that it is necessary to eliminate such images with a lowpass filter.

In an example of calculating the partial tone components under conditions shown in Table III, more precisely a partial tone components regarding a musical tone in a frequency band whose fundamental frequency is lower than 1.0 KHz, when first to fourth partial tone components H1 to H4 are calculated at a period of 1/10 KHz, the images x(f) are generated as shown by dotted lines in FIG. 3*b*, when fifth to ninth partial tone components H5 to H8 calculated at a period of 1/20 KHz, x(f) are generated as shown by dotted lines in FIG. 3*c*, and when 9th to 16th partial tone components H9 to H16 calculated at a period of 1/40 KHz, images x(f) are generated as shown by dotted lines in FIG. 3*d*. Accordingly, the images x(f) shown in FIGS. 3*b*, 3*c* and 3*d* should be eliminated respectively with lowpass filters having cut-off frequencies of 4,8 and 16 KHz respectively. As these lowpass filters, 4th-order Chebyshev analogue filters may be used.

As above described, according to the method of producing a musical tone signal of this invention, respective sampling frequencies that satisfy the sampling theorem are determined with reference to a plurality of partial tone components to be calculated, a sampling frequency having the highest frequency among the plurality of sampling frequencies is set as a calculation reference frequency fCA, ratios of respective sampling frequencies regarding respective partial tone components to the calculation reference frequency are determined, a partial tone component having a sampling frequency ratio of 1 is calculated at a period corresponding to the calculation reference frequency, a partial tone component having a ratio of less than [1] is combined with other partial tone components for the sum of the ratios of these components not to exceed [1], and the combined partial tone components are calculated, on the time division basis, in a single calculating channel at periods respectively corresponding to their sampling frequencies. Consequently, the utilization efficiency of the calculating channels can be improved with the result that it becomes possible to produce a musical tone signal containing a large number of partial tone components in less number of calculating channels, thereby reducing the size of the apparatus in the electronic musical instrument.

Examples of the musical tone signal generators for carrying out the method of producing a musical tone signal according to this invention will now be described.

Examples of the musical tone signal generator

Figure 5:
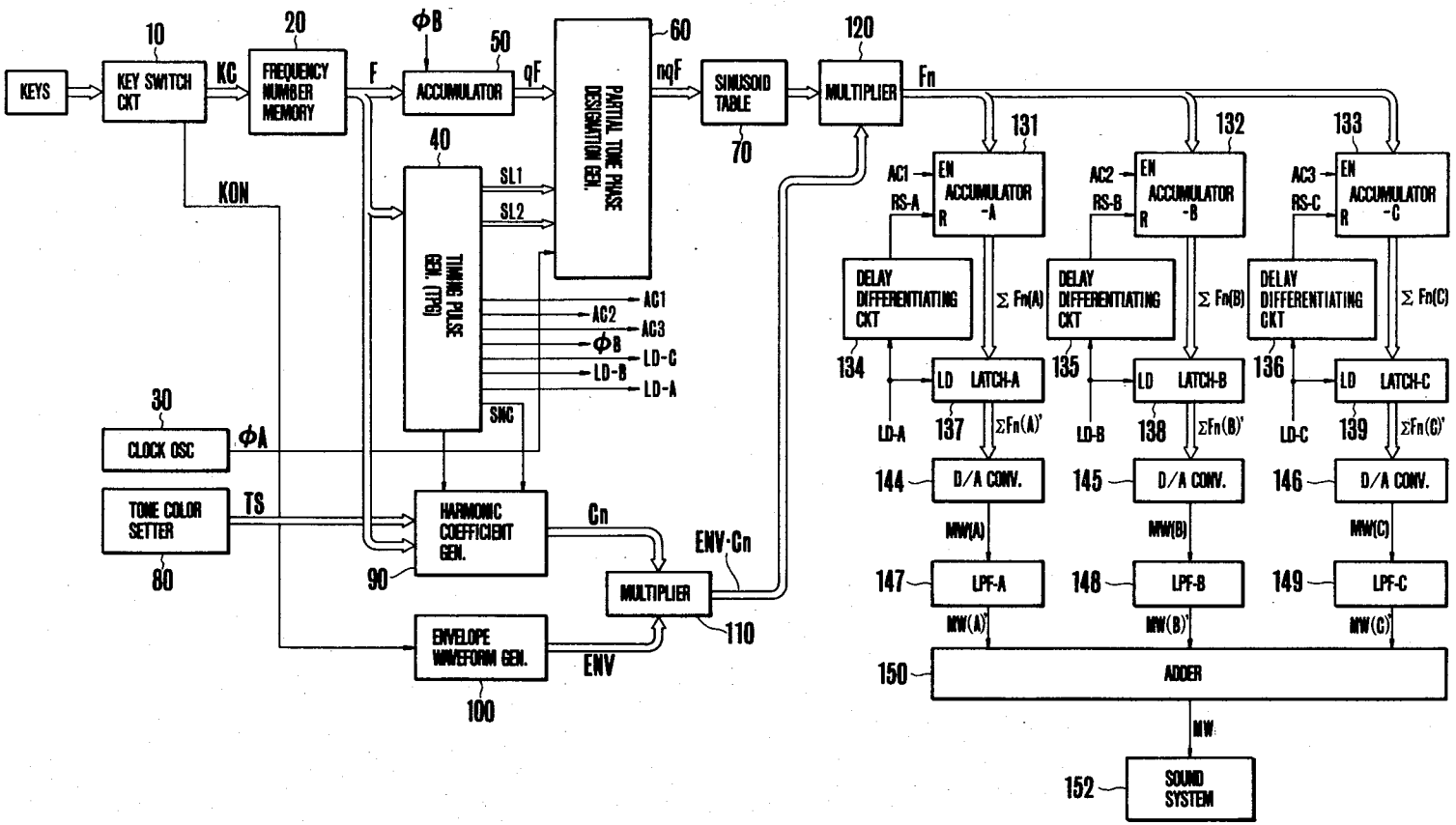
FIG. 5 is a block diagram showing a first embodiment of a musical tone signal generator according to this invention.

FIG. 5 shows one example of the musical tone signal generator according to this invention adapted to generate a musical tone signal satisfying the conditions shown in Table III. Accordingly, this musical tone signal generator provides 11 calculating channels CH0 to CH10.

The 11 calculating channels CH0 to CH10 may be provided in parallel, but in this embodiment, a single computing apparatus having respective calculating channels CH0 to CH10 is used on the time division basis. Accordingly, the calculating channels CH0 to CH10 of this embodiment correspond to time division time slots respectively. The relationship between the time slots and the calculating channels CH to CH10 is shown in FIG. 4.

Figure 4:
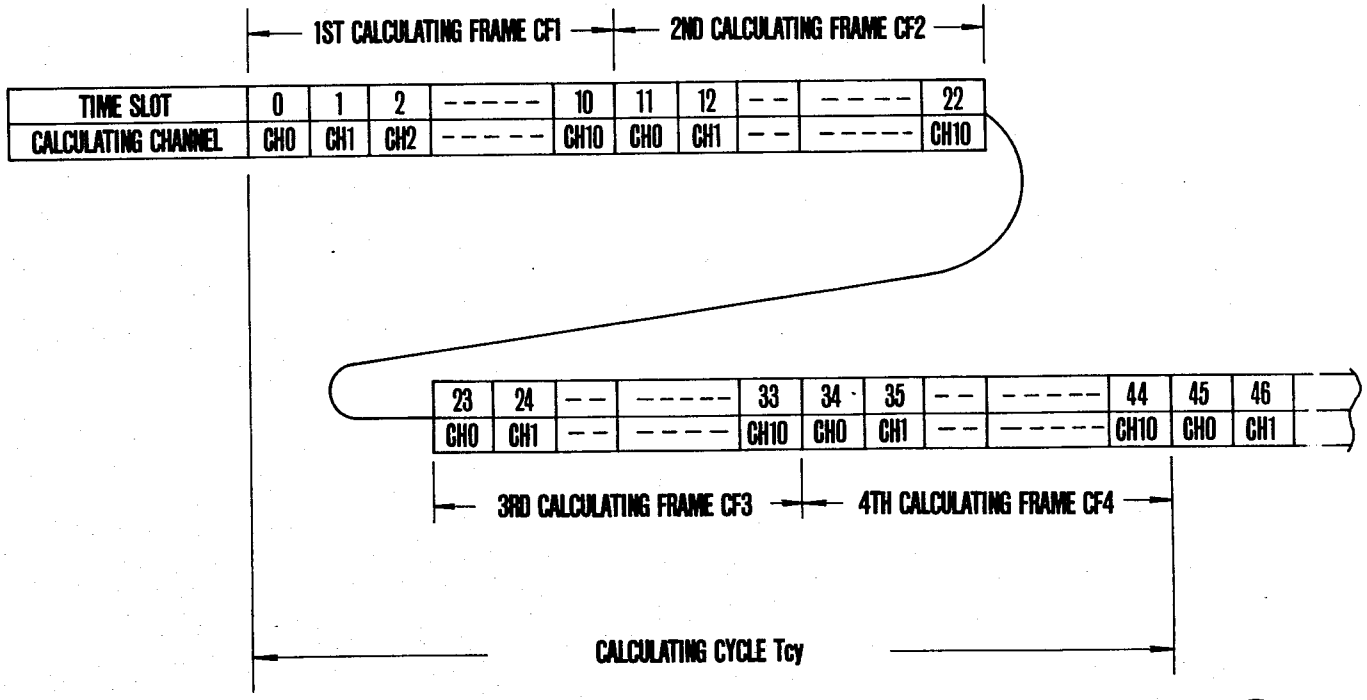
FIG. 4 is a chart showing the relationship between the time division time slots and the calculating channels.

As can be noted from FIG. 4, one cycle of the operation of all calculating channels CH0 to CH10 requires 11 time slots. The interval (corresponding to 11 time slots) of the one cycle which all calculating channels completes is herein termed "a calculating frame".

A musical tone signal satisfying the conditions shown in above mentioned Table III with the musical tone signal generator is generated by the above described method in which respective partial tone components are calculated with specific calculating channels (see Tables VIa and VIb).

As can be noted from these tables VIa and VIb, when the fundamental frequency f of the generated musical tone signal is lower than 1.0 KHz, it is necessary to sequentially calculate, on the time division basis, a plurality of partial tone components with a single calculating channel (see Table VIa), to calculate all 16 partial tone components H1 to H16. Accordingly each calculating channel must repeat four times the calculating operation. Consequently, in order to calculate all of the 16 partial tone components H1 to H16, it is necessary to provide 4 calculating frames. An interval comprising 4 calculating frames is herein termed a "calculating cycle $T_{cy}$", whereas four calculating frames in one calculating cycle $T_{cy}$ is called "first to fourth calculating frames CF1 to CF4".

Of course, where the fundamental frequency f of the generated musical tone signal is higher than 1.0 KHz, all partial tone components (in this case 11 components from the first to the eleventh) are calculated in one calculating frame.

It is necessary to match the intervals of respective calculating frames CF, in which all calculating channels operate, with the calculation reference period 1/fCA, that is 1/40 KHz (=25 μs). For this reason the intervals of respective calculating channels CH0 to CH10 are set to be equal to 1/(11×40) KHz=(about 2.3 μs). The calculating cycle time $T_{cy}$ is set to be 4/40 KHz (=100 μs).

In this embodiment, the partial tone components to be calculated with respective calculating channels during the first to the fourth calculating frames CF1 to CF4 of one calculating cycle Tcy are set as shown in the following Tables VIIa and VIIb, in which Table VIIa shows partial tone components H1 to H16 to be calculated with calculating channels CH0 to CH10 where the fundamental frequency f of the generated musical tone signal is lower than 1.0 KHz, whereas Table VIIb shows partial tone components H1 to H16 to be calculated with respective calculating channels CH0 to CH10 where the fundamental frequency f of the generated musical tone signal is higher than 1.0 KHz.

TABLE VIIa

| Calculating Frame | condition: f < 1000 Hz Calculating Channel | | | | | | | | | | |
|---|---|---|---|---|---|---|---|---|---|---|---|
| | CH0 | CH1 | CH2 | CH3 | CH4 | CH5 | CH6 | CH7 | CH8 | CH9 | CH10 |
| CF1 | H1 | H5 | H6 | H9 | H10 | H11 | H12 | H13 | H14 | H15 | H16 |
| CF2 | H2 | H7 | H8 | H9 | H10 | H11 | H12 | H13 | H14 | H15 | H16 |
| CF3 | H3 | H5 | H6 | H9 | H10 | H11 | H12 | H13 | H14 | H15 | H16 |
| CF4 | H4 | H7 | H8 | H9 | H10 | H11 | H12 | H13 | H14 | H15 | H16 |

TABLE VIIb

| Calculating Frame | condition: f ≧ 1000 Hz Calculating Channel | | | | | | | | | | |
|---|---|---|---|---|---|---|---|---|---|---|---|
| | CH0 | CH1 | CH2 | CH3 | CH4 | CH5 | CH6 | CH7 | CH8 | CH9 | CH10 |
| CF1 | H1 | H2 | H3 | H4 | H5 | H6 | H7 | H8 | H9 | H10 | H11 |
| CF2 | H1 | H2 | H3 | H4 | H5 | H6 | H7 | H8 | H9 | H10 | H11 |
| CF3 | H1 | H2 | H3 | H4 | H5 | H6 | H7 | H8 | H9 | H10 | H11 |
| CH4 | H1 | H2 | H3 | H4 | H5 | H6 | H7 | H8 | H9 | H10 | H11 |

Construction

Referring now to FIG. 5, a key switch circuit (keyer) 10 comprises a number of key switches corresponding to respective keys (tone pitches C2 to B6) of a keyboard of an electronic musical instrument and is constructed such that when a certain key is depressed, a corresponding key switch is operated to produce a key code KC (i.e., a key information) and a key-on signal KON which represents the key is depressed. The key switch circuit 10 contains a single tone priority circuit so that when more than two keys are depressed at the same time only a key code KC having a higher order of priority is outputted. In this case, the key code KC is kept produced until a next key is depressed.

A frequency number memory device 20 is provided to store frequency numbers F corresponding to the tone pitches of respective keys at respective addresses. When a key code KC from the key switch circuit 10 is applied to the frequency number memory device 20 as an address signal, the memory device 20 produces a frequency number F corresponding to the tone pitch of the depressed key.

A clock oscillator 30 produces a clock pulse φA having a frequency 440 KHz 11 times the calculation reference frequency fCA of 40 KHz, one period 1/440 KHz of the clock pulse φA corresponding to one calculating channel time. The relationships between the clock pulse φA and the channel times of respective calculating channels CH0 to CH10 are shown in FIGS. 7a, 7b and FIGS. 8a, 8b.

A timing pulse generator (TPG) 40 is provided to suitably divide the frequency of the clock pulse φA supplied from the clock pulse oscillator 30 producing a clock pulse φB (see FIG. 7c and FIG. 8c) having the same frequency as the calculation reference frequency fCA of 40 KHz. The timing pulse generator 40 further divides the frequency of the clock pulse φB to produce a calculating cycle signal SNC (see FIG. 7d and FIG. 8d) which represents the start of each calculating cycle Tcy and becomes "1" in synchronism with the first calculating channel time of the first calculating frame CF1.

Also the timing pulse generator 40 produces order designation signals SL1 and SL2 (each 4 bits) which designates order of a partial tone component to be calculated in each of 11 calculating channels CH0 to CH10 in respective one of first to fourth calculating frames CF1 to CF4.

The order designation signals SL1 and SL2 are outputted at times corresponding to respective calculating channels CH0 to CH10 as shown in Tables VIIa and VIIb. But, as Tables VIIa and VIIb clearly show, since the partial tone components to be calculated with the calculating channels CH0 to CH11 are different depending upon whether the fundamental frequency f of the generated musical tone signal is higher or lower than 1.0 KHz, it is necessary to change the contents of the order designation signals SL1 and SL2 according to the fundamental frequency f of the generated musical tone signal. To this end the frequency number F outputted from the frequency number memory device 20 is inputted to the timing pulse generator 40 and in response to the frequency number F, the timing pulse generator 40 judges whether the fundamental frequency f of the generated musical tone signal is higher or lower than 1.0 KHz. As above described, since the frequency number F corresponds to the tone pitch of the depressed key, it is easy to discriminate the fundamental frequency f of the generated musical tone signal based on the frequency number F.

FIGS. *7f* and *7g* show the order designation signals SL1 and SL2 when the fundamental frequency f of the generated musical tone signal is lower than 1.0 KHz. These signals SL1 and SL2 have contents corresponding to the respective partial tone components to be calculated with respective calculating channels CH0 to CH10 shown in FIG. *7e*. FIGS. *8f* and *8g* show order designation signals SL1 and SL2 at a time when the fundamental frequency f of the generated musical tone signal is higher than 1.0 KHz, these signals SL1 and SL2 having contents corresponding to the partial tone components to be calculated with the calculating channels CH0 to CH10.

FIGS. *7a* to *7k* and FIGS. *8a* to *8k* show timing charts of various signals outputted from the timing pulse generator 40 when the fundamental frequency of the generated musical signal is lower than 1.0 KHz and higher than 1.0 KHz respectively.

Furthermore, the timing pulse generator 40 produces accumulation designation signals AC1, AC2 and AC3 for accumulating, during one calculating cycle Tcy, the instantaneous amplitude value Fn of the predetermined partial tone component Hn in A accumulator-A 131, an accumulator-B 132 and an accumulator-C 133 provided for different calculating periods (for different sampling frequency ratios) to be described later. The accumulation designation signal AC1 is the signal for accumulating the instanteneous amplitude value Fn of a partial tone component Hn to be calculated at a period of 1/10 KHz, the signal AC2 is the signal for accumulating the instantenuous amplitude value Fn of a partial tone component Hn to be calculated at a period of 1/20 KHz and the signal AC3 is the signal for accumulating the instantaneous amplitude value Fn of a partial tone component Hn to be calculated at a period of 1/40 KHz.

Similar to the order designation signals SL1 and SL2, the partial tone components to be calculated with respective calculating channels CH0 to CH10 are different in accordance with the fundamental frequency f of the generated musical tone signal so that the contents of the accumulation designation signals AC1 to AC3 are required to be changed according to the fundamental frequency f (see FIGS. *7h* to *7j* and FIGS. *8h* to *8j*).

The detail of the construction of the timing pulse generator 40 which generates various signals will now be described.

Construction of the timing pulse generator (TPG) 40

Figure 6:
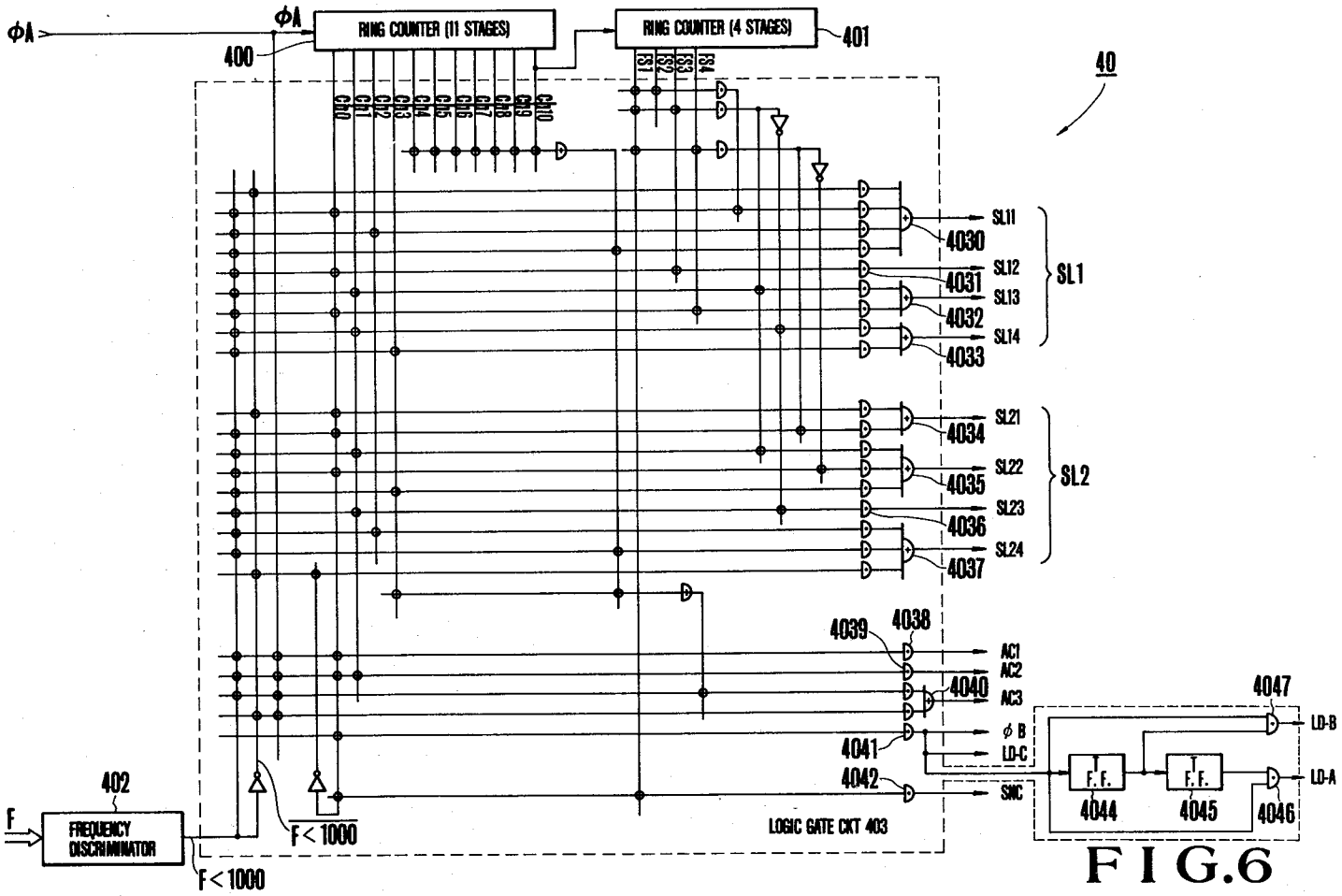
FIG. 6 is a connection diagram showing the detailed construction of the timing pulse generator of the musical tone signal generator shown in FIG. 5.

As shown in FIG. 6, the timing pulse generator 40 comprises a 11-stage ring counter 400 which counts the number of the clock pulses $\phi$A and applies channel signals ch0 to ch10 corresponding to 11 calculating channels CH0 to CH10 respectively, a 4-stage ring counter 401 which counts the number of the outputs of the last stage of the ring counter 400, that is the channel signal ch10 for producing calculating frame signals FS1 to FS4 corresponding to first to fourth calculating frames CF1 to CF4, a frequency discriminator 402 generating a signal F<1000 as a result of a judgement whether the fundamental frequency f of a generated musical tone signal have a frequency number F of less than 1.0 KHz and a logic gate circuit 403 which forms signals SL1, SL2, AC1 to AC3, $\phi$B and SNC based on the output signals of the ring counters 400 and 401 and the frequency discriminator 402.

The logic gate circuit 403 is constituted by a plurality of AND gate circuits, OR gate circuits and inverters and the outputs of the gate circuits become "1" when the logic equations shown in the following Table VIII are satisfied. The timing charts of various signals outputted from the timing pulse generator 40 are shown in FIGS. *7a* to *7k* and FIGS. *8a* to *8k*.

Although this embodiment is one example of, the timing pulse generator 40, other circuits may also be used so long as they can satisfy the logic equations shown in Table VIII.

TABLE VIII

| gate | signal | logic equation |
|---|---|---|
| frequency discriminator 402 | F < 1000 | "1", when frequency number F corresponds to a value of less than 1000 Hz |
| OR gate 4030 | SL11 | $\overline{F < 1000} + (F < 1000) \cdot ch0 \cdot FS1 \cdot FS2 + (F < 1000) \cdot ch2 + (F < 1000) \cdot (ch4 + ch5 + ch6 + ch7 + ch8 + ch9 + ch10)$ |
| AND gate 4031 | SL12 | $(F < 1000) \cdot ch0 \cdot FS3$ |
| OR gate 4032 | SL13 | $(F < 1000) \cdot ch1 \cdot FS1 \cdot FS3 + (F < 1000) \cdot ch0 \cdot FS4$ |
| OR gate 4033 | SL14 | $(F < 1000) \cdot ch1 \cdot \overline{FS1 \cdot FS3} + (F < 1000) \cdot ch3$ |
| OR gate 4034 | SL21 | $(\overline{F < 1000}) \cdot ch0 + (F < 1000) \cdot ch0 \cdot FS1 \cdot FS4$ |
| OR gate 4035 | SL22 | $(F < 1000) \cdot ch1 \cdot FS1 \cdot FS3 + (F < 1000) \cdot ch0 \cdot \overline{FS1 \cdot FS4} + (F < 1000) \cdot ch3$ |
| AND gate | SL23 | $(F < 1000) \cdot ch1 \cdot \overline{FS1 \cdot FS3}$ |
| OR gate 4037 | SL24 | $(F < 1000) \cdot ch2 + (F < 1000) \cdot (ch4 + ch5 + ch6 + ch7 + ch8 + ch9 + ch10) + (\overline{F < 1000}) \cdot \overline{ch0}$ |
| AND gate 4038 | AC1 | $(F < 1000) \cdot \phi A \cdot ch0$ |
| AND gate 4039 | AC2 | $(F < 1000) \cdot \phi A \cdot ch0 \cdot ch1$ |
| OR gate 4040 | AC3 | $(F < 1000)\phi A \cdot (ch3 + ch4 + ch5 + ch6 + ch7 + ch8 + ch9 + ch10) + (\overline{F < 1000}) \cdot \phi A$ |
| AND gate 4041 | $\phi$B | ch0 |
| AND gate 4042 | SNC | ch0 FS1 |

Turning back again to FIG. 5, an accumulator 50 sequentially accumulates the frequency number F outputted from the frequency number memory device 20 at a period of the clock pulse $\phi$B, which is the same as the calculation reference period 1/40 KHz, for producing its accumulated value qF (q=1, 2, 3, . . . ) as a signal designating a sampling point of the amplitude of the generated musical tone signal to be calculated. Since the clock pulse $\phi$B is generated for each calculating frame CF, the accumulated value qF of the accumulator 50 increase each calculation frame. Suppose now that the accumulated value qF is qoF at the first calculating frame CF1 of the calculating cycle Tcy, at the second calculating frame CF2, the qF becomes (qo+1)F, at the third calculating frame the qF becomes (qo+2)F, at the fourth calculating frame CF4, the qF becomes (qo+3)F and so on. The manner of increasing the accumulated value qF is shown in FIG. *7k* and FIG. *8k*.

There is further provided a partial tone phase designation signal generator 60, which in response to the order designation signals SL1 and SL2 supplied from the timing pulse generator 40 converts the accumulated value qF supplied from the accumulator 50 into a partial tone phase designation signal nqF (n=1, 2, 3, . . . k) for designating the sampling point phase of a partial tone component Hn to be calculated in a given calculating channel among calculating channels CH0 to CH10, the partial tone phase designation signal nqF being produced in synchronism with the channel time of each one of the calculating channels CH0 to CH10. The accumulated value qF thus outputted from the accumulator 50 represents the sampling point phase i one period of the generated musical tone signal, whereas the signal nqF outputted from the partial tone phase designation signal generator 60 represents the phase of the nth-order partial tone component Hn at that sampling point phase qF.

Figure 9:
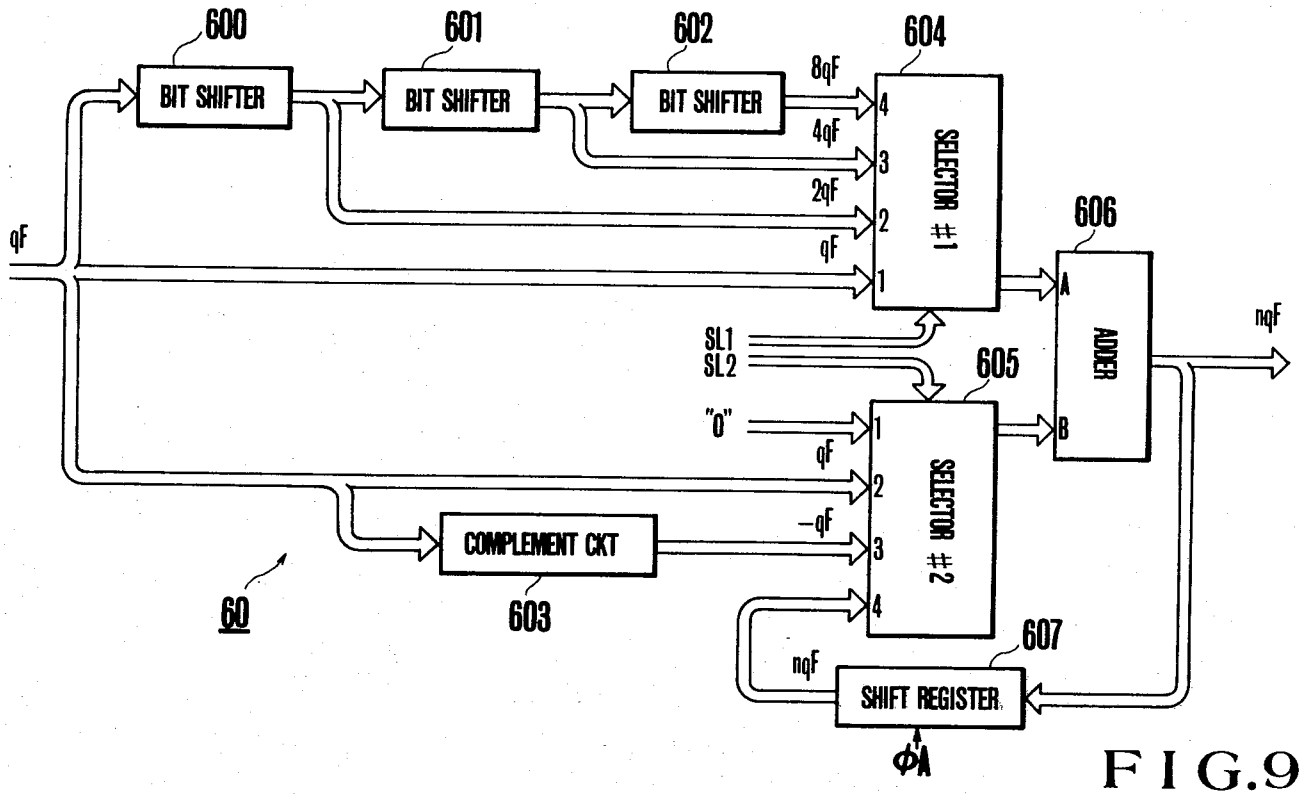
FIG. 9 is a block diagram showing the detail of the partial tone phase designation signal generator shown in FIG. 5.

The partial tone phase designation signal generator 60 may be constructed as shown in FIG. 9, for example.

Partial tone phase designation signal generator 60

As shown in FIG. 9, the generator 60 comprises a bit shifter 600 which shifts by one bit toward the upper order the respective bits of the accumulated value qF supplied from the accumulator 50 (FIG. 5) to convert the accumulated value qF into an accumulated value 2qF, which is supplied to a second bit shifter 601 and an input terminals (2) of a selector 604. The bit shifter 601 shifts by one bits toward the upper order the respective bits of the accumulated value 2qF to convert the same into an accumulated value 4qF, which is applied to a third word shifter 602 and an input terminal (3) of the selector 604. Again, the bit shifter 602 shifts by one bit toward the upper order the respective bits of the accumulated value 4qf to convert the same into an accumulated value 8qF supplied to an input terminal (4) of the selector 604.

The selector 604 selects and outputs one of the accumulated values qF, 2qF, 4qF and 8qF respectively supplied to its input terminals (1) to (4), that is the one designated by the order designation signal SL1 supplied from the timing pulse generator 40 (FIG. 5). In this case the order designation signal SL1 is constituted by 4 bit signals, SL11, SL12, SL13 and SL14 which become "1" under conditions shown in Table VIII (see FIGS. 7 and 8). When signal SL11 is "1", the selector 604 selects and outputs the accumulated value qF supplied to its input terminal (1), when signal SL12 is "1" selects and outputs the accumulated value 2qF inputted to its input terminal (2), when signal SL13 is "1" selects and outputs the accumulated value 4qF inputted to its input terminal (3), and when signal SL14 is "1" selects and outputs the accumulated value 8qF inputted to its input terminal (4).

A complement circuit 603 is provided to calculate two's complement of the accumulated value qF and to supply the complement to the input terminal (3) of a selector 605, at this time, the input terminals (1), (2) and (4) of the selector 605 are respectively supplied with a signal "0", the accumulated value qF and an accumulated value nqF outputted from a shift register 607 to be described later.

The selector 665 selects and outputs one of the signals "0", qF, -qF and nqF inputted to its input terminals (1) to (4) according to the designation of the order designation signal SL2 supplied from the timing pulse generator 40. In this case, the order designation signal SL2 is constituted by 4 bit signals SL21, SL22, SL23 and SL24 which become "1" under conditions shown in Table VIII (see FIGS. 7 and 8). The selector 605 selects and outputs the signal "0" inputted to its input terminal (1) when signal SL21 is "1", whereas when signal SL22 is "1", selects and outputs the accumulated value qF inputted to its input terminal (2), when signal SL23 is "1" selects and outputs the accumulated value—qF inputted to its input terminal (3), and when the signal SL24 is "1", selects and outputs the accumulated value nqF inputted to its input terminal (4).

An adder 606 is provided to add together the output signals of the selector 604 and 605 and to output its sum as the partial tone phase designation signal nqF regarding a partial tone component Hn to be calculated according to the designation of signals SL1 and SL2.

The shift register 607 is set with the signal nqF outputted from the adder 606 at the leading edge of the clock pulse $\phi$A and supplies its content to the input terminal (4) of the selector 605 as the accumulated value nqF when the next clock pulse $\phi$A is generated.

As an example, the operation of the partial tone phase designation signal generator 60 will be described hereunder for a case in which the partial tone components Hn to be calculated in the first calculating frame CF1 shown in Table VIIa are H1, H5, H6, H9 to H16.

Figure 7:
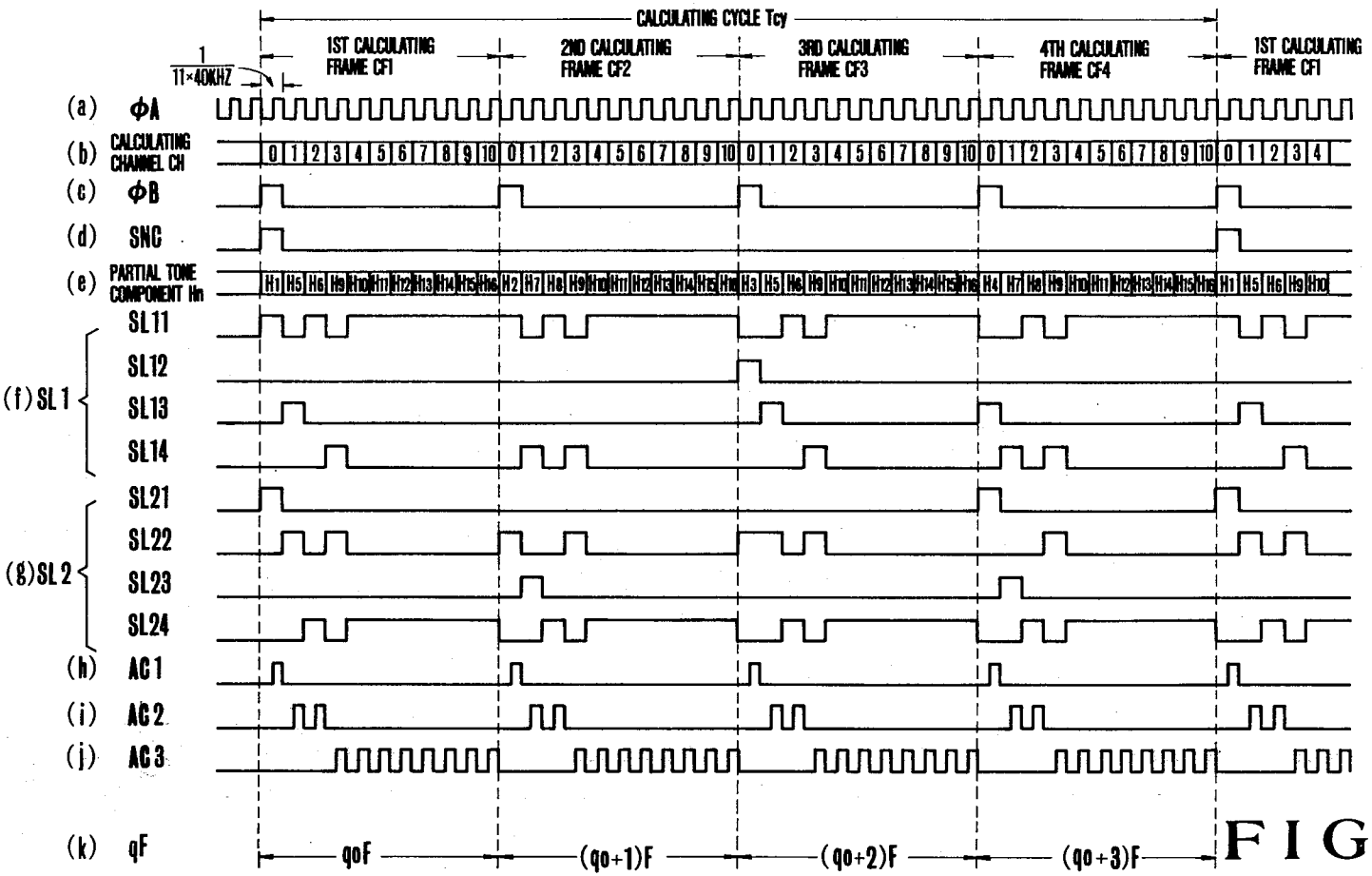
FIGS. 7*a* through 7*k* and FIGS. 8*a* through 8*k* are timing charts showing the timings of various signals generated by the timing pulse generator shown in FIG. 6.

During a channel time corresponding to the calculating channel CH0 of the first calculating frame CF1, of the signals SL11 to SL14 and SL21 to SL24 constituting signals SL1 and SL2, only signals SL11 and SL21 are "1" as can be noted from the logic equations shown in Table VIII and the timing chart shown in FIG. 7. For this reason, the selector 604 (FIG. 9) selects the accumulated value qoF and supplies it to the adder 606, where the selector 605 selects signal "0" and supplies it to the adder 606 with the result that the adder 606 causes a calculating channel CH0 to produce 1qoF as a partial tone phase designation signal nqF (in this case n=1) regarding the first partial tone component H1. The accumulated value 1qoF thus produced from the adder 606 is set in the shift register 607 at the leading edge of the clock pulse $\phi$A.

During the next channel time corresponding to the calculating channel CH1, only signals SL13 and SL22 become "1" as can be noted from the timing chart shown in FIG. 7. Accordingly, the selector 604 selects the accumulated value 4qoF and supplies the same to the adder 606, whereas the selector 605 selects the accumulated value qF and applies the same to the adder 606. As a consequence, the adder 606 causes the calculating channel CH1 to produce a partial tone phase designation signal 5qoF regarding the fifth partial tone component H5. At this time, the accumulated value 5qoF is set in the shift register 607 at the leading edge of the clock pulse $\phi$A. Thereafter, similar operations are performed also in the channel times corresponding to the calculating channels CH2 and CH3 so that the adder 606 sequentially produces partial tone phase designation signals 5qoF and 9qoF regarding the fifth and ninth partial tone components H5 and H9 respectively. Between a channel time corresponding to the calculating channel CH4 and the channel time corresponding to the calculating channel CH10, since only signals SL11 and SL24 become continuously "1" the selector 604 would continuously select and output the accumulated value qoF, while the selector 605 would continuously select and output the accumulated value nqoF outputted from the shift register 607. Consequently the adder 606 sequentially produces partial tone phase designation signals 10qoF, 11qoF . . . 16qoF regarding the 10th to 16th partial tone components H10 to H16 which increase by 1qoF following the renewal of the channel time after passage of a channel time corresponding to the calculating channel CH4.

Returning again to FIG. 5, there is also provided a sinusoid table 70 which stores in its addresses the sampling point amplitude values in one period of a sine waveform. When supplied from the partial tone phase designation signal generator 60 with a signal nqF corresponding to a partial tone component Hn to be calculated in respective calculating channels CH0 to CH10 as an address signal the sinusoid table 70 produces a sine amplitude value corresponding to the signal nqF.

A tone color setter 80 includes a plurality of tone color setting switches adapted to set the tone color of the generated musical tone so as to produce a tone color setting information TS corresponding to the tone color setting switches.

A harmonic coefficient generator 90 is provided for producing harmonic coefficients Cn (n=1, 2, 3 . . . k) regarding the partial tone components H1 to Hk calculated in respective calculating channels CH0 to CH10 corresponding to the tone color setting informations TS outputted from the tone color setter 80, in synchronism with the calculating timings of respective partial tone components H1 to Hk. The clock pulse $\phi$A and the calculating cycle signal SNC are applied to the harmonic coefficient generator 90 for the purpose of generating a harmonic coefficient Cn synchronously with the calculating timing of a corresponding partial tone component Hn. The purpose of applying the frequency number F to the harmonic coefficient generator 90 is to switch the harmonic coefficient Cn corresponding to the variation in the partial tone component Hn since the partial tone components to be calculated with respective calculating channels CH0 to CH10 vary on whether the fundamental frequency f of the generated musical tone signal is above or below 1.0 KHz.

Figure 10:
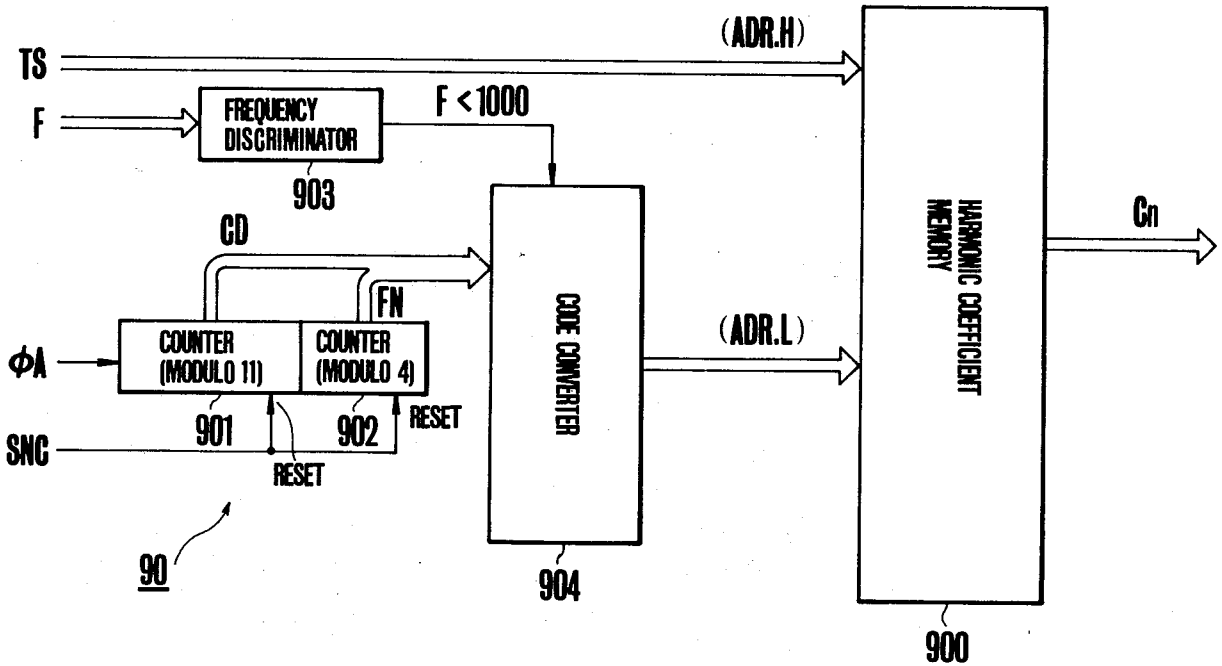
FIG. 10 is a block diagram showing the detail of the harmonic coefficient generator shown in FIG. 5.

The detail of the harmonic coefficient generator 90 is illustrated in FIG. 10, for example.

Harmonic coefficient generator 90

As shown in FIG. 10, the harmonic coefficient generator 90 comprises a harmonic coefficient memory device 900 including, for example, 3 memory blocks MB1 to MB3 according to the type of the tone colors settable with the tone color setter 80 and the each address of these memory blocks stores harmonic coefficient Cn that set the relative level of each partial tone component Hn for producing a tone having the tone colors. To the memory device 900 is inputted the tone color setting information Ts produced by the tone color setter 80 to act as an upper order address signal ADR·H so as to select one of the memory blocks MB1 to MB3 corresponding to this information TS.

After being reset by the calculating cycle signal SNC produced by the timing pulse generator 40, a counter 901 of modulo 11 counts the number of clock pulses $\phi$A to produce its output as order designation data CD (CD=0, 1, 2 . . . 10) to designate the orders of the partial tone components to be calculated in respective calculating channels CH0 to CH10. After being reset by the calculation cycle signal SNC, a counter 902 of modulo 4 counts the number of carry signals outputted from the counter 901 to produce an output as a calculating frame number FN representing calculating frames CF1 to CF4 in one calculation cycle Tcy.

A frequency discriminator 903 is provided for the purpose of judging whether the frequency number F produced by the frequency number memory device 20 is higher or lower than 1.0 KHz and when the frequency number is lower than 1.0 KHz, a discrimination signal F<1000 of "1" is produced.

Since the orders of the partial tone components to be calculated in respective calculating channels CH0 to CH10 are different for the fundamental frequency f and respective calculating frames CF1 to CF4, a code converter 904 is used to modify the order designation data CD produced by the counter 901. The data obtained by modifying the order designation data CD is used to designate the order of a partial tone component Hn to be calculated at this time and applied to the harmonic coefficient memory device 90 as a lower order address signal ADR·L.

When the harmonic coefficient memory device 900 is storing the harmonic coefficient informations C1 to C16 regarding respective partial tone components H1 to H16 as shown in the following Table IX, and when the descrimination signal F<1000 is "1" the code converter 904 modifies the order designation data CD and outputs the modified data as shown in the following Table X.

TABLE IX

| color setting information TS | upper order address signal ADR · H | lower order address signal ADR · L | memory block | harmonic coefficients Cn |
|---|---|---|---|---|
| TS1 (00) | 0 0 | 0 0 0 0 | MB1 | C1(TS1) |
| | | 0 0 0 1 | | C2(TS1) |
| | | 0 0 1 0 | | C3(TS1) |
| | | . | | . |
| | | . | | . |
| | | 1 1 1 1 | | C16(TS1) |
| TS2 (01) | 0 1 | 0 0 0 0 | MB2 | C1(TS2) |
| | | 0 0 0 1 | | C2(TS2) |
| | | 0 0 1 0 | | C3(TS2) |
| | | . | | . |
| | | . | | . |
| | | 1 1 1 1 | | C16(TS2) |
| TS3 (10) | 1 0 | 0 0 0 0 | MB3 | C1(TS3) |
| | | 0 0 0 1 | | C2(TS3) |
| | | 0 0 1 0 | | C3(TS3) |
| | | . | | . |
| | | . | | . |
| | | . | | . |
| | | 1 1 1 1 | | C16(TS3) |

TABLE X

| condition | calculating frame | input channel data CD (decimal representation) | output (lower order address signal ADR L) binary representation | decimal representation |
|---|---|---|---|---|
| F < 1000: "1" | CF1 | 0 | 0000 | 0 |
| | (FN = 00) | 1 | 0100 | 4 |
| | | 2 | 0101 | 5 |
| | | 3 | 1000 | 8 |
| | | 4 | 1101 | 9 |
| | | 5 | 1010 | 10 |
| | | 6 | 1011 | 11 |
| | | 7 | 1100 | 12 |
| | | 8 | 1101 | 13 |
| | | 9 | 1110 | 14 |
| | | 10 | 1111 | 15 |
| | CF2 | 0 | 0001 | 1 |
| | (FN = 01) | 1 | 0110 | 6 |
| | | . | . | . |
| | | . | . | . |
| | | 10 | 1111 | 15 |
| | CF3 | 0 | 0010 | 2 |
| | (FN = 10) | 1 | 0100 | 4 |
| | | . | . | . |
| | | . | . | . |
| | | 10 | 1111 | 15 |
| | CF4 | 0 | 0011 | 3 |
| | (FN = 11) | 1 | 0110 | 6 |
| | | 2 | 0111 | 7 |
| | | . | . | . |

TABLE X-continued

| condition | calculating frame | input channel data CD (decimal representation) | output (lower order address signal ADR L) binary representation | decimal representation |
|---|---|---|---|---|
| | | . | . | . |
| | | . | . | . |
| | | 9 | 1110 | 14 |
| | | 10 | 1111 | 15 |

As an example, the operation of the harmonic coefficient generator 90 will be described hereunder for a case wherein the partial tone components to be calculated in the first calculating frame CF1 shown in Table VIIa are H1, H5, H6 and H9 to H16.

At first, the counters 901 and 902 are reset by the calculating cycle signal SNC at the commencement of the calculation cycle Tcy. Thereafter, the counter 901 counts the number of the clock pulses $\phi$A to produce a gradually increasing order designation data CD. On the other hand, the content of the counter 902 is sequentially incremented by a carry signal produced by the counter 901. But in the first calculating frame CF1 its count, i.e., the calculating frame number FN is "00".

At this time the discrimination signal F<1000 produced by the frequency discriminator 903 is "1". For this reason, the code converter 904 sequentially converts the order designation data CD into "0000" "0100", "0101" . . . "1111" according to the conditions shown in Table X. These converted output signals of the order designation data CD are applied to the harmonic coefficient memory device 900 as the lower order address signal ADR·L. Let us now assume that a tone color setting information TS1 ("00") is given to the harmonic coefficient memory device 900 as a upper order address signal ADR·H. Then the harmonic coefficient memory device 900 sequentially outputs the harmonic coefficient information C1(TS1), C5(TS1), C6(TS1) . . . C16 (TS1) stored in addresses of the memory block MB1 corresponding to the tone color setting information TS1 and designated by the lower order address signal ADR·L.

Returning back again to FIG. 5, an envelope waveform generator 100 is provided which starts its operation in response to a key-on signal KON produced by the key switch circuit 10 to produce an envelope waveform signal EVN having a desired envelope waveform.

The multiplier 110 multiplies a harmonic coefficient Cn outputted from the harmonic coefficient generator 90, on the time division basis, for respective calculating channels with the envelope waveform signal ENV produced by the envelope waveform generator 100 for outputting the product ENV·Cn as an amplitude information imparted with an envelope in respective calculating channels CH0 to CH10.

A multiplier 120 multiplies the sine amplitude values sin $\pi/\kappa$ nqF of the partial tone component Hn to be calculated in respective calculating channels CH0 to CH10 and sequentially outputted from the sinusoid table 70 with the corresponding amplitude information ENV·Cn with respect to respective calculating channels CH0 to CH10 to produce a product ENV·Cn·sin $\pi/\kappa$·nqF as the amplitude value Fn of the partial tone components Hn to be calculated in respective calculating channels CH0 to CH10.

Delay differentiating circuits 134 to 136 are respectively provided for delaying, a very short time, load pulses LD-A, LD-B and LD-C generated by the timing pulse generator 40 and for differentiating at the leading edge of the delayed load pulses LD-A, LD-B and LD-C to produce signals (used as reset pulse signals RS-A, RS-B and RS-C) which become "1" for an interval slightly shorter than one-half of one period time of 1/440 KHz of the clock pulse $\phi$A.

After being reset by the reset pulse signal RS-A, the accumulator-A 131 accumulates the amplitude value Fn of a partial tone component Hn (any one of the first to fourth components—see Table VIIa) calculated in four calculating frame times at a period of 1/10 KHz each time an accumulation designation signal AC1 is outputted from the timing pulse generator 40. The accumulated value ΣFn acting as a synthesized amplitude value ΣFn(A) regarding a partial tone components H1 to H4 to be calculated at a period of 1/10 KHz ($=f_{CA}\cdot\frac{1}{4}$) is latched in a latch-A by the load pulse LD-A, and very short time after the amplitude value ΣFn(A) in the accumulator-A 131 is reset by the reset pulse RS-A.

After being reset by the reset pulse signal RS-B, the accumulator-B 132 accumulates the amplitude value Fn of the partial tone component Hn (any one of fifth, sixth, seventh and eighth—see Table VIIa) calculated in two calculating frame times at a calculating period of 1/20 KHz each time an accumulation designated signal AC2 is outputted from the timing pulse generator 40. The accumulated value ΣFn(F5+F6+F7+F8) outputted as a synthesized amplitude value ΣFn(B) regarding a partial tone components H5 to H8 calculated at a period of 1/20 KHz ($=f_{CA}\cdot\frac{1}{2}$) is latched in a latch-B by the load pulse LD-B, and very short time after the amplitude value ΣFn(B) in the accumulator-B 132 is reset by the reset pulse RS-B.

After being reset by the reset pulse RP-C, the accumulator-C 133 accumulates the amplitude values Fn of the partial tone component Hn (any one of 9th to 16th or first to 11th—see Tables VIIa and VIIb) calculated at a period of 1/40 KHz during one calculating frame time each time an accumulation designation signal AC3 is produced by the timing pulse generator 40, and the accumulated value ΣFn(F9+F10+ . . . F16 or F1+F2+ . . . F11) is latched as a synthesized amplitude value ΣFn(C) regarding the partial tone components H9 to H16 or H1 to H11 calculated at a period of 1/40 KHz in a latch-C by the load pulse LD-C, and very short time after the accumulated value ΣFn(C) in the accumulator-C 133 is reset by the reset pulse RS-C.

For example, where the fundamental frequency f of the generated musical tone signal is lower than 1.0 KHz during a channel time corresponding to the calculating channel CH0 of the first calculating frame CF1, the multiplier 120 produces the amplitude value F1 (=ENV·C1·sin $\pi/\kappa$ qF) of the first partial tone component H1. On the other hand, as shown in Table VIII and FIG. 7, during this channel time, the timing pulse generator 40 produces the accumulation designation signal AC1. As a consequence, the amplitude value F1 of the first partial tone component H1 produced by the multiplier 120 is applied to the accumulator 131 and added to its content (immediately after commencing the first calculating frame CF1, the content is reset to "0"). During the channel time corresponding to the calculating channel CH1, the multiplier 120 produces the amplitude value F5(=ENV·C5·sin $\pi/\kappa$ 5qF) of the fifth partial tone component H5, whereas the timing pulse generator 40 produces the accumulation designation signal AC2. Consequently, the amplitude value F5 of the fifth partial tone component H5 would be added to the content (which has been reset to "0") of the accumulator-B 132. Thereafter, similar operations are successively executed in respective channel times of the calculating channels CH2 to CH10. At the end of the first calculating frame CF1, the content, i.e., the synthesized amplitude value ΣFn(A) of the accumulator-A 131 becomes [F1], while the content, i.e., the synthesized amplitude value ΣFn(B) of the accumulator-B 132 becomes [F5+F6] and the content, i.e., the synthesized amplitude value ΣFn(C) of the accumulator-C 133 becomes [F9+F10+F11+F12+F13+F14+F15+F16].

Consequently, each of these accumulator-A 131, accumulator-B 132 and accumulator-C 133 constitute a synthesizing part that synthesizes the amplitude values of partial tone components calculated by predetermined calculating channels at predetermined periods.

Delay differentiating circuits 134, 135 and 136 are respectively supplied with signals LD-A through LD-C which are sent out from the timing signal generator 40 and operate to delay these signals for an extremely short time. Further the delay differentiating circuits differentiate at the leading edges of the delayed signals for producing reset pulse signals RS-A, RS-B and RS-C which become "1" for an interval a little shorter than one half of one period 1/440 KHz of the clock pulse φA.

A, B and C latch circuits 137, 138 and 139 respectively receive synthesized amplitude values ΣFn(A), ΣFn(B), and ΣFn(C) having different calculation periods supplied from corresponding accumulators 131, 132 and 133 by the timing action of signals LD-A through LD-C supplied from the timing signal generator 40 and hold these synthesized amplitude values until they receive next signals LD-A through LD-C. More particularly, the latch-A circuit 137 receives the synthesized amplitude value ΣFn(A) at the timing of generation of the load pulse LD-A having the period corresponding to four calculating frames or one calculating cycle, the received value ΣFn(A) being held and supplied to a digital to analogue converter 144 as a latched amplitude value ΣFn(A)' just before the latch-A circuit 137 is to receive a next new synthesized amplitude value. In the same manner, the latch-B circuit 138 and latch-C circuit 139 receive the synthesized amplitude values ΣFn(B) and ΣFn(C) at the timing of generation of the load pulses LD-B and LD-C having the periods corresponding to two calculating frames and one calculating frame respectively, the received values ΣFn(B) and ΣFn(C) being held and supplied to digital to analogue converters 145 and 146 as latched amplitude values ΣFn(B)' and ΣFn(C)' just before the latch-B circuit 138 and the latch-C circuit 139 is to receive next new synthesized amplitude values respectively.

The digital to analogue converters 144, 145 and 146 convert the latched amplitude values Fn(A)', Fn(B)' and Fn(C)' supplied from latch circuits 137, 138 and 139 into corresponding analogue signals, that is musical tone signals MW(A), MW(B) and MW(C) respectively, these musical tone signals being supplied to low pass filters 147, 148 and 149 respectively.

Lowpass filters (LPF-A) 147, (LPF-B) 148 and (LPF-C) 149 have cut-off frequencies of 4, 8 and 10 KHz respectively (see FIGS. 3*b* through 3*d*) for eliminating components corresponding to images produced by sampling contained in the musical tone signals MW(A), MW(B) and MW(C) sent out from respective digital to analogue converters 144, 145 and 146, thereby outputting musical tone signals MW(A)', as have already been described each of these lowpass filters can comprise a 4th-order Chebyshev analogue lowpass filter for example.

An adder 150 is provided for adding together the musical tone signals MW(A)', MW(B)' and MW(C)' to output the sum [MW(A)'+MW(B)'+MW(C)'] as a synthesized musical tone signal, that is a musical tone signal comprising the calculated partial tone components. A sound system 152 converts the musical tone signal into a musical tone.

Operation of the musical tone signal generator

The musical tone signal generator constructed as above described operates as follows:

When a power source switch, not shown, is closed the clock oscillator 30 begins to produce a clock pulse φA having a frequency of 440 KHz (=11.fCA), and the clock pulse φA thus produced is supplied to the partial tone phase designation signal generator 60, and the harmonic coefficient generator 90.

Then, the timing pulse generator 40 counts the number of the clock pulse φA with the ring counter 400 (FIG. 6) which produces channel signals ch0 to ch10 corresponding to respective calculating channels CH0 to CH10 and also counts the number of the channel signals ch10 with the ring counter 401 to produce calculating frame signals FS1 to FS4 corresponding to respective calculating frames CF1 to CF4. Then, in response to these signals ch0 to ch10 and FS1 to FS4, the logic gate circuit 403 produces a clock pulse φB having a frequency of 40 KHz and pulse width of 1/440 KHz (see FIG. 7*c* and FIG. 8*c*) and a calculating cycle signal SNC having a frequency of 10 KHz and a pulse width of 1/440 KHz (see FIG. 7*d* and FIG. 8*d*).

Under these conditions when a performer depresses a key of the keyboard after setting a desired tone color by the tone color setter 80, a frequency number F corresponding to the tone pitch of the depressed key would be read out of the frequency number memory device 20.

Then, the accumulator 50 sequentially accumulates the frequency number F at the period of generation of the clock pulse φB for producing an accumulated value qF which gradually increases as qoF, (qo+1)F, (qo+2)F, (qo+3)F . . . in successive calculating frames CF.

When a frequency number F is supplied to the timing pulse generator 40 as a result of the key depression, the frequency discriminator 402 (FIG. 6) judges whether the fundamental frequency f is lower than 1.0 KHz or not so as to produce order designation signals SL1 and SL2, and accumulation designation signals AC1 to AC3 as a result of the judgment.

More particularly, uppon receipt of the frequency number F, the frequency discriminator 402 in the timing pulse generator 40 judges whether the fundamental frequency f of the generated musical tone signal is higher or lower than 1.0 KHz according to the value of the frequency number F. When the result of judgment shows that the frequency number F is lower than 1.0 KHz, the frequency discriminator 402 would produce a signal F<1000 showing this fact. In order to calculate respective partial tone components H1 to H16 in a manner as shown in Table VIIa, the logic gate circuit 403 in the timing pulse generator 40 passes order designation signals SL1 and SL2, and accumulation designation signals AC1 to AC3 having contents as shown in the time charts shown in FIG. 7 according to signal $F<1000$, channel signals ch0 to ch10 produced by ring counters 400 and 401 respectively and the calculating frame signals FS1 to FS4.

Figure 8:
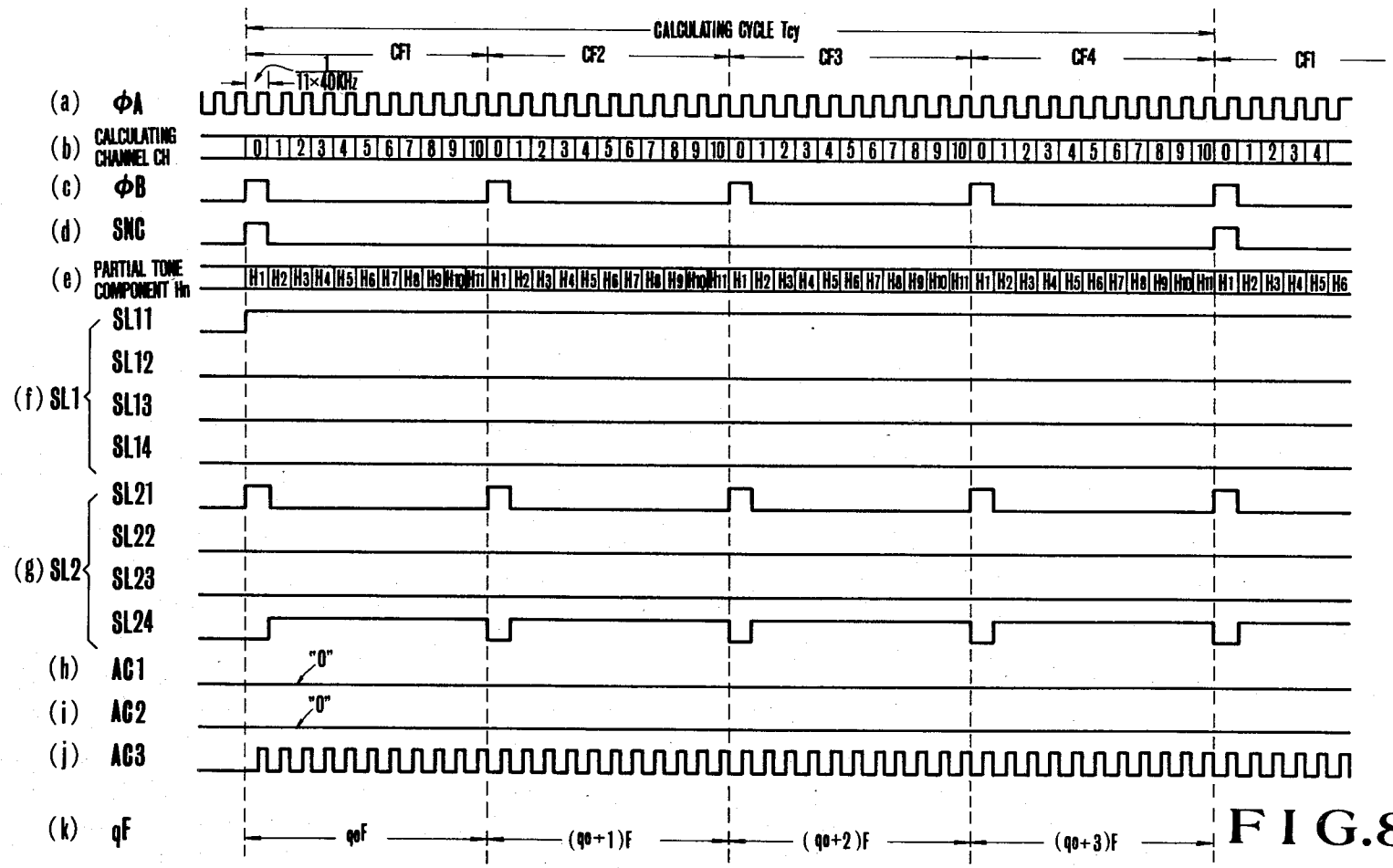

Conversely, where the frequency number F corresponds to the fundamental frequency f higher than 1.0 KHz and where the frequency discriminator 402 does not produce the signal $F<1000$, since the logic gate circut 403 calculates respective partial tone components H1 to H11 in a manner as shown in Table VIIB, the order designation signals SL1 and SL2 and accumulation designation signals AC1 to AC3 having contents as shown in the time charts shown in FIG. 8 would be produced.

The operations during the first to the fourth calculating frames CF1 to CF4, when the fundamental frequency f of the generated musical tone signal is lower than 1.0 KHz, will be described hereunder.

First calculating frame CF1

In the first calculating frame CF1, the accumulated value qF outputted from the accumulator 50 is equal to qoF. During the first calculating frame CF1, the timing pulse generator 40 produces order designation signals SL1 and SL2 for calculating partial tone components H1, H5, H6, H9 . . . H16 as shown in Table VII*a* (see FIGS. 7*f* and 7*g*). Consequently, the partial tone phase designation signal generator 60 produces, in synchronism with respective channel times, signals 1qoF of $n=1$, 5qoF of $n=5$, 6qoF of $n=6$ and 9qoF to 16qoF of $n=9$ to 16 which are used to act as partial tone phase designation signals nqoF for calculating the partial tone components H1, H5, H6, H9 to H16 at the sampling point qoF during one period of the generated musical tone signal. As a consequence, the sinusoid table 70 produces, in synchronism with respective channel times, sine amplitude values $\sin \pi/\kappa$ 1qoF, $\sin \pi/\kappa$ 5qoF, $\sin \pi/\kappa$ 6qoF, $\sin \pi/\kappa$ 9qof . . . $\sin \pi/\kappa$ 16qoF respectively corresponding to the partial tone phase designation signals 1qoF, 5qoF, 6qoF, 9qoF . . . 16qoF at respective sampling points. Thus during the first calculating frame CF1, at the sampling points having sampling point phase qoF, sinusoid table 70 produces sine amplitude values $\pi/\kappa$ nqoF regarding the fundamental wave H1 of $n=1$, the fifth partial tone component H5 of $n=5$, the sixth partial tone component H6 of $n=6$, and 9th to 16th partial tone components H9 to H16 of $n=9$ to 16.

Second calculating frame CF2

In the second calculating frame CF2, the accumulated value qF is equal to $(qo+1)F$. In this frame, the timing pulse generator 40 outputs the order designation signals SL1 and SL2 to calculate the partial tone components H2, H7, H8, H9 to H16 as shown in Table VIIa.

For this reason, the partial tone phase designation signal generator 60 generates, in synchronism with respective channel times, signals $2(qo+1)F$ of $n=2$, $7(qo+1)F$ of $n=7$, $8(qo+1)F$ of $n=8$, and $9(qo+1)F$ to $16(qo+1)F$ of $n=9$ to 16 as the partial tone phase designation signals nqF for calculating the partial tone components H2, H7, H8, H9 to H16 at the sampling point phase $(qo+1)F$.

As a consequence, the sinsuoid table 70 outputs, in synchronism with respective channel times, sine amplitude values $\sin \pi/\kappa\ 2(qo+1)F$, $\sin \pi/\kappa\ 7(qo+1)F$, $\sin \pi/\kappa\ 8(qo+1)F$, $\sin \pi/\kappa\ 9(qo+1)F$ to $\sin \pi/\kappa\ 16(qo+1)F$ regarding the second partial tone component H2, the seventh partial tone component H7, the eighth partial tone component H8, 9th to 16th partial tone components H9 to H16.

Third calculating frame CF3

In this frame the accumulated value qF is equal to $(qo+2)F$, and the timing pulse generator 40 produces order designation signals SL1 and SL2 to calculate the partial tone components H3, H5, H6 and H9 to H16 as shown in Table VIIa.

As a consequence, the partial tone phase designation signal generator 60 produces, in synchronism with respective channel times, signals $3(qo+2)F$ of $n=3$, $5(qo+2)F$ of $n=5$, $6(qo+2)F$ of $n=6$, and $9(qo+2)F$ to $16(qo+2)F$ of $n=9$ to 16 as the partial tone phase designation signals nqF for calculating the partial tone components H3, H5, H6, H9 to H16 at the sampling point phase $(qo+2)F$.

Accordingly, the sinsuoid table 70 produces, in synchronism with respective channel times, sine amplitude values $\sin \pi/\kappa\ 3(qo+2)F$, $\sin \pi/\kappa\ 5(qo+2)F$, $\sin \pi/\kappa\ 6(qo+2)F$, $\sin \pi/\kappa\ 9(qo+2)F$ . . . $\sin \pi/\kappa\ 16(qo+2)F$ respectively regarding the third partial tone component H3, the fifth partial tone component H5, the sixth partial tone component H9, the 9th to 16th partial tone components H9 to H16 at the sampling points phase $(qo+2)F$ during one period of the generated nusical tone signal waveform.

The fourth calculating frame CF4

In this frame, the accumulated value qF is equal to $(qo+3)F$ and the timing pulse generator 40 produces order designation signals SL1 and SL2 for calculating the partial tone components H4, H7, H8 and H9 to H16 as shown in Table VIIa.

Consequently, the partial tone phase designation signal generator 60 produces, in synchronism with respective channel times, signals $4(qo+3)F$ of $n=4$, $7(qo+3)F$ of $n=7$, $8(qo+3)F$ of $n=8$, and $9(qo+3)F$ to $16(qo+3)F$ of $n=9$ to 16 utilized to calculate the partial tone components H4, H7, H8 and H9 to H16 at the sampling point phase $(qo+3)F$.

As a consequence, the sinusoid table 70 produces, in synchronism with respective channel times, sine amplitude values $\sin \pi/\kappa\ 4(qo+3)F$, $\sin \pi/\kappa\ 7(qo+3)F$, $\sin \pi/\kappa\ 8(qo+3)F$, $\sin \pi/\kappa\ 9(qo+3)F$ to $\sin \pi/\kappa\ 16(qo+3)F$ regarding the fourth partial tone component H4, the seventh partial tone component H7, the eighth partial tone component H8 and the 9th to 16th partial tone components H9 to H16 at the sampling point phase $(qo+3)F$ during one period of the generated musical tone signal waveform.

After completion of the calculation of the partial tone components during this fourth calculating frame CF4, a new calculation cycle starts in which the accumulated value is $(qo+5)F$ and operations similar to those of the first calculating frame CF1 are repeated.

The sine amplitude value $\pi/\kappa$ nqF regarding each partial tone components Hn outputted from the sinusoid table 70 in a manner as above described is multiplied in the multiplier 120 with the amplitude information EW-V·Cn regarding the partial tone components Hn to set the amplitude so that the multiplier 120 outputs the amplitude value Fn of each partial tone component Hn.

As can be clearly understood from the foregoing description, the amplitude values F9 to F16 of the 9th through 16th partial tone components H9 to H16 are outputted from the multiplier 120 each time the accumulated value qF is updated, in other words, at a period of 1/40 KHz (=1/fCA). Furthermore the amplitudes values F5 to F8 of the fifth to eigth partial tone components H5 to H8 are outputted from the multiplier 120 at alternate variations of the accumulated value qF, i.e., at a period of 1/20 KHz (=2/FCA). Further, the amplitude values of the first to the fourth partial tone components H1 to H4 are produced by the multiplier 120 at a rate of one for every 4 renewals of the accumulated value, i.e., at a period of 1/10 KHz (=1/fCA).

The amplitude values F1 to F16 of respective partial tone components H1 to H16 outputted from the multiplier 120 are accumulated by the accumulators 131 to 133 for different calculating periods for respectively corresponding calculating frames. More particularly, the amplitude values F1 to F4 of the first to fourth partial tone components H1 to H4 having a calculating period of $(\frac{1}{4})\cdot(1/10)$ KHz are accumulated in the accumulator-A 131 for calculating frames CF1 to CF4 in the accumulator-A 131 each time the accumulation designation signal AC1 is generated (see FIG. 7*h*).

The accumulated value ΣFn(A) of the accumulator-A 131 is sent to the latch-A circuit 137 and latched in accordance with the load pulse LD-A generated by the timing pulse generator 40. The output of this latch circuit 137 is sent to the digital to analogue converter 144 which converts ΣFn(A)′ into a corresponding analogue value MW(A) and sent to the lowpass filter 147 which eliminates the components corresponding to the images produced by sampling (components higher than 4 KHz) and applies its output MW(A)′ to the adder 150.

The amplitude values $F_5$ through $F_8$ of the fifth to 8th order partial tone components $H_5$ through $H_8$ having a calculation period of $(\frac{1}{2})\cdot f_{CA}\cdot(1/20)$ KHz are accumulated by the accumulator-B 132 for calculation frames $CF_1$ to $CF_2$ and $CF_3$ to $CF_4$ at the time of generating an accumulation designation signal AC2 (see FIG. 7*i*). The accumulated value ΣFn(B) outputted from the accumulator-B 132 is latched by the latch-B circuit 138 according to the load pulse LD-B generated by the timing pulse generator 40. The output of the latch-B circuit 138 is sent to the digital to analogue converter 145 which converts ΣFn(B)′ into a corresponding analogue value MW(B) that is sent to the lowpass filter 148, which eliminates the components corresponding to the images produced by sampling (components higher than 8 KHz) and applies its output MW(B)′ to the adder 150.

The amplitude values $F_9$ through $F_{16}$ of the 9th through 16th partial tone components $H_9$ through $H_{16}$ having a calculation period of $F_{CA}\cdot(1/40)$ KHz are accumulated by the accumulator-C 133 for each calculation frame at the time of generation of an accumulation designation signal AC3. The accumulated value ΣFn(C) of the accumulator-C 133 is latched by the latch-C circuit 139 in accordance with the load pulse LD-B generated by the timing pulse generator 40. The output of the latch-C circuit 139 is sent to the digital to analogue converter 146 to be converted into a corresponding analogue value MW(C) which is sent to the lowpass filter 149 in which the components corresponding to the images produced by sampling (components higher than 16 KHz) contained in the analogue value MW(C), and the output MW(C)′ of the lowpass filter 149 is sent to the adder 150.

The outputs of respective lowpass filters, i.e., the synthesized amplitude values MW(A)′, MW(B)′ and MW(C)′ regarding partial tone components applied to the adder 150 applied as above described are added together and its output is sent to the sound system 152 as a synthesized musical tone signal.

Consequently, the sound system 152 produces a musical tone corresponding to the tone pitch of the depressed key and having a tone color set by the tone color setter 80.

Although, foregoing description concerns a case in which the fundamental frequency f of the generated musical tone signal is lower than 1.0 KHz, even when the fundamental frequency f of the generated musical tone signal is higher than 1.0 KHz, the operation of the circuit can readily be understood from Table VIIb and FIG. 8.

For the reason described above, according to the musical tone signal generator of this invention, it is possible to reduce the number of the calculating channels to 11/16 of that of the prior art musical tone signal generator thus reducing the size thereof.

Modification of the musical tone signal generator

Figure 11:
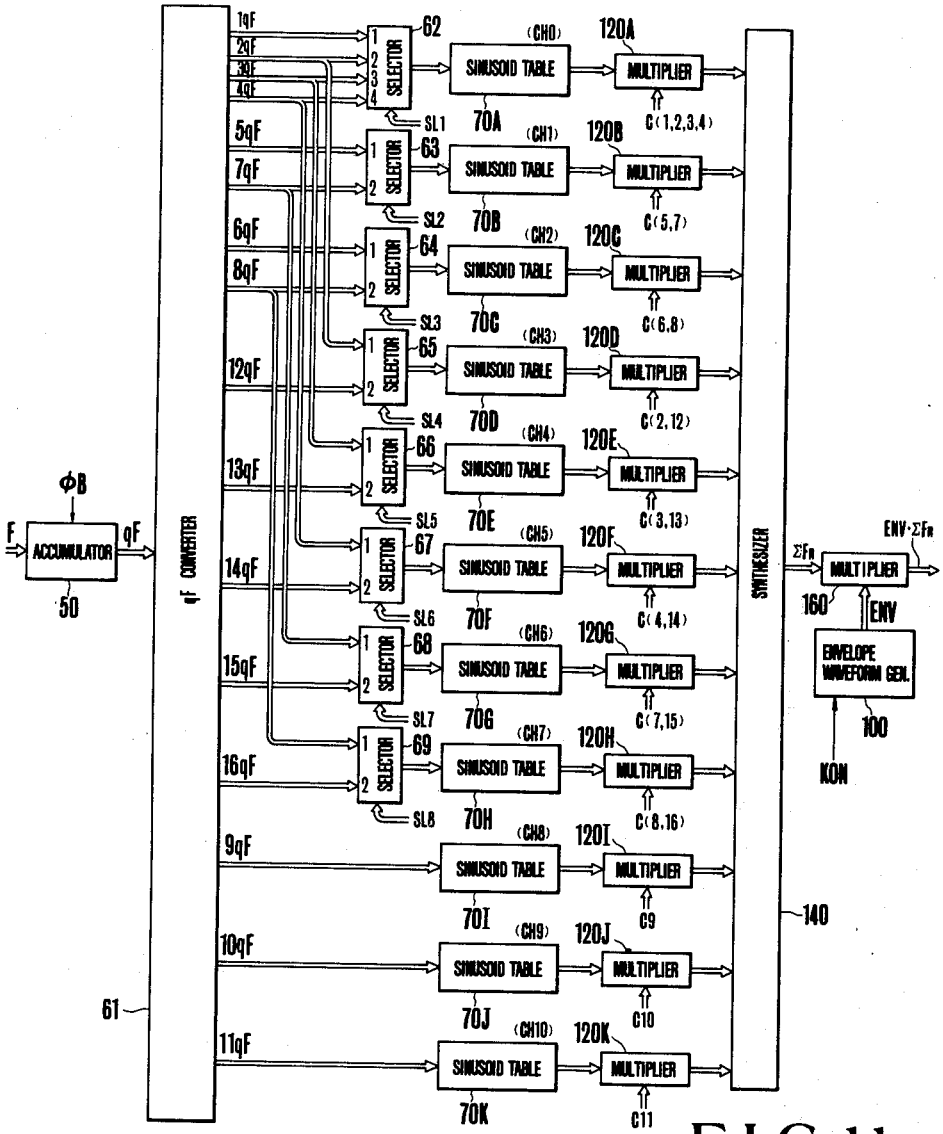
FIG. 11 is a block diagram showing essential portions of a second embodiment of the musical tone signal generator according to this invention.

Although the embodiment of the musical tone signal generator was constructed to calculate, on the time division basis, a plurality of partial tone components H1 to H16 or H1 to H11 by using 11 time division calculating channels CH0 to CH10, a modification wherein respective partial tone components are calculated in parallel with 11 parallel calculating channels CH0 to CH10 as shown in FIG. 11. In this case, it is assumed that the conditions of the musical tone signals to be generated are the same as those of the first embodiment shown in FIG. 5. Thus, the modified musical tone signal generator shown in FIG. 11 comprises 11 calculating channels CH0 to CH10 in parallel. Since respective partial tone components are in parallel calculated by the parallel calculating channels CH0 to CH10, the clock pulse $\phi$A shown in FIG. 5 and having a frequency of 440 KHz is not necessary in this modification, and only the clock pulse $\phi$B having a frequency of 40 KHz is used. Thus the period 1/40 KHz of this clock pulse $\phi$B corresponds to one calculating frame time and four calculating frame time comprise one calculating cycle Tcy.

In this modification, only portions different from those shown in FIG. 5 due to parallel calculation of respective partial tone components are shown and described.

In FIG. 11, a qF converter 61 is provided to convert the accumulated value qF produced by the accumulator 50 into partial tone phase designation signals 1qF to 16qF for designating the sampling point phases of respective partial tone components H1 to H16 and to output these converted signals in parallel. Although the detail of this qF converter 61 is not shown, it should be understood that it is constructed to convert the signal qF into signals 1qF to 16qF by means of bit shifters, etc. similar to the circuit 60 shown in FIG. 9.

Signals 9qF, 10qF and 11qF among signals 1qF to 16qF parallelly outputted from the qF converter 61 are respectively supplied to the sinusoid tables 70I to 70K and the remaining signals 1qF to 8qF and 12qF to 16qF are selectively applied to the sinusoid tables 70A to 70H through selectors 62 to 69.

The reason that the signals 1qF to 8qF and 12qF to 16qF are selectively supplied to the sinusoid tables 70A to 70H is to use tables, on the time division basis.

More particularly, although in the musical tone signal generator according to this modification there are provided 11 the sinusoid tables 70A to 70K for 11 calculating channels, in order to calculate partial tone components H1–H16 or H1 to H11 in a manner as shown in Table VIIa or VIIb by utilizing these tables 70A to 70K. When 16 partial tone components H1 to H16 are calculated in a manner as shown in Table VIIa, or the fundamental frequency f of the generated musical tone signal is lower than 1 KHz, it is necessary to use some of these tables on the time division basis. For this reason, among these tables 70A to 70K, the table 70A is commonly used by the partial tone components H1 to H4 having a calculating period of 1/10 KHz (the value of the sampling frequency ratio $\beta n$ is $\frac{1}{4}$). Thus, the table 70A is supplied from the selector 62 with either one of the partial tone phase designation signals 1qF, 2qF, 3qF and 4qF regarding the partial tone components H1 to H4 to act as an address signal during each calculating frame CF.

The table 70b is commonly used by the partial tone components H5 and H7 having a calculating period of 1/20 KHz (the value of the sampling frequency ratio $\beta n$ is $\frac{1}{2}$). Accordingly, either one of the partial tone phase designation signals 5qF, and 7qF regarding the partial tone components H5 and H7 is supplied to this table 70B from the selector 63 during each calculating frame CF to act as an address signal.

Furthermore, the table 70C is commonly used by the partial tone components H6 and H8 having a calculating period of 1/20 KHz (the value of the sampling frequency ratio $\beta n$ is $\frac{1}{2}$). As a consequence, either one of the signals 6qF and 8qF designating the sampling point phases regarding the partial tone components H6 and H8 is applied to the table 70C from the selector 64 in each sampling frame to act as an address signal.

The table 70D is utilized to calculate the partial tone component H12 when the fundamental frequency f of the generated musical tone signal is lower than 1 KHz, whereas when the fundamental frequency f is higher than 1 KHz, the table 70D is utilized to calculate the partial tone component H2. Consequently, either one of the partial tone phase designation signals 12qF and 2qF regarding the partial tone components H12 and H2 is applied to the memory device 70D from the selector 65 according to the fundamental frequency f of the generated musical tone signal to act as an address signal.

The table 70E is used to calculate the partial tone component H13 when the fundamental frequency f of the generated musical tone signal is lower than 1 KHz, whereas to calculate the partial tone component H14 when the fundamental frequency is higher than 1 KHz. Consequently, either one of the partial tone phase designation signals 13qF and 3qF regarding the partial tone components H13 and H3 is applied to the table 70E from the selector 66 in accordance with the fundamental frequency f of the generated musical tone signal to act as an address signal.

The table 70F is used to calculate the partial tone component H14 when the fundamental frequency f of the generated musical tone signal is lower than 1 KHz, whereas when the fundamental frequency f is higher than 1 KHz, the table 70F is used to calculate the partial tone component H4. Consequently, either one of the partial tone phase designation signals 14qF and 4qF regarding the partial tone components H14 and H4 is supplied to the table 70F from the selector 67 in accordance with the fundamental frequency f of the generated musical tone signal to act as an address signal.

The table 70G is used to calculate the partial tone component H15 when the fundamental frequency f of the generated musical tone signal is lower than 1 KHz, whereas when the fundamental frequency f is higher than 1 KHz, the table 70G is utilized to calculate the partial tone component H7. Consequently either one of the partial tone phase designation signals 15qF and 7qF regarding the partial tone components H15 and H7 is supplied to the table 70G from the selector 68 in accordance with the fundamental frequency f of the generated musical tone signal to act as an address signal.

The table 70H is utilized to calculate the partial tone component H16 when the fundamental frequency f of the generated musical tone signal is lower than 1 KHz, whereas when the fundamental frequency f is higher than 1 KHz, utilized to calculate the partial tone component H8. As a consequence, either one of the partial tone phase designation signals 16qF and 8qF regarding the partial tone components H16 and H8 is applied to the table 70H from the selector 69 according to the fundamental frequency f of the generated musical tone signal to act as an address signal.

In order to calculate respective partial tone components H1 to H16 or H1 to H11 in a manner as shown in Tables VIIa or VIIb, it is necessary to suitably generate selection control signals for the selectors 62 to 69, that is order designation signals SL1 to SL8 that designate the orders of respective partial tone components H1 to H16 or H1 to H11 to be calculated.

Figure 12:
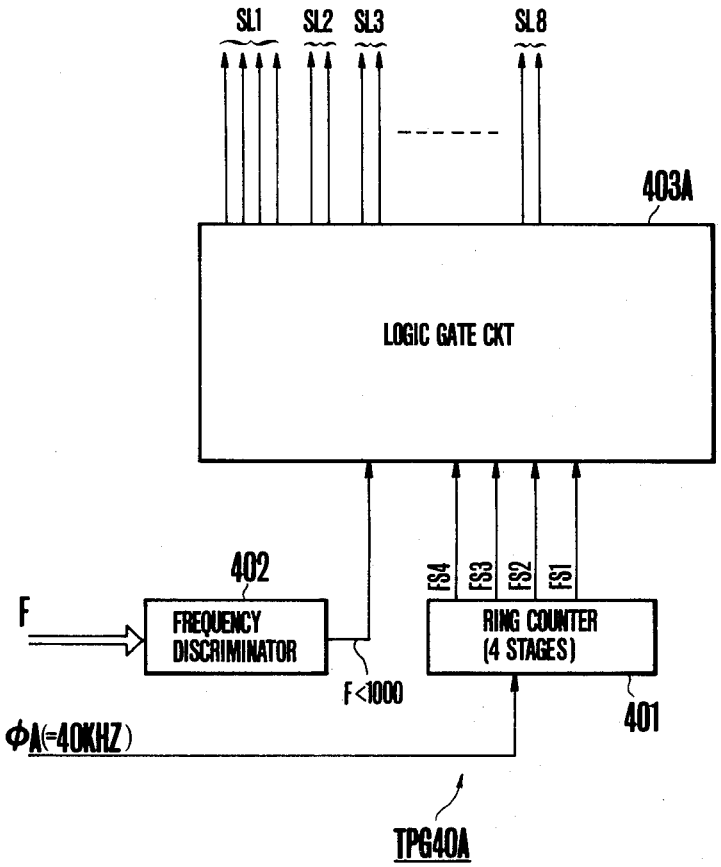
FIG. 12 is a block diagram showing the detail of the timing pulse generator utilized in the modified musical tone signal generator shown in FIG. 11.

These order designation signals SL1 to SL8 are generated, for example, by a timing pulse generator 40A having a construction as shown in FIG. 12. The timing pulse generator 40A shown in FIG. 12 is designed under a similar consideration as that of the timing pulse generator 40 shown in FIG. 6 but in the musical tone signal generator of this embodiment, since 11 calculating channels CH0 to CH10 are connected in parallel, the 11 stage ring counter 400 shown in FIG. 6 can be omitted and the clock pulse $\phi B$ having a frequency of 40 KHz is directly applied to the 4 stage ring counter 401 as a count input.

A logic gate circuit 403A is constructed to produce order designation signals SL1 to SL8 having contents as shown in FIGS. 13*d* to 13*k* or FIGS. 14*d* to 14*k* is based on the output signal $F<1000$ of the frequency discriminator 402 and the output signals FS1 to FS4 of the ring counter 401.

Figure 13:
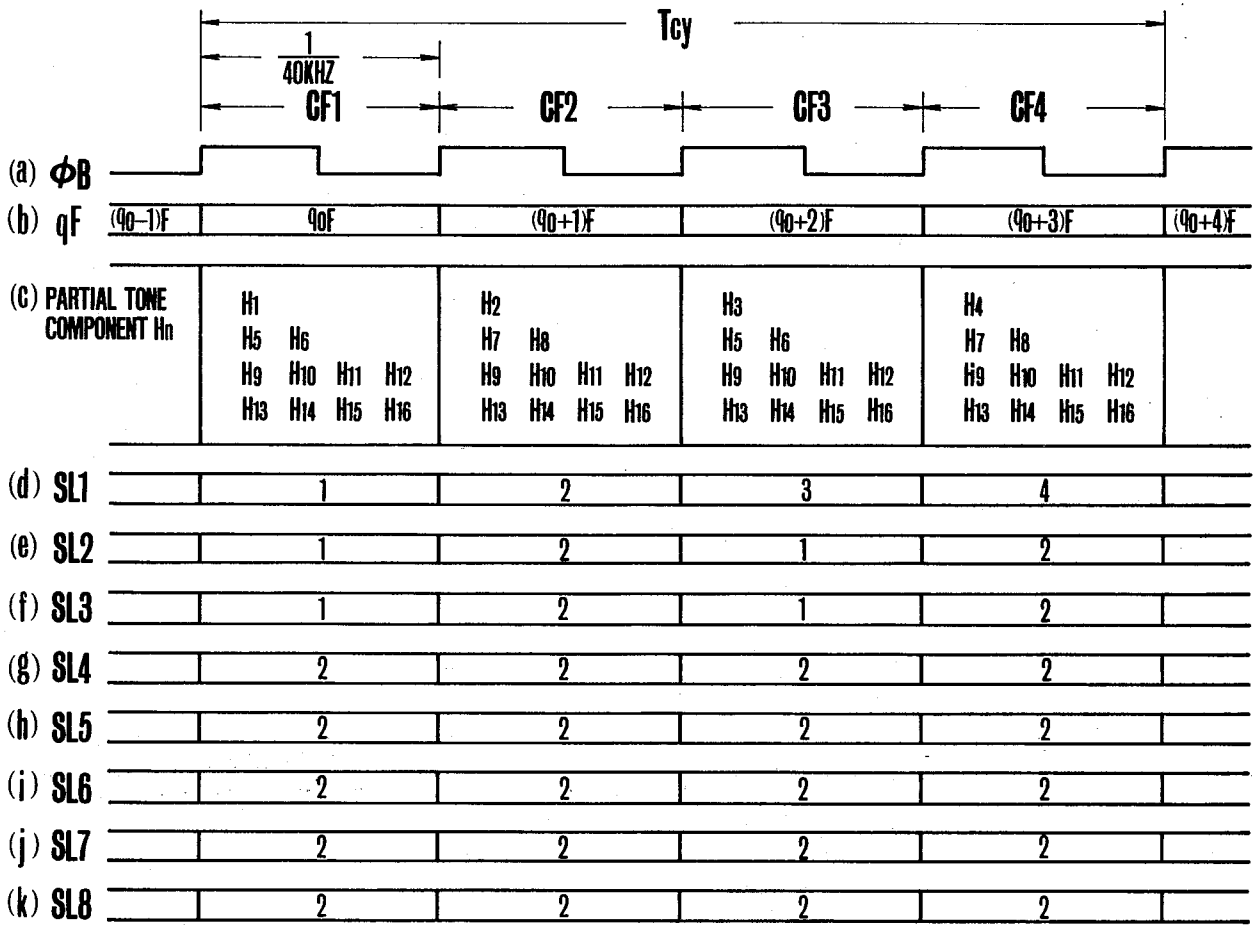
FIGS. 13*a* through 13*k* and FIGS. 14*a* through 14*k* are timing charts showing the timings of various signals produced by the timing signal generator shown in FIG. 12.

More particularly, the timing pulse generator 40A shown in FIG. 12 produces order designation signals SL1 to SL8 as shown in FIGS. 13*d* to 13*k* when the fundamental frequency f of the generated musical tone signal is lower than 1 KHz, whereby each of the sinusoid tables 70A to 70K produce a sine amplitude value $\sin \pi/\kappa$ nqF regarding a partial tone component Hn as shown in FIG. 13*c* during each calculating frame.

Figure 14:
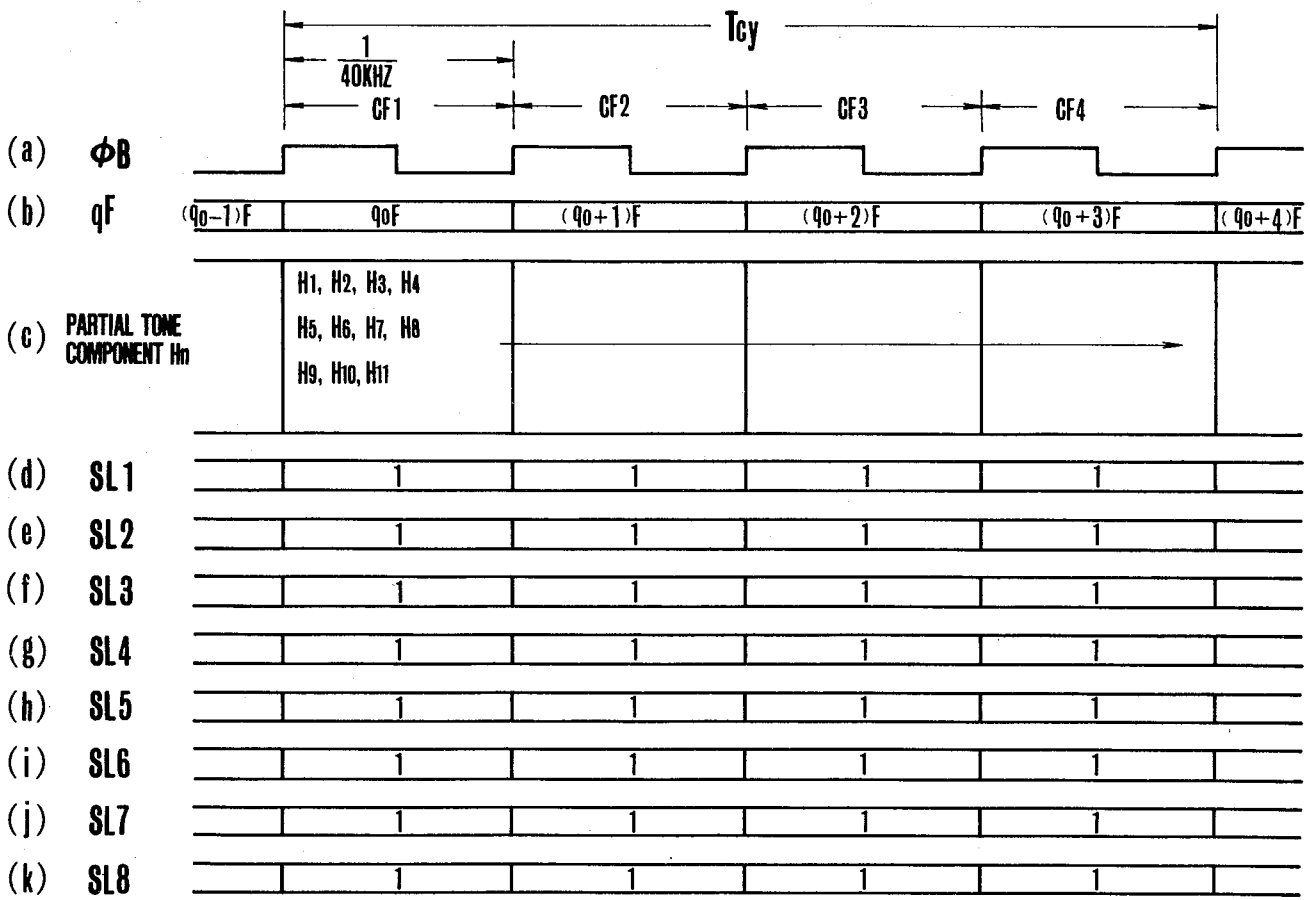

Further, the timing pulse generator 40A generates under order designation signals SL1 to SL8 as shown in FIGS. 14*d* to 14*k* when the fundamental frequency f of the generated musical tone signal is higher than 1 KHz, whereby each of the sinusoid tables 70A to 70K produce a sine amplitude value $\sin \pi/\kappa$ nqF regarding the partial tone component Hn as shown in FIG. 14*c* during each calculating frame.

The amplitude values $\sin \pi/\kappa$ nqF regarding 11 partial tone components, which are outputted in parallel during each calculating frame, are respectively multiplied with corresponding order harmonic coefficients Cn in the multipliers 120A to 120K to set the amplitudes.

Figure 15:
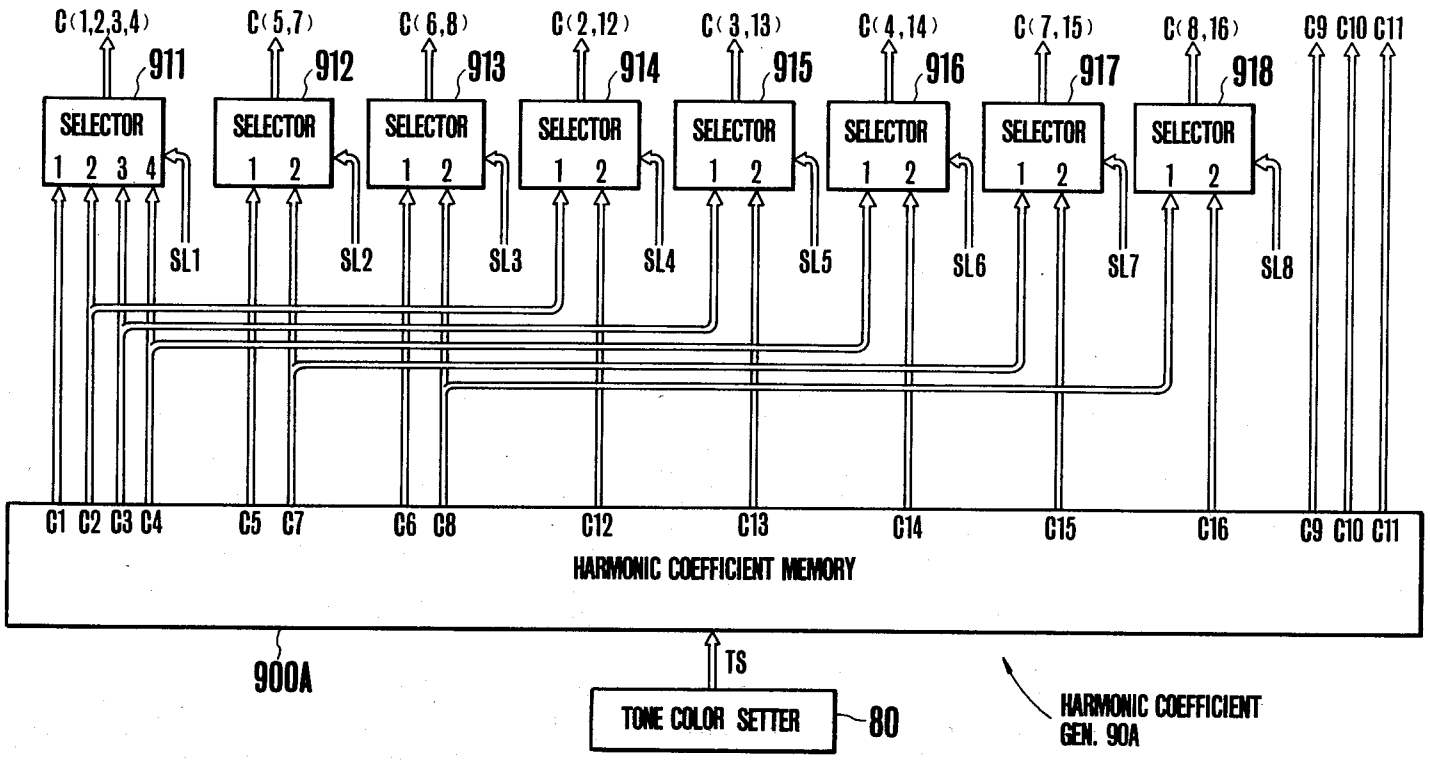
FIG. 15 is a block diagram showing the detail of the harmonic coefficient generator utilized in the musical tone signal generator shown in FIG. 11.

In this case, the harmonic coefficients Cn regarding 11 parallel sine amplitude valves sin $\pi/\kappa$ nqF are generated by a harmonic coefficient generator 90A constructed as shown in FIG. 15.

In FIG. 15, a harmonic coefficient memory device 900A normally produces in parallel harmonic coefficient information C1 to C16 regarding 16 partial tone components H1 to H16 corresponding to a tone color set by the tone color setter 80. Harmonic coefficient informations C1 to C8 and C12 to C16 are selectively extracted by selectors 911 to 918 according to the order designation signals SL1 to SL8 and then supplied to the multipliers 120A to 120H. More particularly, the harmonic coefficient information C1 to C4 is supplied to the selector 911 where one of the informations designated by the order designation signal SL1 is selectively extracted and applied to the multiplier 120A. The harmonic coefficient information C5 and C7 is applied to the selector 912 where one of these harmonic coefficient information designated by the order designation signal SL2 is selectively extracted and supplied to the multiplier 120B.

In the same manner, pairs of harmonic coefficient informations C6 and C8, C2 and C12, C3 and C13, C4 and C14, C7 and C15 and C8 and C16 are respectively applied to the selectors 913 to 916 in which either ones of the paired harmonic coefficient informations designated by respective order designation signals SL3 to SL8 are selected and applied to multipliers 120C to 120H. On the other hand, harmonic coefficient informations C9, C10 and C11 are applied directly to the multipliers 120I to 120K respectively.

In this case, the partial tone designation signals 1qF to 8qF and 12qF to 16qF respectively inputted to the selectors 62 to 69 shown in FIG. 11, and the harmonic coefficient informations C1 to C8 and C12 to C16 respectively inputted to the selectors 911 to 918 shown in FIG. 15 are selected to form corresponding partial tone orders. Since common order designation signals SL1 to SL8 are used, to each one of the multipliers 120A to 120H are synchronously applied one sine amplitude value sin $\pi/\kappa$ nqF and one harmonic coefficient information Cn. For this reason in each of the multipliers 120A to 120K, a sine amplitude value sin $\pi/\kappa$ nqF is multiplied with a corresponding harmonic coefficient information Cn to set the amplitude for the sine amplitude value sin $\pi/\kappa$ nqF.

The amplitude values Fn (Cn sin $\pi/\kappa$ nqF) for the 11 parallel partial tone components Hn set with their amplitudes as above described are synthesized by a synthesizer 140 in the same manner as in the first embodiment shown in FIG. 5. The synthesizer 140 comprises accumulators and low pass filters etc. just like the embodiment shown in FIG. 5.

The synthesized amplitude value ΣFn synthesized by the synthesizer 140 and regarding 11 parallel partial tone components is multiplied in a multiplier 160 with an envelope waveform signal ENV produced by the envelope waveform generator 100 to inpart an envelope to form a musical tone signal ENV.

As can be clearly understood from the foregoing description, with this modification it is possible to reduce the number of the calculating channels to 11/16 of that of the prior art just like the first embodiment shown in FIG. 5, thus reducing the size and cost of the computing apparatus in electronic musical instrument.

Still another embodiment of the musical tone signal generator

In the foregoing embodiments shown in FIGS. 5 and 11, a plurality of partial tone components Hn were calculated at periods corresponding to the values of respective sampling frequency ratios $\beta$n for the purpose of improving the utilization efficiency of the calculating channels thereby reducing the number of the calculatin channels. This embodiment is an improvement over previously described embodiments in which the number of the calculating channels is further less than the number of the partial tone components to be calculated thereby making it possible to produce a musical tone signal comprising much more numbers of the partial tone components.

For this reason, in this embodiment, among a plurality of partial tone components to be calculated, instantaneous amplitude values of lower order partial tone components are calculated by utilizing sinusoid tables like the foregoing embodiments, and the instantaneous amplitude values of higher order partial tone components are simultaneously calculated by utilizing sinusoid tables with a window function, i.e., a product of a window function W such a Hanning window by a sine function.

The term "window function" means a window in which a portion of a continuous waveform is cut for a time width t along a time axis. The window function comprises an element that determines the shape of the window (a portion thereof to be cut) and an element determines the interval of the window (the time width in which the waveform is cut) with the result that the spectrum of waveform passing through the window is different from that of the original waveform.

Figure 16:
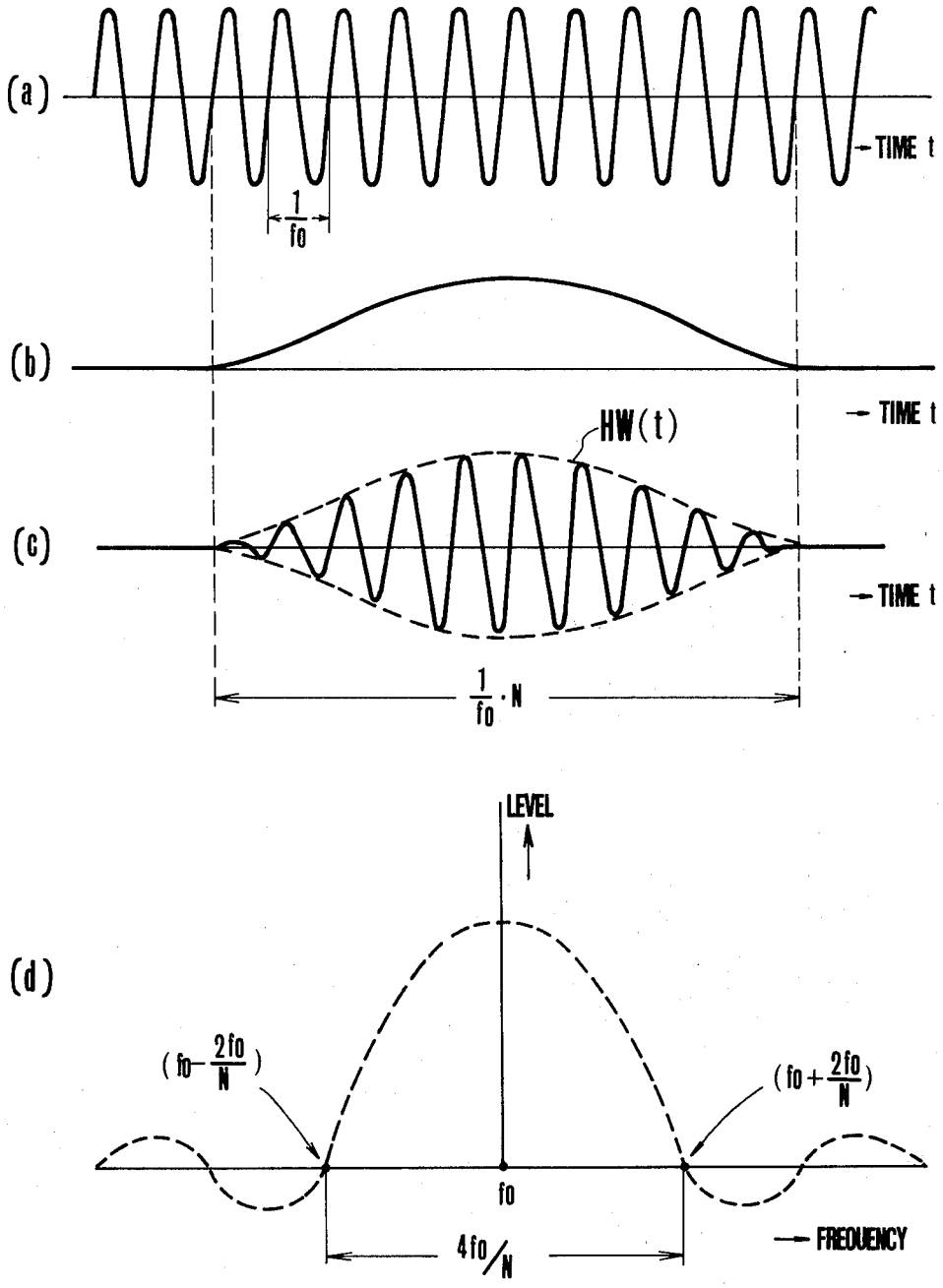
FIGS. 16*a* to 16*d* are graphs useful to explain the method of producing a musical tone signal generator utilizing a window function used in a third embodiment of the musical tone signal generator according to this invention.

Among the time windows are known a rectangular window, a Hamming window, a Hanning window, a Gaussian window, a Dolph-Chebyshev window, etc. For example, when a sine waveform shown in FIG. 16*a* and having a frequency fo is passed through a Hanning window W having a time width of (1/fo)·N as shown in FIG. 16*b*, a waveform HW(t) as shown in FIG. 16*c* can be obtained. In this case, the waveform HW(t) manifests a spectrum envelope whose bandwidth (main lobe) is shown by FIG. 16*b* as (4 fo/N.). The term "main lobe" is defined as the region between $$\omega = fo - \frac{2fo}{N} \text{ and } fo + \frac{2fo}{N}.$$

Consequently, where a waveform amplitude obtained by multiplying a sine wave having a period N by a Hanning window function W is stored in a memory device and where the stored waveform amplitude value having the period of N is read out at a period of 1/fo, the read out waveform would have a plurality of frequency components distributed in a bandwidth of (fo±2 fo/N) about a frequency fo. Accordingly, with this method, it is possible to simultaneously obtain a plurality of partial tone components distributing in a predetermined frequency band, which means a decrease in the number of the calculating channels.

According to this embodiment, a sinusoid table with a window function is utilized to simultaneously calculate higher order partial tone components by grouping them into a certain number of groups for certain frequency bands. In this case, the reason that lower order partial tone components are individually calculated by utilizing a convertional sinusoid table lies in that such lower order partial tone components should be accurately and individually controlled their amplitude in order to set a tone color.

The detail of this embodiment will now be described as follows. In this embodiment, musical tones are generated under the conditions described in the following Table XI.

TABLE XI

| | condition |
|---|---|
| number of simultaneously produced tones | one |
| key range | 5 octaves of tone pitches of from C2 -toB6 |
| construction of partial tone component of musical tone | first partial tone (fundamental) to 128th partial tone |
| highest frequency of a partial tone component that can be produced | 16 KHz |

In this case, first to eighth partial tone components H1 to H8 are individually calculated with a conventional sinusoid table, whereas 9th to 128th partial tone components H9 to H128 are grouped for a number of frequency bands and each group is simultaneously calculated by using sinusoid tables with window functions of 4 systems. More particularly, with regard to the 9th to 16th partial tone components H9 to H16, they are simultaneously calculated for respective frequency bands of a spectrum envelope as shown in FIG. 16*d* with 10th, 12th, 14th and 16th partial tone components H10, H12, H14 and H16 as respective center components.

With regard to the 17th to 128th partial tone components H17 to H128 each of the sinusoid table with window functions of 4 systems is used, on the time division basis, as shown in the following Table XII during one period T of the generated musical tone signal to simultaneously calculate these partial tone components in each frequency band of the spectrum envelope shown in FIG. 16*d* with partial tone component groups of (20th, 40th, 80th), (24th, 48th, 96th), (28th, 56th, 112th) and (32th, 64th, 128th) as respective center components. In summary, 9th to 128th partial tone components H9 to H128 are calculated by a band control for each frequency band having a partial tone component Hn of a predetermined order as a center component.

TABLE XII

| time division | first system | second system | third system | fourth system |
|---|---|---|---|---|
| $0 \leqq T \times < \frac{1}{2} T$ | 20f | 24f | 28f | 32f |
| $\frac{1}{2} T \leqq T \times < \frac{3}{4} T$ | 40f | 48f | 56f | 64f |
| $\frac{3}{4} T \leqq T \times < \frac{7}{8} T$ | 80f | 96f | 112f | 128f |
| $\frac{7}{8} T \leqq T \times < T$ | — | — | — | — |

Thus, in this embodiment of the musical tone signal generator is provided with a sinusoid table of one system and sinusoid tables with window functions of 4 systems. In the following description, a sinusoid table with a window function is called a sinusoid table with WF.

Figure 17:
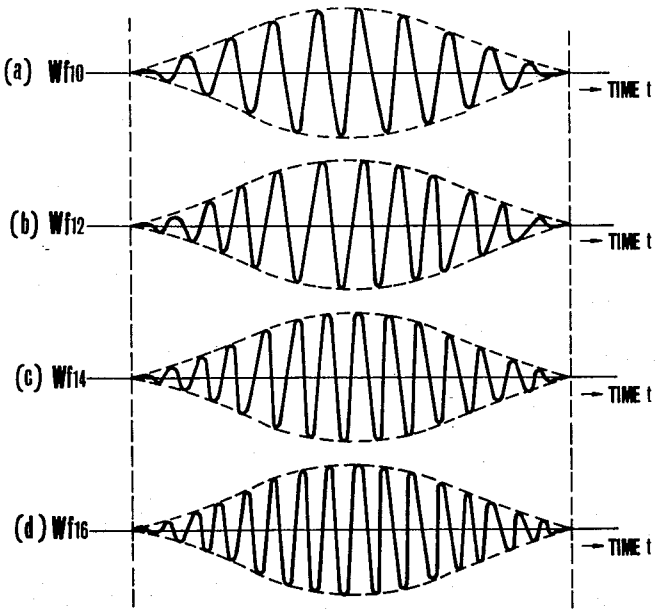
FIGS. 17*a* to 17*d* show waveforms stored in a sinusoidal table with window functions of 4 systems utilized in the third embodiment of the musical tone signal generator according to this invention.
Figure 18:
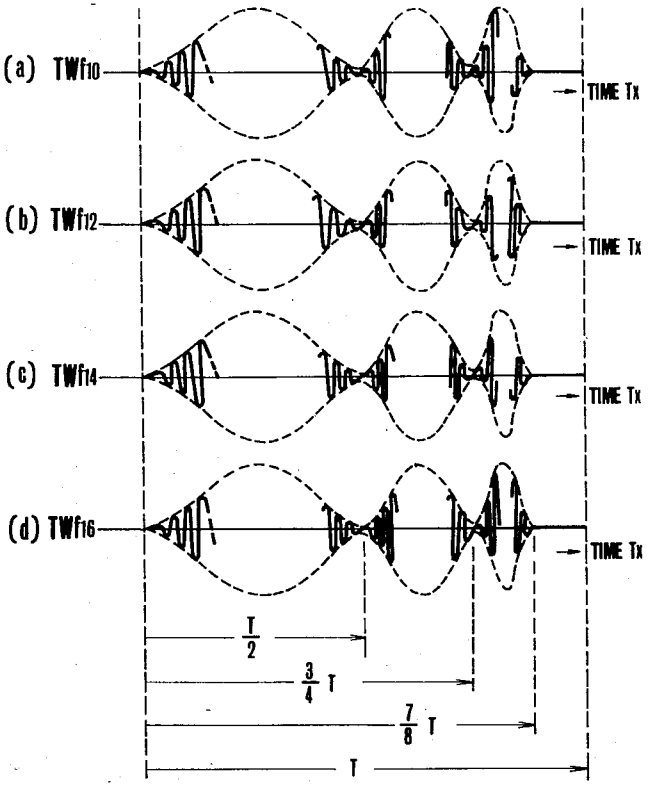
FIGS. 18*a* to 18*d* show waveforms obtained by reading out, at different periods, the waveform stored in the sinusoidal table with window functions of 4 systems.

FIGS. 17*a* through 17*d* show waveforms stored in the sinusoid tables with WFs of the first to fourth systems. As shown in FIG. 17*a*, the sinusoid table with WF of the first system is storing a waveform Wf10 obtained by modifying a sine waveform over 10 periods with a Hanning Window, while the sinusoid table with WF of the second system is storing a waveform Wf12 obtained by modifying a sine waveform over 12 periods with the Hanning Window, as shown in FIG. 17*b*. The sinusoid table with WF of the third system is storing a waveform Wf13 obtained by modifying a sine waveform over 14 periods with the Hamming window, as shown in FIG. 17*c*. The sinusoid table with WF of the fourth system is storing a waveform Wf16 obtained by modifying a sine waveform over 16 periods with the Hanning Window as shown in FIG. 17*d*.

Consequently, when the contents of the sinusoid tables with WFs of the first to fourth systems are read out at the same frequency as the fundamental frequency f (i.e., the frequency of the first partial tone component H1) of the generated musical tone signal, all of a number of partial tone component tones can be obtained simultaneously having a spectrum envelopes expressed by $M=4\ fn\ (1/N)$ and having as the center components the 10th, 12th, 14th and 16th partial tone components respectively, where M represents the width of the main lobe, and fn represents the frequency of the nth partial tone component Hn, in this case fn=f10, f12, f14 and f16.

Denoting the frequency f10 of the 10th partial tone component H10 by [f10=1000 Hz], since in the first system N=10, from the sinusoid table with WF of the first system are simultaneously read out a plurality of partial tone components (9th to 11th) manifesting a spectrum envelope having an a main lobe width $$M=4\cdot 1000/10=400\ \text{Hz},$$

a lower limit frequency of $(f-M/2)=800$ Hz, and a upper limit frequency of $(f+M/2)=1200$ Hz.

In the same manner, with reference to the sinusoid tables with WFs of the second to fourth systems, the main lobe width M is calculated by taking N=12, N=14 and N=16, the partial tone components as shown in the following Table XIII can be simultaneously obtained from the sinusoid tables with WFs of the first to fourth systems.

TABLE XIII

| sinusoid table with WF | width of main lobe (M = 4 fn/N) | upper limit frequency (Fn + M/2) | lower limit frequency (fn − M/2) | calculated partial tone component Hn |
|---|---|---|---|---|
| first system (N = 10) | 400 Hz (fn = 1000) | 1200 Hz | 800 Hz | H9 to H11 |
| second system (N = 12) | 400 Hz (fn = 1200) | 1400 Hz | 1000 Hz | H11 to H13 |
| third system (N = 14) | 400 Hz (fn = 1400) | 1600 Hz | 1200 Hz | H13 to H15 |
| fourth system (N = 16) | 400 Hz (fn = 1600) | 1800 Hz | 1400 Hz | H15 to H17 |

When the waveforms Wf10, Wf12, Wf14 and Wf16 stored in the sinusoid tables with WFs of the first to fourth systems are read out in respective intervals equal to one period of the generated musical tone signals in a manner as shown in Table XII, waveforms TWf10, TWf12, TWf14 and TWf16 as shown in FIGS. 18*a* to 18*d* can be obtained from respective tables with WFs.

More particularly, in a time Tx of $[0 \leqq Tx < (\frac{1}{2})T]$, the waveforms Wf10, Wf12, Wf14 and Wf16 stored in respective sinusoid tables with WFs are read out at a frequency twice the fundamental frequency f of the generated musical tone signal so that the read out waveforms TWf10, TWf12, TWf14 and TWf16 would have frequencies 20f, 24f, 28f and 32f respectively which are 20, 24, 28 and 32 times the fundamental frequency f.

Where the time Tx lies in a time band of $[(\frac{1}{2})T \leqq Tx < (\frac{3}{4})t]$, waveforms Wf10, Wf12, Wf14 and Wf16 stored in the respective sinusoid tables with WFs are read out at a frequency four times the fundamental frequency f so that the read out waveforms TWf10, TWf12, TWf14 and TWf16 would have frequencies of 40f, 48f, 56f and 64f respectively which are 40, 48, 56 and 64 times the fundamental frequency f. On the other hand, in a time band of $[(\frac{3}{4})T \leqq Tx < (\frac{7}{8})T]$, the waveforms Wf10, Wf12, Wf14 and Wf16 stored in the sinusoid tables with WFs are read out at a frequency 8 times the fundamental frequency f so that the respective read out waveforms TWf10, TWf12, TWf14 and TWf16 would have frequencies 80f, 96f, 112f and 128f respectively 80, 96, 112 and 128 times the fundamental frequency f.

Analyzing the spectra of the output waveforms TWf10, TWf12, TWf14 and TWf16 in respective time bands, the width M of the main lobe, the upper limit frequency and the lower limit frequency are shown in the following Tables XIV*a* to XIV*c*. Assuming a fundamental frequency f=100 Hz, the output waveform TWf10 in a time band of $[0 \leqq Tx < (\frac{1}{2})T]$, would have a frequency of fn=2000 Hz and N=10, so that the width M of the main lobe is given by $$M = 4 \cdot 2000/10 = 800 \text{ Hz}$$

thus manifesting a spectrum envelope distributing in a band of +400 Hz having a center frequency 2000 Hz.

TABLE XIVa

| sinusoid table with WF | width of main lobe (Hz) | center frequency (Hz) | upper limit frequency (Hz) | lower limit frequency (Hz) | $(0 \leqq Tx < \frac{1}{2} T)$ calculated partial tone component Hn |
|---|---|---|---|---|---|
| first system (N = 10) | M = 800 | fn = 2000 | 2400 | 1600 | H17 to H23 |
| second system (N = 12) | M = 800 | fn = 2400 | 2800 | 2000 | H21 to H27 |
| third system (N = 14) | M = 800 | fn = 2800 | 3200 | 2400 | H25 to H31 |
| fourth system (N = 16) | M = 800 | fn = 3200 | 3600 | 2800 | H29 to H35 |

TABLE XIVb

| sinusoid table with WF | width of main lobe (Hz) | center frequency (Hz) | upper limit frequency (Hz) | lower limit frequency (Hz) | $(\frac{1}{2} T \leqq Tx < \frac{3}{4} T)$ calculated partial tone component Hn |
|---|---|---|---|---|---|
| first system (N = 10) | M = 1600 | fn = 4000 | 4800 | 3200 | H31 to H47 |
| second system (N = 12) | M = 1600 | fn = 4800 | 5600 | 4000 | H39 to H55 |
| third system (N = 14) | M = 1600 | fn = 5600 | 6400 | 4800 | H49 to H63 |
| fourth system (N = 16) | M = 1600 | fn = 6400 | 7200 | 5600 | H55 to H71 |

TABLE XIVc

| sinusoid table with WF | width of main lobe (Hz) | center frequency (Hz) | upper limit frequency (Hz) | lower limit frequency (Hz) | $(\frac{3}{4} T \leqq Tx < \frac{7}{8} T)$ calculated partial tone component Hn |
|---|---|---|---|---|---|
| first system (N = 10) | M = 3200 | fn = 8000 | 9600 | 6400 | H63 to H95 |
| second system (N = 12) | M = 3200 | fn = 9600 | 11200 | 8000 | H79 to H111 |
| third system (N = 14) | M = 3200 | fn = 11200 | 12800 | 9600 | H95 to H127 |
| fourth system (N = 16) | M = 3200 | fn = 12800 | 14400 | 11200 | H111 to H143 |

However, it should be understood that all partial tone components H1 to H128 at all calculation sampling points are not always read out during one period of the musical tone signal but that orders of the calculated partial tone components differ according to the time bands in one period of the musical tone signal (see Table XIII and Tables XIVa to XIVc).

As above described, the musical tone signal generator of this modification generates a musical tone signal consisting of partial tone components H1 to H128, and the number of the calculating channels necessary to generate these partial tone components H1 to H128 and the calculation reference frequency fCA are set as follows.

Since the maximum frequency of the partial tone component Hn is 16 KHz shown in Table XI, the calculation reference frequency fCA is set to be 40 KHz to satisfy a relation $fCA \leqq 2.16$ KHz.

The sampling frequency ratio $\beta n$ regarding each partial tone component Hn is set to be $\beta n = 1$ to $\beta n = 1/128$ for each frequency band of one octave unit. In this case, regarding the sampling frequency ratios of the partial tone components higher than 9th order calculated by using the tables with WFs, only the partial tone components H10, H12, H14, H16, H20, H24, H28, H32, H40, H48, H56, H64, H80, H96, H112 and H128 acting as center orders are taken into consideration.

The number of the calculating channels is set to be 8 according to a group of the sampling frequency ratio which the partial tone components necessary to form a musical tone signal in the first to fifth octaves OC1 to OC5 belong to.

This setting is made by a similar procedure as has been described in the section hereof titled as Principle of the method of generating the musical tone signal. Thus, at the first step, the number of the partial tone components for different sampling frequency ratios are analyzed with reference to a musical tone signal of octaves OC1 to OC5.

Figure 20:
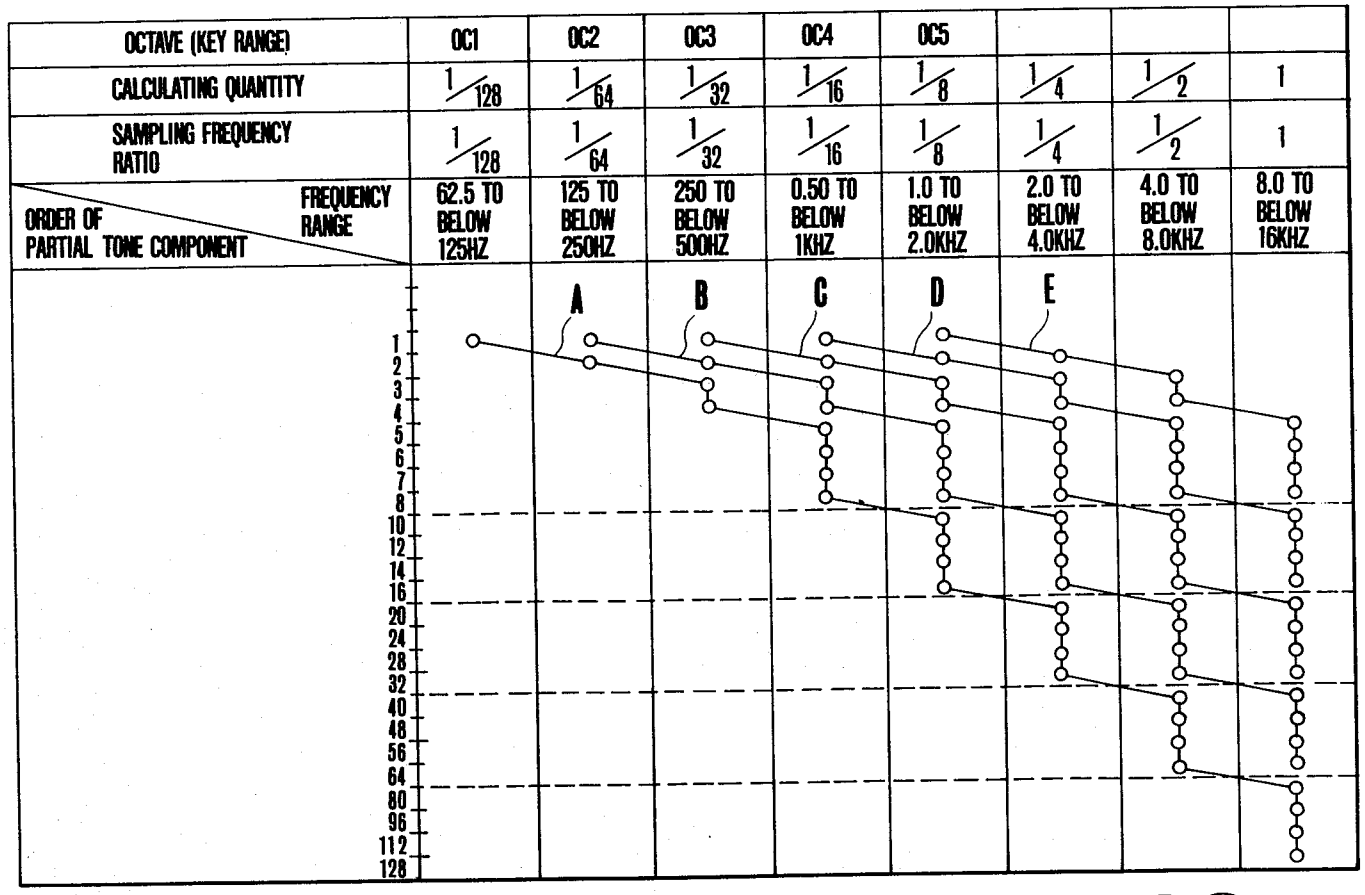
FIG. 20 is a map showing the frequency distribution of the partial tone components calculated in the third embodiment of the musical tone signal generator according to this invention.

As a result of this analysis, it can be noted that the partial tone components concerning a musical tone signal in respective octaves OC1 to OC5 respectively belong to the groups of the sampling frequency ratios shown by lines A to E interconnecting small circles depicted in the distributional map shown in FIG. 20.

Then, based on the distributional map shown in FIG. 20, the overall calculating ability CA necessary to calculate the partial tone components regarding each of the musical tone signals of the first to fifth octaves OC1 to OC5 is calculated for respective octaves.

As above described, since the overall calculating ability CA coincides with the sum of the sampling frequency ratios $\beta n$, the overall calculating abilities of the first to fifth octaves OC1 to OC5 respectively are shown by the following equations (9) to (13). Since the partial tone components higher than the 20th order are calculated by using on the time division basis, the sinusoid tables with WFs, partial tone components higher than the 20th order are calculated irrespective of their frequencies on the assumption that all of these components belong to a group of $\beta n=1$.

$$CA1=1/128+1/64+(1/32)\times 2+(1/16)\times 4+(\tfrac{1}{8})\times 4+1\times 4\simeq 5 \quad (9)$$

$$CA2=1/64+1/32+(1/16)\times 2+(1/8)\times 8+(\tfrac{1}{4})\times 4+1\times 4\simeq 6 \quad (10)$$

$$CA3=1/32+1/16+(\tfrac{1}{8})\times 2+(\tfrac{1}{4})\times 4+(\tfrac{1}{2})\times 4+1\times 4\simeq 8 \quad (11)$$

$$CA4=1/16+\tfrac{1}{8}+(\tfrac{1}{4})\times 2+(\tfrac{1}{2})\times 4+1\times 4\simeq 7 \quad (12)$$

$$CA5=\tfrac{1}{8}+\tfrac{1}{4}+(\tfrac{1}{2})\times 2+1\times 4\simeq 6 \quad (13)$$

For this reason in order to calculate all partial tone components it is necessary that the overall calculating ability should be 8 of CA3 of maximum value among all overall calculating abilities.

For this reason, in this embodiment 8 calculating channels are provided in order to calculate the partial tone components at the calculation reference frequency fCA=40 KHz.

The mode of utilization of these 8 calculating channels is determined for different frequency bands of respective partial tone components. In other words, it is determined that partial tone components in a given frequency band should be calculated in a predetermined calculating channel with a predetermined calculating period.

Figure 21:
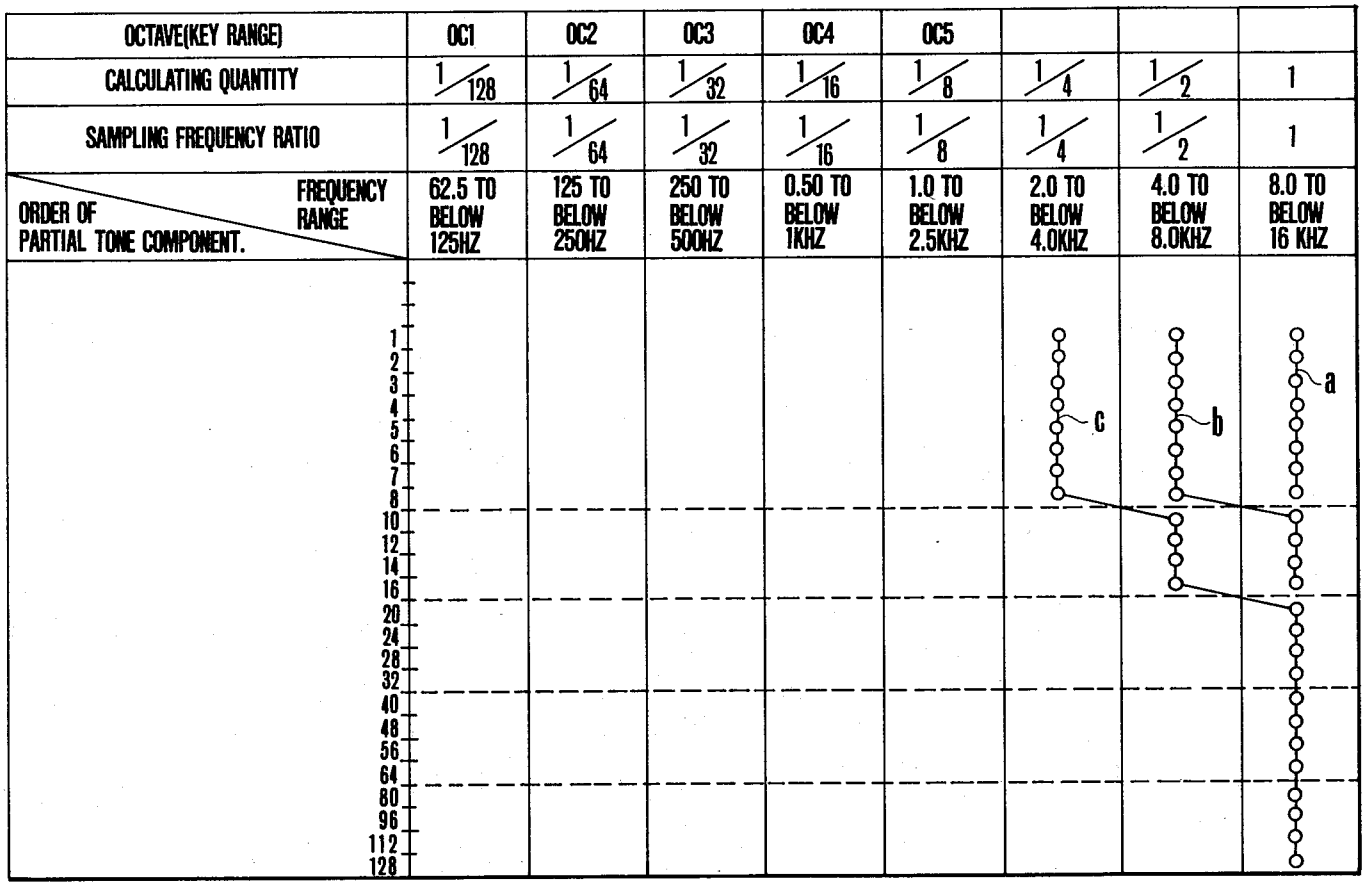
FIG. 21 is a map showing the manner of calculating the partial tone components having a distribution as shown in FIG. 20 in respective calculating channels at different periods.

Rewriting FIG. 20 such that the all overall calculating abilities CA1 to CA5 in respective octaves OC1 to OC5 would be equal to [8], FIG. 21 can be obtained. Consequently, a partial tone components regarding to musical tone signal at the fifth octave OC5 (fundamental frequency f=1.0 to 2.0 KHz) is calculated at a period corresponding to a sampling frequency ratio $\beta n=1$ as shown by a line a interconnecting small circles shown in FIG. 21. A partial tone components regarding of a musical tone signal regarding the fourth octave (fundamental frequency f=0.5 to 1 KHz) is calculated such that first to eighth partial tone components H1 to H8 are calculated at a period corresponding to a sampling frequency ratio $\beta n=\frac{1}{2}$ as shown by a line b interconnecting small circles shown in FIG. 21, while the partial tone components Hn having center frequencies at the 10th, 12th, 14th and 16th partial tone components H10, H12, H14 and H16 are calculated as a period corresponding to a sampling frequency ratio $\beta n=1$.

The partial tone components regarding a musical tone signal at the first to third octaves OC1 to OC3 (the fundamental frequency f lies in a frequency band of lower than 500 Hz) are calculated such that first to 8th partial components H1 to H8 are calculated at a period corresponding to a sampling frequency ratio $\beta n=\frac{1}{4}$ as shown by a line c in FIG. 21, the partial tone components having the 10th to 16th c partial tone components as the center orders are calculated at a period corresponding to a sampling frequency ratio $\beta n=\frac{1}{2}$, whereas the partial tone components having (20th, 40th, 80th), (24th, 48th, 96th), (28th, 56th, 112th) and (32th, 64th, 128th) partial tone components as the center orders are calculated at a period corresponding to a sampling frequency ratio $\beta n=1$ by using the sinusoid tables with WFs on the time division basis.

Thus, the musical tone signal generator of this embodiments comprises 8 calculating channels and the first to 128th partial tone components H1 to H128 are calculated with these 8 calculating channels at period corresponding to the values of the sampling frequency ratios of respective partial tone components.

In this case, the eight calculating channels may be provided in parallel and independently, but in this embodiment a single calculating apparatus is used on the time division basis, by respective calculating channels CH0 to CH0 in the same manner as in the embodiment shown in FIG. 5. Accordingly, in this embodiment, respective calculating channels CH0 to CH7 correspond to time division time slots and the interval of 8 time slots is set to be equal to the calculation reference period time 1/fCA (=1/40 KHz).

One cycle of calculating channels comprising 8 time division time slots is termed herein a calculating frame CF. Since in this embodiment too the minimum value of the sampling frequency ratio is $\frac{1}{4}$, it is necessary to repeat 4 times the calculating operations for respective calculating channels CH0 to CH7 before all partial tone components are calculated. For this reason first to fourth calculating frames CF1 to CF4 are set which constitute one calculating cycle Tcy.

In this embodiment, the partial tone components to be calculated with respective calculating channels CH0 to CH7 during the first to fourth calculating frames CF1 to CF4 of the calculating cycle Tcy, are set as shown in the following Tables XVa through XVf.

Table XVa shows the partial tone components to be calculated with respective calculating channels CH0 to CH7 in a time band in which the time Tx during one period T of the musical tone signal is expressed by a relation $[0\leqq Tx<(\frac{1}{2})T]$ and when the fundamental frequency f of the generated musical tone signal is lower than 500 Hz, while Table XVb shows partial tone components to be calculated with respective calculating channels CH0 to CH7 in a time band in which the time Tx in one period T of the musical tone signal is expressed by a relation $[(\frac{1}{2})T \leqq Tx < (\frac{3}{4})T]$ when the fundamental frequency f of the generated musical tone signal is lower than 500 Hz. Table XVc shows the partial tone components to be calculated with respective calculating channels CH0 to CH7 in a time band in which the time Tx is one period T of the musical tone signal is expressed by a relation $[(\frac{3}{4})T \leqq Tx < (\frac{7}{8})T]$ when the fundamental frequency f of the generated musical tone signal is less than 500 Hz, while Table XVd shows the partial tone components to be calculated with respective calculating channels CH0 to CH7 in a time band in which the time Tx in one period T of the musical signal is expressed by a relation $[(\frac{7}{8})T \leqq Tx < T]$ when the fundamental frequency f of the generated musical signal is lower than 500 Hz.

In the same manner, Table XVe shows the partial tone components to be calculated with respective calculating channels CH0 to CH7 during one period T of the musical tone signal when the fundamental frequency f of the generated musical tone signal is between 500 and 1000 Hz, whereas Table XVf shows the partial tone components to be calculated with respective calculating channels CH0 to CH7 during one period T of the musical tone signal when the fundamental frequency f of the generated musical tone signal is higher than 1000 Hz. Regarding the partial tone components to be calculated by using sinusoid tables with Wfs, only the partial tone components comprising the center orders are shown.

TABLE XVa

| calculating frame | calculating channel CH0 | CH1 | CH2 | CH3 | CH4 | CH5 | CH6 | CH7 | condition |
|---|---|---|---|---|---|---|---|---|---|
| CF1 | H1 | H20 | H10 | H24 | H2 | H28 | H12 | H32 | |
| CF2 | H3 | ↓ | H14 | ↓ | H4 | ↓ | H16 | ↓ | $f < 500$ Hz |
| CF3 | H5 | ↓ | H10 | ↓ | H6 | ↓ | H12 | ↓ | $0 \leqq Tx < \frac{1}{2}T$ |
| CF4 | H7 | ↓ | H15 | ↓ | H8 | ↓ | H16 | ↓ | |

TABLE XVb

| calculating frame | calculating channel CH0 | CH1 | CH2 | CH3 | CH4 | CH5 | CH6 | CH7 | condition |
|---|---|---|---|---|---|---|---|---|---|
| CF1 | H1 | H40 | H10 | H48 | H2 | H56 | H12 | H64 | |
| CF2 | H3 | ↓ | H14 | ↓ | H4 | ↓ | H16 | ↓ | $f < 500$ Hz |
| CF3 | H5 | ↓ | H10 | ↓ | H6 | ↓ | H12 | ↓ | $\frac{1}{2}T \leqq Tx < \frac{3}{4}T$ |
| CF4 | H7 | ↓ | H14 | ↓ | H8 | ↓ | H16 | ↓ | |

TABLE XVc

| calculating frame | calculating channel CH0 | CH1 | CH2 | CH3 | CH4 | CH5 | CH6 | CH7 | condition |
|---|---|---|---|---|---|---|---|---|---|
| CF1 | H1 | H80 | H10 | H96 | H2 | H112 | H12 | H128 | |
| CF2 | H3 | ↓ | H14 | ↓ | H4 | ↓ | H16 | ↓ | $f < 500$ Hz |
| CF3 | H5 | ↓ | H10 | ↓ | H6 | ↓ | H12 | ↓ | $\frac{3}{4}T \leqq Tx < \frac{7}{8}T$ |
| CF4 | H7 | ↓ | H14 | ↓ | H8 | ↓ | H16 | ↓ | |

TABLE XVd

| calculating frame | calculating channel CH0 | CH1 | CH2 | CH3 | CH4 | CH5 | CH6 | CH7 | condition |
|---|---|---|---|---|---|---|---|---|---|
| CF1 | H1 | X | H10 | X | H2 | X | H12 | X | |
| CF2 | H3 | X | H14 | X | H4 | X | H16 | X | $f < 500$ Hz |
| CF3 | H5 | X | H10 | X | H6 | X | H12 | X | $\frac{7}{8}T \leqq Tx < T$ |
| CF4 | H7 | X | H14 | X | H8 | X | H16 | X | |

TABLE XVe

| calculating frame | calculating channel CH0 | CH1 | CH2 | CH3 | CH4 | CH5 | CH6 | CH7 | condition |
|---|---|---|---|---|---|---|---|---|---|
| CF1 | H1 | H10 | H2 | H12 | H3 | H14 | H4 | H16 | |
| CF2 | H5 | ↓ | H6 | ↓ | H7 | ↓ | H8 | ↓ | $500 \leqq f < 1000$ Hz |
| CF3 | H1 | ↓ | H2 | ↓ | H3 | ↓ | H4 | ↓ | |
| CF4 | H5 | ↓ | H6 | ↓ | H7 | ↓ | H8 | ↓ | |

TABLE XVf

| calculating frame | calculating channel CH0 | CH1 | CH2 | CH3 | CH4 | CH5 | CH6 | CH7 | condition |
|---|---|---|---|---|---|---|---|---|---|
| CF1 | H1 | H2 | H3 | H4 | H5 | H6 | H7 | H8 | |
| CF2 | ↓ | ↓ | ↓ | ↓ | ↓ | ↓ | ↓ | ↓ | $f \geqq 1000$ Hz |
| CF3 | ↓ | ↓ | ↓ | ↓ | ↓ | ↓ | ↓ | ↓ | |
| CF4 | ↓ | ↓ | ↓ | ↓ | ↓ | ↓ | ↓ | ↓ | |

Construction

Figure 22:
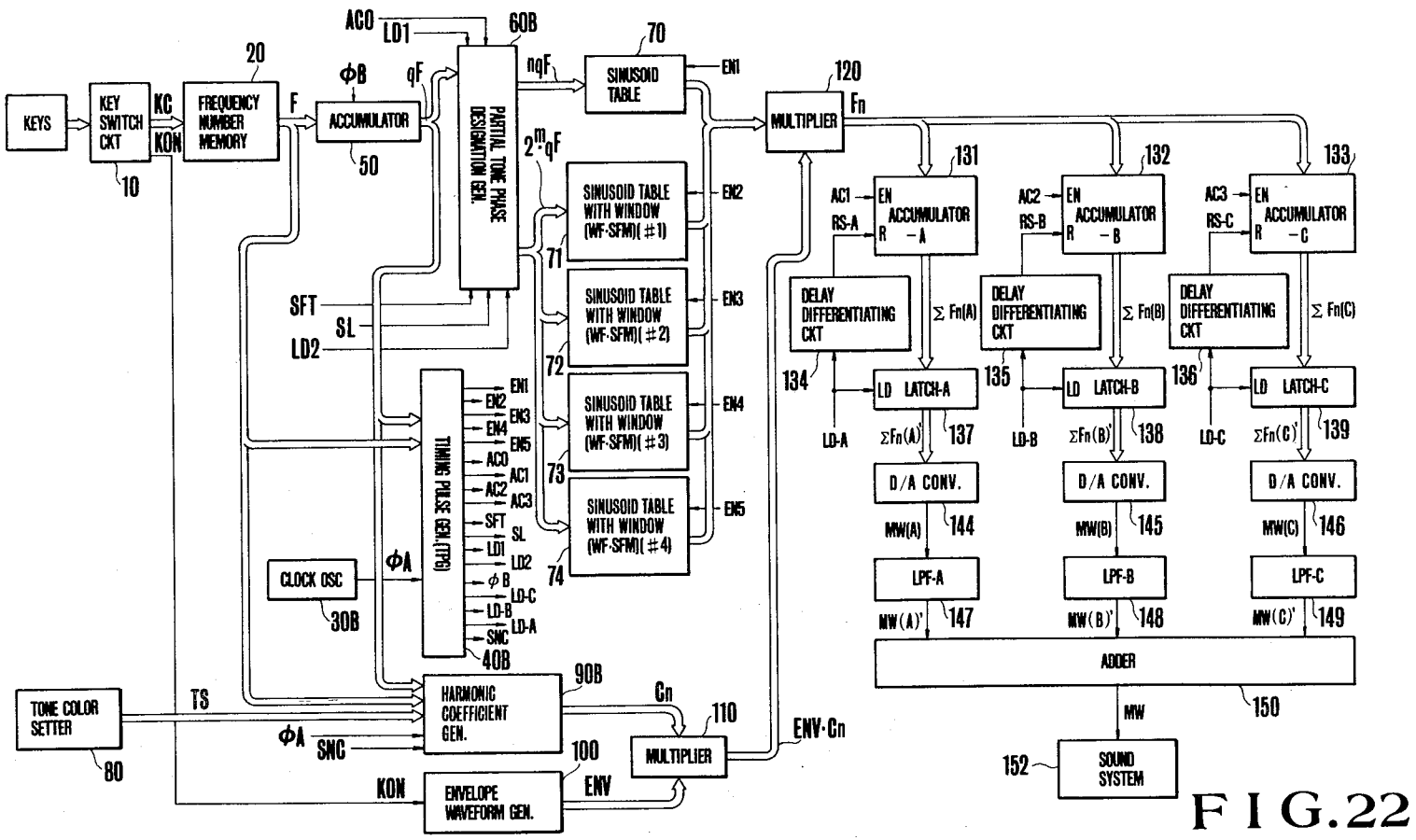
FIG. 22 is a block diagram showing the third embodiment of the musical tone generator according to this invention.

FIG. 22 is a block diagram showing one example of the construction of a musical tone signal generator according to this invention in which elements corresponding to those shown in FIG. 5 are designated by the same reference charactors so that description thereof will not be made.

In FIG. 22, a clock oscillator 30B generates clock pulse $\phi A$ having a frequency 8 times that of the calculation reference frequency fCA (=40 KHz), i.e. 8·fCA(=320 KHz). One period of this clock pulse $\phi A$ corresponds to one calculating channel time.

A timing pulse generator (TPG) 40B divides the frequency of the clock pulse $\phi A$ supplied thereto from the clock oscillator 30B to produce a clock pulse $\phi B$ having the same frequency as the calculation reference frequency fCA and a pulse width of $(\frac{1}{8})$·fCA. The timing pulse generator 40B further divides the frequency of the clock pulse $\phi B$ to produce a calculating cycle signal SNC having a time width of $(\frac{1}{8})$·fCA and representing the commencement of one calculating cycle Tcy. In response to the clock pulse $\phi A$, a frequency number F supplied from the frequency number memory device 20 and an accumulator value qF supplied from the accumulator 50, the timing pulse generator 40B also generates various control signals that designate partial tone components to be calculated with the respective 8 calculating channels CH0 to CH7 in each of the first to fourth calculating frames CF1 to CF4. The detail of these control signals are shown in the following Table XVI. In the following description the sinusoid tables with window functions WFs of the first to fourth systems will be abbreviated as WF·SEM (1) through WF·SEM (4).

TABLE XVI

| Signal | Description |
|---|---|
| EN1 | enable signal to enable the sinusoid table 70 |
| EN2 | enable signal to enable a WF · SFM(1) 71 |
| EN3 | enable signal to enable a WF · SFM(2) 72 |
| EN4 | enable signal to enable a WF · SFM(3) 73 |
| EN5 | enable signal to enable a WF · SFM(4) 74 |
| AC1 | accumulation designation signal for accumulating the amplitude values Fn of partial tone component Hn having a calculating period of $(\frac{1}{4})$ · fCA (= 10 KHz). applied to a accumulator 131 |
| AC2 | accumulation designation signal for accumulating amplitude values Fn of partial tone components Hn having a calculating period of $(\frac{1}{2})$ · fCA (= 20 KHz). applied to B accumulator 132. |
| AC3 | accumulation designation signal for accumulating partial tone components Hn having a calculating period of fCA (= 40 KHz). applied to C accumulator 133. |
| AC0 | control signals given to partial tone |
| SFT | phase designation signal generator 60B |
| SL | for forming predetermined partial tone |
| LD1 | phase designation signals nqF and $2^m$ · qF |
| LD2 | in respective calculating channels CH0 to CH7 in respective calculating frames CF1 to CF4, namely, |
| | AC0 accumulation designation signal |
| | SFT shift signal |
| | SL selection signal |
| | LD1,LD2 load signal |

Figure 23:
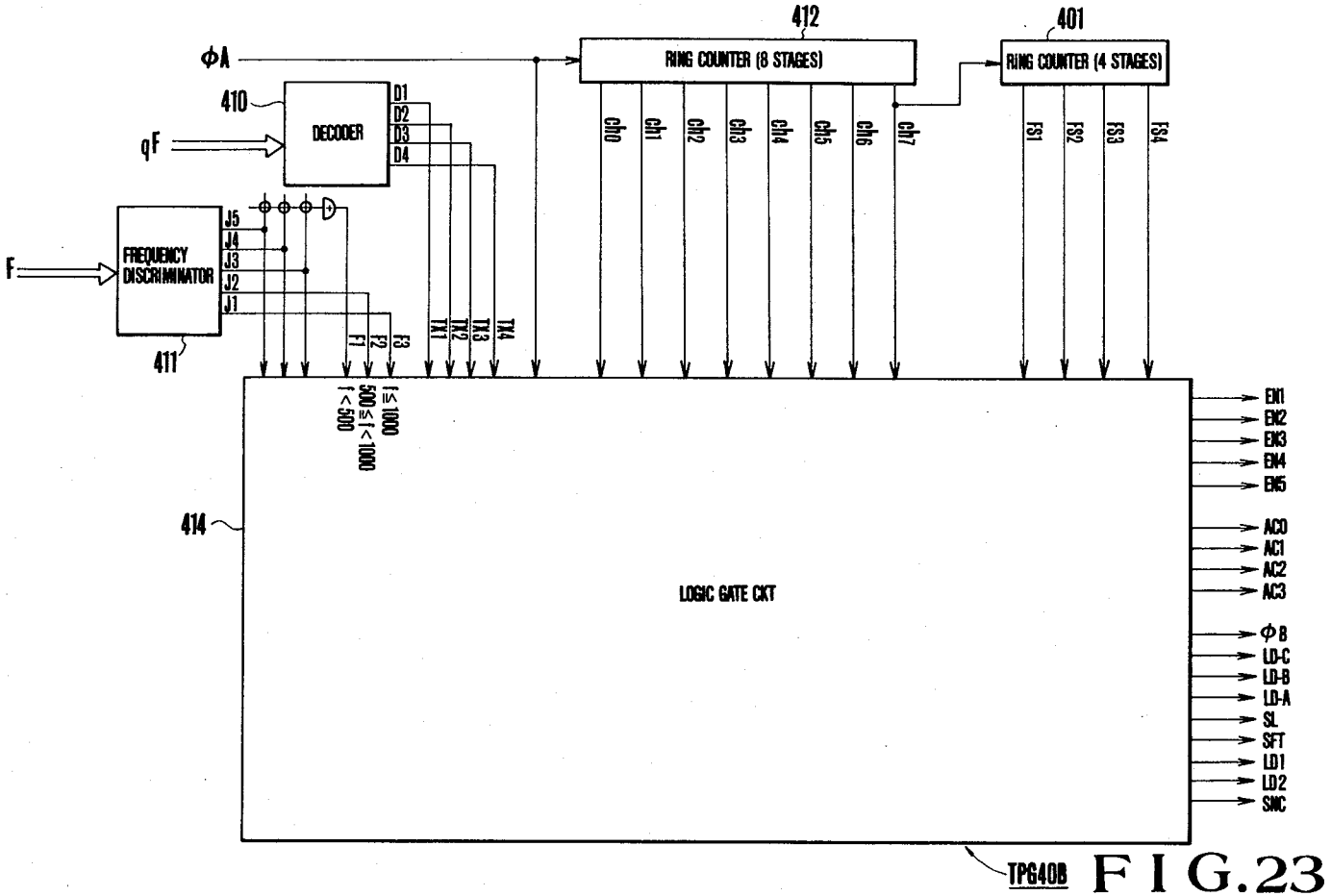
FIG. 23 is a block diagram showing the detail of the timing pulse generator utilized in the musical tone signal generator shown in FIG. 22.

One example of the construction of the timing pulse generator 40B which generates these control signals is shown in FIG. 23. Although the timing pulse generator 40B is designed on the same considerations as the timing generator 40 shown in FIG. 6, in the musical tone signal generator of this embodiment since the partial tone components to be calculated in a time band in one period of the generated musical tone are different, a decoder 410 is provided for discriminating the time bands in one period of the generated musical tone signal. There is also provided a frequency discriminator 411 for judging the fundamental frequency f of the generated musical tone signal, the frequency discriminator 411 being constructed to discriminate three frequency bands of $f<500$ Hz, 500 Hz$\leqq f<1000$ Hz and $f\leqq 1000$ Hz.

Figure 24:
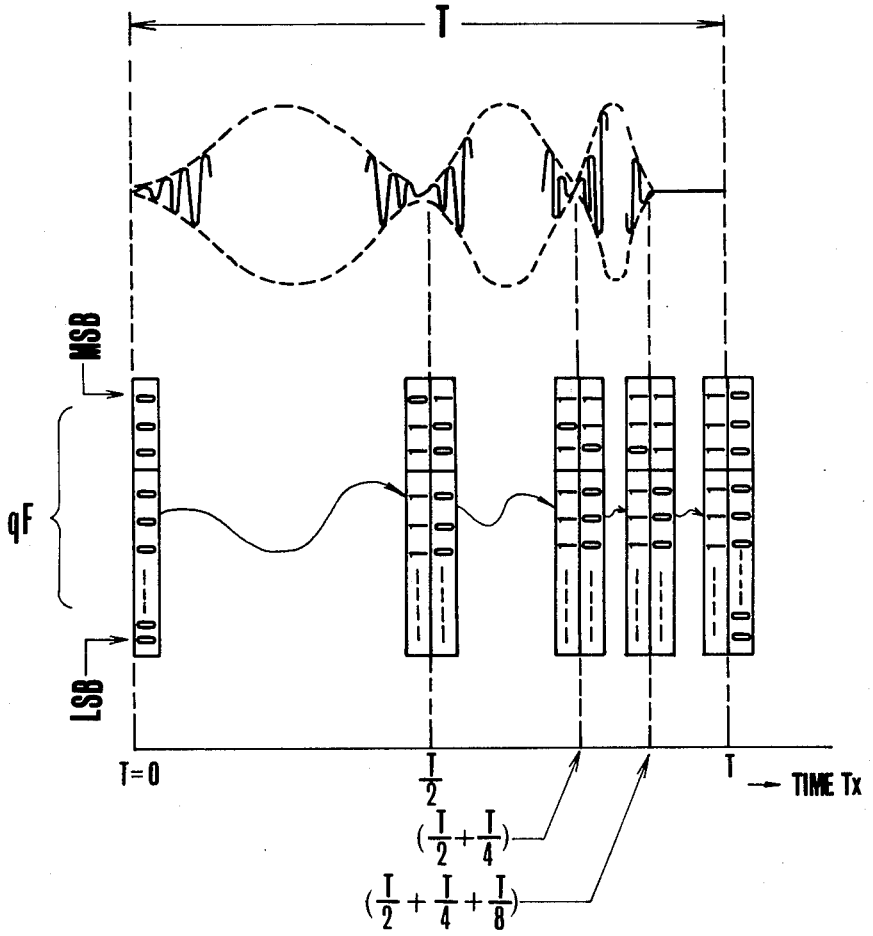
FIG. 24 is a graph useful to explain the manner of controlling switching of the read out speed of the sinusoidal table with the window functions of 4 systems utilized in the musical tone signal generator shown in FIG. 22.

In this case, the judgment as to whether the fundamental frequency f of the generated musical tone signal belongs to which one of the frequency bands $f<500$ Hz, 500 Hz$\leqq f<1000$ Hz and $f\leqq 1000$ Hz is determined according to the value of the frequency number F outputted from the frequency number memory device 20 in the same manner as in the embodiment shown in FIG. 5. Respective time bands (positions of the time Tx) in one period T of the musical tone signal are judged by the accumulator 50. The manner of variation of the accumulated value qF is shown in FIG. 24. As can be noted from FIG. 24, during a time band of $[0\leqq Tx<(\frac{1}{2})\cdot T]$, the upper order 3 bits are "000" to "110", during a time band of $[(\frac{1}{2})\ T\leqq Tx<\frac{3}{4}T]$, the upper order 3 bits are "100" to "101", and during the time band of $[(\frac{7}{8})\ T\leqq Tx<T]$, the upper order 3 bits are "111". Consequently, the timing pulse generator 40B is constructed such that it discriminates respective time bands in one period of the musical tone signal in accordance with the value of the upper order 3 bits.

The decoder 410 shown in FIG. 23 decodes the accumulated value qF outputted from the accumulator 50 (FIG. 22) for producing a signal Tx1 showing that the time band in one period of the musical tone signal is $[0\leqq Tx<T/2]$ when the upper order 3 bits are "000" to "011" as well as signal Tx2 showing that the time band is $[(\frac{1}{2})\ T\leqq Tx<(\frac{3}{4})\ T]$ when the upper three bits are "100" to "101". Also the decoder 410 produces a signal showing that the time band is $[(\frac{3}{4})\ T\leqq Tx<(\frac{7}{8})\ T]$ when the upper order 3 bits of the accumulated value qF are "110", and a signal Tx4 showing that time band is $[(\frac{7}{8})\cdot T\leqq Tx<T]$ when the upper order 3 bits of the accumulated value qF are "111".

Based on the value of the frequency number F, the frequency descriminator 411 produces a signal F1 when the frequency number F corresponds to a fundamental frequency f of lower than 500 Hz, whereas produces a signal F2 when the frequency number F corresponds to a fundamental frequency f of from 500 to 1000 Hz. When the value of the frequency number F corresponds to a fundamental frequency f higher than 1000 Hz, a signal F3 showing this fact is produced.

A ring counter 412 counts the number of the clock pulses $\phi A$ to send channel signals ch0 to ch7 corresponding to 8 calculating channels CH0 to CH7.

A ring counter 401 counts the number of a channel signals ch7 outputted from the last stage of the ring counter 412 for producing calculating frame signals FS1 to FS4 respectively corresponding to the first to fourth calculating frames CF1 to Cf4.

A logic gate circuit 414 produces aforementioned signals EN1 to EN5, AC0 to AC3, $\phi B$, SL, SFT, LD1, LD2 and SNC in response to various signals outputted by the decoder 410, the frequency discriminator 411, and ring counters 412 and 401. The timings of generation of these signals of the logic gate circuit 414 are shown in FIGS. 25A to 25F. Similar to the timing pulse generator 40 shown in FIG. 6, the logic gate circuit 414 is constituted by the same element as that of the timing pulse generator 40B.

FIGS. 25A through 25F are time charts respectively corresponding to the conditions necessary to calculate respective partial tone components in a manner shown in Tables XVa to XVf.

Turning back to FIG. 22, there is also provided a partial tone phase designation signal generator 60B, which in response to signals LD1, LD2, AC0 SET and SL received from the timing pulse generator 40B, converts the accumulated value qF supplied from the accumulator 50 into a partial tone phase designation signal nqF and into a signal $2^m$.qF (m=0, 1, 2, 3) for designating the sampling point phases of the partial tone components to be calculated with respective calculating channels (CH0 to CH7 and outputs these converted signals in synchronism with the channel times corresponding to respective calculating channels. In this case, signal nqF is supplied to the sinusoid table 70 as an address signal, whereas signal $2^m$.qF is applied to the WF.SFM(1)71 to WF.SFM(4)74 as an address signal.

Figure 25A:
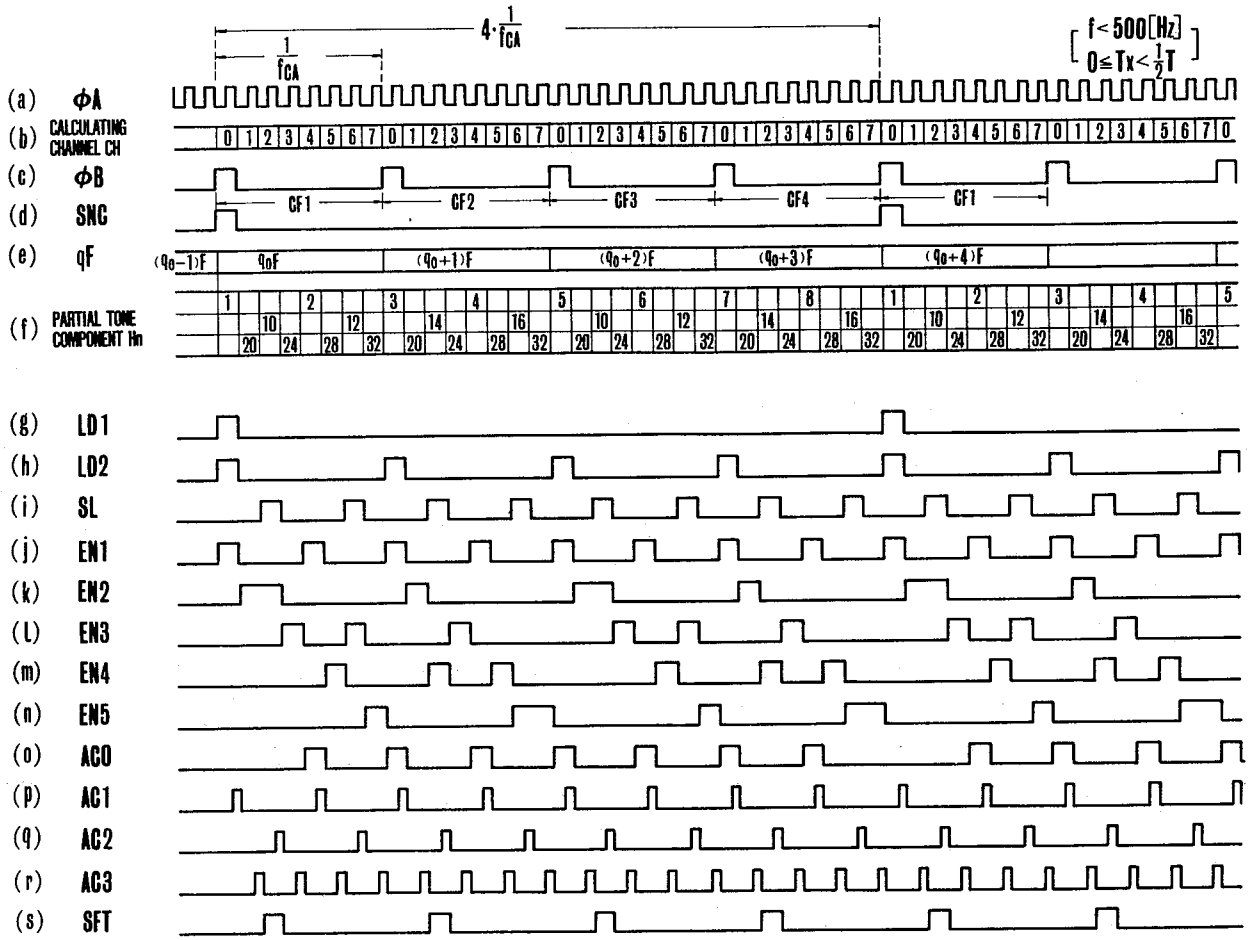
FIGS. 25A through 25F are timing charts showing the timings of various signals produced by the timing pulse generator shown in FIG. 23.
Figure 25B:
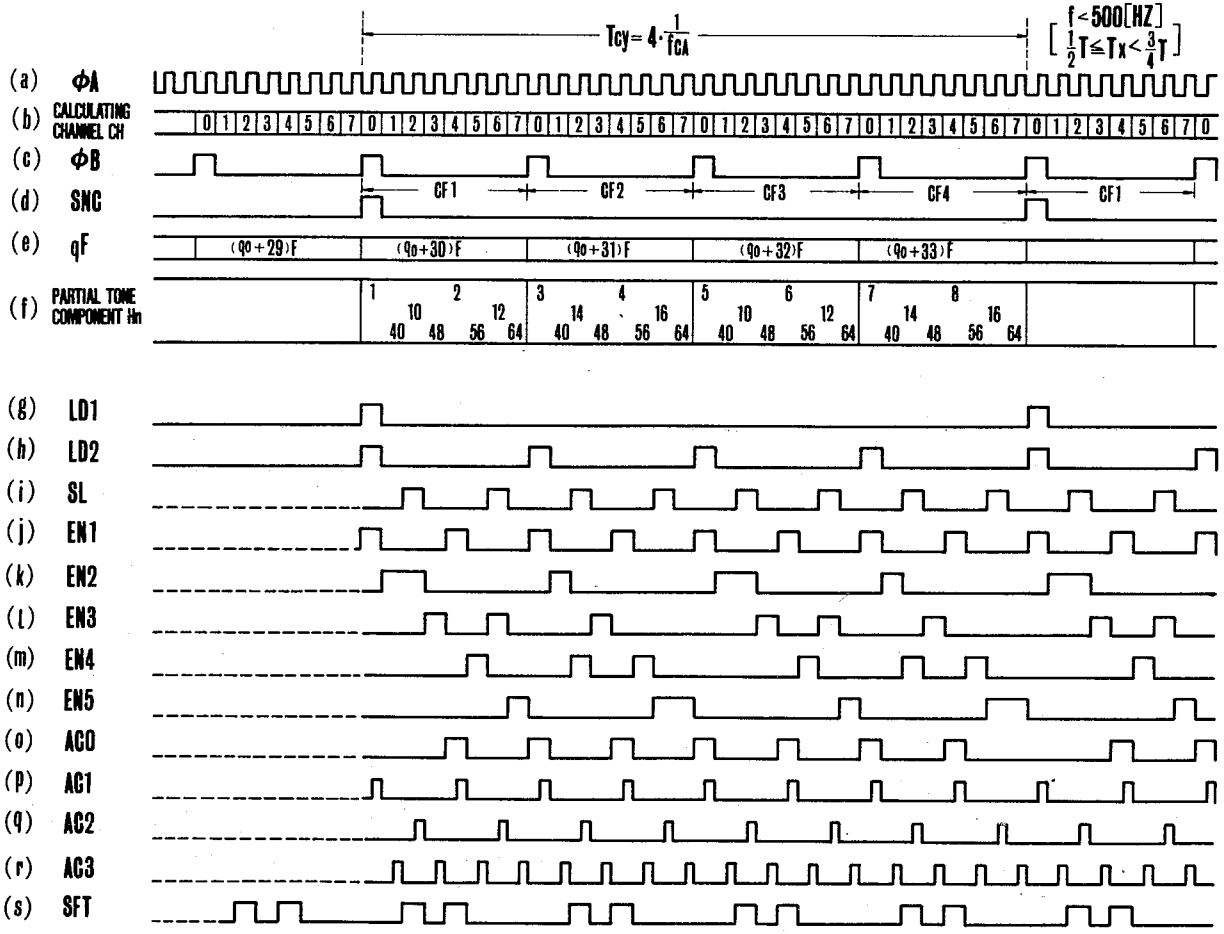
Figure 25C:
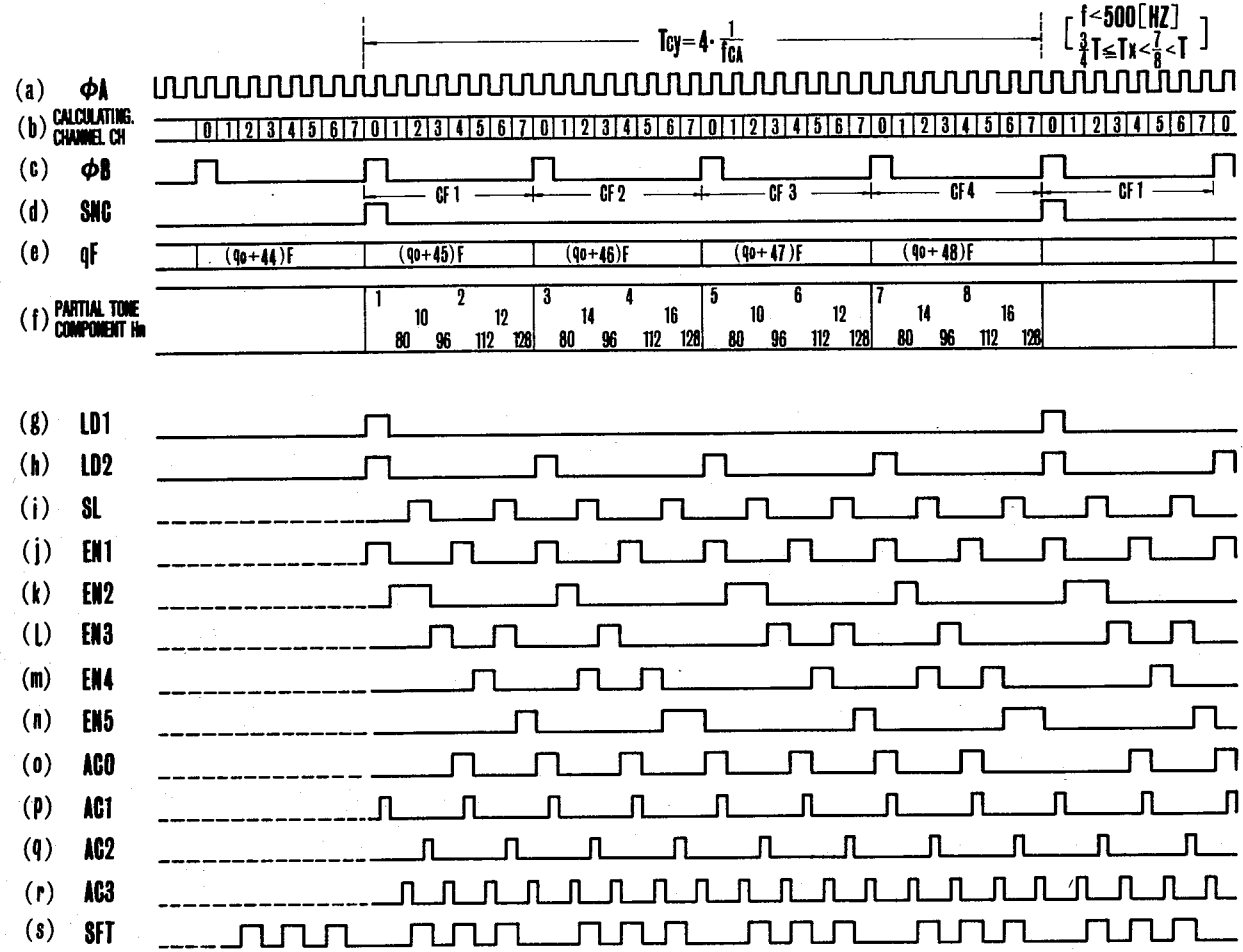
Figure 25D:
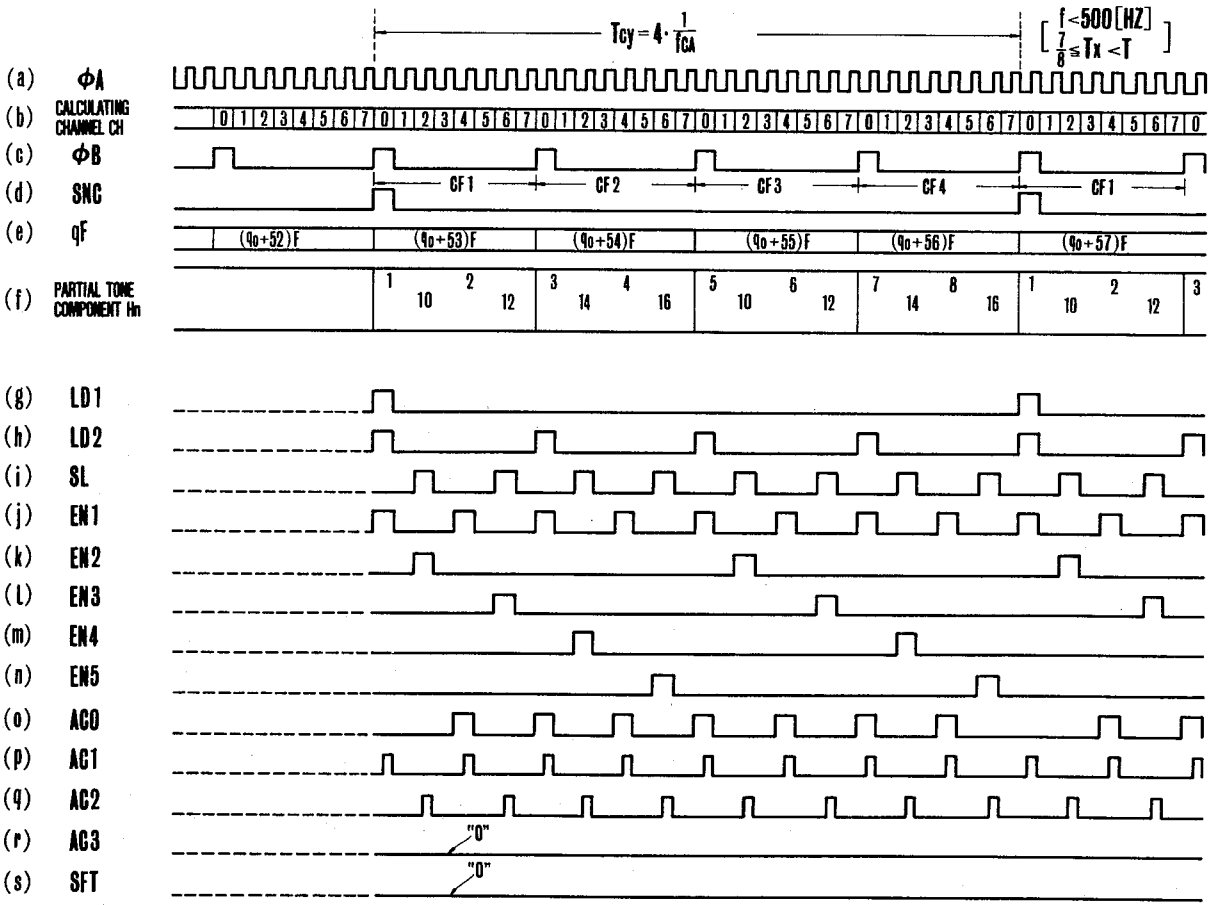
Figure 25E:
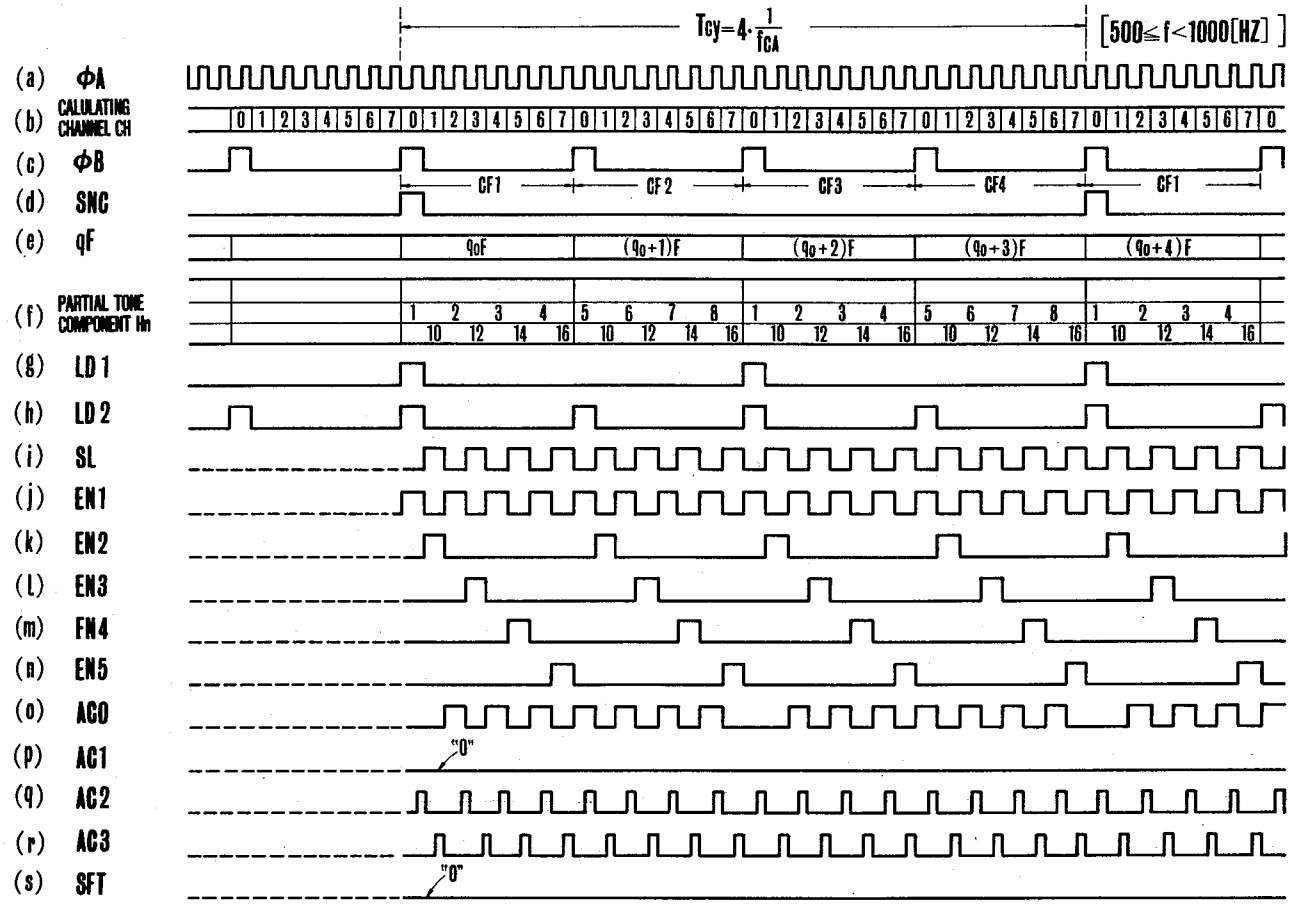
Figure 25F:
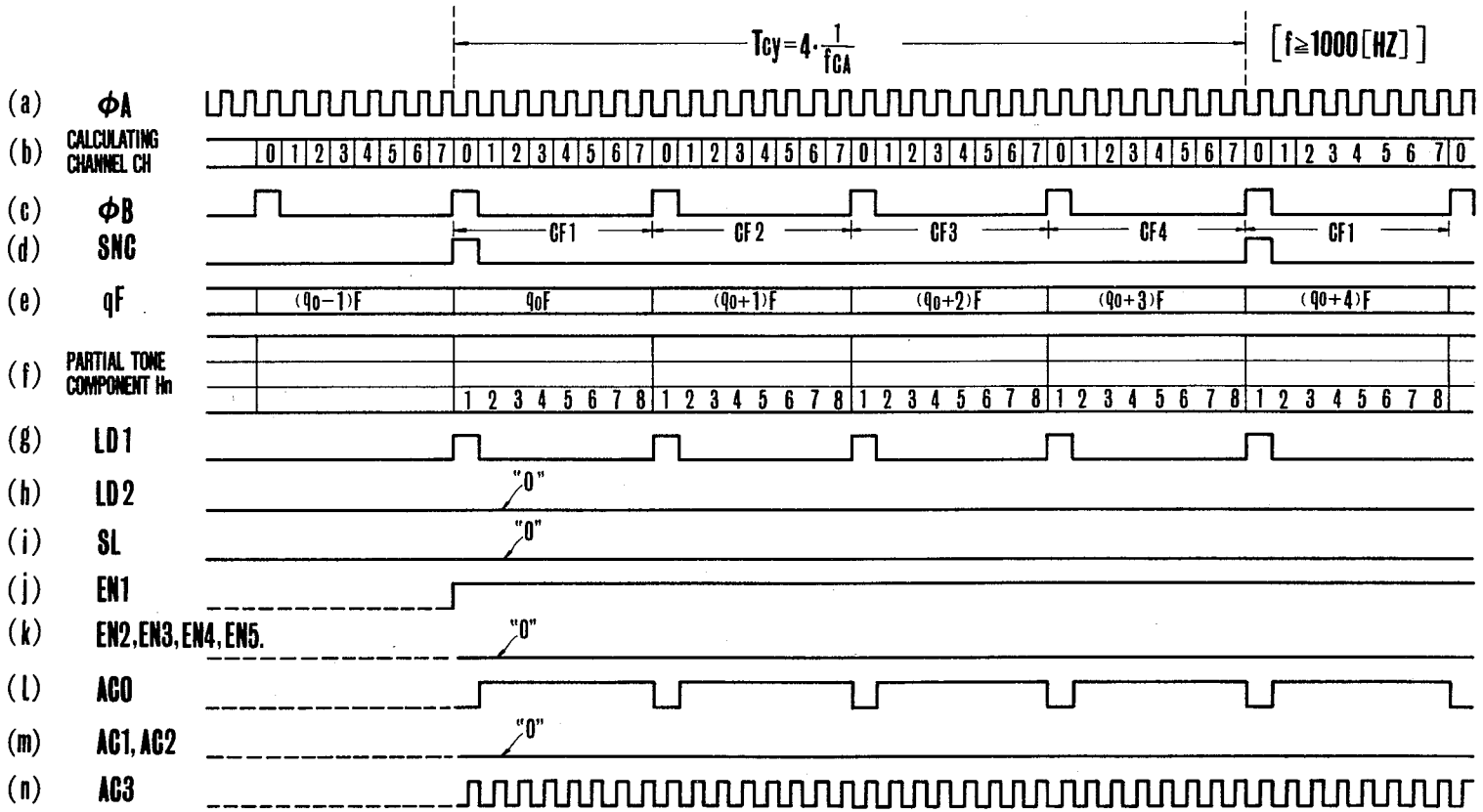
Figure 26:
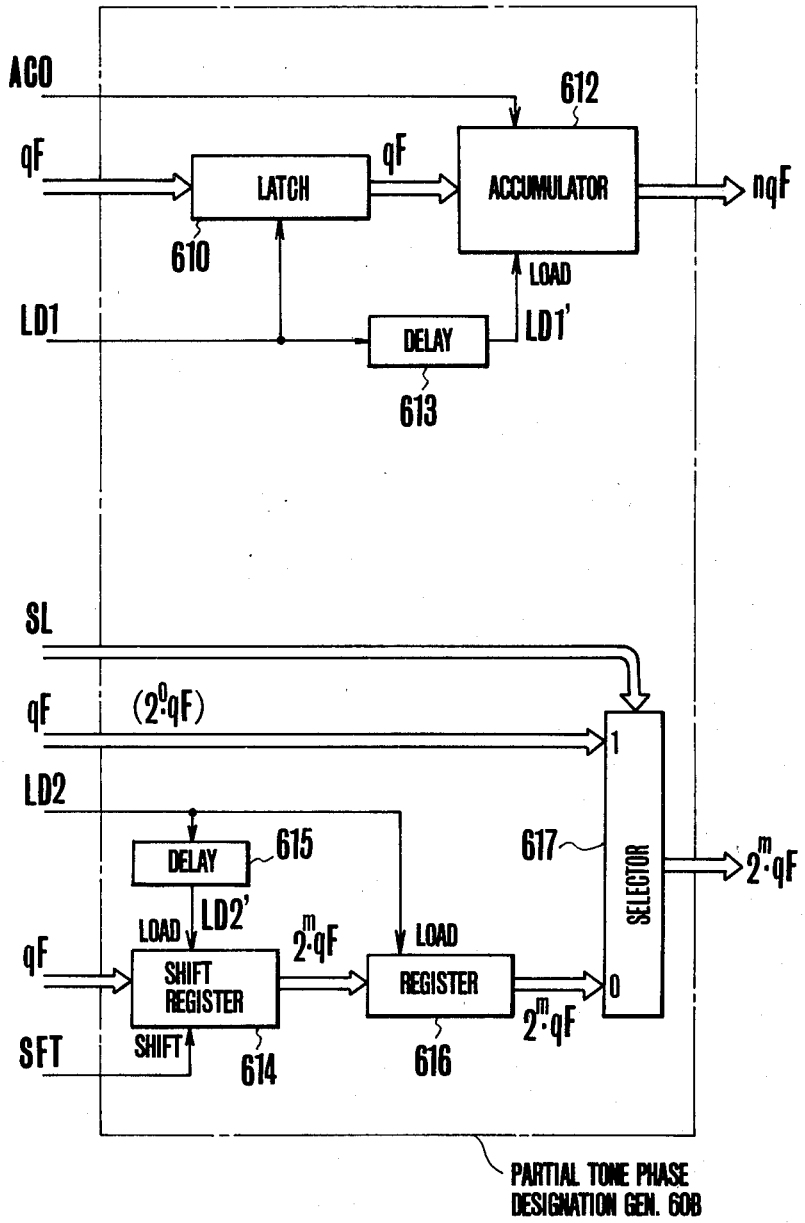
FIG. 26 is a block diagram showing the detail of the partial tone phase designation signal generator of the modified musical tone signal generator shown in FIG. 22.

The partial tone phase designation signal generator 60B is constructed as shown by the block diagram shown in FIG. 26 in which a register 610 takes in the accumulated value qF outputted from the accumulator 50 (FIG. 22) according to a load signal LD1 (see (g) of FIGS. 25A to 25F) produced by the timing pulse generator 40B at the commencement of a calculating cycle Tcy, holds the taken in accumulated value during one calculating cycle Tcy and then supplies the accumulated value thus held to an accumulator 612. After taking in the accumulated value qF outputted from the register 610 according to a delayed load signal LD1' outputted from the register 610 (at this time, the content of the accumulator 612 has been cleared) the accumulator 612 sequentially accumulates the accumulated value qF each time an accumulatin designation signal AC0 (see (O) of FIGS. 25A to 25E and (l) of FIG. 25F) is generated by the timing pulse generator 40B and sends out the accumulated value nqF (n=1, 2, 3, . . . 8) as partial tone phase designation signals 1qF, 2qF, 3qF . . . 8qF for calculating first to eighth partial tone components H1 to H8.

In response to a signal LD2' which is obtained by delaying with a delay circuit 615 a load signal LD2 (see (h) of FIGS. 25A to 25E) produced by the timing pulse generator 40B at the commencement of respective calculating frames CF1 to Cf4 by a time slightly shorter than one period 1/fCA of the clock pulse $\phi$A, a shift register 614 takes in the accumulated value qF outputted from the accumulator 506 (FIG. 22), and then shifts by one bit the accumulated value qF toward the upper orders each time a shift signal SFT (see (s) of FIGS. 25A to 25E) is generated by the timing pulse generator 40B to produce signal $2^m$·qF (m represents the number of times of generating signal SFT) having a value $2^m$ times of the accumulated value qF. A register 616 takes in the signal $2^m$·qF outputted from the shift register 614 at the time of building-up of the load signal LD2 to hold this signal $2^m$·qF until the next load signal LD2 is generated and then supplies the signal $2^m$·qF thus held to a selector 617. The timing of taking the signal $2^m$·qF into the register 616 is slightly earlier than the timing of taking the accumulated value qF into the shift register 614 by the delayed time produced by the delay circuit 615 so that the signal $2^m$·qF outputted from the shift register 616 during the second calculating frame CF2, for example, becomes equal to $2^m$ times the accumulated value qF taken into the shift register 614 during the preceding first calculating frame CF1. In other words the register 616 produces $2^m$·qF, the accumulated value qF with a $2^m$ times, delayed by one calculating frame time than the variation of the accumulated value qF produced by the accumulator 50 (FIG. 22).

The selector 617 selects either one of the signal $2^m$ qF from the register 616 and the accumulated value qF outputted from the accumulator 50 according to the selection signal SL (see (i) of FIGS. 25A to 25F) outputted from the timing pulse generator 40B and sends the selected signal to the WF.SFM(1)71 to WF.SFM(4)74 (FIG. 22) as the partial tone phase designation signal $2^m$·qF. As shown by (i) of FIGS. 25A and 25F, the selection signal SL becomes "1" at a time when a plurality of partial tone components are simultaneously calculated by using the 10th, 12th, 14th and 16th partial tone components H10, H12, H14 and H16 as respective center orders, whereby the selector 617 produces the accumulated value qF as the partial tone phase designation signal $2^m$·qF. Thus, the selector 617 selects the accumulated value qF and outputs the signal $2^m$·qF, m=0.

Turning back to FIG. 22, the sinusoid table 70 is storing, in its respective addresses, respective sampling point amplitude values over one period of a sine waveform and enabled to read out upon receiving an enabling signal EN1 of "1" from the timing pulse generator 40B, thus producing a sine amplitude value sin $\pi/\kappa$ nqF for a partial tone phase designation signal nqF when supplied with the partial tone phase designation signal nqF from the partial tone phase designation signal generator 60B as an address signal.

The WF.SFM(1)71 to WF.SFM(4)74 respectively comprise memory elements of the same storing capacity and store in their respective addresses respective sampling point amplitude values having waveforms Wf10, Wf12, Wf14 and Wf16 as shown in FIGS. 17*a* through 17*d*. When supplied with an enable signal of "1" from the timing pulse generator 40B, the WF.SFM(1)71 is enabled thereby producing an amplitude value W·sin 10 ($\pi/\kappa\cdot 2^m$·qF) of the waveform Wf10 corresponding to the signal $2^m$·qF when signal $2^m$·qF (m=0, 1, 2, 3) is applied as an address signal, in which W represents the Hanning Window function.

When supplied with an enable signal EN3 from the timing pulse generator 40B, the WF.SFM(2) 72 is enabled to read out so as to produce an amplitude value W·sin 12($\pi/\kappa\cdot 2^m$·qF) of a waveform Wf12 corresponding to the signal $2^m$·qF when the signal $2^m$·qF (m=0, 1, 2, 3) is applied from the partial tone phase designation generator 60B as an address signal.

When supplied with an enable signal EN4 of "1" from the timing pulse generator 40B, the WF.SFM(3)73 is enabled to read out so as to produce an amplitude value W·sin 14($\pi/\kappa\cdot 2^m$·qF) of a waveform corresponding to the signal $2^m$·qF when the signal $2^m$·qF (m=0, 1, 2, 3) is applied from the partial tone phase designation generator 60B as an address signal.

When supplied with an enable signal EN5 of "1" from the timing pulse generator 40B, the WF.SFM(4)74 is enabled to read out so as to produce an amplitude value W·sin 16($\pi/\kappa\cdot 2^m$·qF) of a waveform Wf16 corresponding to the signal $2^m$·qF when supplied wth the signal $2^m$·qF(m=0, 1, 2, 3) from the partial tone phase designation signal generator 60B.

The enable signals EN1 to EN5 applied to these sinusoid table 70 and WF·SFM(1)71 to WF·SFM(4)74 are produced from the timing pulse generator 40B at the timings that satisfy the aforementioned Tables XVa to XVd [see (j) to (n) of FIGS. 25A to 25E, and (j) and (k) of FIG. 25F]. Thus, for example, when calculating the 8th partial tone component H8 in a given calculating channel, only the enable signal EN1 becomes "1".

A harmonic coefficient generator 90B produces coefficient information for the partial tone components calculted in respective calculating channels CH0 to CH7 and corresponding to a tone color setting information Ts produced by a tone color setter 80, in synchronism with the calculating timings of respective partial tone components. At this time, since the order numbers of the partial tone components calculated in respective calculating channels are different dependent upon the fundamental frequency f of the generated muscial tone signal, the time band in one period of the generated musical tone signal, and the calculation frame number, the frequency number F, the accumulated value qF and the calculation cycle signal SNC applied to the harmonic coefficient generator 90B such that a harmonic coefficient Cn commensulate with such variation can be produced.

Figure 27:
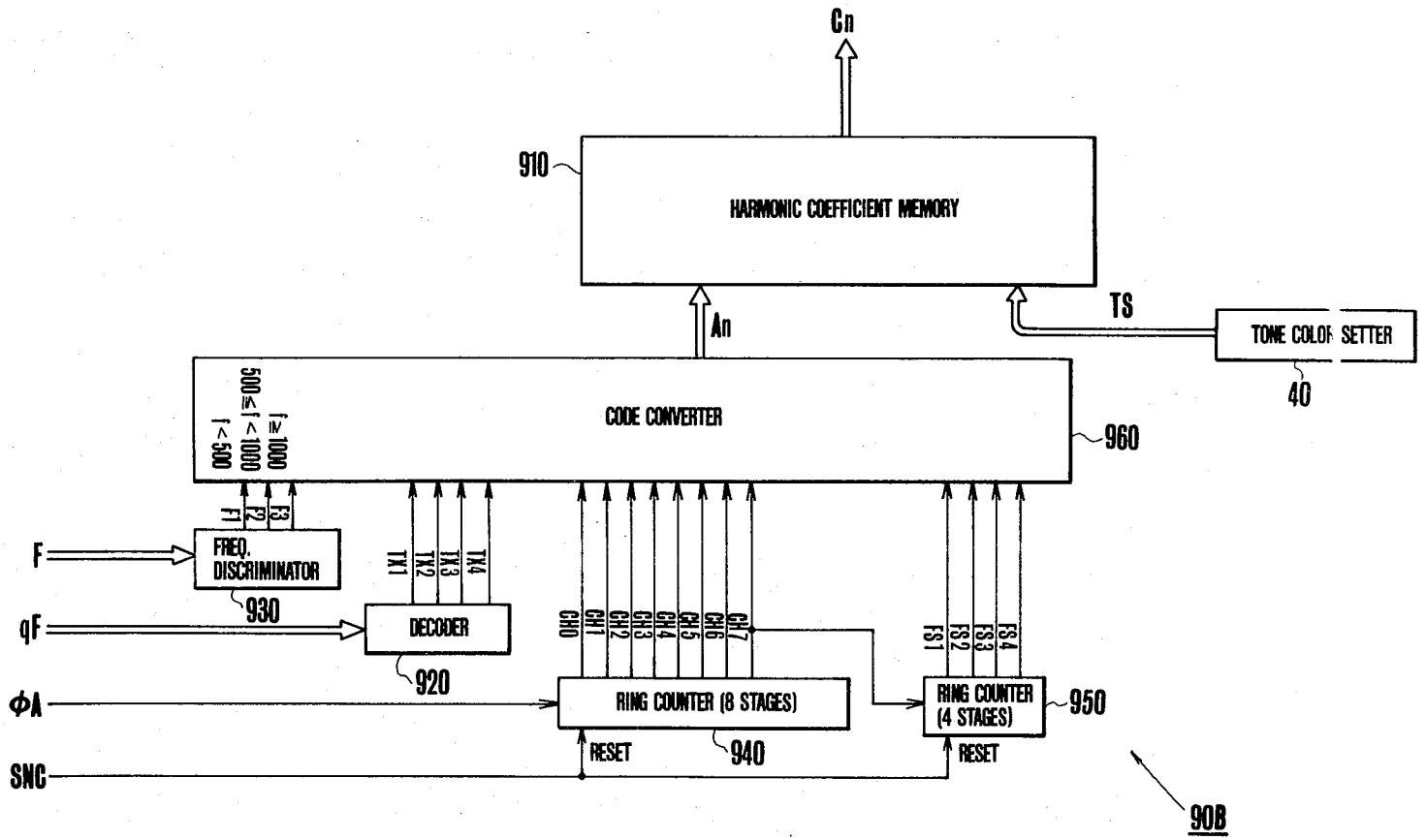
FIG. 27 is a block diagram showing the detail of the harmonic coefficient memory of the musical tone signal generator shown in FIG. 22.

The harmonic coefficient generator 90B is designed on the same consideration as the harmonic coefficient generator 90 shown in FIG. 10, and the detail thereof is shown in FIG. 27.

A harmonic coefficient memory device 910 shown in FIG. 27 is provided with a plurality of memory blocks corresponding to the types of the tone color setting information Ts. In respective memory addresses of these memory blocks are stored harmonic coefficient informations Cn (C1 to C8, C12 to C128) corresponding to the tone color setting informations TS and to the partial tone components H1 to H8, H10, H12, H14, H16, H20, H28, H32, H40,H48, H56, H64, H80, H96, H112 and H128, and a coefficient information Cn stored in a memory address designated by an address signal An regarding to a partial tone component Hn to be calculated is applied from a code converter 960 (to be described later) each time the address signal An is applied in each calculating channel time.

A decoder 920, a frequency discriminator 930 and ring counters 940 and 950 have identical functions as the decoder 410, the frequency descriminator 411, and the ring counters 412 and 401 of the timing pulse generator 40B shown in FIG. 23 and respectively output signals TX1 to TX4, F1 to F3, CH0 to CH7, FS1 to Fs4 which are applied to the code converter 960.

Based on various signals produced by the decoder 920, the frequency discriminator 930 and the ring counters 940 and 950, the code converter 960 produces an address signal An for reading out from the memory device 910 a harmonic coefficient information Cn for various partial tone components presently to be calculated. As before, the code converter 960 can be constituted by an ROM.

Turning back again to FIG. 22, a multiplier 120 is provided to multiply either one of the sine amplitude value sin $\pi/\kappa \cdot nqF$ outputted from the sinusoid table 70 and the amplitude values W·sin $10(\pi/\kappa \cdot 2^m \cdot qF)$ to W·sin $16(\pi/\kappa \cdot 2^m \cdot qF)$ outputted from WF.SFM(1)71 to SFM(4)74 in response to a corresponding amplitude information ENV.Cn outputted from the multiplier 110 and imparted with an envelope in respective times of the calculating channels CH0 to CH7 to produce either one of the following products as an instantaneous amplitude value Fn of the nth partial tone components Hn of the generated musical tone signal (a) ENV·Cn·[sin $\pi/\kappa \cdot nqF$]
(b) ENV·Cn·[W·sin $10(\pi/\kappa \cdot 2^m \cdot qF)$]
(c) ENV·Cn·[W·sin $12(\pi/\kappa \cdot 2^m \cdot qF)$]
(d) ENV·Cn·[W·sin $14(\pi/\kappa \cdot 2^m \cdot qF)$]
(e) ENV·Cn·[W·sin $16(\pi/\kappa \cdot 2^m \cdot qF)$]

An accumulator-A 131, an accumulator-B 132 and an accumulator-C 133 have the same functions as those shown in FIG. 5 and produce synthesized amplitude values ΣFn(A), ΣFn(B), and ΣFn(C) regarding partial tone components Hn having different calculating periods 1/10 KHz, 1/20 KHz and 1/40 KHz.

An A latch circuit 137, a B latch circuit 138 and a C latch circuit 139 take in the output signals ΣFn(A), ΣFn(B) and ΣFn(C) of the accumulators 131, 132 and 133 at the timing of the generation of load pulses LD-A, LD-B and LD-C respectively and then produce these taken in signals as synthesized amplitude values ΣFn(A'), ΣFn(B') and ΣFn(C'). Digital to analogue converters 144, 145 and 146 respectively convert output signals ΣFn (A)', ΣFn(B)' and ΣFn(C)' of latch-A 137, latch-B 138 and latch-C 139 into corresponding analogue signals MW(A), MW(B) and MW(C) which are respectively applied to low pass filters 147, 148 and 149 respectively having cutoff frequencies of 4 KHz, 8 KHz and 16 KHz for eliminating the images contained in the output signals MW(A), MW(B) and MW(C) of the digital to analogue converters 144, 145 and 146 to produce signals MW(A)', MW(B)' and MW(C)'. These signals MW(A)', MW(B)' and MW(C)' are synthesized by an adder 150 to produce a signal MW. The signal MW is sent to a sound system 152 to produce a musical tone.

Operation

The musical tone generator shown in FIG. 22 operates as follows. In this modification, the types (orders n of the partial tones) of the partial tone components Hn to be calculated in respective calculating channels CH0 to CH7 differ dependent upon the fundamental frequency f of the generated musical tone signal and the time band in one period thereof. Accordingly, the operation will be described according to the following order: (a1) the operation in which the fundamental frequency f is lower than 500 Hz and the time band in one period of the musical tone signal is expressed by a relation $[0 \leqq Tx < (\frac{1}{2})T]$, (a2) the operation in which the fundamental frequency f is lower than 500 Hz and the time band is expressed by a relation $[(\frac{1}{2})\,T \leqq Tx < (\frac{3}{4})\,T]$, (a3) the operation in which the fundamental frequency f is lower than 500 Hz and the time band is expressed by a relation $[(\frac{3}{4})\,T \leqq Tx < (\frac{7}{8})\,T]$, (a4) the operation in which the fundamental frequency f is lower than 500 Hz and the time band is expressed by a relation $[(\frac{7}{8})\,T \leqq Tx < T]$, (b) the operation in which the fundamental frequency f is expressed by a relation $[500 \leqq f < 1000$ Hz] and (c) the operation wherein the fundamental frequency f is higher than 1000 Hz.

(a1) the operation where f<500 Hz and time band is expressed by a relation $[0 \leqq Tx < (\frac{1}{2})\,T]$

First calculating frame CF1

During the first calculating frame CF1, the partial tone components H1, H2, H10, H12, H20, H24, H28 and H32 as shown in the Table XVa are calculated. For this reason, the timing pulse generator 40B produces various control signals necessary to calculate aforementioned partial tone components H1, H2 . . . H32.

More particularly, the timing pulse generator 40B produces load signals LD1 and LD2 as shown in (g) and (h) of FIG. 25A, at the commencement (the time of the calculating channel CH0) of the first calculating frame. Then, at the time of building-up of the load signal LD1, the accumulated value qoF outputted from the accumulator 50 is taken into the register 610 (FIG. 26) in the partial tone phase designation signal generator 60B. After being delayed slightly, the accumulated value qoF thus taken into the register 610 is received by the accumulator 612 (FIG. 26) whereby during the channel time of the calculating channel CH0 an accumulated value signal 1 qoF of n=1 would be outputted from the accumulator 612 as the partial tone phase designation signal nqF.

On the other hand, at the time of building-up of the load signal LD2 outputted from the timing pulse generator 40B, the output signal $2^m$·qF of the shift register 614 in the partial tone phase designation signal generator 60B is taken into the register 616, while the accumulated value qoF outputted from the accumulator 50 slightly later is taken ito the shift register 614.

In this case, the output signal $2^m$·qF of the shift register 614 has already been processed in the preceding calculating frame, that is during the fourth calculating frame CF4 of the previous calculating cycle Tcy. More particularly, during the previous fourth calculating frame CF4, the timing pulse generator 40B generates various control signals just in the same manner as in the fourth calculating frame CF4 in which the accumulated value qF changes to (qo+3)F as shown in FIG. 25A, and the load signal LD2 which became "1" during the channel time of the calculating channel CH0 of the fourth calculating frame CF4 causes the shift register 614 to take in the accumulated value (qo−1)F being outputted from the accumulator 50 at that time. Further, the shift signal SFT which became "1" during the channel time of the calculating channel CH2 causes the content (qo−1)F of the shift register 614 to shift by one bit toward the upper order. Consequently, the output signal $2^m$·qF of the shift register 614 taken into the shift register 614 during the channel time of the calculating channel CH0 of the first calculating frame CF1 is a signal $2^1$·(qo−1)F, i.e., 2·(qo−1)F.

The signal 2·(qo−1)F taken into the register 616 is suplied to selector 617. During the channel time of the calculating channel CH0, the selection signal SL outputted from the timing pulse generator 40B is "0" as shown by (i) of FIG. 25A. Accordingly, the selector 617 selects signal 2·(qo−1)F out of input signals qoF and 2·(qo−1)F and produce it as a partial tone phase designation signal 2·(qo−1)F.

As above described, the partial tone phase designation signals 1·qoF and 2·(qo−1)F outputted from the partial tone phase designation signal generator 60B are respectively applied to the sinusoid table 70 and WF.SFM(1)71 to WF.SFM(4)74 as address signals.

However, during the channel time of the calculating channel CH0, among enable signals EN1 to EN5 outputted from the timing pulse generator 40B, only the signal EN1 is "1" as shown by (j) to (n) of FIG. 25A. For this reason, only the sinusoid table 70 is enabled to read out so that the sinusoid table 70 produces a sine amplitude value sin [$\pi/\kappa$·1·qoF] corresponding to the signal 1·qoF. In other words, the sine amplitude value sin [$\pi/\kappa$·1·qoF] regarding the first partial tone component H1 would be produced.

This sine amplitude value sin [$\pi/\kappa$·1·qoF] regarding the first partial tone component H1 is applied to the multiplier 120 where it is multiplied with an amplitude information ENV·C1 produced by the multiplier 110 and corresponding to the first partial tone component H1 to set the amplitude. This output signal ENV·C1·sin [$\pi/\kappa$·1·qoF] is taken into the accumulator-A 131 according to the accumulation designation signal AC1 (see (p) of FIG. 25A) to act as an instantaneous amplitude value F1.

As above described, during the channel time of the calculating channel CH0 of the first calculating frame CF1, the instantaneous value F1 of the first partial tone component H1 is calculated as shown in (f) of FIG. 25A.

During the channel time of the calculating channel CH1, as can be noted from the timing chart shown in FIG. 25A, among various control signals produced by the timing pulse generator 40B, selection signal SL is still maitained at "0" so that the enable signal EN2 and the accumulation designation signal AC3 become "1".

Accordingly, the partial tone phase designation signal generator 60B continues to produce the partial tone phase designation signals 1·qoF and 2·(qo−1)F. However, since only the enable signal EN2 becomes 1, now only the WF.SFM(1)71 is enabled to read out with the result that the WF.SFM(1)71 produces a waveform amplitude value W·sin 10[$\pi/\kappa$·2·(qo−1)F] corresponding to the signal 2·(qo−1)F. In other words, the waveform amplitude value W·sin 10[$\pi/\kappa$·2·(qo−1)F] regarding the 20th partial tone component H20 is produced. This waveform amplitude value W·sin 10[$\pi/\kappa$·2·(qo−1)F] regarding the 20th partial tone component H20 is applied to the multiplier 120 where it is multiplied with the amplitude information ENV C20 corresponding to the 20th partial tone component H20 which is produced by the multiplier 110 at the same time thus setting the amplitude. The output signal ENV·C20·W·sin 10[$\pi/\kappa$·2·(qo−1)F] of the multiplier 120 is applied to the accumulator-C 133 under the designation of the accumulation designation signal AC3 (FIG. 25 (r)) to act as the instantaneous amplitude value F20 regarding the 20th partial tone component H20.

In this manner, during the channel time of the calculating channel CH1 of the first calculating frame CF1, the instantaneous amplitude value F20 of the 20th partial tone component H20 is calculated (see (f) of FIG. 25A).

Then, during the channel time of the calculating channel CH2, as can be noted from the timing chart that shown in FIG. 25A, the selection signal SL becomes "1" and the enable signal maintains its "1" state, and the shift signal SFT and the accumulation designation signal AC2 become "1".

As a consequence, the partial tone phase designation generator 60B cotinues to produce the partial tone phase designation signal 1 qoF and selects and outputs the accumulated value qoF·($2^0$·qoF) produced by the accumulator 50 via a selector 617 whereby the WF.SFM(1)71 produces a waveform amplitude value W·sin 10[$\pi/\kappa$·qoF] corresponding to the signal qoF. In other words, the waveform amplitude value W·sin 10[$\pi/\kappa$·qoF regarding the 10th partial tone component H10 is produced.

This waveform amplitude value W·sin 10[$\pi/\kappa$·qoF] regarding the 10th partial tone component H10 is supplied to the multiplier 120 where it is multiplied with the amplitude information ENV C10 corresponding to the 10th partial tone component H10 to set the amplitude. The output signal ENV·C10·W·sin 10[$\pi/\kappa$·qoF] is applied to the accumulator-B 132 under the designation of the accumulation designation signal AC2 (see FIG. 25 (g)) to act as an instantaneous amplitude value F10.

At this time, the shift signal SFT becomes "1" (see FIG. 25 (p)) so that at the time of building-up of this shift signal SFT, the bits of the accumulated value qoF held in the shift register 614 (FIG. 26) of the partial tone phase designation generator 60 are shifted one bits toward the upper order, with the result that the output signal $2^m$·qF of the shift register 614 becomes $2^1$·qoF which is used in the next second calculating frame CF2.

As above described, during the channel time of the calculating channel CH2 of the first calculating frame CF1 the instantaneous amplitude value F10 of the 10th partial tone component H10 is calculated (see (g) of FIG. 25A).

Then, during the channel time of the calculating channel CH3, as can be clearly noted from the time chart shown in FIG. 25A, the selection signal SL becomes "0", whereas the enable signal EN3 and the accumulation designation signal AC3 become "1".

As a consequence, the partial tone phase designation signal generator 60B not only continues to produce the partial tone phase designation signal 1·qoF but also to produce signal 2·(qo−1)F. Moreover, as only the enable signal EN3 becomes "1", only the WF.SMF(2)72 is enabled to read out, whereby it produces a waveform amplitude value W·sin 12[$\pi/\kappa$·2·(qo−1)F] corresponding to signal 2·(qo−1)F. Thus, the waveform amplitude value W·sin 12[$\pi/\kappa$·2·(qo−1)F] regarding the 24th partial tone component H24 is produced and applied to the multiplier 120 where it is multiplied with an amplitude information ENV C24 simultaneously outputted from the multiplier 110 and corresponding to the 24th partial tone component H24 to set an amplitude. The output ENV·C24·W·sin 12[$\pi/\kappa$·2·(qo−1)F] is stored in the accumulator-C 133 as the instantaneous amplitude value F24 regarding the 24th partial tone component H24 under the designation of the accumulation designation signal AC3.

Accordingly content of the accumulator-C 133 is equal to the sum of the instantaneous amplitude value F20 regarding the 20th partial tone component H20 and the instantaneous value F24 regarding the 24th partial tone component H24.

As above described, during the calculating time of the calculating channel CH3 of the first calculating frame CF1 the instantaneous amplitude value F24 of the 24th partial tone component H24 is calculated (see (f) of FIG. 25A).

During the channel time of the calculating channel CH4, as can be clearly noted from the timing chart shown in FIG. 25A, the selection signal SL is continuously maintained at "0" state and the enable signal EN1 becomes "1" instead of the enable signal EN3 while at the same time the accumulation designation signals AC0 and AC1 become "1".

As the accumulation designation signal AC0 (see (o) of FIG. 25A) becomes "1", the output signal 1·qF of the shift register 610 is added to the present value 1·qF of the accumulator 612 of the partial tone phase designation generator 60B, with the result that the partial tone phase designation signal nqF outputted from the accumulator 612 would change to 2·qoF. On the other hand, since the selection signal SL is "0", the selector 617 selects and outputs the signal 2·(qo−1)F outputted from the register 616.

At this time, only the enable signal EN1 is "1" so that only the sinusoid table 70 is enabled to read out a sine function amplitude value sin ($\pi/\kappa$·2·qoF) corresponding to the partial tone phase designation signal 2·qoF. Thus, the sine wave amplitude value sin ($\pi/\kappa$·2·qoF) regarding the second partial tone component H2 is produced.

This sine amplitude value sin ($\pi/\kappa$·2·qoF) regarding the second partial tone component H2 is multiplied by the multiplier 120 with an amplitude information ENV.C2 concurrently outputted from the multiplier 110 and regarding the second partial tone component H2. The output signal ENV·C2·sin [$\pi/\kappa$·2·qoF] of the multiplier 120 is stored in the accumulator-A 131 as the instantaneous amplitude value F2 regarding the second partial tone component H2 under the designation of the accumulation designation signal AC1.

Consequently, the content of the accumulator 131 becomes equal to the sum (F1+F2) of the instantaneous amplitude value F1 regarding the first partial tone component H1 and the instantaneous value F2 regarding the second partial tone component H2.

In this manner, during the channel time of the calculating channel CH4 of the first calculating channel CF1, the instantaneous amplitude value F2 of the second partial tone component H2 is calculated (see (f) of FIG. 25A).

Then, during the channel time of the calculating channel CH5, as can be noted from the timing chart shown in FIG. 25A, the selection signal SL is still maintained at "0", whereby the enable signal EN4 and the accumulation designation signal AC3 become "1".

For this reason, the partial tone phase designation signal generator 60B continues to generate the partial tone phase designation signal 2·qoF and signal 2·(qo−1)F. However, since at this time the enable signal EN4 becomes "1", the WF·SIM(3)73 alone is enabled to read out the sine wave amplitude value W·sin 14[$\pi/\kappa$·2·(qo−1)F] corresponding to the partial tone phase designation signal 2·(qo−1)F. In other words, the waveform amplitude value W·sin 14[$\pi/\kappa$·2·(qo−L)F] regarding the 28th partial tone component H28 is obtained.

This waveform amplitude value sin 14[$\pi/\kappa$·2·(qo−1)F] regarding the 28th partial tone component H28 is multiplied in the multiplier 120 with the amplitude information ENV.C28 regarding the 28th partial tone component H28 and concurrently produced by the multiplier 120 to set the amplitude. The output signal ENV·C28·W·sin 14[$\pi/\kappa$·2·(qo−1)F] of the multiplier 120 is stored in the accumulator −C 133 as the instantaneous amplitude value F28 regarding the 28th partial tone component H28 under the designation of the accumulation designation signal AC3.

Consequently, the cotent of the accumulator-C 133 becomes equal to the sum (F2+F24+F28) of the instantaneous value F20 regarding the 20th partial tone component H20, the instantaneous amplitude value F24 regarding the 24th partial tone component H24 and the instantaneous amplitude value F28 regarding the 28th partial tone component H28.

As above described, during the channel time of the calculating channel CH5 of the first calculating frame CF1 the instantaneous amplitude value F28 of the 28th partial tone component H28 is calculated (see (f) of FIG. 25A).

Then, during the channel time of the calculating channel CH6, as can be noted from the timing chart shown in FIG. 25A, the selection signal SL becomes "1" and the enable signal EN3 and the accumulation designation signal AC2 also become "1".

Consequently, the partial tone phase designation signal generator 60B produces the partial tone phase designation signals 2·qoF and qoF with the result that WF·SFM(2)72 produces the waveform amplitude value W·sin 12[$\pi/\kappa$·qoF] corresponding to the partial tone phase designation signal qoF, i.e., the waveform amplitude value W·sin 12[$\pi/\kappa$·qoF] regarding the 12th partial tone component H12.

This waveform amplitude value W·sin 12[$\pi/\kappa$·qoF] regarding the 12th partial tone component H12 is multiplied in the multiplier 120 with the amplitude information ENV C12 concurrently produced from the multiplier 110 and regarding the 12th partial tone component H12 to set the amplitude. The output ENV·C12·W·sin 12[$\pi/\kappa$·qoF) of the multiplier 120 is stored in the accumulator-B 132 as the instantaneous amplitude value F12 regarding the 12th partial tone component H12 under the designation of the accumulation designation signal AC2.

Consequently, the content of the accumulator-B 132 becomes equal to the sum (F10+F12) of the instantaneous amplitude value F10 regarding the 10th partial tone component H10 and the instantaneous amplitude value F12 regarding the 10th partial tone component H12.

In this manner, during the channel time of the calculating channel of the first calculating frame CF1, the instantaneous amplitude value F12 regarding the 12th partial tone component H12 is calculated (see (f) of FIG. 25A).

As can be noted from the timing charge shown in FIG. 25A, during the channel time of the calculating channel CH7 the selection signal SL becomes "0", whereas the enable signal EN5 and the accumulation signal AC3 become "1" respectively.

Accordingly, the partial tone phase designation signal generator 60B produces partial tone phase designation signals 2·qoF and 2·(qo−1)F, whereby the WF·SFM(4)74 produces a waveform amplitude value W·sin 16[$\pi/\kappa$2(qo−1)F] corresponding to the partial tone phase designation signal 2·(qo−1)F, in other words, a waveform amplitude value W·sin 16[$\pi/\kappa$·2(-qo−1)F] regarding the 32th partial tone component H32. This waveform amplitude value W·sin 16[$\pi/\kappa$·2(-qo−1)F] is multiplied in the multiplier 120 with an amplitude information concurrently produced by the multiplier 110 and corresponding to the 32th partial tone component H32. The output ENV·C32·W·sin 16[$\pi/\kappa$·2(qo−1)F] of the multiplier 120 is stored in the C accumulator 133 as an instantaneous amplitude value F32 regarding the 32th partial tone component H32 according to an accumulation designation signal AC3.

Consequently, the content of the accumulator-C 133 becomes the sum (F20+F24+F28+F32) of the instantaneous values F20, F24, F28 and F32 respectively regarding the 20th partial tone component H20, the 24th partial tone component H24 the 28th partial tone component H28 and the 32th partial tone component H32. In this manner, during the channel time of the calculating channel of the first calculating frame CF1, the instantaneous amplitude value F32 of the 32th partial tone component H32 is calculate d (see (f) of FIG. 25A).

As above described, during the first calculating frame CF1, the instantaneous amplitude values F1, F2, F10, F12, F20, F24, F32 of the partial tone components H1, H2, H10 H12, H20, H24, H28 and H32 are calculated.

The second calculating frame CF2

As shown in Table 15*a*, during the second calculating frame, the instantaneous amplitude values of the partial tone components H3, H4, H14, H16, H20, H24, H28 and H32 are calculated.

In the second calculating frame CF2, at the time of building-up of the clock pulse $\phi$B generated at the start of this frame, the contents of the accumulator-A 131, the accumulator-B 132 and the accumulator-C 133, are the sums ΣFn(A)(=F1+F2), ΣFn(B) (=F10+F12) and ΣFn(C) (=F20+F24+F28+F32) for respective calculation periods of the instantaneous amplitude values of respective partial tone components calculated in the preceding first calculating frame CF1. Only the content ΣFn(C) of the accumulator-C 133 is stored in a latch circuit-C. Slightly later, the content ΣFn(C) of the accumulator-C 133 is cleared by a reset pulse RS-C produced by delay differentiating circuit.

The signal ΣFn(C) stored in the latch circuit-C 139 are converted into analogue signal MW(C) by digital to analogue converter 146 and then, through 149, synthesized into a musical tone signal MW by the adder 150. The musical tone signal MW is applied to a sound system 150.

At the time of building-up of a load signal LD2 (see (h) of FIG. 25A) produced by the timing pulse generator 40B at the same time as the production of the clock pulse $\phi$B, the output signal $2^m$·qF of the shift register 614 of the partial tone phase designation signal generator 60B is applied to a register 616. The output signal $2^m$·qF of the shift register 614 becomes 2·qoF in the provious first calculating frame CF1. For this reason, the register 616 stores signal 2·qoF under the control of the load signal LD2 and this signal 2·qoF is supplied to a selector 617.

At the time when the clock pulse $\phi$B builds-up, the accumulated value qF outputted from the accumulator 50 (FIG. 22) changes to (qo+1)F from qoF. This new accumulated value (qo+1)F is stored in the shift register 614 according to the load signal LD2.

During the channel time of the calculating channel corresponding to the commencement of the second calculating frame CF2, the timing pulse generator 40B produces as accumulation designation signal AC0 ((o) of FIG. 25A). Consequently, the accumulator 612 of the partial tone phase designation signal generator 60B adds the accumulated value "2·qoF" up to that time to the output signal "1·qoF" of the register 610 to produce "3·qoF" as a new partial tone phase designation signal nqF.

Consequently, during a channel timne of the calculating channel CH0 corresponding to the commencement of the second calculating frame CF2, the output signal nqF of the accumulator 612 of the partial tone phase designation signal generator 60B represents "3 qoF", the output signal $2^m$·qF of the register 616 represents 2·qoF and the output signal $2^m$·qF of the shift register 614 represents (qo+1)F. The accumulated value qF produced by the accumulator 50 (FIG. 22) represents (qo+1)F.

As a consequence, in the second calculating frame CF2, respective partial tone components are calculated based on these signals 3·qoF, 2·qoF and (qo+1)F [$=2^{o}\cdot(qo+1)F$]. the calculation of the partial tone components in the channel times of respective calculating channels CH0 to CH7 in the second calculating frame CF2 is made in the same manner as in the first calculating frame CF1 so that its outline is shown in the following Table XVII and will not be described in detail.

TABLE XVII

2ND CALCULATING FRAME CF2

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H3 | (qo + 1)F | LD2, EN1 AC0, AC1 | (qo + 1)F | 3 · qoF | 2 · qoF | $ENV \cdot C3 \cdot \sin\left[\frac{\pi}{k} \cdot 3 \cdot qoF\right] = F3$ | F1 + F2 + F3 | F10 + F12 | 0 |
| CH1 | H20 | (qo + 1)F | EN2 AC3 | (qo + 1)F | 3 · qoF | 2 · qoF | $ENV \cdot C20 \cdot W \cdot \sin 10\left[\frac{\pi}{k} \cdot 2 \cdot qoF\right] = F20$ | F1 + F2 + F3 | F10 + F12 | F20 |
| CH2 | H14 | (qo + 1)F | SL, EN4 AC2, SFT | 2 · (qo + 1)F | 3 · qoF | (qo + 1)F | $ENV \cdot C14 \cdot W \cdot \sin 14\left[\frac{\pi}{k} \cdot (qo + 1)F\right] = F14$ | F1 + F2 + F3 | F10 + F12 + F14 | F20 |
| CH3 | H24 | (qo + 1)F | EN3 AC3 | 2 · (qo + 1)F | 3 · qoF | 2 · qoF | $ENV \cdot C24 \cdot W \cdot \sin 12\left[\frac{\pi}{k} \cdot 2 \cdot qoF\right] = F24$ | F1 + F2 + F3 | F10 + F12 + F14 | F20 + F24 |
| CH4 | H4 | (qo + 1)F | EN1, AC0 AC1 | 2 · (qo + 1)F | 4 · qoF | 2 · qoF | $ENV \cdot C4 \cdot \sin\left[\frac{\pi}{k} \cdot 4 \cdot qoF\right] = F4$ | F1 + F2 + F3 + F4 | F10 + F12 + F14 | F20 + F24 |
| CH5 | H28 | (qo + 1)F | EN4 AC3 | 2 · (qo + 1)F | 4 · qoF | 2 · qoF | $ENV \cdot C28 \cdot W \cdot \sin 14\left[\frac{\pi}{k} \cdot 2 \cdot qoF\right] = F28$ | F1 + F2 + F3 + F4 | F10 + F12 + F14 | F20 + F24 + F28 |
| CH6 | H16 | (qo + 1)F | SL, EN5 AC2 | 2 · (qo + 1)F | 4 · qoF | (qo + 1)F | $ENV \cdot C16 \cdot W \cdot \sin 16\left[\frac{\pi}{k} \cdot (qo + 1)F\right] = F16$ | F1 + F2 + F3 + F4 | F10 + F12 + F14 + F16 | F20 + F24 + F28 |
| CH7 | H32 | (qo + 1)F | EN5 AC3 | 2 · (qo + 1)F | 4 · qoF | 2 · qoF | $ENV \cdot C32 \cdot W \cdot \sin 16\left[\frac{\pi}{k} \cdot 2 \cdot qoF\right] = F32$ | F1 + F2 + F3 + F4 | F10 + F12 + F14 + F16 | F20 + F24 + F28 + F32 |

The third calculating frame CF3 and the fourth calculating frame CF4

In the same manner as the first and second calculating frames CF1 and CF2, in the third and fourth calculating frames CF3 and CF4 too, the predetermined partial tone components shown in Table XVa are calculated in the channel times of respective calculating channels CH0 to CH7. Accordingly, the outlines of the operations in the channel times of respective calculating channels CH0 to CH7 in the third and fourth calculating frames CF3 and CF4 are shown in the following Tables XVIII and XIX without describing it in detail.

TABLE XVIII

3RD CALCULATING FRAME CF3

| Calculating channel | Calculated partial tone component Hn | Output qF of accumulator 50 | Control signals which become "1" among output signals of the timing pulse generator 40B | Content of circuit 60B: Output 2m · qF of shift register 614 | Output signals: nqF | Output signals: $2^m \cdot qF$ | Output of multiplier 120 | Contents of accumulators 131 to 133: ΣFn (A) | ΣFn (B) | ΣFn (C) |
|---|---|---|---|---|---|---|---|---|---|---|
| CH0 | H5 | (qo + 2)F | LD2, EN1 AC0, AC1 | (qo + 2)F | 5 · qoF | 2 · (qo + 1)F | $ENV \cdot C5 \cdot \sin\left[\frac{\pi}{k} \cdot 5 \cdot qoF\right] = F5$ | F1 + F2 + F3 + F4 + F5 | 0 | 0 |
| CH1 | H20 | (qo + 2)F | EN2 AC3 | (qo + 2)F | 5 · qoF | 2 · (qo + 1)F | $ENV \cdot C20 \cdot W \cdot \sin 10\left[\frac{\pi}{k} \cdot 2 \cdot (qo + 1)F\right] = F20$ | F1 + F2 + F3 + F4 + F5 | 0 | F20 |
| CH2 | H10 | (qo + 2)F | SL, EN2 AC2, SFT | 2 · (qo + 2)F | 5 · qoF | (qo + 2)F | $ENV \cdot C10 \cdot W \cdot \sin 10\left[\frac{\pi}{k} \cdot (qo + 2)F\right] = F10$ | F1 + F2 + F3 + F4 + F5 | F10 | F20 |
| CH3 | H24 | (qo + 2)F | EN3 AC3 | 2 · (qo + 2)F | 5 · qoF | 2 · (qo + 1)F | $ENV \cdot C24 \cdot W \cdot \sin 12\left[\frac{\pi}{k} \cdot 2 \cdot (qo + 1)F\right] = F24$ | F1 + F2 + F3 + F4 + F5 | F10 | F20 + F24 |
| CH4 | H6 | (qo + 2)F | EN1, AC0 AC1 | 2 · (qo + 2)F | 6 · qoF | 2 · (qo + 1)F | $ENV \cdot C6 \cdot \sin\left[\frac{\pi}{k} \cdot 6 \cdot qoF\right] = F6$ | F1 + F2 + F3 + F4 + F5 + F6 | F10 | F20 + F24 |
| CH5 | H28 | (qo + 2)F | EN4 AC3 | 2 · (qo + 2)F | 6 · qoF | 2 · (qo + 1)F | $ENV \cdot C28 \cdot W \cdot \sin 14\left[\frac{\pi}{k} \cdot 2 \cdot (qo + 1)F\right] = F28$ | F1 + F2 + F3 + F4 + F5 + F6 | F10 | F20 + F24 + F28 |
| CH6 | H12 | (qo + 2)F | SL, SN3 AC2 | 2 · (qo + 2)F | 6 · qoF | (qo + 2)F | $ENV \cdot C12 \cdot W \cdot \sin 12\left[\frac{\pi}{k} \cdot (qo + 2)F\right] = F12$ | F1 + F2 + F3 + F4 + F5 + F6 | F10 + F12 | F20 + F24 + F28 |
| CH7 | H32 | (qo + 2)F | EN5 AC3 | | 6 · qoF | 2 · (qo + 1)F | $ENV \cdot C32 \cdot W \cdot \sin 16\left[\frac{\pi}{k} \cdot 2 \cdot (qo + 1)F\right] = F32$ | F1 + F2 + F3 + F4 + F5 + F6 | F10 + F12 | F20 + F24 + F28 + F32 |

TABLE XIX

4TH CALCULATING FRAME CF4

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H7 | (qo + 3)F | LD2, EN1 AC0, AC1 | (qo + 3)F | 7 · qoF | 2 · (qo + 2)F | $ENV \cdot C7 \cdot \sin\left[\frac{\pi}{k} \cdot 7 \cdot qoF\right] = F7$ | F1 + F2 + F3 + F4 + F5 + F6 + F7 | F10 + F12 | 0 |
| CH1 | H20 | (qo + 3)F | EN2 AC3 | (qo + 3)F | 7 · qoF | 2 · (qo + 2)F | $ENV \cdot C20 \cdot W \cdot \sin 10\left[\frac{\pi}{k} \cdot 2 \cdot (qo + 2)F\right] = F20$ | F1 + F2 + F3 + F4 + F5 + F6 + F7 | F10 + F12 | F20 |
| CH2 | H14 | (qo + 3)F | SL, EN4 AC2, SFT | 2 · (qo + 3)F | 7 · qoF | (qo + 3)F | $ENV \cdot C14 \cdot W \cdot \sin 14\left[\frac{\pi}{k} \cdot (qo + 3)F\right] = F14$ | F1 + F2 + F3 + F4 + F5 + F6 + F7 | F10 + F12 + F14 | F20 |
| CH3 | H24 | (qo + 3)F | EN3 AC3 | 2 · (qo + 3)F | 7 · qoF | 2 · (qo + 2)F | $ENV \cdot C24 \cdot W \cdot \sin 12\left[\frac{\pi}{k} \cdot 2 \cdot (qo + 2)F\right] = F24$ | F1 + F2 + F3 + F4 + F5 + F6 + F7 | F10 + F12 + F14 | F20 + F24 |
| CH4 | H8 | (qo + 3)F | EN1, AC0 AC1 | 2 · (qo + 3)F | 8 · qoF | 2 · (qo + 2)F | $ENV \cdot C8 \cdot \sin\left[\frac{\pi}{k} \cdot 8 \cdot qoF\right] = F8$ | F1 + F2 + F3 + F4 + F5 + F6 + F7 + F8 | F10 + F12 + F14 | F20 + F24 |
| CH5 | H28 | (qo + 3)F | EN4 AC3 | 2 · (qo + 3)F | 8 · qoF | 2 · (qo + 2)F | $ENV \cdot C28 \cdot W \cdot \sin 14\left[\frac{\pi}{k} \cdot 2 \cdot (qo + 2)F\right] = F28$ | F1 + F2 + F3 + F4 + F5 + F6 + F7 + F8 | F10 + F12 + F14 | F20 + F24 + F28 |
| CH6 | H16 | (qo + 3)F | SL, EN5 AC2 | 2 · (qo + 3)F | 8 · qoF | (qo + 3)F | $ENV \cdot C16 \cdot W \cdot \sin 16\left[\frac{\pi}{k} \cdot (qo + 3)F\right] = F16$ | F1 + F2 + F3 + F4 + F5 + F6 + F7 + F8 | F10 + F12 + F14 + F16 | F20 + F24 + F28 |
| CH7 | H32 | (qo + 3)F | EN5 AC3 | 2 · (qo + 3)F | 8 · qoF | 2 · (qo + 2)F | $ENV \cdot C32 \cdot W \cdot \sin 16\left[\frac{\pi}{k} \cdot 2 \cdot (qo + 2)F\right] = F32$ | F1 + F2 + F3 + F4 + F5 + F6 + F7 + F8 | F10 + F12 + F14 + F16 | F20 + F24 + F28 + F32 |

When the operations up to the fourth calculating frame CF4 are finished in the manner described above, the calculating cycle Tcy is advanced to the next cycle to execute calculations of respective partial tone components in the first calculating frame CF1.

A predetermined time after, the upper order three bits of the accumulated value qF outputted from the accumulator 50 become "011" and when "100" is produced, the timing pulse generator 40B judges that the time band in the first period of the musical tone signal has become $[T/2 \leqq Tx < (\frac{3}{4})T]$ and produces various control signals shown in FIG. 25B for the purpose of calculating the partial tone components H1 to H8, H10, H12, H14, H16, H40, H48, H56 and H64 shown in Table XVb. Suppose now that when the upper order three bits of the accumulated value qF has changed to "100" the qF is (qo+30)F.

(a2) operation at $f < 500$ Hz and in a time band of $[(\frac{1}{4})T \leqq Tx < (\frac{3}{4})T]$ The operation in this time band differs from that described above in that for the purpose of calculating the 40th partial tone component H40, the 48th partial tone component H48, the 56th partial tone component H56 and the 64th partial tone component H64, a shift signal SFT is applied twice to the shift register 614 (FIG. 26) of the partial tone phase designation signal generator 60B in each of the calculating frames CF1 to CF4.

When the shift signal SFT is applied twice to the shift register 614, the content $2^m \cdot qF$ of the shift register 614 becomes $2^2$ qF which is twice of the accumulated value qF in the previous calculating frame and waveform amplitude values $W \cdot \sin 10[\pi/\kappa \cdot 4 \cdot qF)$, $W \cdot \sin 12[\pi/\kappa \cdot 4 \cdot qF)$, $W \cdot \sin 14(\pi/\kappa \cdot 4 \cdot qF)$ and $W \cdot \sin 16[\pi/\kappa \cdot 4 \cdot qF)$ regarding the partial tone components H40, H48, H56 and H64 can be obtained by using $2^2 \cdot qF(=4 \cdot qF)$ where $m=2$.

The outline of this operation is shown in the following Tables XX through XXIII.

TABLE XX

1ST CALCULATING FRAME CF1

| Calculating channel | Calculated partial tone component Hn | Output qF of accumulator 50 | Control signals which become "1" among output signals of the timing pulse generator 40B | Content of circuit 60B: Output 2m · qF of shift register 614 | Output signals: nqF | Output signals: $2^m \cdot qF$ | Output of multiplier 120 | Contents of accumulators 131 to 133: ΣFn (A) | ΣFn (B) | ΣFn (C) |
|---|---|---|---|---|---|---|---|---|---|---|
| CH0 | H1 | (qo + 30)F | LD1, LD2 EN1, AC1 | (qo + 30)F | (qo + 30)F | 4 · (qo + 29)F | $ENV \cdot C1 \cdot \sin\left\{\frac{\pi}{k} \cdot (qo + 30)F\right\} = F1$ | F1 | 0 | 0 |
| CH1 | H40 | (qo + 30)F | EN2 AC3 | (qo + 30)F | (qo + 30)F | 4 · (qo + 29)F | $ENV \cdot C40 \cdot W \cdot \sin 10\left\{\frac{\pi}{k} \cdot 4 \cdot (qo + 29)F\right\} = F40$ | F1 | 0 | F40 |
| CH2 | H10 | (qo + 30)F | SL, EN2 AC2, SFT | 2 · (qo + 30)F | (qo + 30)F | (qo + 30)F | $ENV \cdot C10 \cdot W \cdot \sin 10\left\{\frac{\pi}{k} \cdot (qo + 30)F\right\} = F10$ | F1 | F10 | F40 |
| CH3 | H48 | (qo + 30)F | EN3 AC3 | 2 · (qo + 30)F | 2 · (qo + 30)F | 4 · (qo + 29)F | $ENV \cdot C48 \cdot \sin 12\left\{\frac{\pi}{k} \cdot 4 \cdot (qo + 29)F\right\} = F48$ | F1 | F10 | F40 + F48 |
| CH4 | H2 | (qo + 30)F | EN1, AC0 AC1, SFT | 4 · (qo + 30)F | 2 · (qo + 30)F | 4 · (qo + 29)F | $ENV \cdot C2 \cdot \sin\left\{\frac{\pi}{k} \cdot 2 \cdot (qo + 30)F\right\} = F2$ | F1 + F2 | F10 | F40 + F48 |
| CH5 | H56 | (qo + 30)F | EN4 AC3 | 4 · (qo + 30)F | 2 · (qo + 30)F | 4 · (qo + 29)F | $ENV \cdot C56 \cdot W \cdot \sin 14\left\{\frac{\pi}{k} \cdot 4 \cdot (qo + 29)F\right\} = F56$ | F1 + F2 | F10 | F40 + F48 + F56 |
| CH6 | H12 | (qo + 30)F | SL EN3 AC2 | 4 · (qo + 30)F | 2 · (qo + 30)F | (qo + 30)F | $ENV \cdot C12 \cdot W \cdot \sin 12\left\{\frac{\pi}{k} \cdot (qo + 30)F\right\} = F12$ | F1 + F2 | F10 + F12 | F40 + F48 + F56 |
| CH7 | H64 | (qo + 30)F | EN5 AC3 | 4 · (qo + 30)F | 2 · (qo + 30)F | 4 · (qo + 30)F | $ENV \cdot C64 \cdot W \cdot \sin 16\left\{\frac{\pi}{k} \cdot 4 \cdot (qo + 29)F\right\} = F64$ | F1 + F2 | F10 + F12 | F40 + F48 + F56 + F64 |

TABLE XXI

2ND CALCULATING FRAME CF2

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H3 | (qo + 31)F | LD2, EN1 AC0, AC1 | (qo + 31)F | 3 · (qo + 30)F | 4 · (qo + 30)F | $ENV \cdot C3 \cdot \sin\left\{\frac{\pi}{k} \cdot 3 \cdot (qo + 30)F\right\} = F3$ | F1 + F2 + F3 | F10 + F12 | 0 |
| CH1 | H40 | (qo + 31)F | EN2 AC3 | (qo + 31)F | 3 · (qo + 30)F | 4 · (qo + 30)F | $ENV \cdot C40 \cdot W \cdot \sin 10\left\{\frac{\pi}{k} \cdot 4 \cdot (qo + 30)F\right\} = F40$ | F1 + F2 + F3 | F10 + F12 | F40 |
| CH2 | H14 | (qo + 31)F | SL, EN4 AC2, SFT | 2 · (qo + 30)F | 3 · (qo + 30)F | (qo + 31)F | $ENV \cdot C14 \cdot W \cdot \sin 14\left\{\frac{\pi}{k} \cdot (qo + 31)F\right\} = F14$ | F1 + F2 + F3 | F10 + F12 + F14 | F40 |
| CH3 | H48 | (qo + 31)F | EN3 AC3 | 2 · (qo + 31)F | 3 · (qo + 30)F | 4 · (qo + 30)F | $ENV \cdot C48 \cdot \sin 12\left\{\frac{\pi}{k} \cdot 4 \cdot (qo + 30)F\right\} = F48$ | F1 + F2 + F3 | F10 + F12 + F14 | F40 + F48 |
| CH4 | H4 | (qo + 31)F | EN1, AC0 AC1, SFT | 4 · (qo + 31)F | 4 · (qo + 30)F | 4 · (qo + 30)F | $ENV \cdot C4 \cdot \sin\left\{\frac{\pi}{k} \cdot 4 \cdot (qo + 30)F\right\} = F4$ | F1 + F2 + F3 + F4 | F10 + F12 + F14 | F40 + F48 |
| CH5 | H56 | (qo + 31)F | EN4 AC3 | 4 · (qo + 31)F | 4 · (qo + 30)F | 4 · (qo + 30)F | $ENV \cdot C56 \cdot W \cdot \sin 14\left\{\frac{\pi}{k} \cdot 4 \cdot (qo + 30)F\right\} = F56$ | F1 + F2 + F3 + F4 | F10 + F12 + F14 | F30 + F48 + F56 |
| CH6 | H16 | (qo + 31)F | SL EN5 AC2 | 4 · (qo + 31)F | 4 · (qo + 30)F | (qo + 31)F | $ENV \cdot C16 \cdot W \cdot \sin 16\left\{\frac{\pi}{k} \cdot (qo + 31)F\right\} = F16$ | F1 + F2 + F3 + F4 | F10 + F12 + F14 + F16 | F30 + F48 + F56 |
| CH7 | H64 | (qo + 31)F | EN5 AC3 | 4 · (qo + 31)F | 4 · (qo + 30)F | 4 · (qo + 30)F | $ENV \cdot C64 \cdot W \cdot \sin 16\left\{\frac{\pi}{k} \cdot 4 \cdot (qo + 30)F\right\} = F64$ | F1 + F2 + F3 + F4 | F10 + F12 + F14 + F16 | F30 + F48 + F56 + F64 |

TABLE XXII

3RD CALCULATING FRAME CF3

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H5 | (qo + 32)F | LD1, EN1 AC0, AC1 | (qo + 32)F | 5 · (qo + 30)F | 4 · (qo + 31)F | $ENV \cdot C5 \cdot \sin\left\{\frac{\pi}{k} \cdot 5 \cdot (qo + 30)F\right\} = F5$ | F1 + F2 + F3 + F4 + F5 | 0 | 0 |
| CH1 | H40 | (qo + 32)F | EN2 AC3 | (qo + 32)F | 5 · (qo + 30)F | 4 · (qo + 31)F | $ENV \cdot C40 \cdot W \cdot \sin 10\left\{\frac{\pi}{k} \cdot 4 \cdot (qo + 31)F\right\} = F40$ | F1 + F2 + F3 + F4 + F5 | 0 | F40 |
| CH2 | H10 | (qo + 32)F | SL, EN2 AC2, SFT | 2 · (qo + 32)F | 5 · (qo + 30)F | (qo + 32)F | $ENV \cdot C10 \cdot W \cdot \sin 10\left\{\frac{\pi}{k} \cdot (qo + 32)F\right\} = F10$ | F1 + F2 + F3 + F4 + F5 | F10 | F40 |
| CH3 | H48 | (qo + 32)F | EN3 AC3 | 2 · (qo + 32)F | 5 · (qo + 30)F | 4 · (qo + 31)F | $ENV \cdot C48 \cdot \sin 12\left\{\frac{\pi}{k} \cdot 4 \cdot (qo + 31)F\right\} = F48$ | F1 + F2 + F3 + F4 + F5 | F10 | F40 + F48 |
| CH4 | H6 | (qo + 32)F | EN1, AC0 AC1, SFT | 4 · (qo + 32)F | 6 · (qo + 30)F | 4 · (qo + 31)F | $ENV \cdot C6 \cdot \sin\left\{\frac{\pi}{k} \cdot 6 \cdot (qo + 30)F\right\} = F6$ | F1 + F2 + F3 + F4 F5 + F6 | F10 | F40 + F48 |
| CH5 | H56 | (qo + 32)F | EN4 AC3 | 4 · (qo + 32)F | 6 · (qo + 30)F | 4 · (qo + 31)F | $ENV \cdot C56 \cdot W \cdot \sin 14\left\{\frac{\pi}{k} \cdot 4 \cdot (qo + 31)F\right\} = F56$ | F1 + F2 + F3 + F4 + F5 + F6 | F10 | F40 + F48 + F56 |
| CH6 | H12 | (qo + 32)F | SL EN3 AC2 | 4 · (qo + 32)F | 6 · (qo + 30)F | (qo + 32)F | $ENV \cdot C12 \cdot W \cdot \sin 12\left\{\frac{\pi}{k} \cdot (qo + 32)F\right\} = F12$ | F1 + F2 + F3 + F4 + F5 + F6 | F10 + F12 | F40 + F48 + F56 |
| CH7 | H64 | (qo + 32)F | EN5 AC3 | 4 · (qo + 32)F | 6 · (qo + 30)F | 4 · (qo + 32)F | $ENV \cdot C64 \cdot W \cdot \sin 16\left\{\frac{\pi}{k} \cdot 4 \cdot (qo + 31)F\right\} = F64$ | F1 + F2 + F3 + F4 + F5 + F6 | F10 + F12 | F40 + F48 + F56 + F64 |

TABLE XXIII

4TH CALCULATING FRAME CF4

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H7 | (qo + 33)F | LD2, EN1 AC0, AC1 | (qo + 33)F | 7 · (qo + 30)F | 4 · (qo + 32)F | $ENV \cdot C7 \cdot \sin\left(\frac{\pi}{k} \cdot 7 \cdot (qo + 30)F\right) = F7$ | F1 + F2 + F3 + F4 + F5 + F6 + F7 | F10 + F12 | 0 |
| CH1 | H40 | (qo + 33)F | EN2 AC3 | (qo + 33)F | 7 · (qo + 30)F | 4 · (qo + 32)F | $ENV \cdot C40 \cdot W \cdot \sin 10\left(\frac{\pi}{k} \cdot 4 \cdot (qo + 32)F\right) = F40$ | F1 + F2 + F3 + F4 + F5 + F6 + F7 | F10 + F12 | F40 |
| CH2 | H14 | (qo + 33)F | SL, EN4 AC2, SFT | 2 · (qo + 33)F | 7 · (qo + 30)F | (qo + 33)F | $ENV \cdot C14 \cdot W \cdot \sin 14\left(\frac{\pi}{k} \cdot (qo + 33)F\right) = F14$ | F1 + F2 + F3 + F4 + F5 + F6 + F7 | F10 + F12 + F14 | F40 |
| CH3 | H48 | (qo + 33)F | EN3 AC3 | 2 · (qo + 33)F | 7 · (qo + 30)F | 4 · (qo + 32)F | $ENV \cdot C48 \cdot \sin 12\left(\frac{\pi}{k} \cdot 4 \cdot (qo + 32)F\right) = F48$ | F1 + F2 + F3 + F4 + F5 + F6 + F7 | F10 + F12 + F14 | F40 + F48 |
| CH4 | H8 | (qo + 33)F | EN1, AC0 AC1, SFT | 4 · (qo + 33)F | 8 · (qo + 30)F | 4 · (qo + 32)F | $ENV \cdot C8 \cdot \sin\left(\frac{\pi}{k} \cdot 8 \cdot (qo + 30)F\right) = F8$ | F1 + F2 + F3 + F4 + F5 + F6 + F7 + F8 | F10 + F12 + F14 | F40 + F48 |
| CH5 | H56 | (qo + 33)F | EN4 AC3 | 4 · (qo + 33)F | 8 · (qo + 30)F | 4 · (qo + 32)F | $ENV \cdot C56 \cdot W \cdot \sin 14\left(\frac{\pi}{k} \cdot 4 \cdot (qo + 32)F\right) = F56$ | F1 + F2 + F3 + F4 + F5 + F6 + F7 + F8 | F10 + F12 + F14 | F40 + F48 + F56 |
| CH6 | H16 | (qo + 33)F | SL EN5 AC2 | 4 · (qo + 33)F | 8 · (qo + 30)F | (qo + 33)F | $ENV \cdot C16 \cdot W \cdot \sin 16\left(\frac{\pi}{k} \cdot (qo + 33)F\right) = F16$ | F1 + F2 + F3 + F4 + F5 + F6 + F7 + F8 | F10 + F12 + F14 + F16 | F40 + F48 + F56 |
| CH7 | H64 | (qo + 33)F | EN5 AC3 | 4 · (qo + 33)F | 8 · (qo + 30)F | 4 · (qo + 33)F | $ENV \cdot C64 \cdot W \cdot \sin 16\left(\frac{\pi}{k} \cdot 4 \cdot (qo + 33)F\right) = F64$ | F1 + F2 + F3 + F4 + F5 + F6 + F7 + F8 | F10 + F12 + F14 + F16 | F40 + F48 + F56 + F64 |

As can be noted from the foregoing description, in a time band of $$[\tfrac{1}{8}T \leqq Tx < \tfrac{3}{8}T]$$

in one period of the musical tone signal, the first to the eight partial tone components $H_1$ to $H_8$ are respectively calculated in a period of $$\frac{4}{fcA}\left(=\frac{1}{10\text{KHz}}\right),$$

the 10th to 16th partial tone components $H_{10}$, $H_{12}$, $H_{14}$ and $H_{16}$ are respectively calculated in a period of $$\frac{2}{fcA}\left(=\frac{1}{20\text{KHz}}\right)$$

while the 48th to the 64th partial tone components $H_{40}$, $H_{48}$, $H_{56}$ and $H_{64}$ are respectively calculated in a period of $$\frac{1}{fcA}\left(=\frac{1}{40\text{KHz}}\right).$$

A predetermined time after, the upper order 3 bits of the accomulated value qF outputted by the accumulator 50 change to "101" and then to "110". Then, the timing pulse generator 40B judges that the time band in one period of the musical tone signal has changed to $$[\tfrac{3}{8}T \leqq Tx < \tfrac{5}{8}T]$$

so as to produce various control signals shown in FIG. 25c for the purpose of calculating the partial tone components $H_1$ to $H_8$, $H_{10}$, $H_{12}$, $H_{14}$, $H_{16}$, $H_{80}$, $H_{96}$, $H_{112}$ and $H_{128}$ shown in Table XVc.

Suppose now that the accumulated value qF is (qo+45)F at a time when the upper order three bits of the accumulated value qF becomes "110".

(a3) operation at a frequency of f<5000 Hz and in a time band $$[\tfrac{3}{8}T \leqq Tx \tfrac{5}{8}T]$$

This operation is similar to that described above except that, for the purpose of calculating the 80th, 96th, 112th and128th partial tone components $H_{80}$, $H_{96}$, $H_{112}$ and $H_{128}$, the shift signal SFT is applied three times to the shift register 614 of the partial tone phase designation signal generator 60B.

Then, the content of the shift register 614 becomes $2^3 \cdot qF$, $2^3$ times the accumulated value qF in the previous calculating time, and the waveform amplitude values $W \cdot \sin 10[\pi/\kappa \cdot 8 \cdot qF]$, $$W \cdot \sin 10\left[\frac{\pi}{\kappa} \cdot 8 \cdot qF\right],\ W \cdot \sin 12\left[\frac{\pi}{\kappa} \cdot 8 \cdot qF\right],$$

$$W \cdot \sin 14\left[\frac{\pi}{\kappa} \cdot 8 \cdot qF\right] \text{ and } W \cdot \sin 16\left[\frac{\pi}{\kappa} \cdot 8 \cdot qF\right]$$

regarding the partial tone components $H_{80}$, $H_{96}$, $H_{112}$ and $H_{128}$ are produced by WF·SFM(1)71 through WF·SFM(4)74 by using this signal $2^3 \cdot qF$ where m=3.

The outline of the operations are shown in the following Tables XXIV through XXVII without describing them in detail.

TABLE XXIV

1ST CALCULATING FRAME CF1

| Calculating channel | Calculated partial tone component Hn | Output qF of accumulator 50 | Control signals which become "1" among output signals of the timing pulse generator 40B | Content of circuit 60B: Output 2m · qF of shift register 614 | Output signals: nqF | Output signals: $2^m \cdot qF$ | Output of multiplier 120 | Contents of accumulators 131 to 133: ΣFn (A) | ΣFn (B) | ΣFn (C) |
|---|---|---|---|---|---|---|---|---|---|---|
| CH0 | H1 | (qo + 45)F | LD1, LD2 EN1, AC1 | (qo + 45)F | (qo + 45)F | 8 · (qo + 44)F | $ENV \cdot C1 \cdot \sin\left\{\frac{\pi}{k} \cdot (qo + 45)F\right\} = F1$ | F1 | 0 | 0 |
| CH1 | H80 | (qo + 45)F | EN2 AC3 | (qo + 45)F | (qo + 45)F | 8 · (qo + 44)F | $ENV \cdot C80 \cdot W \cdot \sin 10\left\{\frac{\pi}{k} \cdot 8 \cdot (qo + 44)F\right\} = F80$ | F1 | 0 | F80 |
| CH2 | H10 | (qo + 45)F | SL, EN2 AC2, SFT | 2 · (qo + 45)F | (qo + 45)F | (qo + 45)F | $ENV \cdot C10 \cdot W \cdot \sin 10\left\{\frac{\pi}{k} \cdot (qo + 45)F\right\} = F10$ | F1 | F10 | F80 |
| CH3 | H96 | (qo + 45)F | EN3 AC3 | 2 · (qo + 45)F | (qo + 45)F | 8 · (qo + 44)F | $ENV \cdot C96 \cdot \sin 12\left\{\frac{\pi}{k} \cdot 8 \cdot (qo + 44)F\right\} = F96$ | F1 | F10 | F80 + F96 |
| CH4 | H2 | (qo + 45)F | EN1, AC0 AC1, SFT | 4 · (qo + 45)F | 2 · (qo + 45)F | 8 · (qo + 44)F | $ENV \cdot C2 \cdot \sin\left\{\frac{\pi}{k} \cdot 2 \cdot (qo + 45)F\right\} = F2$ | F1 + F2 | F10 | F80 + F96 |
| CH5 | H112 | (qo + 45)F | EN4 AC3 | 4 · (qo + 45)F | 2 · (qo + 45)F | 8 · (qo + 44)F | $ENV \cdot C112 \cdot W \cdot \sin 14\left\{\frac{\pi}{k} \cdot 8 \cdot (qo + 44)F\right\} = F112$ | F1 + F2 | F10 | F80 + F96 + F112 |
| CH6 | H12 | (qo + 45)F | SL, EN3 AC2, SFT | 8 · (qo + 45)F | 2 · (qo + 45)F | (qo + 45)F | $ENV \cdot C12 \cdot W \cdot \sin 12\left\{\frac{\pi}{k} \cdot (qo + 45)F\right\} = F12$ | F1 + F2 | F10 + F12 | F80 + F96 + F112 |
| CH7 | H128 | (qo + 45)F | EN5 AC3 | 8 · (qo + 45)F | 2 · (qo + 45)F | 8 · (qo + 44)F | $ENV \cdot C128 \cdot W \cdot \sin 16\left\{\frac{\pi}{k} \cdot 8 \cdot (qo + 44)F\right\} = F128$ | F1 + F2 | F10 + F12 | F80 + F96 + F112 + F128 |

TABLE XXV

2ND CALCULATING FRAME CF2

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H3 | (qo + 46)F | LD2, EN1 AC0, AC1 | (qo + 46)F | 3 · (qo + 45)F | 8 · (qo + 45)F | $ENV \cdot C3 \cdot \sin\left\{\frac{\pi}{k} \cdot 8 \cdot (qo + 45)F\right\} = F3$ | F1 + F2 + F3 | F10 + F12 | 0 |
| CH1 | H80 | (qo + 46)F | EN2 AC3 | (qo + 46)F | 3 · (qo + 45)F | 8 · (qo + 45)F | $ENV \cdot C80 \cdot W \cdot \sin 10\left\{\frac{\pi}{k} \cdot 8 \cdot (qo + 45)F\right\} = F80$ | F1 + F2 + F3 | F10 + F12 | F80 |
| CH2 | H14 | (qo + 46)F | SL, EN4 AC2, SFT | 2 · (qo + 46)F | 3 · (qo + 45)F | (qo + 46)F | $ENV \cdot C14 \cdot W \cdot \sin 14\left\{\frac{\pi}{k} \cdot (qo + 46)F\right\} = F14$ | F1 + F2 + F3 | F10 + F12 + F14 | F80 |
| CH3 | H96 | (qo + 46)F | EN3 AC3 | 2 · (qo + 46)F | 3 · (qo + 45)F | 8 · (qo + 45)F | $ENV \cdot C96 \cdot \sin 12\left\{\frac{\pi}{k} \cdot 8 \cdot (qo + 45)F\right\} = F96$ | F1 + F2 + F3 | F10 + F12 + F14 | F80 + F96 |
| CH4 | H4 | (qo + 46)F | EN1, AC0 AC1, SFT | 4 · (qo + 46)F | 4 · (qo + 45)F | 8 · (qo + 45)F | $ENV \cdot C4 \cdot \sin\left\{\frac{\pi}{k} \cdot 4 \cdot (qo + 45)F\right\} = F4$ | F1 + F2 + F3 + F4 | FF10 + F12 + F14 | F80 + F96 |
| CH5 | H112 | (qo + 46)F | EN4 AC3 | 4 · (qo + 46)F | 4 · (qo + 45)F | 8 · (qo + 45)F | $ENV \cdot C112 \cdot W \cdot \sin 14\left\{\frac{\pi}{k} \cdot 8 \cdot (qo + 45)F\right\} = F112$ | F1 + F2 + F3 + F4 | F10 + F12 + F14 | F80 + F96 + F112 |
| CH6 | H16 | (qo + 46)F | SL, EN5 AC2, SFT | 8 · (qo + 46)F | 4 · (qo + 45)F | (qo + 46)F | $ENV \cdot C16 \cdot W \cdot \sin 16\left\{\frac{\pi}{k} \cdot (qo + 46)F\right\} = F16$ | F1 + F2 + F3 + F4 | F10 + F12 + F14 + F16 | F80 + F96 + F112 |
| CH7 | H128 | (qo + 46)F | EN5 AC3 | 8 · (qo + 46)F | 4 · (qo + 45)F | 8 · (qo + 45)F | $ENV \cdot C128 \cdot W \cdot \sin 16\left\{\frac{\pi}{k} \cdot 8 \cdot (qo + 45)F\right\} = F128$ | F1 + F2 + F3 + F4 | F10 + F12 + F14 + F16 | F80 + F96 + F112 + F128 |

TABLE XXVI

3RD CALCULATING FRAME CF3

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H5 | (qo + 47)F | LD2, EN1 AC0, AC1 | (qo + 47)F | 5 · (qo + 45)F | 8 · (qo + 46)F | $ENV \cdot C5 \cdot \sin\left\{\frac{\pi}{k} \cdot 5 \cdot (qo + 45)F\right\} = F5$ | F1 + F2 + F3 + F4 + F5 | 0 | 0 |
| CH1 | H80 | (qo + 47)F | EN2 AC3 | (qo + 47)F | 5 · (qo + 45)F | 8 · (qo + 46)F | $ENV \cdot C80 \cdot W \cdot \sin 10\left\{\frac{\pi}{k} \cdot 8 \cdot (qo + 46)F\right\} = F80$ | F1 + F2 + F3 + F4 + F5 | 0 | F80 |
| CH2 | H10 | (qo + 47)F | SL, EN2 AC2, SFT | 2 · (qo + 47)F | 5 · (qo + 45)F | (qo + 47)F | $ENV \cdot C10 \cdot W \cdot \sin 10\left\{\frac{\pi}{k} \cdot (qo + 47)F\right\} = F10$ | F1 + F2 + F3 + F4 + F5 | F10 | F80 |
| CH3 | H96 | (qo + 47)F | EN3 AC3 | 2 · (qo + 47)F | 5 · (qo + 45)F | 8 · (qo + 46)F | $ENV \cdot C96 \cdot \sin 12\left\{\frac{\pi}{k} \cdot 8 \cdot (qo + 46)F\right\} = F96$ | F1 + F2 + F3 + F4 + F5 | F10 | F80 + F96 |
| CH4 | H6 | (qo + 47)F | EN1, AC0 AC1, SFT | 4 · (qo + 47)F | 6 · (qo + 45)F | 8 · (qo + 46)F | $ENV \cdot C6 \cdot \sin\left\{\frac{\pi}{k} \cdot 6 \cdot (qo + 45)F\right\} = F6$ | F1 + F2 + F3 + F4 + F5 + F6 | F10 | F80 + F96 |
| CH5 | H112 | (qo + 47)F | EN4 AC3 | 4 · (qo + 47)F | 6 · (qo + 45)F | 8 · (qo + 46)F | $ENV \cdot C112 \cdot W \cdot \sin 14\left\{\frac{\pi}{k} \cdot 8 \cdot (qo + 46)F\right\} = F112$ | F1 + F2 + F3 + F4 + F5 + F6 | F10 | F80 + F96 + F112 |
| CH6 | H12 | (qo + 47)F | SL, EN3 AC2, SFT | 8 · (qo + 47)F | 6 · (qo + 45)F | (qo + 47)F | $ENV \cdot C12 \cdot W \cdot \sin 12\left\{\frac{\pi}{k} \cdot (qo + 47)F\right\} = F12$ | F1 + F2 + F3 + F4 + F5 + F6 | F10 + F12 | F80 + F96 + F112 |
| CH7 | H128 | (qo + 47)F | EN5 AC3 | 8 · (qo + 47)F | 6 · (qo + 45)F | 8 · (qo + 46)F | $ENV \cdot C128 \cdot W \cdot \sin 16\left\{\frac{\pi}{k} \cdot 8 \cdot (qo + 46)F\right\} = F128$ | F1 + F2 + F3 + F4 + F5 + F6 | F10 + F12 | F80 + F96 + F112 + F128 |

TABLE XXVII

4TH CALCULATING FRAME CF4

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H7 | (qo+48)F | LD2, EN1 AC0, AC1 | (qo+48)F | 7·(qo+45)F | 8·(qo+47)F | $ENV \cdot C7 \cdot \sin\left\{\frac{\pi}{K} \cdot 7 \cdot (qo + 45)F\right\} = F7$ | F1+F2+ F3+F4+ F5+F6+ F7 | F10+F12 | 0 |
| CH1 | H80 | (qo+48)F | EN2 AC3 | (qo+48)F | 7·(qo+45)F | 8·(qo+47)F | $ENV \cdot C80 \cdot W \cdot \sin 10\left\{\frac{\pi}{K} \cdot 8 \cdot (qo + 47)F\right\} = F80$ | F1+F2+ F3+F4+ F5+F6+ F7 | F10+F12 | F80 |
| CH2 | H14 | (qo+48)F | SL, EN4 AC2, SFT | 2·(qo+48)F | 7·(qo+45)F | (qo+48)F | $ENV \cdot C14 \cdot W \cdot \sin 14\left\{\frac{\pi}{K} \cdot (qo + 48)F\right\} = F14$ | F1+F2+ F3+F4+ F5+F6+ F7 | F10+F12 +F14 | F80 |
| CH3 | H96 | (qo+48)F | EN3 AC3 | 2·(qo+48)F | 7·(qo+45)F | 8·(qo+47)F | $ENV \cdot C96 \cdot W \cdot \sin 12\left\{\frac{\pi}{K} \cdot 8 \cdot (qo + 47)F\right\} = F96$ | F1+F2+ F3+F4+ F5+F6+ F7 | F10+F12 +F14 | F80+F96 |
| CH4 | H8 | (qo+48)F | EN1, AC0 AC1, SFT | 4(qo+48)F | 8·(qo+45)F | 8·(qo+47)F | $ENV \cdot C8 \cdot \sin\left\{\frac{\pi}{K} \cdot 8 \cdot (qo + 45)F\right\} = F8$ | F1+F2+ F3+F4+ F5+F6+ F7+F8 | F10+F12 +F14 | F80+F96 |
| CH5 | H112 | (qo+48)F | EN4 AC3 | 4·(qo+48)F | 8·(qo+45)F | 8·(qo+47)F | $ENV \cdot C112 \cdot W \cdot \sin 14\left\{\frac{\pi}{K} \cdot 8 \cdot (qo + 47)F\right\} = F112$ | F1+F2+ F3+F4+ F5+F6+ F7+F8 | F10+F12 +F14 | F80+F96 +F112 |
| CH6 | H16 | (qo+48)F | SL, EN5 AC2, SFT | 8·(qo+48)F | 8·(qo+45)F | (qo+48)F | $ENV \cdot C16 \cdot W \cdot \sin 16\left\{\frac{\pi}{K} \cdot (qo + 48)F\right\} = F16$ | F1+F2+ F3+F4+ F5+F6+ F7+F8 | F10+F12 +F14 F16 | F80+F96 +F112 |
| CH7 | H128 | (qo+48)F | EN5 AC3 | 8·(qo+48)F | 8·(qo+45)F | 8·(qo+47)F | $ENV \cdot C128 \cdot W \cdot \sin 16\left\{\frac{\pi}{K} \cdot 8 \cdot (qo + 47)F\right\} = F128$ | F1+F2+ F3+F4+ F5+F6+ F7+F8 | F10+F12 +F14+ F16 | F80+F96 +F112+ F128 |

As will be clear from the foregoing description, in a time band $$[\tfrac{3}{4}T \leqq Tx < \tfrac{7}{8}T]$$

in one period of the musical tone signal, the first to 8th partial tone components $H_1$ to $H_8$ are calculated respectively in a period of $$\frac{4}{fcA}\left(=\frac{1}{10\text{KHz}}\right),$$

whereas the 10th to 16th partial tone components $H_{10}$, $H_{12}$, $H_{14}$ and $H_{16}$ ar calculated respectively in a period of $$\frac{2}{fcA}\left(=\frac{1}{20\text{KHz}}\right).$$

The 80th through 128th partial tone components $H_{80}$, $H_{96}$, H112 and H128 are calculated respectively in a period of $$\frac{1}{fcA}\left(=\frac{1}{40\text{KHz}}\right).$$

A predetermined time after, when the upper order three bits of the accumulated value qF outputted from the accumulator 50 change to "111" the timing pulse generator 40B judges that the time band in one period of the musical tone signal has changed to $$[\tfrac{7}{8}T \leqq Tx < T]$$

so as to produce various control signals as shown in FIG. 25D to calculate partial tone components $H_1$ to $H_8$, $H_{10}$, $H_{12}$, $H_{14}$ and $H_{16}$ shown in Table XV.

Let us assume now that the accumulated value becomes (qo+53)F when the upper three bits of the accumulated value qF change to "111".

(a4) operation at a frequency of f<500 Hz and in a time band $$[\tfrac{7}{8}T \leqq Tx < T]$$

This operation is similar to that already described except that only the first to 8th partial tone components $H_1$ to $H_8$ and the 10th to 16th partial tone components $H_{10}$, $H_{12}$, $H_{14}$ and $H_{16}$ to $H_{16}$ are calculated with predetermined calculating periods respectively. The outlines of these operations are shown in the following Tables XXVIII through XXXI without describing them in detail.

TABLE XXVIII

1ST CALCULATING FRAME CF1

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | ΣFn (B) | ΣFn (C) |
|---|---|---|---|---|---|---|---|---|---|---|
| CH0 | H1 | (qo+53)F | LD1, LD2 EN1, AC1 | (qo+53)F | (qo+53)F | (qo+52)F | $ENV \cdot C1 \cdot \sin\left\{\frac{\pi}{K} \cdot (qo + 53)F\right\} = F1$ | F1 | 0 | 0 |
| CH1 | — | (qo+53)F | — | (qo+53)F | (qo+53)F | (qo+52)F | — | F1 | 0 | 0 |
| CH2 | H10 | (qo+53)F | SL EN2 AC2 | (qo+53)F | (qo+53)F | (qo+53)F | $ENV \cdot C10 \cdot W \cdot \sin 10\left\{\frac{\pi}{K} \cdot (qo + 53)F\right\} = F10$ | F1 | F10 | 0 |
| CH3 | — | (qo+53)F | — | (qo+53)F | (qo+53)F | (qo+52)F | — | F1 | F10 | 0 |
| CH4 | H2 | (qo+53)F | EN1 AC0 AC1 | (qo+53)F | 2·(qo+53)F | (qo+52)F | $ENV \cdot C2 \cdot \sin\left\{\frac{\pi}{K} \cdot 2 \cdot (qo + 53)F\right\} = F2$ | F1+F2 | F10 | 0 |
| CH5 | — | (qo+53)F | — | (qo+53)F | 2·(qo+53)F | (qo+52)F | — | F1+F2 | F10 | 0 |
| CH6 | H12 | (qo+53)F | SL EN3 AC2 | (qo+53)F | 2·(qo+53)F | (qo+53)F | $ENV \cdot C \cdot W \cdot \sin 12\left\{\frac{\pi}{K} \cdot (qo + 53)F\right\} = F12$ | F1+F2 | F10+F12 | 0 |
| CH7 | — | (qo+53)F | — | (qo+53)F | 2·(qo+53)F | (qo+52)F | — | F1+F2 | F10+F12 | 0 |

TABLE XXIX

2ND CALCULATING FRAME CF2

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H3 | (qo+54)F | LD2, EN1 AC0, AC1 | (qo+54)F | 3·(qo+53)F | (qo+53)F | $ENV \cdot C3 \cdot \sin\left\{\frac{\pi}{K} \cdot 3 \cdot (qo + 53)F\right\} = F3$ | F1+F2+F3 | F10+F12 | 0 |
| CH1 | — | (qo+54)F | — | (qo+54)F | 3·(qo+53)F | (qo+53)F | — | F1+F2+F3 | F10+F12 | 0 |
| CH2 | H14 | (qo+54)F | SL EN4 AC2 | (qo+54)F | 3·(qo+53)F | (qo+54)F | $ENV \cdot C14 \cdot W \cdot \sin 14\left\{\frac{\pi}{K} \cdot (qo + 54)F\right\} = F14$ | F1+F2+F3 | F10+F12+F14 | 0 |
| CH3 | — | (qo+54)F | — | (qo+54)F | 3·(qo+53)F | (qo+53)F | — | F1+F2+F3 | F10+F12 | 0 |
| CH4 | H4 | (qo+54)F | EN1 AC0 AC1 | (qo+54)F | 4·(qo+53)F | (qo+53)F | $ENV \cdot C4 \cdot \sin\left\{\frac{\pi}{K} \cdot 4 \cdot (qo + 53)F\right\} = F4$ | F1+F2+F3+F4 | F10+F12+F14 | 0 |
| CH5 | — | (qo+54)F | — | (qo+54)F | 4·(qo+53)F | (qo+53)F | — | F1+F2+F3+F4 | F10+F12+F14 | 0 |
| CH6 | H16 | (qo+54)F | SL EN5 AC2 | (qo+54)F | 4·(qo+53)F | (qo+54)F | $ENV \cdot C16 \cdot W \cdot \sin 16\left\{\frac{\pi}{K} \cdot (qo + 54)F\right\} = F16$ | F1+F2+F3+F4 | F10+F12+F14+F16 | 0 |
| CH7 | — | (qo+54)F | — | (qo+54)F | 4·(qo+53)F | (qo+53)F | — | F1+F2+F3+F4 | F10+F12+F14+F16 | 0 |

TABLE XXX

3RD CALCULATING FRAME CF3

| Calculating channel | Calculated partial tone component Hn | Output qF of accumulator 50 | Control signals which become "1" among output signals of the timing pulse generator 40B | Content of circuit 60B: Output 2m · qF of shift register 614 | Output signals: nqF | Output signals: $2^m \cdot qF$ | Output of multiplier 120 | Contents of accumulators 131 to 133: ΣFn (A) | ΣFn (B) | ΣFn (C) |
|---|---|---|---|---|---|---|---|---|---|---|
| CH0 | H5 | (qo+55)F | LD2, EN1 AC0, AC1 | (qo+55)F | 5·(qo+53)F | (qo+54)F | $ENV \cdot C5 \cdot \sin\left\{\frac{\pi}{K} \cdot 5 \cdot (qo + 53)F\right\} = F5$ | F1+F2+ F3+F4+ F5 | 0 | 0 |
| CH1 | — | (qo+55)F | — | (qo+55)F | 5·(qo+53)F | (qo+54)F | — | F1+F2+ F3+F4+ F5 | 0 | 0 |
| CH2 | H10 | (qo+55)F | SL EN2 AC2 | (qo+55)F | 5·(qo+53)F | (qo+55)F | $ENV \cdot C10 \cdot W \cdot \sin 10\left\{\frac{\pi}{K} \cdot (qo + 55)F\right\} = F10$ | F1+F2+ F3+F4+ F5 | F10 | 0 |
| CH3 | — | (qo+55)F | — | (qo+55)F | 5·(qo+53)F | (qo+54)F | — | F1+F2+ F3+F4+ F5 | F10 | 0 |
| CH4 | H6 | (qo+55)F | EN1 AC0 AC1 | (qo+55)F | 6·(qo+53)F | (qo+54)F | $ENV \cdot C6 \cdot \sin\left\{\frac{\pi}{K} \cdot 6 \cdot (qo + 53)F\right\} = F6$ | F1+F2+ F3+F4+ F5+F6 | F10 | 0 |
| CH5 | — | (qo+55)F | — | (qo+55)F | 6·(qo+53)F | (qo+54)F | — | F1+F2+ F3+F4+ F5+F6 | F10 | 0 |
| CH6 | H12 | (qo+55)F | SL EN3 AC2 | (qo+55)F | 6·(qo+53)F | (qo+55)F | $ENV \cdot C12 \cdot W \cdot \sin 12\left\{\frac{\pi}{K} \cdot (qo + 55)F\right\} = F12$ | F1+F2+ F3+F4+ F5+F6 | F10+F12 | 0 |
| CH7 | — | (qo+55)F | — | (qo+55)F | 6·(qo+53)F | (qo+54)F | — | F1+F2+ F3+F4+ F5+F6 | F10+F12 | 0 |

TABLE XXXI

4TH CALCULATING FRAME CF4

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H7 | (qo+56)F | LD2, EN1 AC0, AC1 | (qo+56)F | 7·(qo+53)F | (qo+55)F | $ENV \cdot C7 \cdot \sin\left\{\frac{\pi}{K} \cdot 7 \cdot (qo + 53)F\right\} = F7$ | F1+F2+ F3+F4+ F5+F6+ F7 | F10+F12 | 0 |
| CH1 | — | (qo+56)F | — | (qo+56)F | 7·(qo+53)F | (qo+55)F | — | F1+F2+ F3+F4+ F5+F6+ F7 | F10+F12 | 0 |
| CH2 | H14 | (qo+56)F | SL EN4 AC2 | (qo+56)F | 7·(qo+53)F | (qo+56)F | $ENV \cdot C14 \cdot W \cdot \sin 14\left\{\frac{\pi}{K} \cdot (qo + 56)F\right\} = F14$ | F1+F2+ F3+F4+ F5+F6+ F7 | F10+F12 +F14 | 0 |
| CH3 | — | (qo+56)F | — | (qo+56)F | 7·(qo+53)F | (qo+55)F | — | F1+F2+ F3+F4+ F5+F6+ F7 | F10+F12 +F14 | 0 |
| CH4 | H8 | (qo+56)F | EN1 AC0 AC1 | (qo+56)F | 8·(qo+53)F | (qo+55)F | $ENV \cdot C8 \cdot \sin\left\{\frac{\pi}{K} \cdot 8 \cdot (qo + 53)F\right\} = F8$ | F1+F2+ F3+F4+ F5+F6+ F7+F8 | F10+F12 +F14 | 0 |
| CH5 | — | (qo+56)F | — | (qo+56)F | 8·(qo+53)F | (qo+55)F | — | F1+F2+ F3+F4+ F5+F6+ F7+F8 | F10+F12 +F14 | 0 |
| CH6 | H16 | (qo+56)F | SL EN5 AC2 | (qo+56)F | 8·(qo+53)F | (qo+56)F | $ENV \cdot C16 \cdot W \cdot \sin 16\left\{\frac{\pi}{K} \cdot (qo + 56)F\right\} = F16$ | F1+F2+ F3+F4+ F5+F6+ F7+F8 | F10+F12 +F14+F16 | 0 |
| CH7 | — | (qo+56)F | — | (qo+56)F | 8·(qo+53)F | (qo+55)F | — | F1+F2+ F3+F4+ F5+F6+ F7+F8 | F10+F12 +F14+F16 | 0 |

A predetermined time after, when the upper order three bits of the accumulated value qF outputted from the accumulator 50 become "000", that is the accumulated value becomes zero as a result of an overflow, the timing pulse generator 40B judges that the calculation of the musical tone signal waveform over one period has completed and begins the calculation of the musical tone signal of the next new period so as to produce again various control signals as shown in FIG. 25A.

As above described, where the fundamental frequency f of the generated musical tone signal is lower than 500 Hz, the partial tone components $H_1$ to $H_8$ of lower frequencies are calculated at a period of $$\frac{4}{fcA}\left(=\frac{1}{10\text{KHz}}\right),$$

the 10th to 16th partial components $H_{10}$, $H_{12}$, $H_{14}$ and $H_{16}$ are calculated at a period of $$\frac{2}{fcA}\left(=\frac{1}{20\text{KHz}}\right),$$

and the partial tone components having higher orders than 20th order are calculated at a period of $$\frac{1}{fcA}\left(=\frac{1}{40\text{KHz}}\right).$$

Figure 19:
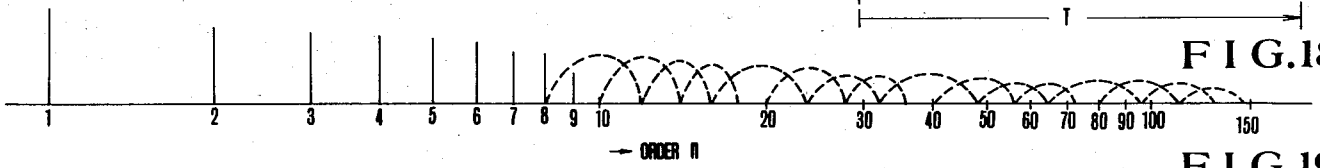
FIG. 19 a graph showing the frequency spectrum of the musical tone signals produced by the third embodiment of the musical tone signal generator of this invention.

As a consequence, a musical tone signal having a spectrum envelope as shown in FIG. 19 is obtained.

(b) operation when $500 \leqq f < 1000$ Hz

In this case, the partial tone components $H_1$ to $H_8$, $H_{10}$, $H_{12}$, $H_{14}$ and $H_{16}$ are calculated in a manner shown in Table XVE, so that under these conditions, the timing pulse generator 40B produces various control signals as shown in FIG. 25E with a predetermined timing.

In this case, the value gF of the partial tone phase designation signal nqF utilized to calculate the first to the eight partial tone components $H_1$ to $H_8$ is updated at every two calculating frames. For this reason, as shown in (g) of FIG. 25E, the load signal LD1 becomes "1" at the commencement (in the calculating channel CH0 of the first and third calculating frames CF1 and CF3).

Consequently, under a condition of [$500 \leqq f < 1000$ Hz], irrespective of the time band in one period of the musical tone signal the amplitude value Fn of each partial tone component Hn is calculated based on sequentially updated accumulated value qF as shown in the following Tables XXXII through XXXV.

TABLE XXXII

1ST CALCULATING FRAME CF1

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H1 | qoF | LD1, LD2 EN1, AC2 | qoF | qoF | (qo−1)F | $ENV \cdot C1 \cdot \sin\left\{\frac{\pi}{K} \cdot qoF\right\} = F1$ | 0 | F1 | 0 |
| CH1 | H10 | qoF | SL EN2 AC3 | qoF | qoF | qoF | $ENV \cdot C10 \cdot W \cdot \sin 10\left\{\frac{\pi}{K} \cdot qoF\right\} = F10$ | 0 | F1 | F10 |
| CH2 | H2 | qoF | EN1 AC0 AC2 | qoF | 2·qoF | (qo−1)F | $ENV \cdot C2 \cdot \sin\left\{\frac{\pi}{K} \cdot 2 \cdot qoF\right\} = F2$ | 0 | F1+F2 | F10 |
| CH3 | H12 | qoF | SL EN3 AC3 | qoF | 2·qoF | qoF | $ENV \cdot C12 \cdot W \cdot \sin 12\left\{\frac{\pi}{K} \cdot qoF\right\} = F12$ | 0 | F1+F2 | F10+F12 |
| CH4 | H3 | qoF | EN1 AC0 AC2 | qoF | 3·qoF | (qo−1)F | $ENV \cdot C3 \cdot \sin\left\{\frac{\pi}{K} \cdot 3 \cdot qoF\right\} = F3$ | 0 | F1+F2+F3 | F10+F12 |
| CH5 | H14 | qoF | SL EN4 AC3 | qoF | 3·qoF | qoF | $ENV \cdot C14 \cdot W \cdot \sin 14\left\{\frac{\pi}{K} \cdot qoF\right\} = F14$ | 0 | F1+F2+F3 | F10+F12+F14 |
| CH6 | H4 | qoF | EN1 AC0 AC2 | qoF | 4·qoF | (qo−1)F | $ENV \cdot C4 \cdot \sin\left\{\frac{\pi}{K} \cdot 4 \cdot qoF\right\} = F4$ | 0 | F1+F2+F3+F4 | F10+F12+F14 |
| CH7 | H16 | qoF | SL EN5 AC3 | qoF | 4·qoF | qoF | $ENV \cdot C16 \cdot W \cdot \sin 16\left\{\frac{\pi}{K} \cdot qoF\right\} = F16$ | 0 | F1+F2+F3+F4 | F10+F12+F14+F16 |

TABLE XXXIII

2ND CALCULATING FRAME CF2

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H5 | (qo+1)F | LD2, EN1 AC0, AC2 | (qo+1)F | 5·qoF | qoF | $ENV \cdot C5 \cdot \sin\left\{\frac{\pi}{K} \cdot 5 \cdot qoF\right\} = F5$ | 0 | F1+F2+ F3+F4+ F5 | 0 |
| CH1 | H10 | (qo+1)F | SL EN2 AC3 | (qo+1)F | 5·qoF | (qo+1)F | $ENV \cdot C10 \cdot W \cdot \sin 10\left\{\frac{\pi}{K} \cdot (qo+1)F\right\} = F10$ | 0 | F1+F2+ F3+F4+ F5 | F10 |
| CH2 | H6 | (qo+1)F | EN1 AC0 AC2 | (qo+1)F | 6·qoF | qoF | $ENV \cdot C6 \cdot \sin\left\{\frac{\pi}{K} \cdot 6 \cdot qoF\right\} = F6$ | 0 | F1+F2+ F3+F4+ F5+F6 | F10 |
| CH3 | H12 | (qo+1)F | SL EN3 AC3 | (qo+1)F | 6·qoF | (qo+1)F | $ENV \cdot C12 \cdot W \cdot \sin 12\left\{\frac{\pi}{K} \cdot (qo+1)F\right\} = F12$ | 0 | F1+F2+ F3+F4+ F5+F6 | F10+F12 |
| CH4 | H7 | (qo+1)F | EN1 AC0 AC2 | (qo+1)F | 7·qoF | qoF | $ENV \cdot C7 \cdot \sin\left\{\frac{\pi}{K} \cdot 7 \cdot qoF\right\} = F7$ | 0 | F1+F2+ F3+F4+ F5+F6+ F7 | F10+F12 |
| CH5 | H14 | (qo+1)F | SL EN4 AC3 | (qo+1)F | 7·qoF | (qo+1)F | $ENV \cdot C14 \cdot W \cdot \sin 14\left\{\frac{\pi}{K} \cdot (qo+1)F\right\} = F14$ | 0 | F1+F2+ F3+F4+ F5+F6+ F7 | F10+F12+F14 |
| CH6 | H8 | (qo+1)F | EN1 AC0 AC2 | (qo+1)F | 8·qoF | qoF | $ENV \cdot C8 \cdot \sin\left\{\frac{\pi}{K} \cdot 8 \cdot qoF\right\} = F8$ | 0 | F1+F2+ F3+F4+ F5+F6+ F7+F8 | F10+F12+F14 |
| CH7 | H16 | (qo+1)F | SL EN5 AC3 | (qo+1)F | 8·qoF | (qo+1)F | $ENV \cdot C16 \cdot W \cdot \sin 16\left\{\frac{\pi}{K} \cdot (qo+1)F\right\} = F16$ | 0 | F1+F2+ F3+F4+ F5+F6+ F7+F8 | F10+F12+F14 F16 |

TABLE XXXIV

3RD CALCULATING FRAME CF3

| Calculating channel | Calculated partial tone component Hn | Output qF of accumulator 50 | Control signals which become "1" among output signals of the timing pulse generator 40B | Content of circuit 60B: Output 2m · qF of shift register 614 | Output signals: nqF | Output signals: $2^m \cdot qF$ | Output of multiplier 120 | Contents of accumulators 131 to 133: ΣFn (A) | ΣFn (B) | ΣFn (C) |
|---|---|---|---|---|---|---|---|---|---|---|
| CH0 | H1 | (qo+2)F | LD1, LD2 EN1, AC2 | (qo+2)F | (qo +2)F | (qo+1)F | $ENV \cdot C1 \cdot \sin\left\{\frac{\pi}{K} \cdot (qo+2)F\right\} = F1$ | 0 | F1 | 0 |
| CH1 | H10 | (qo+2)F | SL EN2 AC3 | (qo+2)F | (qo +2)F | (qo+2)F | $ENV \cdot C10 \cdot W \cdot \sin 10\left\{\frac{\pi}{K} \cdot (qo+2)F\right\} = F10$ | 0 | F1 | F10 |
| CH2 | H2 | (qo+2)F | EN1 AC0 AC2 | (qo+2)F | 2·(qo +2)F | (qo+1)F | $ENV \cdot C2 \cdot \sin\left\{\frac{\pi}{K} \cdot 2 \cdot (qo+2)F\right\} = F2$ | 0 | F1+F2 | F10 |
| CH3 | H12 | (qo+2)F | SL EN3 AC3 | (qo+2)F | 2·(qo +2)F | (qo+2)F | $ENV \cdot C12 \cdot W \cdot \sin 12\left\{\frac{\pi}{K} \cdot (qo+2)F\right\} = F12$ | 0 | F1+F2 | F10+F12 |
| CH4 | H3 | (qo+2)F | EN1 AC0 AC2 | (qo+2)F | 3·(qo +2)F | (qo+1)F | $ENV \cdot C3 \cdot \sin\left\{\frac{\pi}{K} \cdot 3 \cdot (qo+2)F\right\} = F3$ | 0 | F1+F2+ F3 | F10+F12 |
| CH5 | H14 | (qo+2)F | SL EN4 AC3 | (qo+2)F | 3·(qo +2)F | (qo+2)F | $ENV \cdot C14 \cdot W \cdot \sin 14\left\{\frac{\pi}{K} \cdot (qo+2)F\right\} = F14$ | 0 | F1+F2+ F3 | F10+F12+F14 |
| CH6 | H4 | (qo+2)F | EN1 AC0 AC2 | (qo+2)F | 4·(qo +2)F | (qo+1)F | $ENV \cdot C4 \cdot \sin\left\{\frac{\pi}{K} \cdot 4 \cdot (qo+2)F\right\} = F4$ | 0 | F1+F2+ F3+F4 | F10+F12+F14 |
| CH7 | H16 | (qo+2)F | SL EN5 AC3 | (qo+2)F | 4·(qo +2)F | (qo+2)F | $ENV \cdot C16 \cdot W \cdot \sin 16\left\{\frac{\pi}{K} \cdot (qo+2)F\right\} = F16$ | 0 | F1+F2+ F3+F4 | F10+F12+F14 +F16 |

TABLE XXXV

4TH CALCULATING FRAME CF4

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H5 | (qo+3)F | LD2, EN1 AC0, AC2 | (qo+3)F | 5·(qo +2)F | (qo+2)F | $ENV \cdot C5 \cdot \sin\left\{\frac{\pi}{K} \cdot 5 \cdot (qo + 2)F\right\} = F5$ | 0 | F1+F2+ F3+F4+ F5 | 0 |
| CH1 | H10 | (qo+3)F | SL EN2 AC3 | (qo+3)F | 5·(qo +2)F | (qo+3)F | $ENV \cdot C10 \cdot W \cdot \sin 10\left\{\frac{\pi}{K} \cdot (qo + 3)F\right\} = F10$ | 0 | F1+F2+ F3+F4+ F5 | F10 |
| CH2 | H6 | (qo+3)F | EN1 AC0 AC2 | (qo+3)F | 6·(qo +2)F | (qo+2)F | $ENV \cdot C6 \cdot \sin\left\{\frac{\pi}{K} \cdot 6 \cdot (qo + 2)F\right\} = F6$ | 0 | F1+F2+ F3+F4+ F5+F6 | F10 |
| CH3 | H12 | (qo+3)F | SL EN3 AC3 | (qo+3)F | 6·(qo +2)F | (qo+3)F | $ENV \cdot C12 \cdot W \cdot \sin 12\left\{\frac{\pi}{K} \cdot (qo + 3)F\right\} = F12$ | 0 | F1+F2+ F3+F4+ F5+F6 | F10+F12 |
| CH4 | H7 | (qo+3)F | EN1 AC0 AC2 | (qo+3)F | 7·(qo +2)F | (qo+2)F | $ENV \cdot C7 \cdot \sin\left\{\frac{\pi}{K} \cdot 7 \cdot (qo + 2)F\right\} = F7$ | 0 | F1+F2+ F3+F4+ F5+F6 F7 | F10+F12 |
| CH5 | H14 | (qo+3)F | SL EN4 AC3 | (qo+3)F | 7·(qo +2)F | (qo+3)F | $ENV \cdot C14 \cdot W \cdot \sin 14\left\{\frac{\pi}{K} \cdot (qo + 3)F\right\} = F14$ | 0 | F1+F2+ F3+F4+ F5+F6+ F7 | F10+F12+F14 |
| CH6 | H8 | (qo+3)F | EN1 AC0 AC2 | (qo+3)F | 8·(qo +2)F | (qo+2)F | $ENV \cdot C8 \cdot \sin\left\{\frac{\pi}{K} \cdot 8 \cdot (qo + 2)F\right\} = F8$ | 0 | F1+F2+ F3+F4+ F5+F6 F7+F8 | F10+F12+F14 |
| CH7 | H16 | (qo+3)F | SL EN5 AC3 | (qo+3)F | 8·(qo +2)F | (qo+3)F | $ENV \cdot C16 \cdot W \cdot \sin 16\left\{\frac{\pi}{K} \cdot (qo + 3)F\right\} = F16$ | 0 | F1+F2+ F3+F4+ F5+F6+ F7+F8 | F10+F12+ F14+F16 |

(c) operation when f≦1000 Hz

When the fundamental frequency f of the musical tone signal is higher than 1000 Hz, only the partial tone components $H_1$ to $H_8$ are calculated in a manner shown in Table XVF. Consequently, under these conditions, the timing pulse generator 40B produces various control signals shown in FIG. 25F at a predetermined timing. In this case, the value qF of the partial tone phase designation signals nqF utilized to calculate the first to 8th partial tone components $H_1$ to $H_8$ is updated in each calculating frame. For this reason, the load signal LD1 becomes "1" at the commencement of respective calculating frames (a channel time of the calculating channel CH0).

Thus, under a condition of [f≧1000 Hz], in the first calculating frame CF1, for example, the amplitude value Fn of each partial tone components Hn is calculated as shown in the following Table XXXVI.

TABLE XXXVI

1ST CALCULATING FRAME CF1

| Calculating channel | Calculated partial tone component Hn | Output qF of accumulator 50 | Control signals which become "1" among output signals of the timing pulse generator 40B | Content of circuit 60B: Output 2m · qF of shift register 614 | Content of circuit 60B: Output signals nqF | Content of circuit 60B: Output signals $2^m \cdot qF$ | Output of multiplier 120 | Contents of accumulators 131 to 133: ΣFn (A) | Contents of accumulators 131 to 133: ΣFn (B) | Contents of accumulators 131 to 133: ΣFn (C) |
|---|---|---|---|---|---|---|---|---|---|---|
| CH0 | H1 | qoF | LD1<br>EN1<br>AC3 | qoF | qoF | (qo−1)F | $ENV \cdot C1 \cdot \sin\left\{\frac{\pi}{K} \cdot qoF\right\} = F1$ | 0 | 0 | F1 |
| CH1 | H2 | qoF | EN1<br>AC0<br>AC3 | qoF | 2 qoF | (qo−1)F | $ENV \cdot C2 \cdot \sin\left\{\frac{\pi}{K} \cdot 2 \cdot qoF\right\} = F2$ | 0 | 0 | F1+F2 |
| CH2 | H3 | qoF | EN1<br>AC0<br>AC3 | qoF | 3 qoF | (qo−1)F | $ENV \cdot C3 \cdot \sin\left\{\frac{\pi}{K} \cdot 3 \cdot qoF\right\} = F3$ | 0 | 0 | F1+F2+F3 |
| CH3 | H4 | qoF | EN1<br>AC0<br>AC3 | qoF | 4 qoF | (qo−1)F | $ENV \cdot C4 \cdot \sin\left\{\frac{\pi}{K} \cdot 4 \cdot qoF\right\} = F4$ | 0 | 0 | F1+F2+F3+F4 |
| CH4 | H5 | qoF | EN1<br>AC0<br>AC3 | qoF | 5 qoF | (qo−1)F | $ENV \cdot C5 \cdot \sin\left\{\frac{\pi}{K} \cdot 5 \cdot qoF\right\} = F5$ | 0 | 0 | F1+F2+F3+F4+F5 |
| CH5 | H6 | qoF | EN1<br>AC0<br>AC3 | qoF | 6 qoF | (qo−1)F | $ENV \cdot C6 \cdot \sin\left\{\frac{\pi}{K} \cdot 6 \cdot qoF\right\} = F6$ | 0 | 0 | F1+F2+F3+F4+F5+F6 |
| CH6 | H7 | qoF | EN1<br>AC0<br>AC3 | qoF | 7 qoF | (qo−1)F | $ENV \cdot C7 \cdot \sin\left\{\frac{\pi}{K} \cdot 7 \cdot qoF\right\} = F7$ | 0 | 0 | F1+F2+F3+F4+F5+F6+F7 |
| CH7 | H8 | qoF | EN1<br>AC0<br>AC3 | qoF | 8 qoF | (qo−1)F | $ENV \cdot C8 \cdot \sin\left\{\frac{\pi}{K} \cdot 8 \cdot qoF\right\} = F8$ | 0 | 0 | F1+F2+F3+F4+F5+F6+F7+F8 |

As above described, in the musical tone signal generator of the embodiment shown in FIG. 22, while the partial tone components constituting the musical tone signal are calculated at a frequency corresponding to a ratio of the partial tone components Hn to the calculation reference frequency fCA, especially higher order partial tone components are generated by a band control utilizing a Hanning window function. For this reason, it is possible to produce a musical tone signal constituted by a plurality of partial tone components with a construction of small scale. Moreover, as the amplitude of lower order partial tone components can be controlled individually, it is easy to set a fundamental tone color, and in addition since a plurality of higher order partial tone components obtained by the band control are added it is possible to produce a musical tone rich in the tone colors.

Although in this embodiment, a Hanning window function is used as the window function it is also possible to use a Hamming window function or a rectangular window function. This embodiment is constructed such that a waveform gained by modifying a sine waveform of a period N by window function is stored in a memory device which is accessed by a partial tone phase desigantion signal $2^m \cdot qF$ (see FIG. 22), or instead of the above construction it is also possible to modify an amplitude information Cn with a window function.

Another embodiment of a portion generating signals qF, nqF and $2^m \cdot qF$

Figure 28:
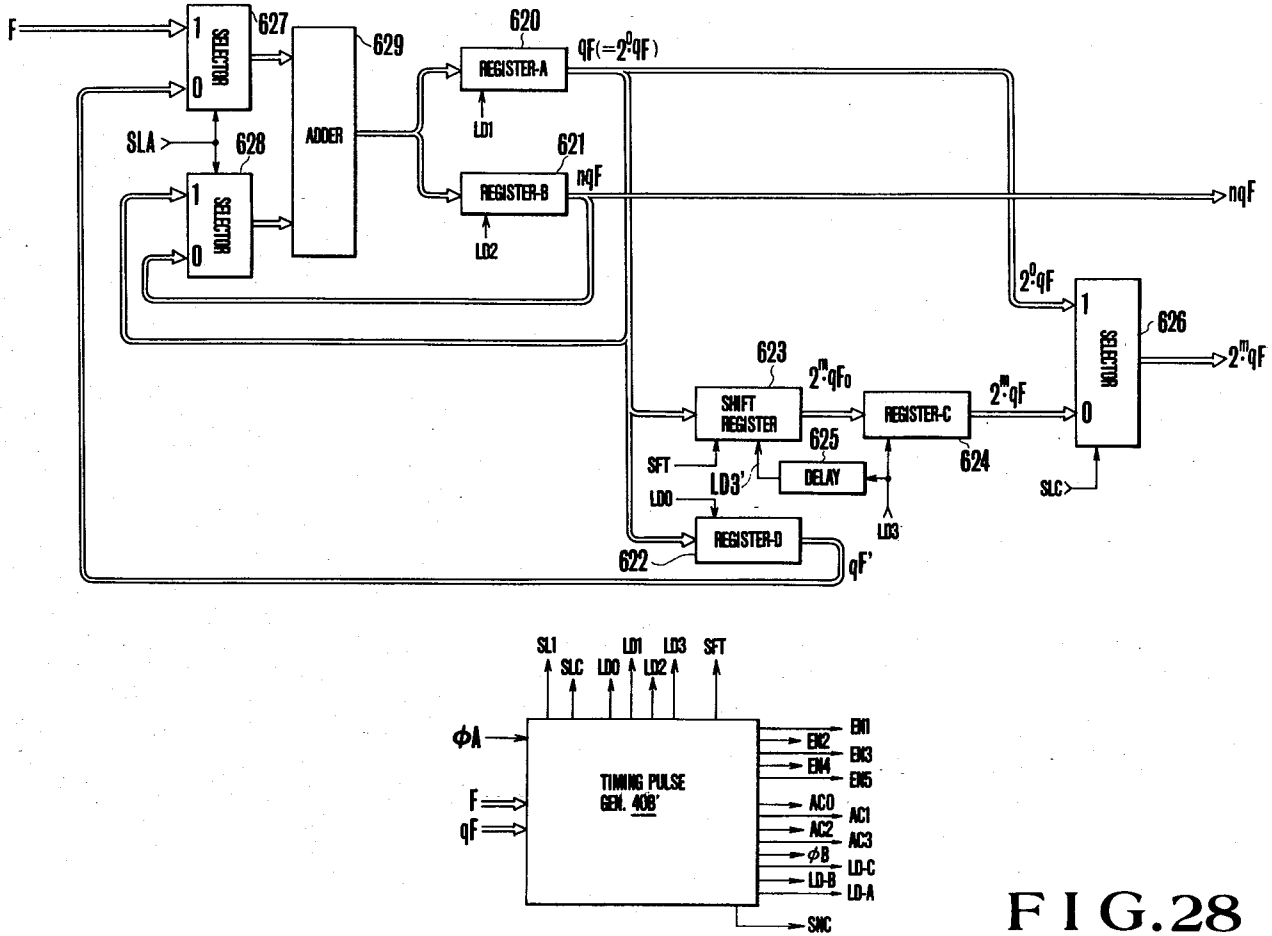
FIG. 28 is a block diagram showing the detail of a modification of portions which generate signals qF, nqF and $2^m$ qF in the circuit shown in FIG. 22.

FIG. 28 shows another embodiment of a portion comprising an accumulator 50 (FIG. 22) which generates signals qF, nqF and $2^m \cdot qF$ (m=0, 1, 2, 3) and a partial tone phase designation signal generator 60B. The modification shown in FIG. 28 is constructed such that signals qF, nqF and $2^m qF$ are obtained by subjecting the frequency number F to a suitable calculating operation.

In this case, a timing signal, etc. obtained by the arithmetic operation of signals qF, nqF and $2^m \cdot qF$ are given by the timing pulse generator 40B but various signals produced by the timing pulse generator 40B are modified somewhat when the method of preparing these signals qF, nqF and $2^m \cdot qF$ is changed. Accordingly, in this modification the timing pulse generator 40B is shown in FIG. 40B' as a timing pulse generator 40B'. This timing pulse generator 40B' produces signals EN1 to EN5, AC0 to AC3, clock pulse $\phi$B and calculation cycle signal SNC just in this same manner as the timing pulse generator 40B shown in FIG. 22 but produces selection signals SLA and SLC, load signals LD0 to LD3 and shift signal SFT shown in FIG. 29A through 29F instead of signals SFT, SL, LD1 and LD2. In the timing chart shown in FIGS. 29A to 29F, signals EN1 to EN5 and signals AC0 to AC3 are not shown.

In FIG. 28, like aforementioned accumulator 50, register-A 620 produces accumulated value qF ($=2^0 \cdot qF$), while a B register-B 621 produces signal nqF like the accumulator 612 shown in FIG. 26. A register-D 622 holds a signal qF for one calculation cycle time $T_{cy}$, the signal being produced by the register-A 620 at the commencement of each calculating cycle $T_{cy}$ and then produces it as a signal qF'. A shift register 623 is provided for shifting by m bits the output signal qF of A register 620 toward upper bits and then producing it as a signal $2^m \cdot qFo$ (m=1, 2, 3). Thus, this shift register corresponds to the shift register 614 shown in FIG. 26. A register-C 624 stores the output signal $2^m \cdot qFo$ of the shift register 623 at the time of building up of the load signal LD3 given by the timing pulse generator 40B' and produces the stored signal as a signal $2^m \cdot qF$. This register-C 624 corresponds to the register 616 shown in FIG. 26. A delay circuit 625 is provided for slightly delaying the load signal LD3 produced by the timing pulse generator 40B' and for supplying the delayed load signal LD3' to the shift register 623 as a load signal. The delay circuit 625 corresponds to the delay circuit 613 shown in FIG. 26. A selector 626 supplies to WF.SFM(1) 71 to WF.SFM(4)74, as an address signal, either one the output signal qF($=2^0qF$) produced by the register-A 620 and the output signal $2^m qF$ of the register-C 624 in accordance with the selection signal SLC produced by the timing pulse generator 40B', and corresponds to the selector 617 shown in FIG. 26.

A circuit portion constituted by selectors 627 and 628 and an adder 629 performs a calculating operation of (qF+F) or (nqF+qF') in accordance with a selection signal SLA produced by the timing pulse generator 40B' and the result of the calculation is applied to both of the register-A 620 and the register-B 621. In this case, the result of calculation is stored in either one or both of the register-A 620 and register-B 621 under the control of load signals LD1 and LD2.

More particularly, when the selection signal SLA produced by the timing pulse generator 40B' is "1", the selector 627 selects and outputs the frequency number F and the selector 628 selects and outputs the signal qF outputted by the register-A. As a consequence, the adder 629 produces a sum (F+qF) or (q+1)F. On the other hand, where the selection signal SLC produced by the timing pulse generator 40B' is "0", the selector 627 selects and products a signal qF' produced by the register-D 622, while the selector 628 selects and outputs a signal nqF outputted by the register-B 621. Accordingly, the adder 629 produces a sum (qF'+nqF) or (n+1)qF. Thus, by suitably controlling the timings of generation of the selection signal SLA, the load signal LD1 applied to the register-A 620 and the load signal LD2 applied to the register-B 621, it is posible to obtain the signal qF from the register-A 620 and the signal nqF from the register-B 621.

This means that the selectors 627 and 628, the adder 629 and register-A 620 cooperate to perform a function corresponding to that of the accumulator 50 shown in FIG. 22, and that the selectors 627 and 628, the adder 629 and the register-B 621 cooperate to perform a function corresponding to that of the accumulator 612 shown in FIG. 26, thus saving one accumulator.

The signal qF utilized in the timing pulse generator 40B' to judge the time band in one period of the generated musical tone signal is given by the register-A 620.

The operation of a case wherein the fundamental frequency f of the generated musical tone signal is less than 500 Hz and the partial tone components Hn ($H_1$ to $H_8$, $H_{10}$, $H_{12}$, $H_{14}$, $H_{16}$, $H_{20}$, $H_{24}$, $H_{28}$, and $H_{32}$) shown in Table XVa are calculated in a time band $[0 \leqq Tx < \frac{1}{2}T]$ in one period T of the generated musical tone signal will be described hereunder, as a typical example.

Figure 29A:
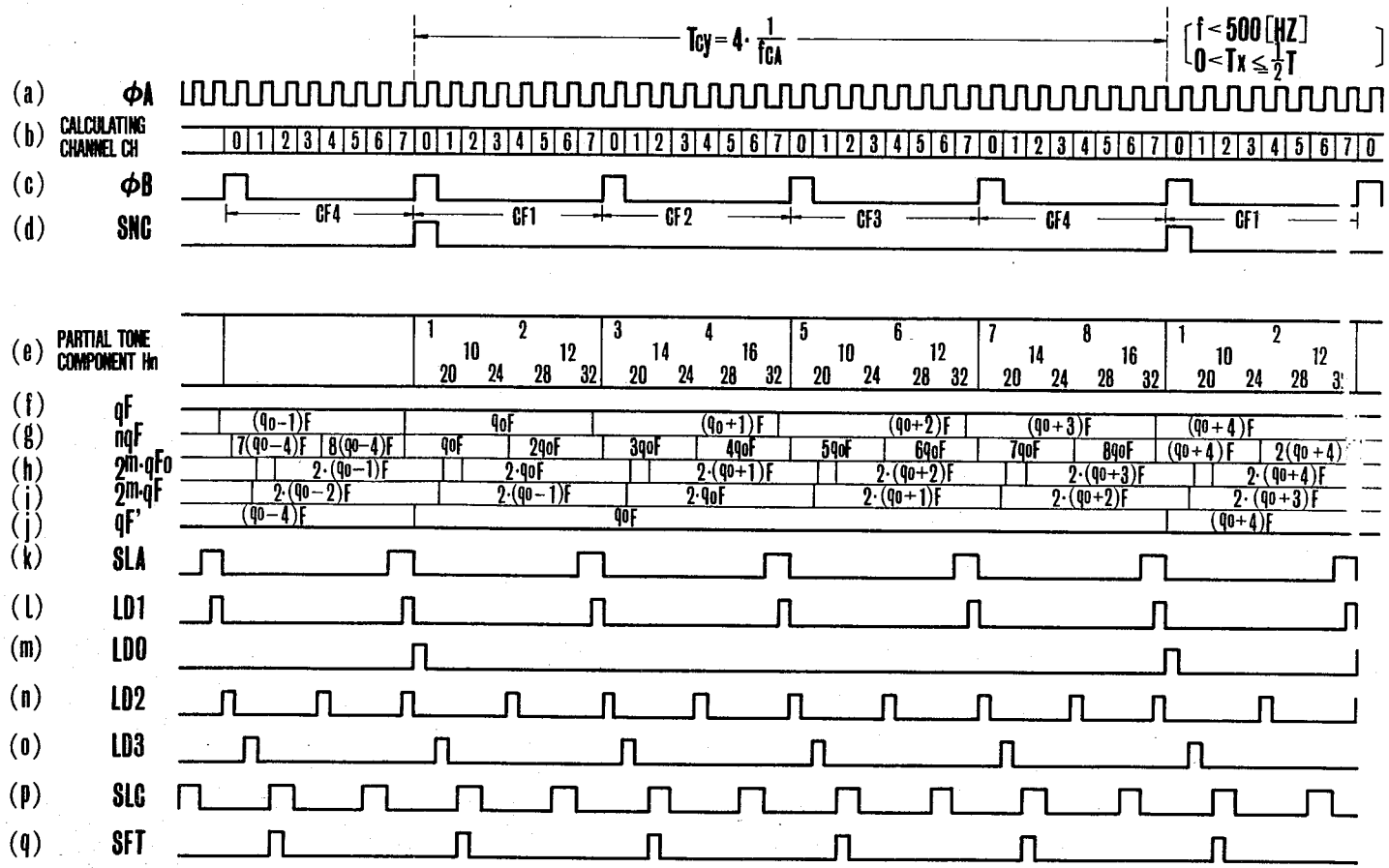
FIGS. 29A through 29F are timing charts showing the timings of various signals produced by the timing signal generator shown in FIG. 28.
Figure 29B:
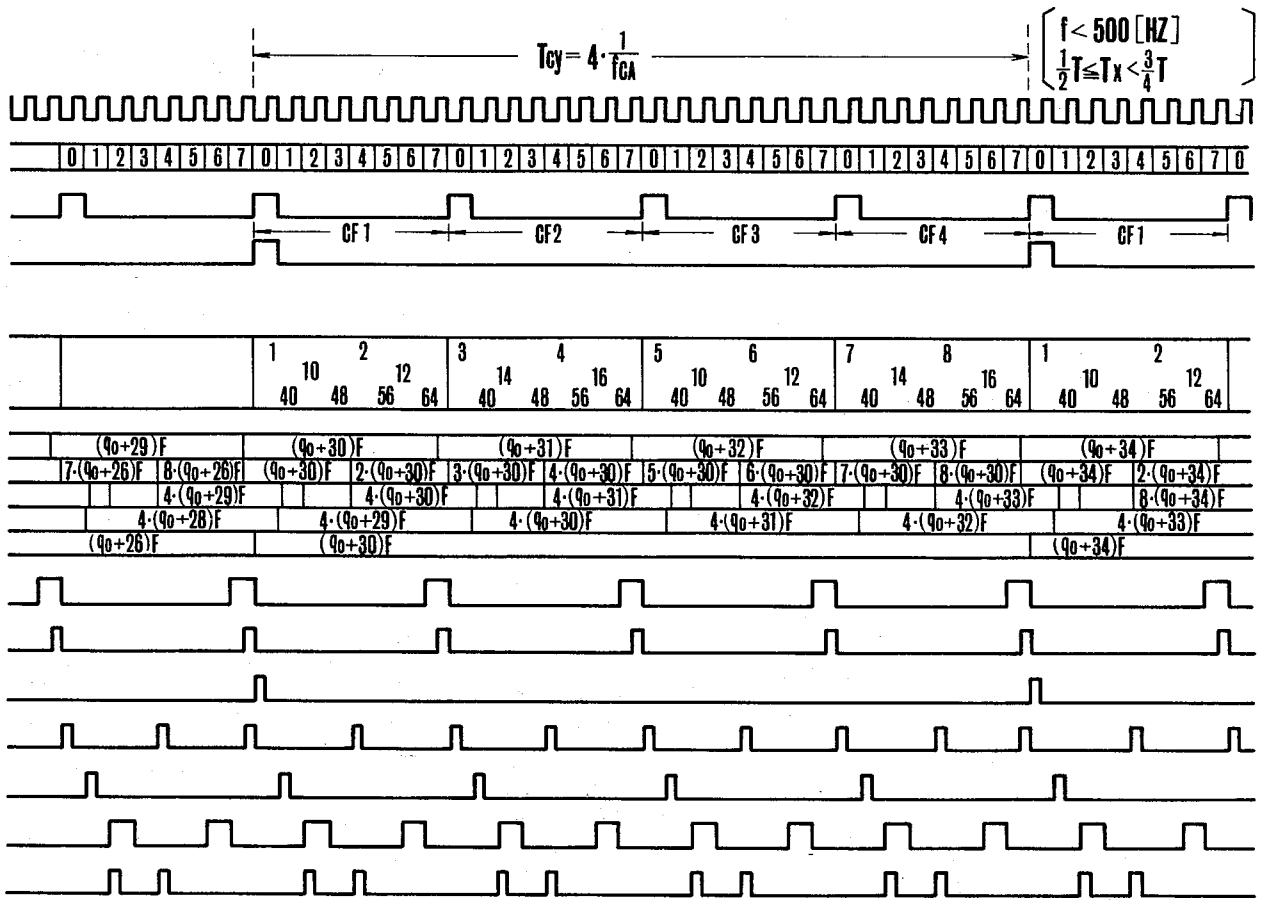
Figure 29C:
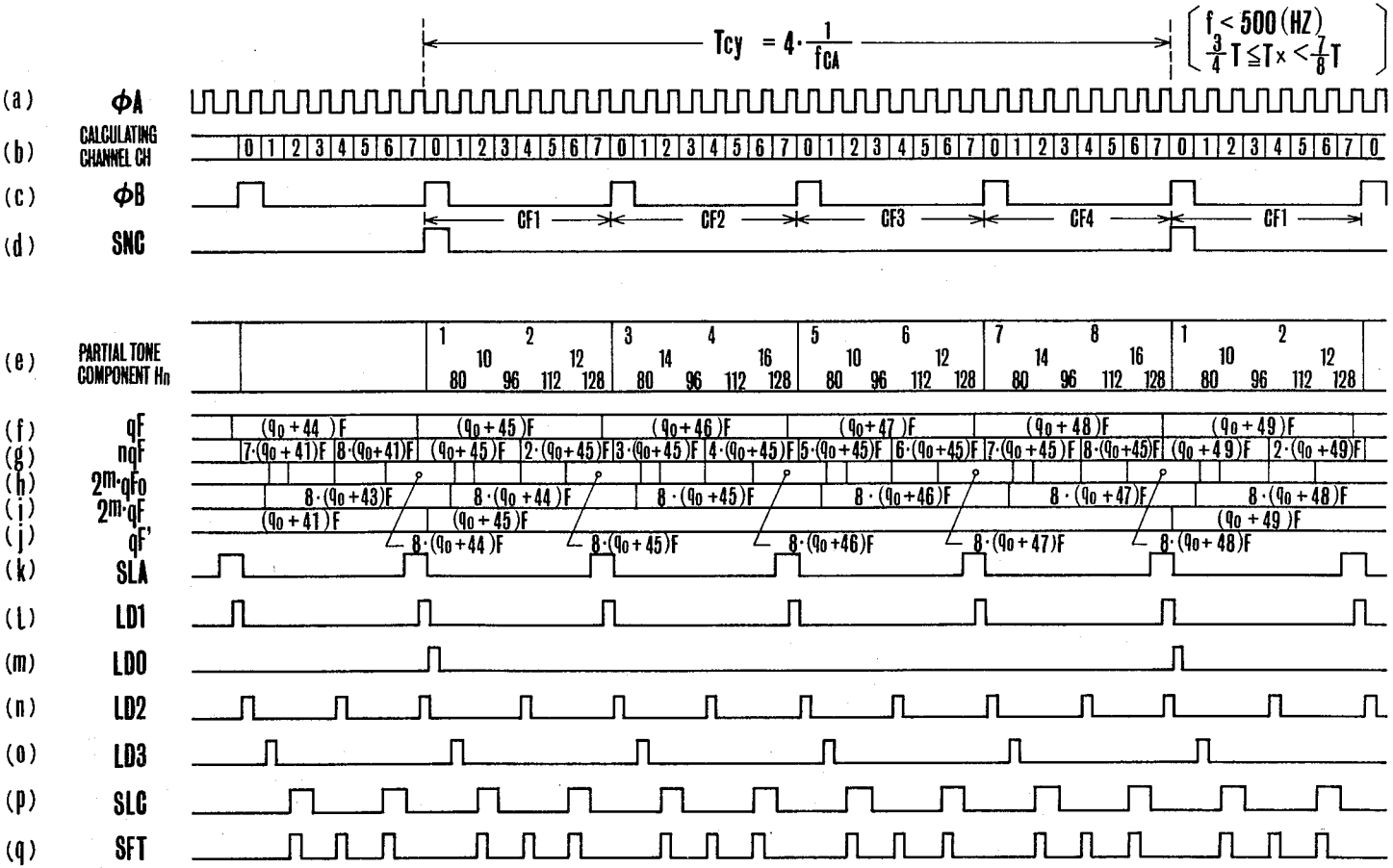
Figure 29D:
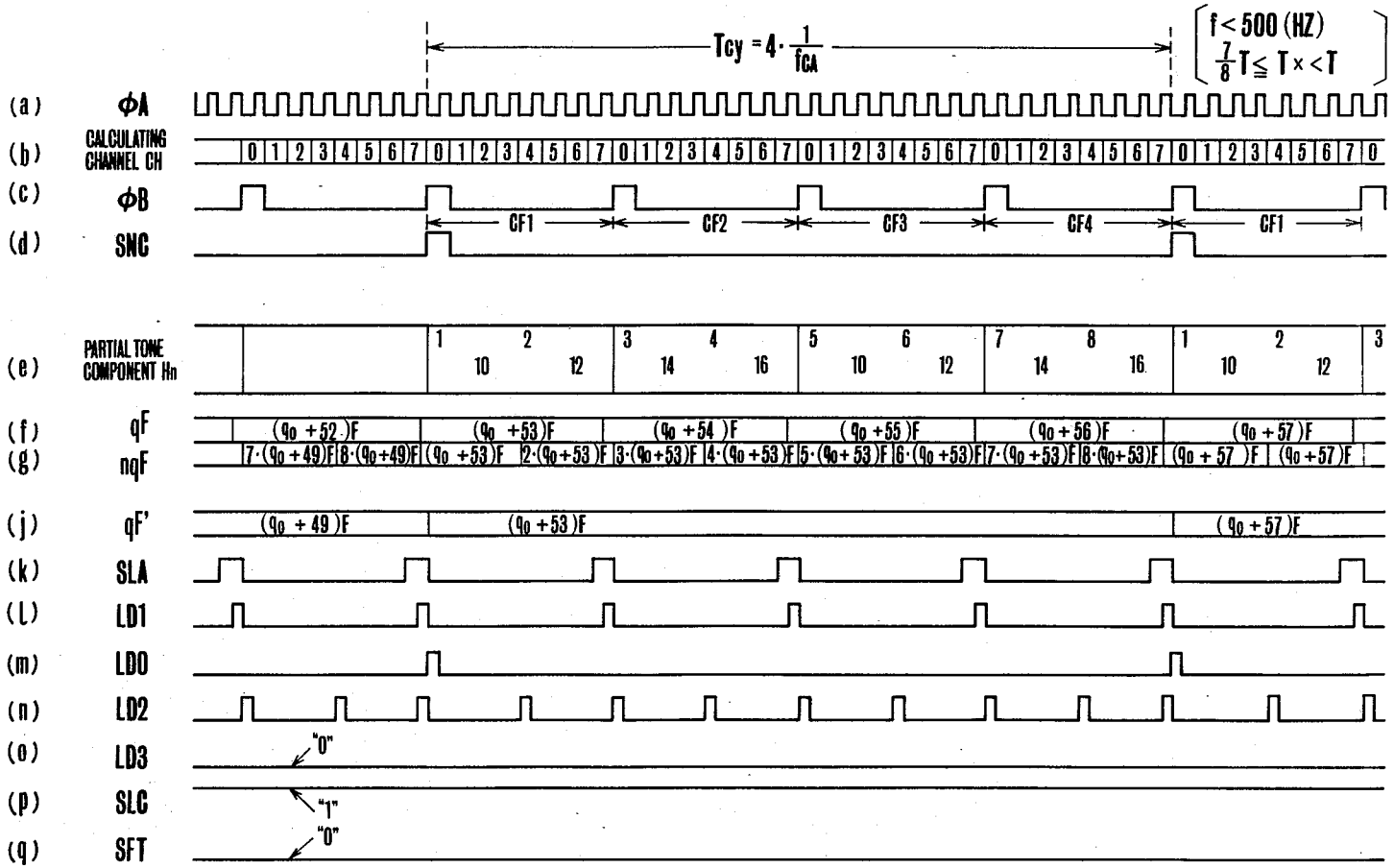
Figure 29E:
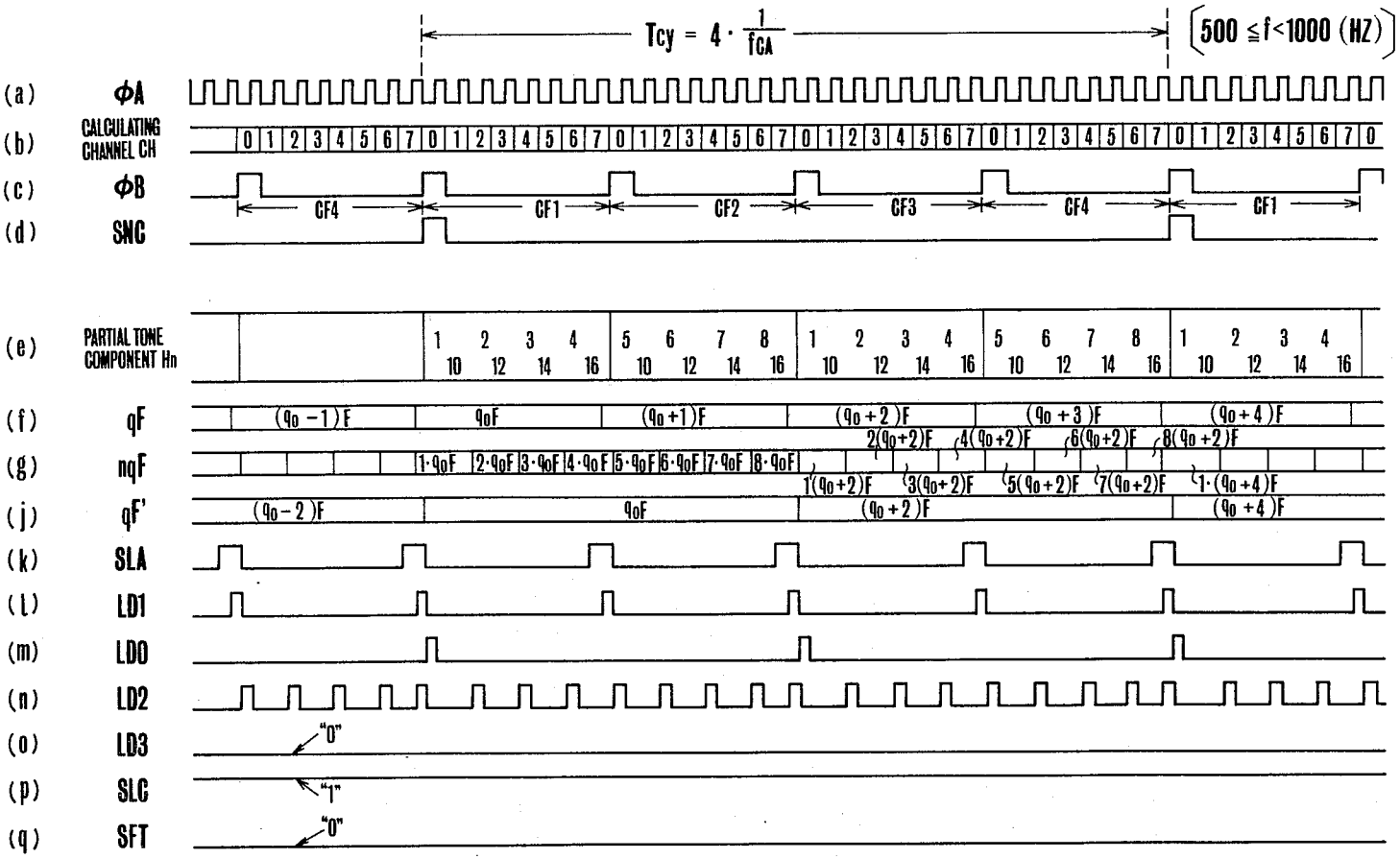
Figure 29F:
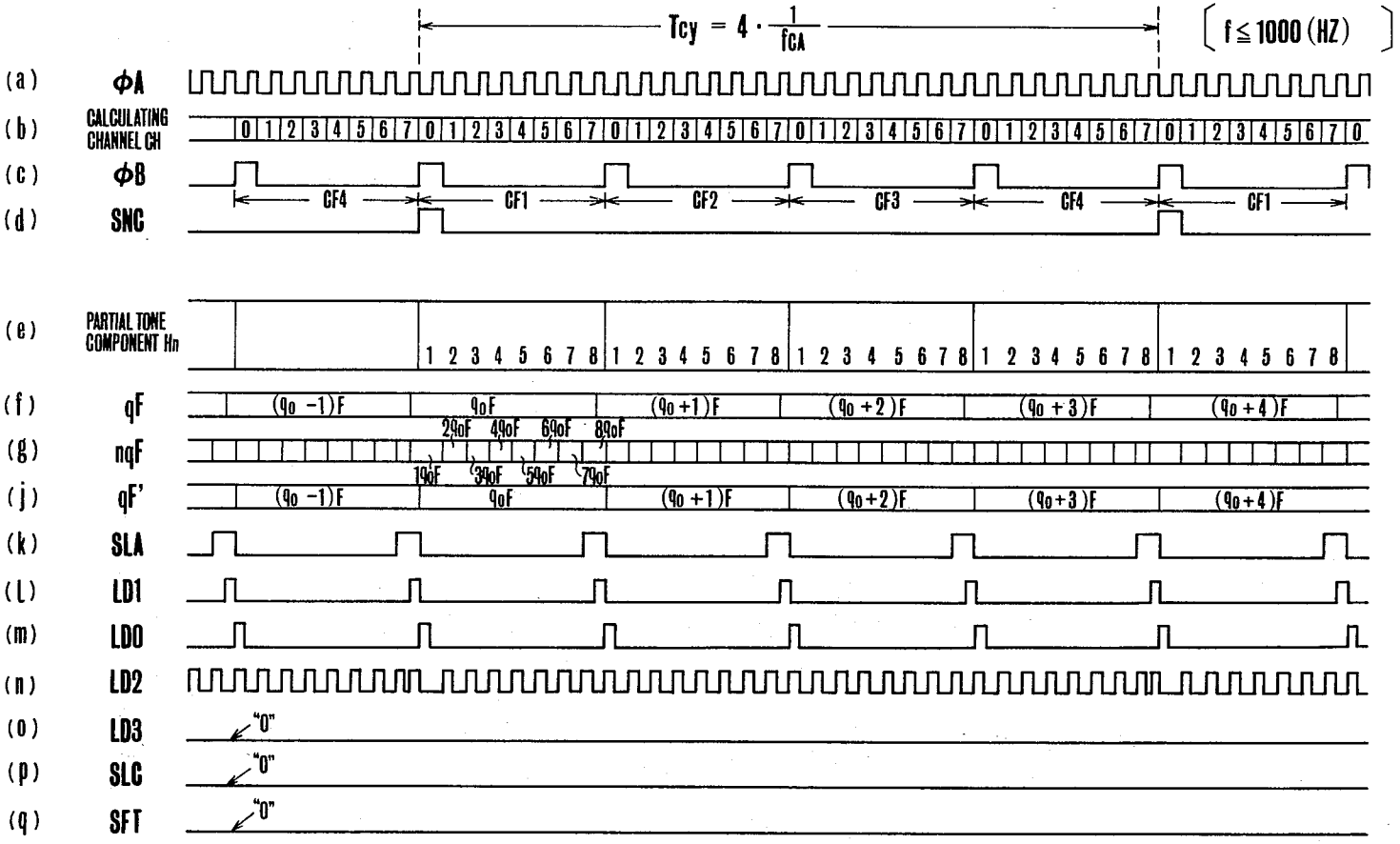

In this case, signals SLA, LD1, LD0, LD2, LD3, SLC and SFT are produced by the timing pulse generator 40B' at timings as shown by (k) to (q) of FIG. 29A.

Thus, signals qF, nqF, $2^m qFo$, $2^m qF$ and qF' are produced as shown in (f)–(j) of FIG. 29A in a calculating frame CF4 preceding the first calculating frame CF1. Suppose now that $qF=(qo-1)F$ $nqF=8(qo-4)F$ $2^m \cdot qFo=2(qo-1)F$ $2^m \cdot qF=2(qo-2)F$ $qF'=(qo-4)F$ Then, at the time of transferring to the calculating operation of the first calculating frame CF1 of the new calculating cycle Tcy, for the purpose of updating the contents of the registers 620 and 621 a selection signal SLA of "1" [(k) of FIG. 29A] is produced in a channel time of the last channel time CH7 of the fourth calculating frame CF4 while at the same time a load signal LD1 of "1" [(l) of FIG. 29A] and a load signal LD2 [(l) of FIG. 29A] are produced by the timing pulse generator, 40B' in the latter half portion of this channel time. Accordingly, the adder 629 operates to calculate a sum $[F+(qo-1)F=qoF]$, and this sum is applied to the register-A 620 and the register-B 621 by the load signals LD1 and LD2.

Accordingly, the contents of the register-A 620 and the register-B 621 are changed to qoF respectively as shown in (f) and (g) in FIG. 29A.

The processings in the first calculating frame CF1 are started from the states described above.

In the first calculating frame CF1, for the purpose of storing the content qoF of the register-A 620 which has been updated to qoF in the register-D 622, a load signal LO0 of "1" [see (m) of FIG. 29A] is produced by the timing pulse generator 40B' in the fore half of a channel time of the calculating channel CH0 whereby the content of the register-D 622 is held the content qoF until the operation is transferred to the next calculating cycle Tcy.

During the channel time of the calculating channel CH0, the content qoF of the register-B 621 which has been updated to qoF is outputted as a signal nqF. Further, the content $2\cdot(qo-2)F$ of the register-C 624 is produced by the selector 626 as a signal $2^m \cdot qF$.

At this time, the signal $2(qo-2)F$ outputted from the selector 626 is supplied to WF·SFM(1) to the WF·SFM(4)74 (FIG. 22) to act as an address signal, but since in the channel time of this calculating channel CH0, only an enable signal EN1 among enable signals EN1 to EN5 is made to be "1" in this channel time, a sine amplitude value $\sin[\pi/\kappa \cdot qoF]$ corresponding to a partial tone phase designation signal $1\cdot qoF$ wherein $n=1$ is produced by the sinusoid table 70.

In the fore half of the channel time of the calculating channel CH1, the load signal LD3 becomes 1 with the result that the content $2^1\cdot(qo-1)F$ of the shift register 623 is stored in the register-C 624 and slightly later the content qoF of the register-A 620 is stored in the shift register 623. Consequently, the content of the register-C 624 becomes $2\cdot(qo-1)F$, whereas the content of the shift register 623 becomes qoF $(=2^0\cdot qoF)$. In this channel time of the calculating channel CH1, the selection signal SLC produced by the timing pulse generator 40B' has become to "0" and since only the enable signal EN2 among the enable signals EN1 to EN5 is "1" (FIG. 25A) the WF SFM(1)71 produces a waveform amplitude value $W\cdot\sin 10[\pi/\kappa\cdot 2\cdot(qo-1)F]$ corresponding to the partial tone phase designation signal $2\cdot(qo-1)F$. In other words, the waveform amplitude value $W\cdot\sin 10[\pi/\kappa\cdot 2\cdot(qo-1)F]$ regarding the 20th partial tone component $H_{20}$ is produced.

Next, in the channel CH2, the timing pulse generator 40B' produces a selection signal SLC of "1" and a shift signal SFT [(p) and (q) of FIG. 29A], whereby the selector 626 produces the output signal $qoF(=2^0\cdot qoF)$ of the register-A 620 as the partial tone phase designation signal $2^m\cdot qF$. The content qoF of the shift register 623 is changed to $2\cdot qoF$ from qoF. In this channel time of the calculating channel CH2, since the enable signal EN2 is still at "1", the WF·SFM(1)71 produces a waveform amplitude value $W\cdot\sin 10[\pi/\kappa\cdot qoF]$ corresponding to the partial tone phase designation signal qoF. In other words, the waveform amplitude value $W\cdot\sin 10[\pi/\kappa\cdot qoF]$ regarding the 10th partial tone component H10 is calculated.

Then, in a channel time of the calculating channel CH3, the selection signal SLC becomes "0" and only the enable signal EN3 becomes "1" so that the WF SFM(2)72 produces a waveform amplitude value $W\cdot\sin 12[\pi/\kappa\cdot 2\cdot(qo-1)F]$ corresponding to the partial tone phase designation signal $2\cdot(qo-1)F$. In other words the waveform amplitude value $W\cdot\sin 12[\pi/\kappa\cdot 2\cdot(qo-1)F]$ regarding the 24th partial tone component H24 is calculated.

Then, in a channel time of the calculating channel CH4, a load signal LD2 of "1" is outputted from the timing pulse generator 40B'. At this time, since the selection signal SLA for the selectors 627 and 628 is "0", the adder 629 produces an output $[qF'+nqF=qoF+qoF=2\cdot qoF]$, with the result that the content of the register-B 621 would be updated to 2qoF. At the same time, since only the enable signal EN1 is made to be "1", the sinusoid table 70 produces a sine amplitude value $\sin[\pi/\kappa\cdot 2\cdot qoF]$ corresponding to the partial tone phase designation signal $2\cdot qoF$. In other words, the sine amplitude value $\sin[\pi/\kappa\cdot 2\cdot qoF]$ regarding the second partial tone component H2 is calculated.

Thereafter, also in the calculating channels CH5 to CH7, signals qF, nqF, and $2^m\cdot qF$ are formed for producing predetermined partial tone components (H28, H12 and H32) shown in Table XVa.

As above described, the circuit shown in FIG. 28 can save one accumulator in comparison with that shown in FIG. 22 used to form signals qF, nqF and $2^m\cdot qF$.

Where various partial tone components are calculated in a manner as shown in Tables XV (b) to (f), the selection signals SLA, the load signals LD0 to LD3, etc. are produced by the timing pulse generator 40B' according to the timing charts shown in FIGS. 29B to 29F so that description of the operation under these conditions will not be made.

Another embodiment of a portion that forms information ENV·Cn

Figure 30:
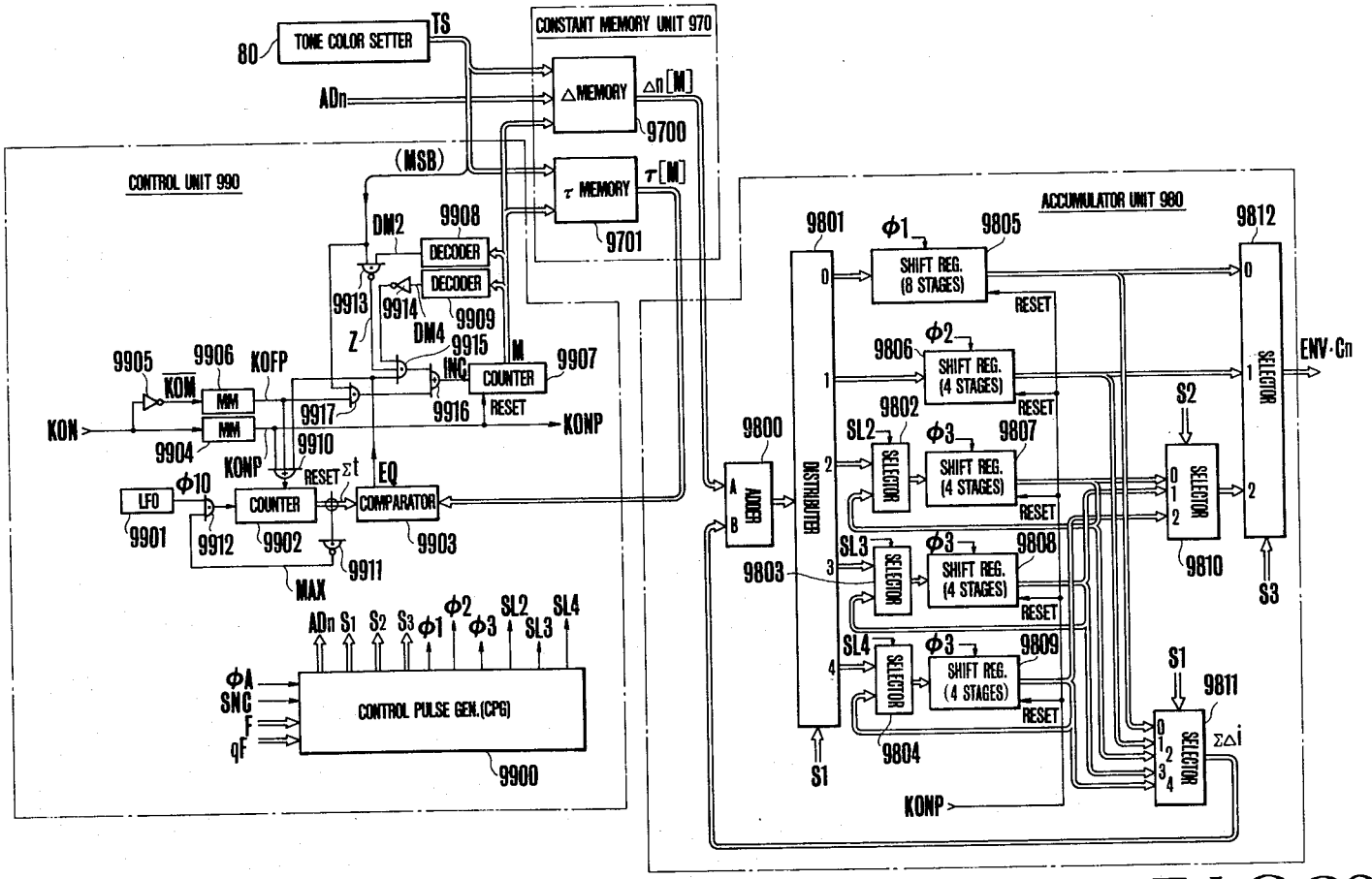
FIG. 30 is a block diagram showing the detail of a modification of a portion generating an information ENV.Cn in the circuit shown in FIG. 22.
Figure 31:
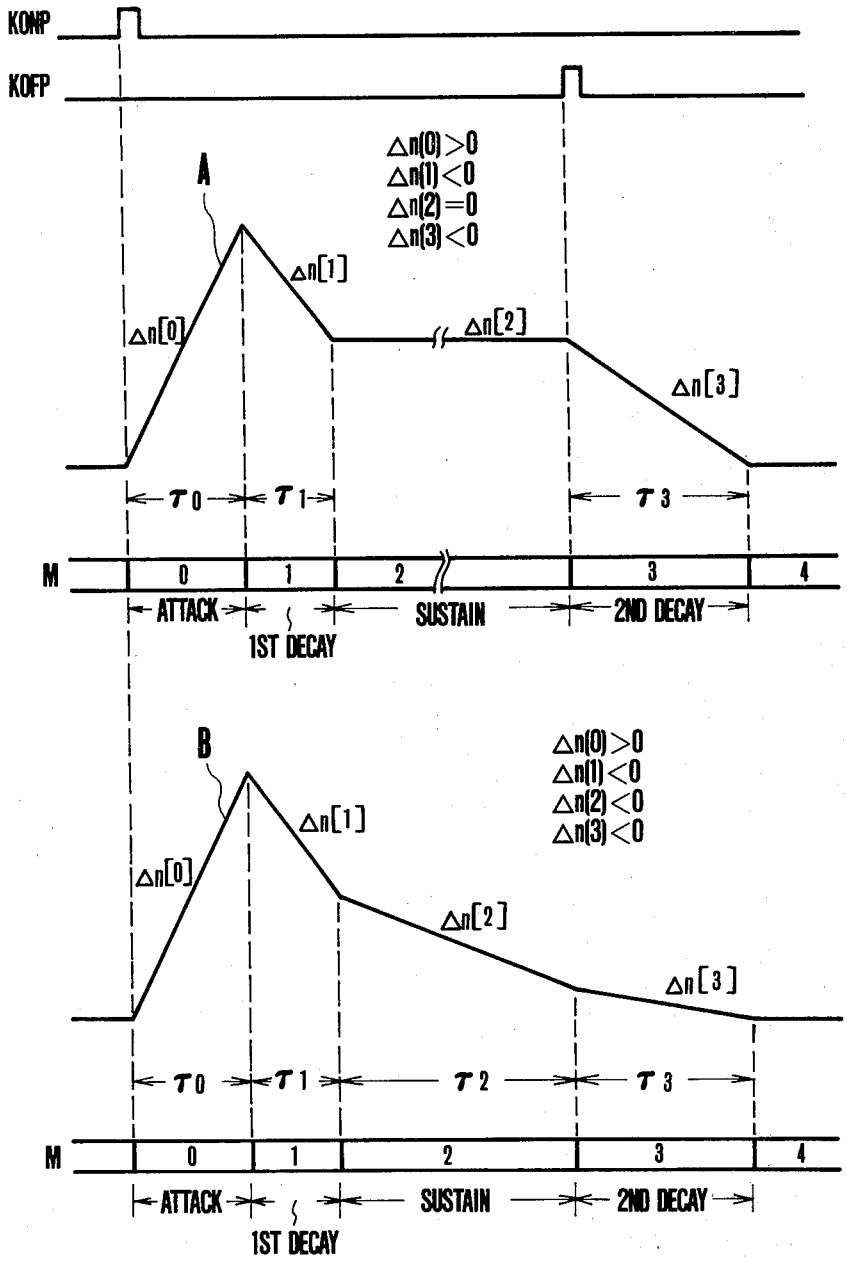
FIG. 31 shows envelope waveforms of the information ENV.Cn generated by the circuit shown in FIG. 30.
Figure 32A:
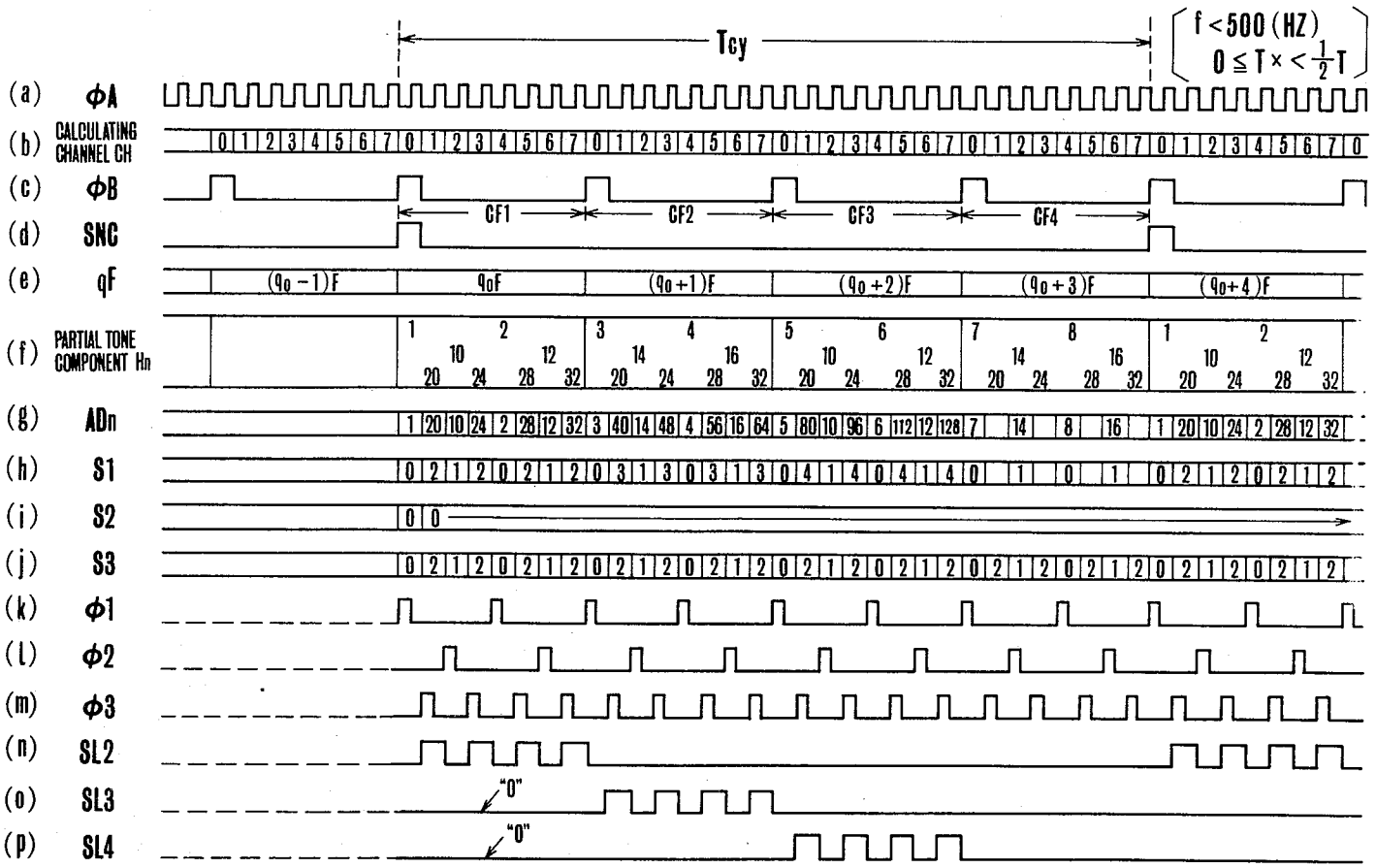
FIGS. 32A through 32F are timing charts showing the timings of various signals produced by the control pulse generator shown in FIG. 30.
Figure 32B:
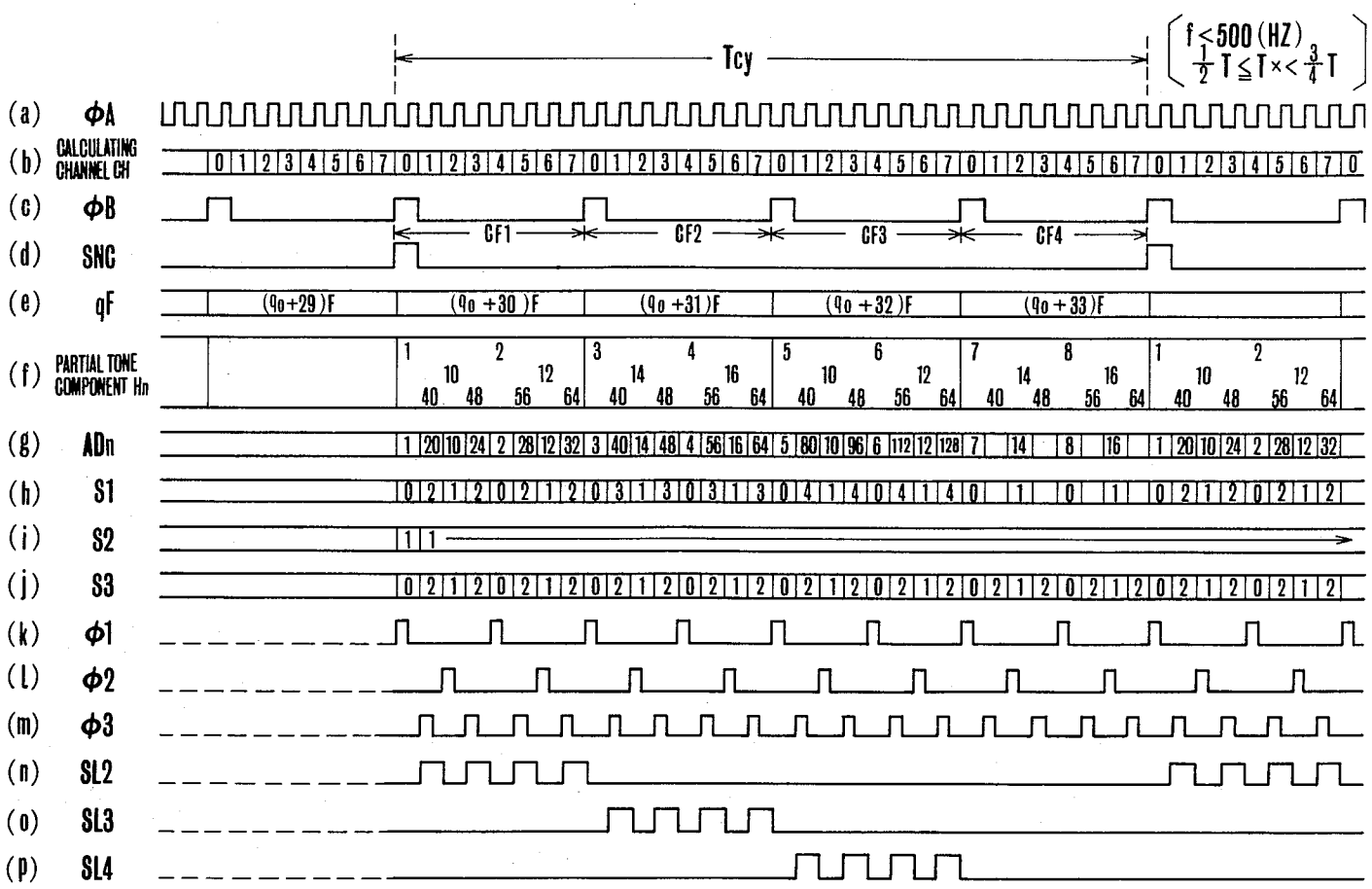
Figure 32C:
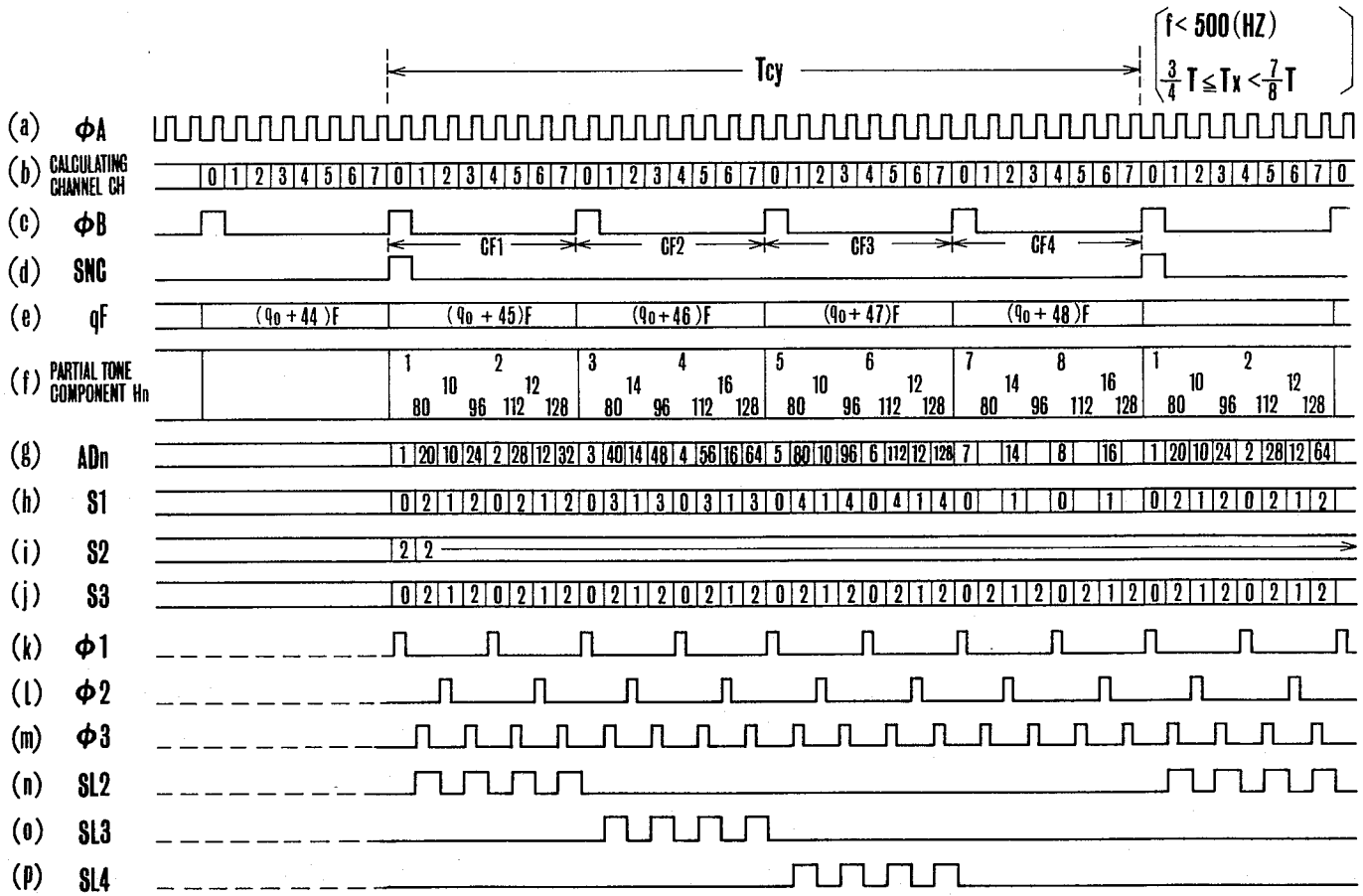
Figure 32D:
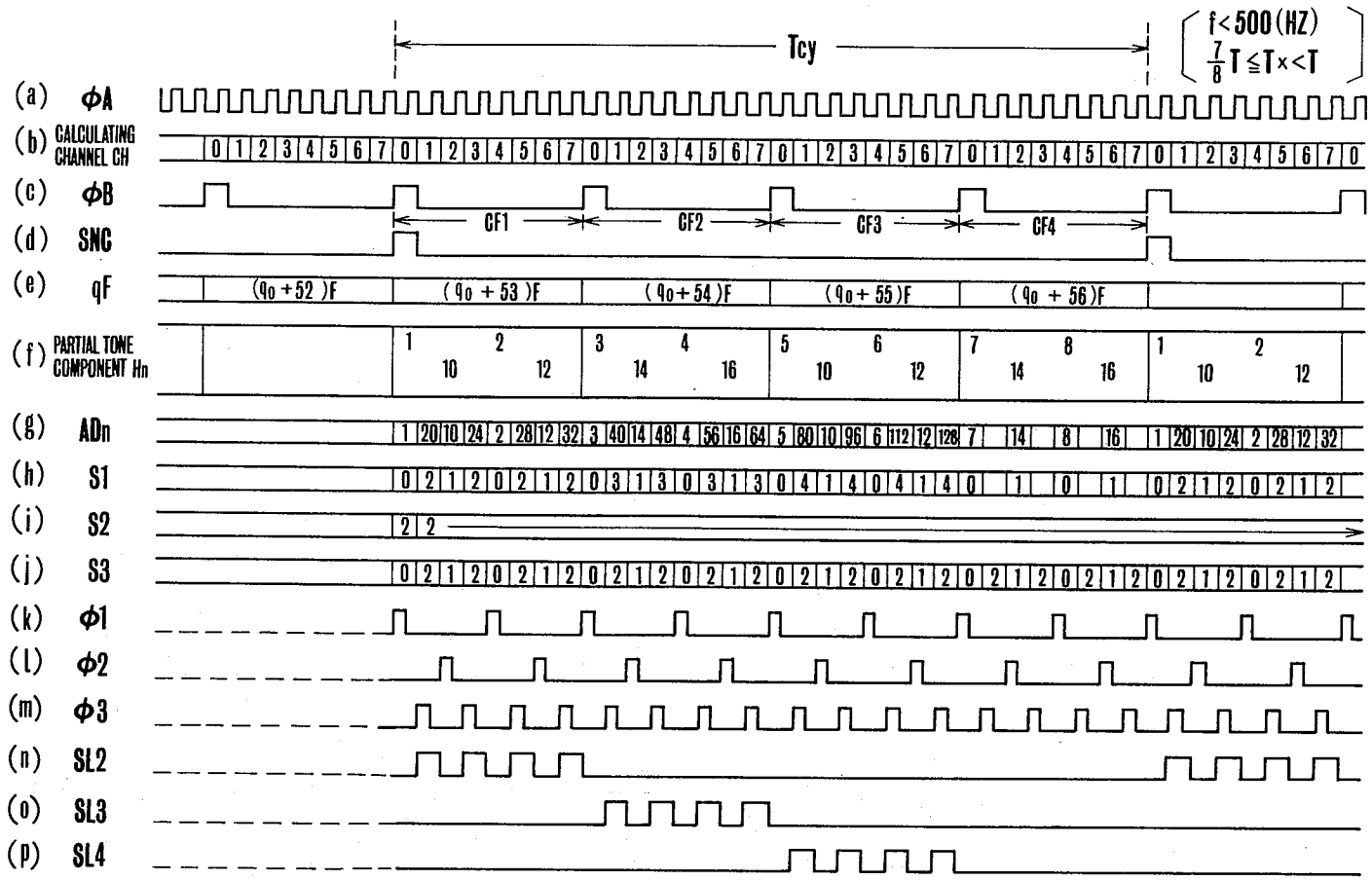
Figure 32E:
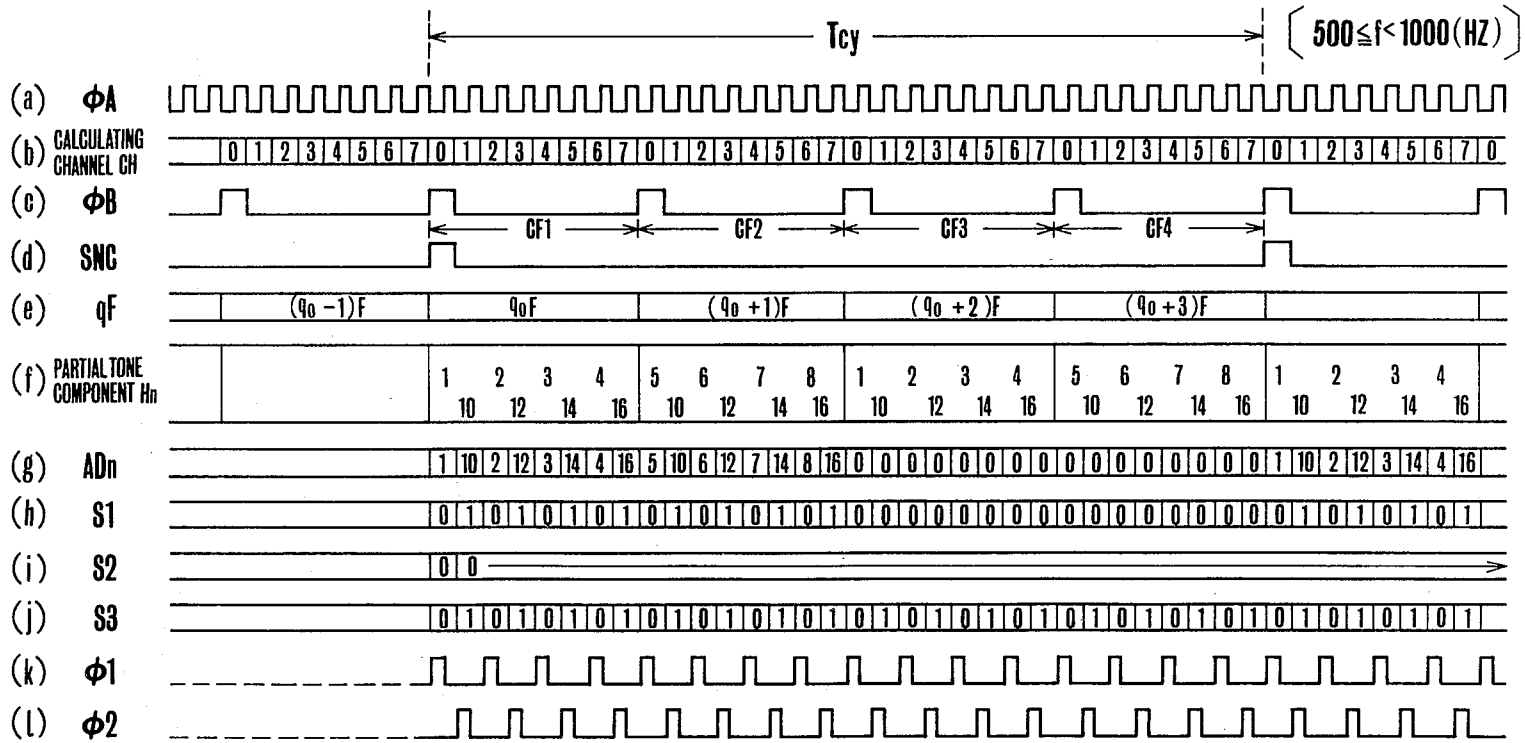
Figure 32F:
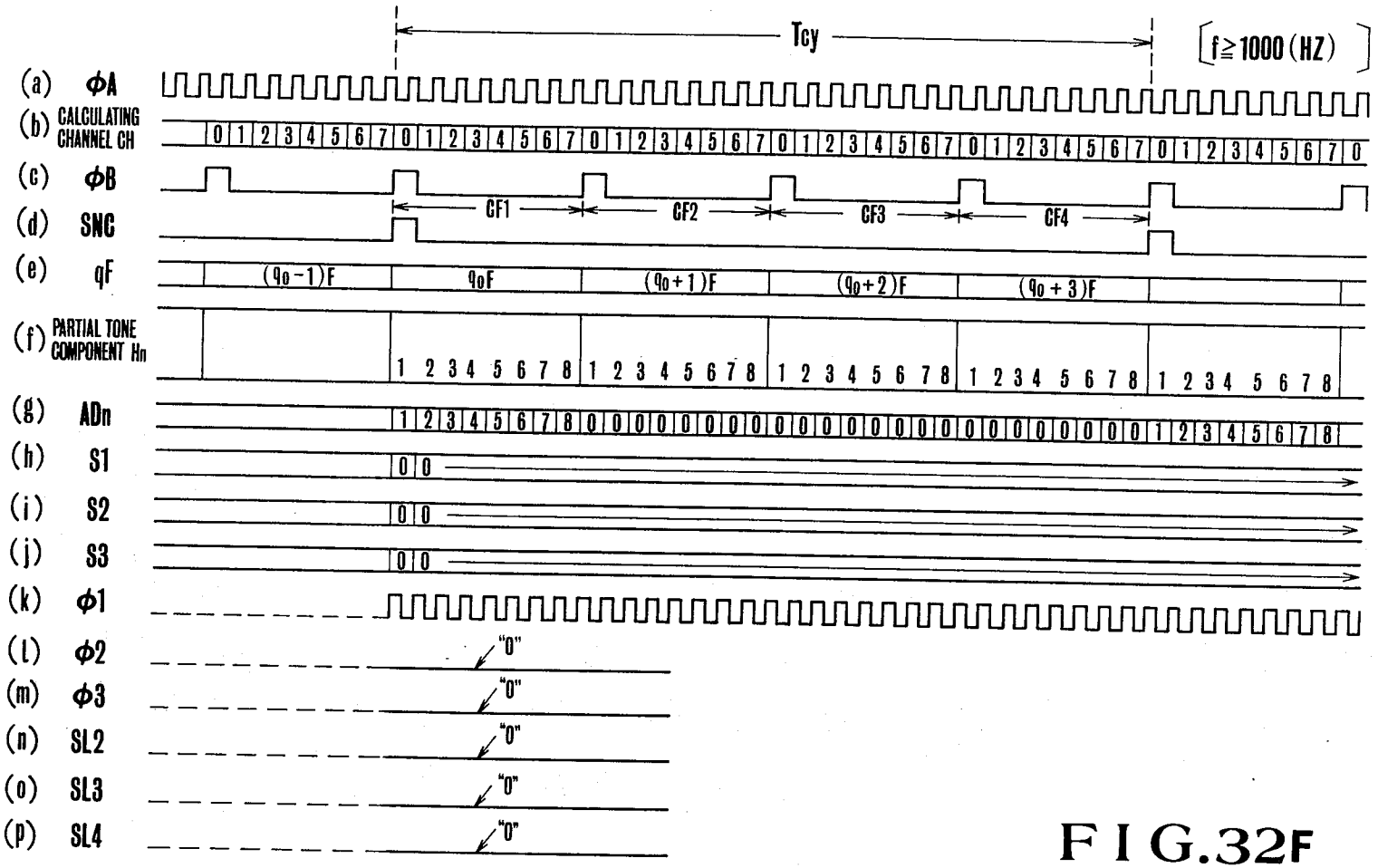

FIG. 30 shows another embodiment of a portion comprising a harmonic coefficient generator 90B for generating a harmonic coefficient Cn, an envelope waveform generator 100, and a multiplier 110 shown in FIG. 22. This modified embodiment can produce informations ENV·Cn imparted with different envelope waveforms for respective partial tone components. For example, as shown by a curve A in FIG. 31, it is possible to produce, according to orders of respective partial tone components, a continuous tone type envelope waveform information ENV·Cn or a percussive tone type emelope waveform information ENV·Cn as shown by a curve B. This result can be obtained by sequentially accumulating an increment (or decrement) information $\tau n[M]$ until the time information $\Sigma t$ coincides with the time information [M] (where M represents the discrimination of the segments of respective envelope waveforms, $\tau[M]$ is common to order of all partial tone components) according to the increment (or decrement) information $\Delta n[M]$ of the information ENV·Cn given to respective partial tone components correspondingly to the tone colors set by the tone color setter 80, and the time information $\tau[M]$ that defines the time length of a segment as an attack, a first decay a sustain and a second decay of such envelopes.

Thus, the principal elements of this portion are a constant memory unit 970 which stores the increment information $\Delta n[M]$ and the time information $\tau[M]$, an accumulator unit 980 which executes the sequential accumulation of the increment information $\Delta n[M]$ and produces its accumulated value $\Sigma\Delta n[M]$ as amplitude setting informations ENV·Cn regarding respective partial tone components, and a control unit 990 for producing various control signals which control the sequential accumulation of the increment informations $\Delta n[M]$ corresponding to the partial tone components in synchronism with the calculating timing of the respective partial tone components.

In FIG. 30, the constant memory unit 970 is made up of a $\Delta$ memory device 9700 and a $\tau$ memory device 9701, the memory device 9700 including memory blocks MBo to the types of the tone colors that can be set by the tone color setter 80 (FIG. 22) as shown in the following Table XXXVII. Each one of the memory blocks MBo to MBn includes submemory blocks SMBo to SMB3 corresponding to respective envelope segments of the attack, the first decay, the sustain and the second decay. Respective submemory blocks SMBo to SMB3 are provided with memory addresses "1" through "128" corresponding to the partial tone components H1 to H128 as shown in Table XXXVIII. At each memory address is stored an increment (or decrement) information $\Delta n[M]$ per unit time regarding the information ENV·Cn of a given partial tone component Hn. In this case, symbol "M" represents respective envelope segments of the attack, the first decay, the sustain, and the second decay. M=0 represents the segment of the attack, M=1 that of the first decay, M=2 that of the sustain, and M=3 that of the second decay. When supplied with a tone color information TS from the tone color setter 80 as a upper order address signal, the $\Delta$ memory device 9700 designates one corresponding to the set tone color among memory blocks MBo to MBn, whereas when a segment designation signal M (to be described later) representing an envelope segment is supplied as a medium order address signal, one of the submemory blocks SMBo to SMB3 is designated. Furthermore, when an order signal ADn (to be described later) synchronous with the calculating timing of each partial tone component Hn is given as a lower order address signal, an information $\Delta n[M]$ utilized to form the information ENV·Cn is produced according to the order n of each partial tone component Hn.

TABLE XXXVII

| Memory block MB | Tone color setting information TS | Submemory block SMB | Segment designation signal M |
|---|---|---|---|
| MB0 | TS0 | SMB0 (Attack) | M = 0 |
| | | SMB1 (First decay) | M = 1 |
| | | SMB2 (Sustain) | M = 2 |
| | | SMB3 (Second decay) | M = 3 |
| MB1 | TS1 | SMB0 | M = 0 |
| | | SMB1 | M = 1 |
| | | SMB2 | M = 2 |
| | | SMB3 | M = 3 |
| . | | . | . |
| . | | . | . |
| . | | . | . |
| MBn | TSn | SMB0 | M = 0 |
| | | SMB1 | M = 1 |
| | | SMB2 | M = 2 |
| | | SMB3 | M = 3 |

TABLE XXXVIII

| Submemory block SMB | Memory address | Memory content Δn [M] | | Order signal ADn |
|---|---|---|---|---|
| SMB0 (Attack) | 1 | Δ1 | [0] | AD1 |
| | 2 | Δ2 | [0] | AD2 |
| | . | . | | . |
| | . | . | | . |
| | . | . | | . |
| | 8 | Δ8 | [0] | AD8 |
| | 10 | Δ10 | [0] | AD10 |
| | 12 | Δ12 | [0] | AD12 |
| | 14 | Δ14 | [0] | AD14 |
| | 16 | Δ16 | [0] | AD16 |
| | 20 | 20 | [0] | AD20 |
| | . | . | | . |
| | . | . | | . |
| | . | . | | . |
| | 112 | 112 | [0] | AD112 |
| | 128 | 128 | [0] | AD128 |
| SMB1 (First decay) | 1 | 1 | [1] | AD1 |
| | . | . | | . |
| | . | . | | . |
| | . | . | | . |
| | 128 | 128 | [1] | AD128 |
| SMB2 (Sustain) | 1 | 1 | [2] | AD1 |
| | . | . | | . |
| | . | . | | . |
| | . | . | | . |
| | 128 | 128 | [2] | AD128 |
| SMB3 (Second decay) | 1 | 1 | [3] | AD1 |
| | 2 | 2 | [3] | AD2 |
| | . | . | | . |
| | . | . | | . |
| | . | . | | . |
| | 112 | 112 | [3] | AD112 |
| | 128 | 128 | [3] | AD128 |

Similar to the $\Delta$ memory device 9700, the $\tau$ memory device 9701 has memory blocks MBo to MBn corresponding to the types of the tone colors that can be set by the tone color setter 80 as shown in the following Table XXXIX. Each of these memory blocks MBo to MBn has memory addresses [0] to [4] corresponding to respective envelope segments, each memory address storing a time information $\tau[M]$ that determines the length of time of a corresponding envelope segment. When to the 7 memory device 9701 a tone color setting information TS is applied by the tone color setter 80 as a upper order address signal and when a segment designation signal M is applied as a lower order address signal, a time information $\tau[M]$ is produced that determines the length of the time of each segment corresponding to a set tone color.

TABL XXXIX

| memory block MB | Tone color setting information TS | memory address | segment designation signal M | Memory content [M] |
|---|---|---|---|---|
| MB0 | TS0 | 0 (Attack) | M = 0 | [0] |
| | | 1 (First decay) | M = 1 | [1] |
| | | 2 (Sustain) | M = 2 | [2] |
| | | 3 (Second decay) | M = 3 | [3] |
| MB1 | TS1 | 0 | M = 0 | [0] |
| | | 1 | M = 1 | [1] |
| | | 2 | M = 2 | [2] |
| | | 3 | M = 3 | [3] |
| . | . | . | . | . |
| . | . | . | . | . |
| . | . | . | . | . |
| . | . | . | . | . |
| MBn | TSn | 0 | M = 0 | [0] |
| | | 1 | M = 1 | [1] |
| | | 2 | M = 2 | [2] |
| | | 3 | M = 3 | [3] |

The most significant bit of the tone color setting information TS produced by the tone color setter 80 becomes "1" when an information ENV·Cn having a continuous tone type envelope waveform (A of FIG. 31) is designated, whereas the most significant bit becomes "0" where an information ENV·Cn having a percussive type envelope waveform (B of FIG. 31) is designated. When the information ENV Cn having the continuous tone type envelope waveform is designated, it is necessary to set the value of an increment information Δn(2) of a segment of the sustain to [0] because for a segment of the sustain it is necessary to hold the sustain until a key is released. For this reason, among the memory blocks MBo to MBn of the Δ memory device 9700, respective addresses of a submemory block SMB2 of a memory block regarding the continuous tone type emvelope waveform (the most significant bit of this memory block is designated by the tone color setting information TS of "1") store an increment information Δn(2) of [0], the segment designation signal M of the submemory block SMB2 being designated by a value [2] corresponding to the sustain.

The control unit 990 comprises a control pulse generator (CPG) 9900 which produces an order signal ADn for reading out informations Δn[M] corresponding to orders respective partial tone components from the Δ memory device 9700 and signals S1 to S3, $\phi$1 to $\phi$3, SL2 to SL4 for accumulating sequentially the information Δn[M] for respective orders a counter 9902 which counts the number of the low frequency pules $\phi$10 (period t) produced by a low frequency oscillator 9901 to produce a time length information Σt representing the time of respective envelope segments; a comparator 9903 which compares the time length information Σt with a time information $\tau$[M] produced by the $\tau$ memory device 9701 at each envelope segment and produces a coincidence signal EQ of "1" when the both informations coincide with each other a counter 9907 which is reset by a narrow width key-on pulse KONP produced by a one shot circuit (MM) 9904 in synchronism with the building up of a key-on signal KON produced by key depression and then counts the number of the coincidence signals EQ outputted from the comparator 9903 to produce aforementioned segment designation signal M a decoder 9908 which detects the fact that the segment designation signal M becomes [2] representing the sustain and a decoder 9909 which detects the fact that the segment designation signal M becomes [4] representing the second decay.

The counter 9902 is reset when (a) the key-on pulse KONP outputted from the one shot circuit 9904 at the commencement of depression of the key, (b) a key-off pulse KOFP produced by the one shot circuit (MM) 9906 in synchronism with the build down of the key-on signal caused by key release, and (c) the concidence signal EQ produced by the comparator 9903 when the time length information Σt coincides with the time information $\tau$[M] are applied as a reset signal via an OR gate circuit 9910. In this case, the counter 9902 is prevented from applying a low frequency pulse $\phi$10 to the counter 9902 through an AND gate circuit 9912 by an output signal MAX ("0" signals) at a NAND gate circuit 9911 which detects the fact that the count Σt of the counter 9902 has reached a maximum value so far as any one of the signals KONP, KOFP and EQ is not given as the reset signal before the count (time length information Σt) of the counter 9902 reaches the maximum value (all bits are "1"). Accordingly, the counter 9902 is stopped at a state showing the maximum value.

The count (segment designation signal M) of the counter 9907 is updated (a) when an increment signal of "1" is applied via an AND gate circuit 9915 and an OR gate circuit 9916 when the comparator 9903 produces a coincidence signal EQ except under conditions (c) and (d) described below, and (b) under a state in which the most significant bit of the tone color setting information TS is "1", when the key-off pulse KOFP is applied to the counter via an AND gate circuit 9917 and the OR gate circuit 9916 as an increment signal INC Condition (c)

Under this condition, as the most significant bit of the tone color setting information TS is "1", the decoder 9908 produces a detection signal DM2 (i.e., the segment designation signal M has a value [2]) and an NAND gate circuit 9913 produces a signal Z of "0". In other words, generation of the information ENV CN of the continuous tone type emvelope waveform is designated and the present envelope segment is the sustain Condition (d)

Under this condition, the decoder 9909 produces a detection signal DM4 (the segment designation signal has a value [4]) and an inverter 9914 produces an output signal DM4 of "0". In other words, generation of the information ENV Cn of all envelope segments up to the second decay has been completed.

At this time, the AND gate circuit 9915 is disabled so that the coincidence signal EQ produced by the comparator 9903 would not be applied to the counter 9907.

For this reason, when the tone color setter 80 designates the generation of the continuous tone type envelope waveform information ENV·Cn, for example application of the key-on signal KON resets the counters 9902 and 9907. Thus, the time length information Σt outputted by the counter 9902 becomes zero and thereafter the counter 9902 begins to count the number of the low frequency pulses $\phi$10 to produce a sequentially increasing time length information Σt. The segment designation signal M outputted from the counter 9907 also becomes zero, whereby a time information $\tau$[0] regarding an attack corresponding to the tone color setting information TS is read out from the $\tau$ memory device 9701. This time information $\tau$[0] regarding the attack is compared with the time length information Σt outputted by the counter 9902 by the comparator 9903. When Σt=τ[0], the comparator 9903 produces a coincidence signal EQ. Then the counter 9902 is reset by this coincidence signal EQ, while at the same time the count of the counter 9907 is updated with the result that the segment designation signal M becomes "1". Accordingly the counter 9902 produces again the time length information Σt which sequentially increases from zero. On the other hand, the τ memory device 9701 produces a time information τ[1] regarding the first decay corresponding to a segment designation signal M of "1". When Σt becomes equal to τ[1] after elapse of a time corresponding to the time information τ [1], the comparator 9903 produces again a coincidence signal EQ to reset the counter 9902. Concurrently therewith the content of the counter 9907 is updated so that the segment designation signal M becomes [2]. Then a time information τ[2] regarding the sustain is read out from the τ memory device 9701. This time information τ[2] is compared with a time length information Σt outputted from the counter 9902 by the comparator 9903.

When Σt becomes equal to τ[2] after elapese of a time corresponding to the time information τ[2], the comparator 9903 produces a coincidence signal EQ. This coincidence signal EQ at a sustain in which the segment designation signal M is "2" will not be applied to the counter 9907 but applied to only the counter 9902 as a reset signal since the output signal Z of the NAND gate circuit 9913 is "0". Thus the counter 9907 holds the segment designation signal M of [2] and produces it as it is. On the other hand, the counter 9902 again begins to count the number of the low frequency pulse ϕ10 from the reset state. Thereafter, when a key-off pulse KOFP is produced by the one shot circuit 9906 as a result of the key release, the content of the counter 9907 is updated by the key-off pulse KOFP so that the segment designation signal M becomes "3". Also the counter 9902 is reset by the key-off pulse KOFP.

When the segment designation signal M is updated to [3[, the memory circuit 9701 now produces a time information τ[3] regarding the second decay. This time information τ[3] is compared with the time length information τt by the comparator 9903. After elapse of a time corresponding to the time information τ[3], τt becomes equal to τ[3]. Then, the comparator 9903 produces a coincidence signal EQ which updates the segment designation signal M to [4] and resets the counter 9902, and the counter 9902 stops at a state in which its count τt shows a maximum value until it is supplied with a key-on pulse KONP regarding a newly depressed key. Also the counter 9907 stops at a state in which its count M="4" until a key-on pulse KONP regarding next newly depressed key is applied.

As can be noted from the foregoing description, the circuit components of the control unit 990 except the control pulse generator 9900 may be considered as a timer that determine the time lengths of respective segments in accordance with the time informations τ[0] to τ[3].

The control pulse generator 9900 produces an order signal ADn which reads out informations Δn [M] corresponding to each partial tone component Hn calculated by respective calculating channels CH0 to CH7 from the Δ memory device 9700, and signals S1 to S3 and SL2 to SL4 necessary to sequentially accumulate informations Δn [M] for orders of respective partial tone components, and accumulation designation signals ϕ1, ϕ2 and ϕ3. In this case, since the fundamental frequency f of the generated musical tone signal and the orders of the partial tone components to be calculated in a time band in one period of the musical tone signal are not equal, like the timing pulse generator 40B of the previous embodiment, the control pulse generator 9000 is supplied with the clock pulse ϕA shown in FIG. 22, a calculation cycle signal SNC, a frequency number F, and an accumulated value qF and is designed on the same consideration as that of the timing pulse generator 40B.

FIGS. 32A to 32F show timing charts of various signals outputted from the control pulse generator 9900 when calculating respective partial tone components in a manner as shown in Table XV (*a*) to (*f*).

The accumulating unit 980 shown in FIG. 30 comprises an adder 9800, a distributor 9801, selectors 9802 to 9804, shift registers 9805 to 9809 and selectors 9810 to 9812.

The shift registers 9805 to 9809 store the accumulated values ΣΔn[M] of the increment informations Δn[M] of orders of respective partial tone components. Of these shift registers, the shift register 9805 stores the accumulated value ΣΔn[M] (where n=1 to 8) corresponding to a partial tone components Hn (where n=1 to 8) having a sampling frequency ratio βn of $\frac{1}{4}$, that is a calculating period of 4/fCA=1/10 KHz and comprises a 8 stage shift register 9805 controlled by the accumulation designation signal ϕ1. The shift register 9806 stores an accumulated value ΣΔn [M] (where n=10, 12, 14, 16) of a partial tone component Hn (where n=10, 12, 14 and 16) having a sampling frequency ratio βn of $\frac{1}{2}$, that is a sampling frequency of 2/fCA=1/20 KHz, the 4 stage shift register 9806 controlled by the accumulation designation signal ϕ2.

The shift registers 9807 to 9809 store accumulated values ΣΔn [M] (where n=20, 24, 28, 32 and 40, 48, 56, 64 and 80, 96, 112, 128 respectively) corresponding to partial tone components Hn (where n=20, 24, 28, 32 and 40, 48, 56, 64 and 80, 96, 112, 128) respectively having a sampling frequency ratio βn of "1", that is a calculating frequency of 1/fCA=1/40 KHz. Among these shift registers, the shift register 9807 stores an accumulated value ΣΔn [M] where the number of orders n=20, 24, 28 and 32, the shift register 9808 stores an accumulated value ΣΔn [M] where the number of orders n=40, 48, 56 and 64 and the shift register 9809 stores an accumulated value ΣΔn [M] where the number of orders n=80, 96, 112 and 128. Each of these shift registers 9807 to 9809 comprises a 4 stage shift register controlled by the accumulation designation signal ϕ3.

The distributor 9801 operates to distribute the output of the adder 9800 among its output terminals 0 to 4 corresponding to the contents [0] to [4] of the selection signal S1, and the selectors 9802 to 9804, and 9810 to 9812 respectively select input terminals designated by the same numbers as the contents of the selection signals SL2 to SL4, S2, S1 and S3.

Accumulation of the increment informations Δn [M] is performed by suitably generating the selection signals S1, SL2 to SL4 and the accumulation designation signals ϕ1 to ϕ3 by a circuit including the shift registers 9805 to 9809, the adder 9800, the distributor 9801 and the selectors 9802 to 9805.

The accumulating operation of Δn [M] will be outlined as follows.

The accumulation of the increment informations Δn [M] of respective orders are sequentially performed on the time division basis. In principle, previously accumulated values ΣΔn [M] which are stored in respective shift registers 9805 to 9811 are applied to an input terminal B of the adder 9800, increment informations Δn [M] of the same orders as the accumulated values ΣΔn [M] are read out from the Δ memory device 9700 and then applied to an input terminal A of the adder 9800 and thereafter both inputs are added to obtain the accumulated value ΣΔn [M] which varies sequentially. A new accumulated value [ΣΔn [M]+Δn[M]] outputted by the adder 9800 is applied to and stored in the original shift registers 9805 to 9809 via the distributor 9801 (partially through selectors 9802 to 9804) until the next acculating timing is reached.

There are a total of 24 types of the increment informations Δn [M] corresponding to the calculating partial tone components H1 to H8, H10, H12, H14, H16, H20, H24, H28, H32, H40, H48, H56, H64, H80, H96, H112 and H128 and in order to from informations ENV·Cn for respective orders at respective envelope segments by using the 24 types of the increment informations Δn [M], the accumulating operations of the informations Δn [M] is performed. On the other hand, since respective partial tone components are calculated at different periods depending upon the values of the sampling frequency ratios, it is necessary to read out the accumulated values ΣΔn [M] stored in respective shift registers 9805 to 9809 in parallel with the accumulating operation described above and in synchronism with the calculating timings corresponding to respective partial tone components. More particularly, it is necessary to perform in parallel the read out operation of the shift registers 9805 to 9809 for accumulating the informations Δn [M] and the read out operation of the shifts registers 9805 to 9809 performed in synchronism with the calculating timings of respective partial tone components.

Accordingly, in this embodiment, the accumulation periods of the information Δn [M] is made to have the same period 1/fCA=1/40 KHz as that of one calculating cycle Tcy, and 32 calculating channel times in one calculating cycle Tcy are assigned with the accumulating operations of the 24 types of the informations as shown in the following Table XXXXX so as to efficiently read out (shift operation) of the shift registers 9805 to 9809. The accumulating operations of the informations Δn [M] of respective orders are performed at the calculating timings of corresponding partial tone components.

TABLE XXXX

| | Calculating Frame CF1 | | Calculating Frame CF2 | | Calculating Frame CF3 | | Calculating Frame CF4 |
|---|---|---|---|---|---|---|---|
| CH0 | first | (Δ1 [M]) | third | (Δ3 [M]) | 5th | (Δ5 [M]) | 7th (Δ7 [M]) |
| CH1 | 20th | (Δ20 [M]) | 40th | (Δ40 [M]) | 80th | (Δ80 [M]) | — |
| CH2 | 10th | (Δ10 [M]) | 14th | (Δ14 [M]) | 10th | (Δ10 [M]) | 14th (Δ14 [M]) |
| CH3 | 24th | (Δ24 [M]) | 48th | (Δ48 [M]) | 96th | (Δ96 [M]) | — |
| CH4 | second | (Δ2 [M]) | 4th | (Δ4 [M]) | 6th | (Δ6 [M]) | 8th (Δ8 [M]) |
| CH5 | 28th | (Δ28 [M]) | 56th | (Δ56 [M]) | 112th | (Δ112 [M]) | — |
| CH6 | 12th | (Δ12 [M]) | 16th | (Δ16 [M]) | 12th | (Δ12 [M]) | 16th (Δ16 [M]) |
| CH7 | 32th | (Δ32 [M]) | 64th | (Δ64 [M]) | 128th | (Δ128 [M]) | — |

When accumulating the informations Δn [M], the order signal ADn for the Δ memory device 9700 represents the order shown in the Table XXXX during the channel times of respective calculating channels.

When forming the accumulated values ΣΔn [M] of the increment informations Δn [M] of the orders 1 to 8 the content of the selection signal S1 is made zero during the channel times of predetermined calculating channels (CH0 to CH7) of the first to the fourth calculating frames CF1 to CF4, and the accumulation designation signals $\phi$1 is made to be "1", while the contents of the order signals ADn for the Δ memory device 9700 are made to correspond to the orders. Then, the contents of respective stages of the shift register 9805 are shifted by one stage so that the accumulated value ΣΔn [M] which has been stored in the last stage is applied to the input of the adder 9800 through the input terminal 0 and the output terminal of the selector 9811 to be added to the increment information Δn [M] of the same order which is being read out from the Δ memory device 9700 at this time. The resulting sum [ΣΔn [M]+Δn [M]] is supplied to the shift register 9805 via the input and output terminals of the distributor 9801 and stored in the first stage of the shift register 9805 as a new accumulated value ΣΔn [M].

To form the accumulated values ΣΔn [M] of the increment informations Δn [M] of the orders 10, 12 14 and 16, the content of the selection signal S1 is made to be [1] during the channel times of predetermined channels CH0 to CH7 shown in the Table XXXX, and the accumulation designation signal $\phi$2 is made to be "1". At the same time the contents of the order signals ADn are made to correspond to the given orders. Then, in the same manner as above described a new accumulated value ΣΔn [M] regarding a given order would be calculated with a circuit including the shift register 9806, the selector 9811, the adder 9800, the distributor 9801 and the shift register 9806.

When forming the accumulated values ΣΔn [M] of the increment informations Δn [M] of the order 20,24, 28, 32 or 40, 48, 56, 64 or 80, 96, 112 and 128, in the same manner as above described, in the channel times of predetermined calculating channels CH0 to CH7 shown in the Table XXXX, this content of the selection signal S1 is made to be [2], [3] or [4] (at the accumulating timings regarding n=20, 24, 28 and 32, the content of the selection signal S1 is made to be [2], and the accumulating timings regarding to n=40, 48, 56 and 64 to be equal to [3], whereas at the accumulating timings regarding n=80, 96, 112 and 128 to be equal to [4]. Furthermore, the accumulation designation signal $\phi$3 is made to be equal to "1" while the contents of the order signals ADn are made to correspond to the given orders.

In this case, the circuit is constructed to simultaneously shift the contents of the shift registers 9807 to 9809 by the accumulation designation signal $\phi$3. For this reason, to form the accumulated vlues ΣΔn [M] of the increment informations Δn [M] of the orders 20,24, 28 and 32, for example, the cotent of the shift register 9807 (the accumulated values ΣΔn [M] of n=20, 24, 28 and 32) is read out together with the content of the shift register 9808 (the accumulated values ΣΔn [M] of n=40, 48, 56 and 64) and the content of the shift register 9809 (the accumulated values $\Sigma\Delta n[M]$ of n=80, 96, 112 and 128), thereby clearing the contents of the shift registers 9808 and 9809. This is also true for a case wherein the accumulated values $\Sigma\Delta n$ [M] of n=40, 48, 56 and 64 or n=80, 96, 112 or 128. To eliminate such defects, selectors 9802 to 9804 are provided on the input sides of shift registers 9807 to 9809 respectively and unnecessary contents of the shift registers 9807 to 9809 are held via selectors 9802 to 9804. For example, at the time of forming the accumulated values $\Sigma\Delta n$ [M] of the increment informations $\Delta n$ [M] of n=20, 24, 28 and 32, both selection signals SL3 and SL4 for the selectors 9803 and 9804 are made to be "0" for circulating and storing the outputs of shift registers 9808 and 9809 through selectors 9803 and 9804. Of course, the selection signal SL2 for the selector 9802 is made to be "1" at this time.

The accumulated values $\Sigma\Delta n$ [M] for respective partial tone components formed as above described are selected and extracted in synchronism with the calculating times of respective partial tone components from the selectors 9810 and 9812 by the selection signals S2 and S3 and outputted as the informations ENV·Cn which may be used to set the amplitudes of the envelope waveforms which are different for respective partial tone components.

The operation of the accumulating unit 980 in the channel times of respective calculating channels CH0 to CH7 can readily be understood from the timing charts shown in FIGS. 32A through 32F. Although foregoing embodiments have been described in terms of a monophonic musical instrument in which the number of the simultaneously generated tones is one, it is easy to construct a poliphonic musical instrument by providing means for assigning tone production to a plurality of depressed keys.

As above described, the method of producing a musical tone signal according to this invention comprises the steps of predetermining sampling frequencies satisfying the sampling theorem with respect to respective partial tone components to be calculated, setting a sampling frequency having the highest frequency among the respective sampling frequencies as a calculation reference frequency, determining ratios of respective sampling frequencies regarding respective partial tone components to the calculation reference frequency, calculating the respective partial tone component having the ratios of one by one calculating channel at a period corresponding to the calculation reference frequency, combining into one set a plurality of partial tone components wherein the sum of the ratios of partial tone components each having a ratio less than one does not exceed beyond one and calculating, on the time division basis, the partial tone components of the set in one calculating channel at periods corresponding to respective sampling frequencies.

Accordingly, the utilization efficiency of the calculating channels can be improved so that it is possible to generate a musical tone signal containing a plurality of partial tone components more than number of calculating channels, thus miniaturizing the size of the instrument.

Especially, where the sampling frequencies regarding respective partial tone components are determined for each frequency band of one octave unit, the control for calculating respective partial tone components becomes easy.

Furthermore where a sine function modified by a window function is used to calculate high order partial tone components, it becomes possible to calculate large number of partial tone components with an extremely small number of calculating channels thereby producing a musical tone rich in tone colors.

What is claimed is:

1. In a method of generating a musical tone signal of the type wherein a plurality of partial tone components of a musical tone signal corresponding to a tone to be produced are calculated with a plurality of channels and said musical tone signal is made by synthesizing said partial determining sampling frequencies that satisfy a sampling theorem with respect to respective ones of said plurality of partial components;

setting the sampling frequency having the highest frequency among said sampling frequencies as a calculation reference frequency;

determining ratios of said determined sampling frequencies of said plurality of partial tone components to said set calculation reference frequency;

calculating a partial tone component whose ratio is one with a channel at a period corresponding to said calculation reference frequency;

establishing a set consisting of some partial tone components among said plurality of partial tone components, the ratio of each being less than one, and wherein the sum of the ratios of said some partial tone components in said set does not exceed 1, and calculating the partial tone components belonging to said set, on the time division basis, with another channel at a period corresponding to said respective sampling frequencies.

2. A method according to claim 1 wherein the sampling frequencies regarding said plurality of partial tone components are determined for each frequency band of a predetermined partial tone.

3. A method according to claim 1 wherein the sampling frequencies regarding said plurality of partial tone components are determined for each partial tone frequency band of one octave unit.

4. In an apparatus for generating a musical tone signal of the type comprising a plurality of channel means for obtaining a plurality of partial tone components corresponding to a musical tone to be produced and having different frequencies, and means for synthesizing said partial tone components to produce said musical tone, the improvement which comprises means for determining respective sampling frequencies that satisfy the sampling theorem regarding respective partial tone components;

calculation reference signal generating means for producing a calculation reference signal having a frequency corresponding to the highest sampling frequency among said sampling frequencies; and means for determining ratios of said sampling frequencies of said partial tone components to the frequency of said calculation reference signal;

at least one of said calculating channels calculating a partial tone component having the ratio of one at a period of said calculation reference signal, while remaining calculating channels combining a plurality of the partial tone components each having the ratio of less than one into a set wherein sum of said ratios does not exceed one, and calculating, on the time division basis, said set of the partial tone components at a period corresponding to said ratio.

5. An electronic musical instrument comprising:
a keyboard having a plurality of keys;
means for generating a plurality of partial tone components having frequencies corresponding to a depressed one among said keys, said partial tone components being allocated into at least two groups in accordance with the frequencies thereof and the amplitude contribution of each partial being calculated at different repetitive sampling cycles corresponding to the respective frequency grouping of said each partial; and
means for producing a musical tone according to said partial tone components.

6. An electronic musical instrument according to claim 5 wherein
said partial tone component generating means comprises means for generating address signals corresponding to said partial tone components, each address signal having a value which progresses at a rate corresponding to said depressed key, and memory means for storing a waveshape in the form of a plurality of sampled values, said memory means being coupled to the output of said address signal generating means and generating, upon receipt of said address signal, said partial tone components whose shape are determined by said stored waveshape and which are represented by said waveshape sample values.

7. An electronic musical instrument according to claim 6 wherein
said address signal generating means generates said address signals, on the time division basis, at said different repetitive sampling cycles in accordance with said groups to said partial tone components respectively and said memory means generates said partial tone components on the time division basis and wherein said musical tone producing means further comprises accumulating means for accumulating said partial tone components in accordance with said groups and for outputting accumulated signals for said groups, said musical tone being produced according to said accumulated signals.

8. An electronic musical instrument according to claim 5 wherein
said partial tone component generating means comprises means for generating address signals corresponding to said partial tone components, each address signal having a value which progresses at a rate corresponding to said depressed key and memory means for storing a plurality of waveshapes each of which is in the form of a plurality of sample values, said memory means being coupled to the output of said address signal generating means and generating, upon receipt of said address signals, said partial tone components whose shape are determined by said stored waveshape and which are represented by said waveshape sample values.

9. An electronic musical instrument according to claim 8 wherein
said address signal generating means generates at least two address signals among said address signals in parallel and wherein said memory means generates at least two partial tone components according to said at least two address signals in parallel.

10. An electronic musical instrument according to claim 6, wherein said stored waveshape is a sinewave.

11. An electronic musical instrument according to claim 5, wherein said partial tone component generating means comprises:
memory means for storing a partial tone component,
means for reading out said partial tone component from said memory means at said different repetitive sampling cycles to generate said partial tone components on the time division basis, and wherein said musical tone producing means comprises means for accumulating said partial tone components generated in accordance with said groups and means for forming the musical tone based upon the outputs of said accumulating means.

12. An electronic musical instrument according to claim 5, wherein said partial tone component generating means comprises means for generating address signals corresponding to said partial tone components, each address signal having a value which progresses at a rate corresponding to said depressed key,
and memory means for storing a sinewave with a window function in the form of a plurality of sampled values, said memory means being coupled to the output of said address signal generating means and generating, upon receipt of said address signals, the partial tone component belonging to either one of said groups, the shape of said partial tone component being determined by said stored sinewave with the window function and said partial tone component being represented by said sample values.

13. An electronic musical instrument according to claim 12, wherein the frequency of said partial tone component changes as a function of time from the start point of said waveshape, said start point of said waveshape being synchronized with a predetermined phase point of the fundamental period of a musical tone to be generated and said waveshape being terminated within a period of said fundamental period of said musical tone.

14. An electronic musical instrument according to claim 8, wherein one of said plurality of waveshapes is a sine waveshape with a window function.

15. A keyboard musical instrument of the harmonic synthesis type in which constituent amplitudes of a plurality of partials are separately evaluated and summed to establish each sample point amplitude of the generated musical tone, said sample point amplitudes being established in real time, and having regular calculation intervals at which each partial constituent amplitude may be evaluated, the improvement comprising:
means for evaluating the constituent amplitude contributions of partials of relatively high frequencies at each of said regular calculation intervals, and for evaluating the constituent amplitude contributions of partials of relatively lower frequencies repetitively but at less than all of said regular calculation intervals.

16. A keyboard musical instrument of the harmonic synthesis type in which constituent amplitudes of a plurality of partials are separately evaluated and summed to establish each sample point amplitude of the generated musical tone, and having regular calculation intervals at which each partial constituent amplitude may be evaluated, the improvement comprising:
means for ascertaining into which of a small number of frequency ranges each of the constituent partials belongs, first means for evaluating the partials of the highest frequency range at each of said regular calculation intervals, second means for evaluating the partials of the next lower frequency range at every second calculation interval, third means for evaluating the partials of the next lower frequency range at every fourth calculation interval, and means for accumulating the evaluated constituent amplitudes of all partials to establish each sample point amplitude of the generated musical tone.

17. In an electronic musical instrument of the harmonic synthesis type, the improvement comprising:

first means for generating lower order partials by individually calculating the constituent sample point amplitude of each such partial, and second means for obtaining, instead of calculating the constituent amplitudes of individual higher order partials, the amplitudes of a stored windowed trigonometric function sampled at a rate related to the central frequency of a band of higher order partials, and means for combining the individual constituent amplitudes generated by said first means and the amplitudes obtained by said second means to synthesize a musical tone.

* * * * *